US008668045B2

(12) United States Patent
Cohen

(10) Patent No.: US 8,668,045 B2
(45) **Date of Patent: *Mar. 11, 2014**

(54) SOUND AND VIBRATION TRANSMISSION PAD AND SYSTEM

(76) Inventor: Daniel E. Cohen, Eden Prairie, MN (US)

( * ) Notice: Subject to any disclaimer, the term of this patent is extended or adjusted under 35 U.S.C. 154(b) by 130 days.

This patent is subject to a terminal disclaimer.

(21) Appl. No.: 13/079,812

(22) Filed: Apr. 4, 2011

(65) Prior Publication Data

US 2012/0051579 A1 Mar. 1, 2012

Related U.S. Application Data

(63) Continuation-in-part of application No. 12/465,501, filed on May 13, 2009, now Pat. No. 7,918,308, which is a continuation of application No. 10/943,186, filed on Sep. 16, 2004, now Pat. No. 7,553,288, which is a continuation-in-part of application No. PCT/US2004/007354, filed on Mar. 10, 2004, application No. 13/079,812, which is a continuation-in-part of application No. 12/746,415, filed as application No. PCT/US2008/085776 on Dec. 6, 2008.

(60) Provisional application No. 60/453,549, filed on Mar. 10, 2003, provisional application No. 60/493,645, filed on Aug. 7, 2003, provisional application No. 60/518,973, filed on Nov. 10, 2003, provisional application No. 61/048,188, filed on Apr. 26, 2008, provisional application No. 61/012,050, filed on Dec. 6, 2007.

(51) Int. Cl.
*A61H 23/02* (2006.01)

(52) U.S. Cl.
USPC ..... 181/150; 181/160; 601/47; 297/217.4; 297/452.37

(58) Field of Classification Search
USPC ..... 181/144, 145, 147, 150, 153, 160, 161, 181/167, 169; 600/27, 28; 601/46, 47, 48, 601/49, 56, 57, 58, 64; 381/301, 105, 106, 381/108, 151, 190, 351, 388; 297/452.13, 297/452.37, 217.4
See application file for complete search history.

(56) References Cited

U.S. PATENT DOCUMENTS

| | | | | | |
|---|---|---|---|---|---|
| 2,338,551 | A | * | 1/1944 | Stanko | 381/57 |
| 2,468,205 | A | * | 4/1949 | Kellogg | 381/83 |
| 2,616,971 | A | * | 11/1952 | Kannenberg | 381/57 |
| 3,009,991 | A | * | 11/1961 | Bekey | 381/96 |

(Continued)

FOREIGN PATENT DOCUMENTS

JP 2003-102086 A 4/2003

*Primary Examiner* — Jeremy Luks
(74) *Attorney, Agent, or Firm* — Briggs and Morgan, P.A.; Aleya R. Champlin; Audrey J. Babcock

(57) ABSTRACT

The present invention is a chair or similar body-supporting apparatus for sitting on, reclining on or lying upon. The chair or similar apparatus is capable of transmitting sound and vibrations generated by a sound source and/or a vibration source to a user's body. The sound and vibrations are transmitted through speakers, transducers, or a combination thereof which are connected to the chair or similar apparatus. The present invention is also a method of providing vibrational energy to a user, including regulating sound and vibrations transmitted through speakers, transducers, or a combination thereof which are connected to a chair or similar body-supporting apparatus.

20 Claims, 97 Drawing Sheets

(56) References Cited

U.S. PATENT DOCUMENTS

| | | | | | |
|---|---|---|---|---|---|
| 4,023,566 | A | * | 5/1977 | Martinmaas | 601/47 |
| 4,038,499 | A | * | 7/1977 | Yeaple | 381/301 |
| 4,064,376 | A | * | 12/1977 | Yamada | 381/152 |
| 4,254,303 | A | * | 3/1981 | Takizawa | 381/107 |
| 4,306,115 | A | * | 12/1981 | Humphrey | 381/107 |
| 4,458,362 | A | * | 7/1984 | Berkovitz et al. | 381/103 |
| 4,507,816 | A | * | 4/1985 | Smith, Jr. | 5/666 |
| 4,583,245 | A | * | 4/1986 | Gelow et al. | 381/59 |
| 4,602,337 | A | * | 7/1986 | Cox | 381/93 |
| 4,628,530 | A | * | 12/1986 | Op De Beek et al. | 381/103 |
| 4,778,027 | A | * | 10/1988 | Taylor | 181/175 |
| 4,888,808 | A | * | 12/1989 | Ishikawa et al. | 381/103 |
| 5,046,101 | A | * | 9/1991 | Lovejoy | 381/57 |
| 5,076,260 | A | * | 12/1991 | Komatsu | 601/59 |
| 5,086,755 | A | * | 2/1992 | Schmid-Eilber | 601/47 |
| 5,097,821 | A | * | 3/1992 | Eakin | 601/47 |
| 5,101,810 | A | * | 4/1992 | Skille et al. | 601/47 |
| 5,113,852 | A | * | 5/1992 | Murtonen | 601/47 |
| 5,132,942 | A | * | 7/1992 | Cassone | 367/159 |
| 5,143,055 | A | * | 9/1992 | Eakin | 601/47 |
| 5,165,017 | A | * | 11/1992 | Eddington et al. | 381/321 |
| 5,314,403 | A | * | 5/1994 | Shaw | 601/148 |
| 5,355,419 | A | * | 10/1994 | Yamamoto et al. | 381/86 |
| 5,368,359 | A | * | 11/1994 | Eakin | 297/217.4 |
| 5,387,026 | A | * | 2/1995 | Matsuhashi et al. | 297/217.4 |
| 5,404,115 | A | * | 4/1995 | Johnson | 330/279 |
| 5,434,926 | A | * | 7/1995 | Watanabe et al. | 381/108 |
| 5,450,494 | A | * | 9/1995 | Okubo et al. | 381/57 |
| 5,520,873 | A | * | 5/1996 | Liene | 264/294 |
| 5,530,761 | A | * | 6/1996 | d'Alayer de Costemore d'Arc | 381/57 |
| 5,550,922 | A | * | 8/1996 | Becker | 381/57 |
| 5,666,426 | A | * | 9/1997 | Helms | 381/57 |
| 5,687,244 | A | * | 11/1997 | Untersander | 381/151 |
| 5,844,992 | A | * | 12/1998 | Boyer | 381/57 |
| 5,865,771 | A | * | 2/1999 | Shuto et al. | 601/47 |
| 5,887,071 | A | * | 3/1999 | House | 381/386 |
| 5,895,348 | A | * | 4/1999 | Hosaka | 600/27 |
| 5,902,167 | A | * | 5/1999 | Filo et al. | 446/81 |
| 5,907,622 | A | * | 5/1999 | Dougherty | 381/57 |
| 6,023,801 | A | * | 2/2000 | Lamm | 5/636 |
| 6,027,463 | A | * | 2/2000 | Moriyasu | 601/46 |
| 6,104,820 | A | * | 8/2000 | Soza | 381/151 |
| 6,267,721 | B1 | * | 7/2001 | Welles | 600/26 |
| 6,369,312 | B1 | * | 4/2002 | Komatsu | 84/723 |
| 6,500,134 | B1 | * | 12/2002 | Cassone | 601/47 |
| 6,529,605 | B1 | * | 3/2003 | Christoph | 381/56 |
| 7,553,288 | B2 | * | 6/2009 | Cohen | 601/47 |
| 2002/0066142 | A1 | * | 6/2002 | Osborne et al. | 5/600 |
| 2004/0021351 | A1 | * | 2/2004 | House | 297/217.4 |
| 2007/0025575 | A1 | | 2/2007 | Oser et al. | |

* cited by examiner

CD Player
Stereo Receiver
Blue Ray Player
HD DVD
HD TV
Toslink Optical Inputs (4)
HDMI Inputs (2)
HDMI Output
BodyLink
IR Receiver
IR Transmitter
BodyLink RJ-45
RS485
BodyLink
RS485
Front panel display
Shows current Connection
And Type Of Audio Stream.

200
Control Screen
USB iPOD
Audio
Chair #1
Chair #2
Chair #3
Chair #4
Toslink Optical
RS485
BodyLink
To Additional Chairs

SOUND AND VIBRATION TRANSMISSION PAD AND SYSTEM

RELATED APPLICATIONS

This application is a continuation-in-part of U.S. patent application Ser. No. 12/746,415, which has a 35 U.S.C. §371 (c) date of Sep. 7, 2010, and is also a continuation-in-part of U.S. patent application Ser. No. 12/465,501, filed on May 13, 2009, which is a continuation of U.S. patent application Ser. No. 10/943,186, filed Sep. 16, 2004, now U.S. Pat. No. 7,553,288, which is a continuation-in-part of PCT Application No. PCT/US2004/007,354, filed Mar. 10, 2004, which claims the benefit of priority of U.S. Provisional Patent Application No. 60/453,549, filed Mar. 10, 2003, U.S. Provisional Patent Application No. 60/493,645, filed Aug. 7, 2003, and U.S. Provisional Patent Application No. 60/518,973, filed Nov. 10, 2003, which applications are incorporated by reference herein in their entireties. U.S. patent application Ser. No. 12/746,415 is a national stage application of PCT Application No. PCT/US2008/085,776, filed Dec. 6, 2008, which claims the benefit of priority of U.S. Provisional Patent Application No. 61/048,188, filed on Apr. 26, 2008, and U.S. Provisional Patent Application No. 61/012,050, filed on Dec. 6, 2007, which applications are incorporated by reference herein in their entireties.

FIELD OF THE INVENTION

This invention relates to a pad, chair or similar body-supporting apparatus for sitting on, reclining on or lying upon. More specifically, the invention relates to pad, chair or similar apparatus capable of transmitting sound and vibrations generated by a sound source and/or a vibration source to a user's body.

BACKGROUND

It is generally perceived that psychological stressors and our awareness of them related to financial worries, job, healthcare, and other issues, as well as broader world concerns have increased during recent decades creating more stress. These trends appear to mirror collective increases in alcohol and other substance abuses in addition to the use of prescription antidepressants, anti-anxiety agents, and pain relievers, in an attempt in part to reduce or treat the effects of these stressors.

Today, most physicians and scientists accept that psychological stressors can either cause or worsen almost all if not all physical, emotional, and mental health problems or illnesses. This occurs as a result of the impact of our negative emotional feelings (principally fear/anxiety, frustration/anger, and shame/guilt) on our physiology or pathophysiology. Furthermore, it is generally believed that the degree to which a person is able to effectively deal with or resolve psychological stressors and the resultant or associated negative emotional feeling states, correlates with their degree of life satisfaction and happiness. This in turn correlates positively with their health and well being, physically, emotionally, and mentally.

It has been shown that stress relief through relaxation exercises or meditation is beneficial to a person's physical, emotional, and mental health and well being. In addition, psychological intervention in the form of counseling and other forms of "talk therapy" has been shown to be beneficial in learning to understand the genesis of our emotional feelings and how best to resolve our negative emotional feelings.

Despite this knowledge, many people spend considerably more time watching TV, which has no redeeming health value, as compared to practicing meditation, relaxation exercises, or trying to understand and resolve their negative emotional feelings. In fact, many people use prescription medications or self-medicate themselves to avoid experiencing their feelings. Furthermore, almost everyone regularly employs psychological coping mechanisms, such as suppression of their emotional feelings and/or displacement of their feelings (blaming others, being non-accountable, etc.) in their attempts to avoid their subconscious underlying painful beliefs about themselves and their circumstances.

As a result of these practices, many people have become more disconnected from their emotional feelings and in turn have a reduced awareness of how their emotional feelings impact their physical body. Most people simply feel less, physically and emotionally. Consciously feeling "more" physically is paramount to learning how to become more physically relaxed by increasing our awareness of how we feel. It is our own biofeedback mechanism that informs us about how well we are handling the effects of stress and how relaxed we are. In addition, feeling "more" emotionally helps us to consciously confront and cease avoiding our persistent problems/issues that continue to impact our health and well being in a negative fashion even when we are not consciously aware of it.

Exposure to sound and vibration occurs when watching and listening to TV, a movie, playing video games or listening to music. When a person participates in such activities, very little of the sound energy and vibration impacts their physical body directly or is transmitted into their body and therefore there is little tactile stimulation. When the participant receives more tactile stimulation there is a greater likelihood that they will become more attentive to their body and the stimulus that is inducing the sound and vibration. Therefore, during TV viewing and/or listening to music or a soundtrack and playing video games another sensory modality (touch) can be stimulated in the participant thereby enhancing the experience. Video gaming is further enhanced using this invention as tactile cueing provides additional information. This affords the user a faster response time as vibratory stimuli can trigger a very fast reflex arc.

Movie theaters typically use high volume sound sources to partially create such an effect. Oftentimes the sound will exceed a safe sound level of 85 decibels (OSHA 3074). Moviegoers therefore may experience harmful effects related to their hearing. People however, frequently enjoy the movie theater experience in part because the higher volume of sound creates more physical and emotional feeling through sound and vibration, which enhances alertness and attentiveness. The higher level of alertness and attentiveness causes the moviegoer to become more engaged in the movie and when the moviegoer leaves the theater, he or she is often aware of a heightened state of arousal and awareness.

However, not all people prefer to experience sound at the same volume level. Some people prefer lower volume, while others prefer higher volume. When more than one person is watching and listening to TV or a movie or listening to music there is often disagreement as to how loud the volume should be in the shared environment. Consequently, there is a need in the art for a method and apparatus which enables a person to experience the sound without the need to either raise or lower the audible volume level of the sound.

SUMMARY OF INVENTION

The present invention relates to a pad, chair or similar body-supporting apparatus for sitting on, reclining on or lying upon. More specifically, the invention relates to a pad, chair or similar apparatus capable of transmitting sound and vibrations generated by a sound source and/or a vibration source to a user's body. The sound and vibrations are transmitted through speakers, transducers, or a combination thereof which are connected to the chair. The transmitted sound and vibrations may include translated frequencies. These translated frequencies are generated by a translation of higher frequencies that can mainly be heard to lower frequencies that can mainly be felt.

The present invention also relates to a method of providing vibrational energy to a user, including regulating sound and vibrations transmitted through speakers, transducers, or a combination thereof which are connected to a chair or similar body-supporting apparatus.

In one embodiment, the subject invention includes a chair having a back pad and a seat pad. Each pad is comprised of a covering layer, surrounding foam, and a speaker module. The speaker module is disposed within the pad and is surrounded by the covering layer and the surrounding foam.

In one embodiment, the covering layers are comprised of a top and bottom layer. Both layers are designed to be very compressible to conform to the user's head or back for comfort purposes and to allow sound and vibration energy to pass with minimal attenuation and obstruction. The top covering layer is made of a highly porous material through which sound and vibrations can readily penetrate. The bottom covering layer lies just under the top layer and is made of a fiber that also has limited sound and vibration filtering.

In one embodiment, the speaker module includes a number of layers to form chambers around the speakers (resonant chambers) and provide orientation and support for the speakers. The resonant chamber space is air-filled between the speaker and a resonating layer.

In one embodiment, the speakers are connected to an amplifier. The amplifier of the present invention can accept audio output from a sound source such as a VCR, DVD, CD or MP3 player, or other electronic devices that have audio output capabilities. The audio output of the amplifier can be sent to the user's TV or stereo receiver (connected to other external speakers) instead of or in addition to the pad. The amplifier includes an automatic volume adjustment mechanism which adjusts the volume of the sound to be transmitted through the pad(s), chair and air.

The present invention is intended to provide physical, emotional, and psychological health and wellness benefits while being used for entertainment purposes and/or activities (watching and listening to TV and movies, listening to music, and playing video games). This invention is intended to cause people to feel more physically in order to become more aware of how their body feels so that they can more easily learn physical relaxation; to feel more emotionally so that they can ultimately confront and resolve their emotional issues; to administer sound energy in the form of sound and vibrations at a multitude of frequencies to physical structures of the body to elicit additional health benefits; and to provide vibratory stimuli associated with auditory stimuli allowing for the potential of reprogramming and/or rewiring of their nervous system; all during the pursuit of entertainment activities.

BRIEF DESCRIPTION OF THE DRAWINGS

For the purposes of facilitating the understanding of the subject matter sought to be protected, there is illustrated in the accompanying drawings an embodiment thereof. From an inspection of the drawings, when considered in connection with the following description, the subject matter sought to be protected, its construction and operation, and many of its advantages should be readily understood and appreciated.

FIGS. 2A-2F are magnified partial views of the schematic wiring diagram, while FIG. 2 shows the whole diagram formed by the partial views of FIGS. 2A-2F.

FIG. 3 is a diagram showing multiple chairs linked to a BodyLink™ receiver in accordance with the present invention. FIGS. 3A-3D are magnified partial views of this diagram, while FIG. 3 shows the whole diagram formed by the partial views of FIGS. 3A-3D.

FIGS. 4A-4H are magnified partial views of this diagram, while FIG. 4 shows the whole diagram formed by the partial views of FIGS. 4A-4H.

FIGS. 5A-5H are magnified partial views of this diagram, while FIG. 5 shows the whole diagram formed by the partial views of FIGS. 5A-5H.

DETAILED DESCRIPTION

The present invention is directed to a method and apparatus for transmitting sound and vibration to a user. The sound and vibration is transmitted through one or more electromagnetic drivers that are connected to a seating configuration. The terms "electromagnetic driver" and "driver" as used herein refer to a speaker and/or transducer. The phrase "seating configuration" as used herein refers to a body-supporting apparatus for sitting on, reclining on or lying upon. A seating configuration may include, for example, a chair, a recliner, a sofa, a loveseat, a row of multiple seats, a mattress, a bed, and the like. The transmitted sound and vibration may include translated frequencies. These translated frequencies are generated by a translation of higher frequencies, which can mainly be heard, to lower frequencies, which can mainly be felt.

The present invention also relates to a method of providing vibrational energy to a user, including regulating sound and vibrations transmitted through speakers, transducers, or a combination thereof which are connected to a chair or similar body-supporting apparatus.

Figure 1:
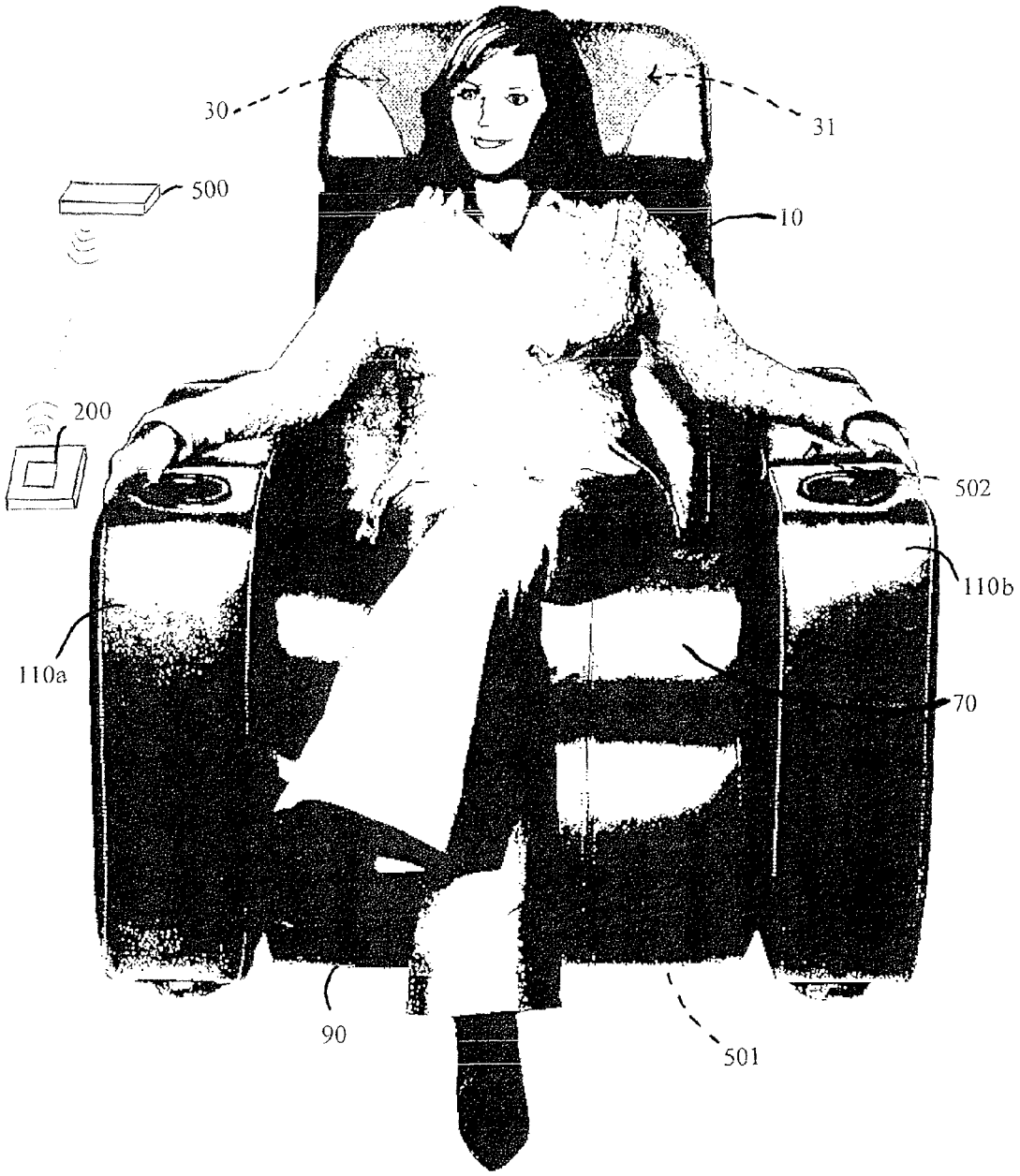
FIG. 1 depicts a person sitting in a chair made in accordance with the present invention.

In one embodiment of this invention, a chair transmits sound and vibration to a user. FIG. 1 depicts a person sitting in a chair made in accordance with the present invention. The chair includes a back 10, seat 70, arms 110*a* and 110*b*, and footrest 90. Head speakers 30 and 31 are located in the back of the chair. Arm controls 502 are located in an arm of the chair, and an amplifier box 501 is underneath the chair. A BodyLink™ receiver 500 and a Control Screen 200, which are used in conjunction with the chair, are also depicted.

Health Benefits

The health benefits of this invention appear to derive from at least three different mechanisms, which can all act synergistically. To a significant extent they may result from the general health improvements seen due to improved homeostatic balance between the parasympathetic (rest and repose) and sympathetic (fight or flight) divisions of the autonomic nervous system. They also may result from the direct effects of sound and vibrational energy interacting with tissues, organs, and other aspects of the body, as well as from a re-programming and/or potentially a rewiring of the nervous system. These three different mechanisms are discussed below.

Improved Homeostasis Between Sympathetic and Parasympathetic Systems

The growing practice of mind-body medicine has fostered a greater awareness between what the mind thinks/believes and how the body physiologically responds. The mind operates either through or as part of a person's central and peripheral nervous system. As such, it is able to influence all functions of the human body through direct nervous activation of specific functions within the organs of the body. It can also act systemically through its influence on the endocrine and immune systems of the body and presumably through other as of yet unknown processes.

Over the past several decades health practitioners have begun to instruct patients on the practice and benefits of the relaxation response (Benson, Beary, Carol, 1974), which is a method to reduce the impact of stressors on the mind and body of a patient or subject. It is now generally accepted that practices such as the relaxation response, including meditation, improve homeostatic balance within the autonomic nervous system (generally resulting in activation of parasympathetic and inhibition of sympathetic processes), causing improved physical health and psychological and emotional well being.

The present invention can elicit a spontaneous relaxation response. The strength of the relaxation response depends upon the sound stimulus used, the activities of the user, and the duration of use. The most profound relaxation responses tend to occur with the use of music for periods of time lasting at least twenty to thirty minutes to approximately one hour.

The standard relaxation response is usually, but not always, practiced with the subject's eyes closed. Having the eyes closed tends to produce greater levels of relaxation, although some subjects are too fearful to let down their defenses and practice relaxation with their eyes closed. The subject is typically presented with a live or recorded set of vocal instructions with or without a musical accompaniment. The subject attempts to follow the instructions that he or she is listening to and endeavors to relax.

Use of the present invention to elicit the relaxation response occurs with the user's eyes open or closed, but also tends to work best when the user's eyes are closed. The user listens to a desired soundtrack or music. Unlike the standard form of relaxation practice, when using this invention the user is able to feel the vibrations associated with the sound source. It is this aspect that appears to be most important in producing a spontaneous relaxation response and it is most importantly what differentiates this form of relaxation practice from others and from simply sitting in a chair listening to music.

The mechanism underlying the relaxation response associated with the present invention is best understood by a simple review of our normal sensory apparatus and how that is used to survey the environment for danger as part of our normal, typically subconscious survival instinct. We use our senses of sight (visual), sound (auditory), and touch (somatosensory), in that order, to survey our environment for danger. Sight provides the earliest possible warning, followed by sound and then touch. This hierarchy reflects the physical properties of the stimuli and the distance from the organism required to stimulate the specific sense.

Signals from the primary sensory nerves (optic, auditory, and peripheral somatic nerves) connect to the amygdala in the central nervous system. These signals are registered here even before they are transmitted to their respective target areas of the cerebral cortex (the thinking brain). Due to the nature of the amygdala and its connections within the nervous system, the organism can more rapidly, instinctively determine if the stimulus received is similar to any stimulus received in the organism's past that is considered dangerous. The organism can then respond instinctively and take whatever action is necessary to avoid harm.

It is the function of the nervous system and in particular, the amygdala and related structures that manifest our survival instinct. These structures and the activation level within the nervous system at large that they cause and maintain, give rise to our level of alertness and arousal. When this system is over-used or over-attended to, the organism tends to have an imbalance in its autonomic nervous system functioning with greater sympathetic than parasympathetic activation. The relaxation response is intended to reset this system and readjust its homeostatic balance.

With use of this invention the visual stimulus is either turned off (eyes closed) or is chosen by the user based upon his or her preference. The auditory stimulus is also both user-selected and presumably pleasurable to the user. With standard relaxation response practices, the sense of touch is left in its normal uninvolved state, poised to sense danger. Given its hierarchical level of importance (the closest in warning system) and with the other senses either turned off or engaged, it has the ability to produce a more heightened level of arousal. Using this invention, however, allows the user's sense of touch to be engaged by synchronously feeling the vibrations associated with the music or soundtrack that is being listened to.

As such, the latter two senses (sound and touch) that represent the closer in warning systems are both synchronously engaged with a stimulus that the user deems pleasurable. Psychologically, the user has been moved from a state of subconscious surveillance to one of welcome and willing sensory engagement. This state is diametrically opposed to that associated with the state of surveillance associated with our survival instinct. As a result, the state of arousal that is normally experienced is reduced, rendering the organism less aroused and more relaxed.

By using music, which by its very nature is a time-varying stimulus, the nervous system is less prone to habituate to the stimulus, as it might with a more constant stimulus and return to its prior state of surveillance. Also, listening with portable devices apart from the present invention, to music previously used in the chair of the present invention, can trigger relaxed feelings that the user has become conditioned to experience. Furthermore, with practice and even without additional cues, the user can learn to recall and reproduce relaxed feelings even without being exposed to the stimulus and thus recreate a more relaxed state independent of the present invention.

Direct Effects of Sound and Vibrational Energy

Sound and vibration due to their frequency characteristics can directly stimulate the tissues and organs of the body. In "Healing Sounds," Jonathan Goldman defines resonance as "the frequency at which an object most naturally vibrates. Everything has a resonant frequency whether we can audibly perceive it." Presumably, everything has an ideal resonant frequency as well, one that is associated with that tissue's or organ's state of maximal health. It is now known that chemical bonding is associated with vibrational shifts of molecules, including those of the cell wall. It is quite conceivable that when tissues or organs resonate closer to their ideal frequency, ensuing cellular and molecular changes result in more normal or ideal functioning.

Entrainment is defined as the tendency for two oscillating bodies to lock into phase so that they vibrate in harmony. It is also defined as a synchronization of two or more rhythmic cycles. It is possible that the physics of entrainment could be applied to tissues and organs of the human body to alter their resonant frequency such that they resonate in a more ideal fashion. This could result in greater health of the tissue or organ, thus resulting in greater health and well being of the organism.

Sound and vibratory stimuli applied to tissues and organs of the body may create health benefits. Faced with the problem of bone loss during space flights in zero gravity conditions, NASA funded studies to evaluate the effects of vibration on bone mass. These studies were described in the Nov. 2, 2001 issue of *Science@NASA* as follows: "NASA-funded scientists suggest that astronauts might prevent bone loss by standing on a lightly vibrating plate for 10 to 20 minutes each day . . . . 'The vibrations are very slight,' notes Stefan Judex, assistant professor of biomedical engineering at the State University of New York at Stony Brook, who worked on the research. The plate vibrates at 90 Hz . . . , with each brief oscillation imparting an acceleration equivalent to one-third of Earth's gravity. 'If you touch the plate with your finger, you can feel a very slight vibration,' he added. 'If you watch the plate, you cannot see any vibration at all.' Although the vibrations are subtle they have had a profound effect on bone loss in laboratory animals such as turkeys, sheep, and rats." *Science@NASA*, Nov. 2, 2001.

Most bone researchers believe that the stresses placed on bones by, e.g., bearing weight or strong physical exertion, signal the bone-building cells through some unknown chemical trigger to fortify bones. Clinton Rubin, a professor of biomedical engineering at SUNY Stony Brook, who was the principal investigator for the study, postulates that the mechanism by which vibration prevents bone loss relates not only to "a few, large stresses placed on the skeleton that signal bone formation, but also many smaller, high-frequency vibrations applied to bones by flexing muscles during common activities such as standing or walking." *Science@NASA*, Nov. 2, 2001.

"Our hypothesis is that a key regulator of bone mass and morphology are the mechanical stimuli that come out of muscle contractions," states Rubin. "So instead of these big, intensive deformations of bone, it's basically lots and lots of little ones [that provide a major stimulus for bone growth]." *Science@NASA*, Nov. 2, 2001. The little contractions that he is referring to are the contractions of the individual motor units within muscles, as they are recruited to fire based upon signals from the nervous system. The frequency of these contractions creates a vibratory stimulus administered to the bone which ranges between 10 and 100 Hz.

Although Rubin never proposes a mechanism of action invoking resonant frequencies, the structure of cancellous bone reveals a crystal-like, cavernous structure, which could predispose it to resonation by an array of frequencies that may match or be sub-harmonics of an ideal resonating frequency for bone.

As described in the *Science@NASA* article, "[t]he interior of bones isn't completely solid. Instead, it consists of a web of mineral filaments—called "trabeculae"—and cells . . . . These trabeculae provide structural rigidity while minimizing weight."

Theoretically the vibratory stimulus itself rather than the stresses they may impose on the bone may be what triggers the lattice-like structure of bone to preserve its mass.

Furthermore, "[i]n one study (published in the October 2001 issue of *The FASEB Journal*), only 10 minutes per day of vibration therapy promoted near-normal rates of bone formation in rats that were prevented from bearing weight on their hind limbs during the rest of the day. Another group of rats that had their hind legs suspended all day exhibited severely depressed bone formation rates—down by 92%—while rats that spent 10 minutes per day bearing weight, but without the vibration treatment, still had reduced bone formation—61% less. These results show that the vibration treatment maintained normal bone formation rates, while brief weight bearing did not," providing additional support to a vibrationally mediated interventional response unassociated with stresses imposed on bone. *Science@NASA*, Nov. 2, 2001.

Vicente Gilsanz, et al, in the *Journal of Bone and Mineral Research* (2006 September; 21(9):1464-74), reported in an article entitled, "Low-level, high-frequency mechanical signals enhance musculoskeletal development of young women with low BMD [bone mass density]" the following:

"The potential for brief periods of low-magnitude, high-frequency mechanical signals to enhance the musculoskeletal system was evaluated in young women with low BMD. Twelve months of this noninvasive signal, induced as whole body vibration for at least 2 minutes each day, increased bone and muscle mass in the axial skeleton and lower extremities compared with controls.

"INTRODUCTION: The incidence of osteoporosis, a disease that manifests in the elderly, may be reduced by increasing peak bone mass in the young. Preliminary data indicate that extremely low-level mechanical signals are anabolic to bone tissue, and their ability to enhance bone and muscle mass in young women was investigated in this study.

"MATERIALS AND METHODS: A 12-month trial was conducted in 48 young women (15-20 years) with low BMD and a history of at least one skeletal fracture. One half of the subjects underwent brief (10 minutes requested), daily, low-level whole body vibration (30 Hz, 0.3 g); the remaining women served as controls. Quantitative CT performed at baseline and at the end of study was used to establish changes in muscle and bone mass in the weight-bearing skeleton.

"RESULTS: Using an intention-to-treat (ITT) analysis, cancellous bone in the lumbar vertebrae and cortical bone in the femoral midshaft of the experimental group increased by 2.1% (p=0.025) and 3.4% (p<0.001), respectively, compared with 0.1% (p=0.74) and 1.1% (p=0.14), in controls. Increases in cancellous and cortical bone were 2.0% (p=0.06) and 2.3% (p=0.04) greater, respectively, in the experimental group compared with controls. Cross-sectional area of paraspinous musculature was 4.9% greater (p=0.002) in the experimental group versus controls. When a per protocol analysis was considered, gains in both muscle and bone were strongly correlated to a threshold in compliance, where the benefit of the mechanical intervention compared with controls was realized once subjects used the device for at least 2 minute/day (n=18), as reflected by a 3.9% increase in cancellous bone of the spine (p=0.007), 2.9% increase in cortical bone of the femur (p=0.009), and 7.2% increase in musculature of the spine (p=0.001) compared with controls and low compliers (n=30).

"CONCLUSIONS: Short bouts of extremely low-level mechanical signals, several orders of magnitude below that associated with vigorous exercise, increased bone and muscle mass in the weight-bearing skeleton of young adult females with low BMD. Should these musculoskeletal enhancements be preserved through adulthood, this intervention may prove to be a deterrent to osteoporosis in the elderly."

This study demonstrated that a very low intensity vibratory stimulus was effective in restoring bone mass in humans and in addition that it was effective at also adding muscle mass when receiving the vibratory stimulus for only a very short period of time per day.

Clinton Rubin, et al, reported in the *Journal of Bone and Mineral Research* (2004 March; 19(3):343-51. Epub 2003 Dec. 22) the following:

"A 1-year prospective, randomized, double-blind, and placebo-controlled trial of 70 postmenopausal women demonstrated that brief periods (<20 minutes) of a low-level (0.2 g, 30 Hz) vibration applied during quiet standing can effectively inhibit bone loss in the spine and femur, with efficacy increasing significantly with greater compliance, particularly in those subjects with lower body mass.

"INTRODUCTION: Indicative of the anabolic potential of mechanical stimuli, animal models have demonstrated that short periods (<30 minutes) of low-magnitude vibration (<0.3 g), applied at a relatively high frequency (20-90 Hz), will increase the number and width of trabeculae, as well as enhance stiffness and strength of cancellous bone. Here, a 1-year prospective, randomized, double-blind, and placebo-controlled clinical trial in 70 women, 3-8 years past the menopause, examined the ability of such high-frequency, low-magnitude mechanical signals to inhibit bone loss in the human.

"MATERIALS AND METHODS: Each day, one-half of the subjects were exposed to short-duration (two 10-minute treatments/day), low-magnitude (2.0 m/s2 peak to peak), 30-Hz vertical accelerations (vibration), whereas the other half stood for the same duration on placebo devices. DXA was used to measure BMD at the spine, hip, and distal radius at baseline, and 3, 6, and 12 months. Fifty-six women completed the 1-year treatment.

"RESULTS AND CONCLUSIONS: The detection threshold of the study design failed to show any changes in bone density using an intention-to-treat analysis for either the placebo or treatment group. Regression analysis on the a priori study group demonstrated a significant effect of compliance on efficacy of the intervention, particularly at the lumbar spine (p=0.004). Posthoc testing was used to assist in identifying various subgroups that may have benefited from this treatment modality. Evaluating those in the highest quartile of compliance (86% compliant), placebo subjects lost 2.13% in the femoral neck over 1 year, whereas treatment was associated with a gain of 0.04%, reflecting a 2.17% relative benefit of treatment (p=0.06). In the spine, the 1.6% decrease observed over 1 year in the placebo group was reduced to a 0.10% loss in the active group, indicating a 1.5% relative benefit of treatment (p=0.09). Considering the interdependence of weight, the spine of lighter women (<65 kg), who were in the highest quartile of compliance, exhibited a relative benefit of active treatment of 3.35% greater BMD over 1 year (p=0.009); for the mean compliance group, a 2.73% relative benefit in BMD was found (p=0.02). These preliminary results indicate the potential for a noninvasive, mechanically mediated intervention for osteoporosis. This non-pharmacologic approach represents a physiologically based means of inhibiting the decline in BMD that follows menopause, perhaps most effectively in the spine of lighter women who are in the greatest need of intervention."

This study provides further evidence of the benefits of vibrational therapy in humans and demonstrates the treatment value of vibrational stimuli specifically for the medical condition of osteoporosis.

Several other medical conditions have also been studied albeit in a very limited way.

Researchers in the Department of Physical Medicine and Rehabilitation, at the Medical University of Vienna, Austria, set out to study whether a whole-body vibration (mechanical oscillations, 2.0-4.4 Hz oscillations at 3-mm amplitude) "in comparison to a placebo administration leads to better postural control, mobility and balance in patients with multiple sclerosis" (MS). *Clinical Rehabilitation* (2005; 19(8):834-842. The results of the double-blind, randomized, controlled trial were reported in the December 2005 issue of *Clinical Rehabilitation*. The authors of this pilot study concluded that "whole-body vibration may positively influence the postural control and mobility in multiple sclerosis patients."

An uncontrolled study was also performed on a small group of patients with peripheral vascular disease using a sound/vibratory stimulus (one, 25 minute period of exposure to a stimulus of 500 and 800 Hz) to determine if that stimulus would provide symptom relief and increased blood flow. The study was reported in *Complementary Therapies in Medicine* (2002; 10:170-175. Thirteen of the fifteen subjects reported improvements in symptoms one week later and a number of the objective measurements of blood flow yielded positive results that were statistically significant.

The research performed to date on sound and vibratory stimuli and their health effects on the human body have been extremely limited, but quite encouraging.

Reprogramming and/or Rewiring of the Nervous System

The relationship between our physical and emotional feelings is experienced regularly. Emotional states, particularly strong ones, are accompanied by physical feelings. Anger and rage results in feeling warm or hot and feeling restless with muscles tensed. Fear and anxiety is often accompanied by "butterflies" in the stomach or nausea, sweating, dry mouth, rapid breathing, tingling around the mouth and fingers, and palpitations. Shame and guilt often causes feelings of embarrassment with a flushed face and neck and a feeling of withdrawing into oneself. More positive emotional feelings such as love, happiness, and joy often create physical feelings associated with having more energy. We feel lighter, stronger, and experience less pain.

Alternatively, physical feelings often create associated emotional feelings. Pain is regularly associated with anxiety. Feeling tired, run down, and depleted often creates feelings of sadness and depression. Having and/or feeling more physical energy or feeling less tired generally causes us to feel more upbeat and enthusiastic, explaining why so many people self-medicate with caffeine and nicotine.

Synchronously feeling vibrations associated with the music of one's choosing is a pleasant experience causing the user to want and intend to feel more. This to a large extent explains the causation underlying the induced relaxation response, but it also provides a link to experiencing more or deeper emotional feelings. Behaviorally, in general, we perceive what we attend to and we generally intend to attend to more pleasurable stimuli. As a result, placing more attention on pleasurable physical feelings predisposes us to feeling more emotionally because in the process we set our intentions to increase our feeling nature (desire to feel more) in general.

Listening to music associated with positive memories and emotional feelings or music that is uplifting and inspirational generally causes us to feel better physically. Listening to such music using the present invention creates a situation which allows us to associate those good feelings with the vibrations experienced in association with the music. With repeated use we can become conditioned to associate those vibrations with good feelings. The human nervous system is programmable to accomplish these types of sensory associations. There is mounting evidence that new sensory associations and related learning may not only change nervous system functioning, but may also change nervous system structure.

Neuroplasticity (variously referred to as brain plasticity or cortical plasticity) refers to the changes that occur in the organization of the brain as a result of experience. The concept of neuroplasticity pushes the boundaries of the brain areas that are still rewiring in response to changes in environment. Several decades ago the consensus was that lower brain and neocortical areas were immutable after development, whereas areas related to memory formation, such as the hippocampus where new neurons continue to be produced into adulthood, were highly plastic.

Hubel and Wiesel had demonstrated that ocular dominance columns in the lowest neocortical visual area, V1, were largely immutable after the critical period in development. Critical periods also were studied for language and suggested it was likely that the sensory pathways were fixed after their respective critical periods. Environmental changes however, could cause changes in behavior and cognition by modifying the connections of the new neurons in the hippocampus. Decades of research have now shown that substantial changes occur in the lowest neocortical processing areas, and that these changes can profoundly alter the pattern of neuronal activation in response to experience. According to the theory of neuroplasticity, thinking, learning, and acting actually change the brain's functional anatomy from top to bottom, if not also its physical anatomy.

Cortical organization, especially for the sensory systems, is often described in terms of maps. For example, sensory information from the foot projects to one cortical site and the projections from the hand target in another site. As the result of this somatotopic organization of sensory inputs to the cortex, cortical representation of the body resembles a map (or homunculus). In the late 1970s and early 1980s, several groups began exploring the impacts of removing portions of the sensory inputs. Merzenich and Kaas used the cortical map as their dependent variable. They found—and this has been since corroborated by a wide range of labs—that if the cortical map is deprived of its input it will become activated at a later time in response to other, usually adjacent inputs. At least in the somatosensory system, in which this phenomenon has been most thoroughly investigated, Wall and Xu have traced the mechanisms underlying this plasticity. Re-organization occurs at every level in the processing hierarchy to result in the map changes observed in the cerebral cortex. It is not cortically emergent.

Merzenich and Jenkins (1990) initiated studies relating sensory experience, without pathological perturbation, to cortically observed plasticity in the primate somatosensory system, with the finding that sensory sites activated in an attended operant behavior increase in their cortical representation. Shortly thereafter, Ebner and colleagues (1994) made similar efforts in the rodent whisker barrel (also somatosensory system). However, the rodent studies were poorly focused on the behavioral end, and Frostig and Polley (1999, 2004) identified behavioral manipulations as causing a substantial impact on the cortical plasticity in that system.

Merzenich and Blake (2002, 2005, and 2006) went on to use cortical implants to study the evolution of plasticity in both the somatosensory and auditory systems. Both systems show similar changes with respect to behavior. When a stimulus is cognitively associated with reinforcement, its cortical representation is strengthened and enlarged. In some cases, cortical representations can increase two to three fold in 1-2 days at the time at which a new sensory motor behavior is first acquired, and changes are largely finished within at most a few weeks. Control studies show that these changes are not caused by sensory experience alone: they require learning about the sensory experience, and are strongest for the stimuli that are associated with reward, and occur with equal ease in operant and classical conditioning behaviors.

An interesting phenomenon involving cortical maps is the incidence of phantom limbs. This is most commonly described in people that have undergone amputations in hands, arms, and legs, but it is not limited to extremities. The phantom limb feeling, which is thought to result from disorganization in the homunculus and the inability to receive input from the targeted area, may be annoying or painful. Incidentally, it is more common after unexpected losses than planned amputations. There is a high correlation with the extent of physical remapping and the extent of phantom pain. As it fades, it is a fascinating functional example of new neural connections in the human adult brain.

The concept of plasticity can be applied to molecular as well as to environmental events. The phenomenon itself is complex and can involve many levels of organization. To some extent the term itself has lost its explanatory value because almost any changes in brain activity can be attributed to some sort of "plasticity." For example, the term is used prevalently in studies of axon guidance during development, short-term visual adaptation to motion or contours, maturation of cortical maps, recovery after amputation or stroke, and changes that occur in normal learning in the adult. Some authors separate forms into adaptations that have positive or negative consequences for the animal. For example, if an organism, after a stroke, can recover to normal levels of performance, that adaptiveness could be considered an example of "positive plasticity." An excessive level of neuronal growth leading to spasticity or tonic paralysis, or an excessive release of neurotransmitters in response to injury which could kill nerve cells, would have to be considered perhaps as a "negative or maladaptive" plasticity.

Neuroplasticity is a fundamental issue that supports the scientific basis for treatment of acquired brain injury with goal-directed experiential therapeutic programs in the context of rehabilitation approaches to the functional consequences of the injury. The adult brain is not "hard-wired" with fixed and immutable neuronal circuits. Many people have been taught to believe that once a brain injury occurs, there is little to do to repair the damage. This is simply not the case and there is no fixed period of time after which "plasticity" is blocked or lost. We simply do not know all of the conditions that can enhance neuronal plasticity in the intact and damaged brain, but new discoveries are being made all of the time. There are many instances of cortical and subcortical rewiring of neuronal circuits in response to training as well as in response to injury. There is solid evidence that neurogenesis, the formation of new nerve cells, occurs in the adult, mammalian brain—and such changes can persist well into old age.

The evidence for neurogenesis is restricted to the hippocampus and olfactory bulb. In the rest of the brain, neurons can die, but they cannot be created. However, there is now ample evidence for the active, experience-dependent re-organization of the synaptic networks of the brain involving multiple inter-related structures including the cerebral cortex. The specific details of how this process occurs at the molecular and ultrastructural levels are topics of active neuroscience research.

As understanding and awareness about neuroplasticity has grown scientists have begun to postulate its involvement in other conditions including chronic pain. In a *Newsweek* cover article, "The New War on Pain," (Jun. 4, 2007) the writers state, "Though further research needs to be done, doctors believe a continuous flood of pain signals to the brain may cause long-term changes in the nervous system that can lead to ongoing pain, even if the original injury has healed."

The article also states, "The military is pioneering its own new approaches. Since 2003, a small but growing number of soldiers in Iraq have been treated at the front with high-tech nerve-blocking devices that are effective but not addictive. They are common in civilian life, but their use in the battlefield is unprecedented." This treatment is administered in the hope that blocking the pain signals early will abort the development of the long-term changes in the nervous system.

The nerve-blocking devices commonly used in civilian life are called TENS (Transcutaneous Electrical Nerve Stimulation) units. They supply a small electrical current believed to block the transmission of competing pain signals at the level of the spinal cord. Although medical doctors and researchers were very enthusiastic about the potential treatment benefits of this technology when it was first introduced decades ago, more recent scientific studies have had mixed results casting some doubt on its level of efficacy. Blocking the pain signals may be more effectively accomplished using the present invention since the physical stimulation (auditory and tactile) with its associated emotional influences impact the nervous system at multiple levels, including cortical locations.

The concept of neuroplasticity would suggest that exposure to an auditory (sound and/or musical) stimulus that elicited certain emotional feelings (with associated physical feelings), while attempting to learn how the sound feels from a somatosensory perspective (associated vibratory stimulus), would create greater functional and potentially anatomic connectivity between the respective sensory and association areas in the nervous system. This would provide greater integration between our senses of hearing and touch and our emotions (including the associated physical accompaniments). For those already suffering from chronic pain this new approach could create its own rewiring at sites that play a role in the chronic pain condition.

Such a system applied differently, but also using positive auditory stimuli, could increase our sensitivity as human beings, as our feeling capability would become enhanced. It is very likely that such a system could be useful for emotional training/retraining for emotional and psychological conditions. This could be useful for the retraining of sociopaths and psychopaths, as well as less severe conditions such as anger management and other behavioral problems.

This type of therapy could be directed at emotional feelings which underlie a person's actions and behaviors. Active exploration of a person's emotions would allow a subject and therapist to explore the subject's beliefs which precipitate those emotional feelings. With repeated exposure to this type of therapy a person could learn to think and feel differently. Conceivably this change could be long-lasting, resulting in long-lasting functional and possibly structural changes within the nervous system.

The Dalai Lama invited Richard Davidson, a Harvard-trained neuroscientist at the University of Wisconsin-Madison's W. M. Keck Laboratory for Functional Brain Imaging and Behavior to his home in Dharamsala, India, in 1992 after learning about Davidson's innovative research into the neuroscience of emotions. Most scientists did not believe the idea that the act of thinking could change the brain, but they agreed to test the theory.

One such experiment involved a group of eight Buddist monk adepts and ten volunteers who had been trained in meditation for one week in Davidson's lab. All the people tested were told to meditate on compassion and love. Two of the controls, and all of the monks, experienced an increase in the number of gamma waves in their brain during meditation. As soon as they stopped meditating, the volunteers' gamma wave production returned to normal, while the monks, who had meditated on compassion for more than 10,000 hours in order to attain the rank of adept, did not experience a decrease to normal in the gamma wave production after they stopped meditating. The synchronized gamma wave area of the monks' brains during meditation on love and compassion was found to be larger than that corresponding activation of the volunteers' brains. Davidson's results were published in the Proceedings of the National Academy of Sciences in November, 1994.

As in all forms of therapy, repeated use (compliance) yields the greatest results. In order for the present invention to be used regularly for entertainment purposes, so that the user will derive more significant health benefits, it must confer desirable user benefits that justify and encourage its use during the aforementioned entertainment activities.

Description of Embodiments of the Invention

One embodiment of the present invention takes the form of seating in multiple configurations containing one sound system per seat (a seating configuration can contain multiple seats). The seating configuration includes a continuous metal frame, a seat pad and a back pad per seat, and at least two arms. The sound system includes an amplifier box, cables, and an array of speakers/drivers. The amplifier box contains multiple (seven, in this embodiment) channels of amplification, digital logic chips and circuitry including, but not limited to, processing capability in the form of digital signal processor chips, a main or central processor, and embedded firmware. The amplifier box can also contain a wireless receiver to receive audio signals. The cover of the amplifier box is shaped to serve as a drip shield to funnel fluids away from the electronic components and connectors, since it is placed under the seat where it potentially could be exposed to fluid from a spilled beverage.

In one embodiment of the system in accordance with the present invention, there are a minimum of three digital signal processing chips (DSPs). This provides a computational capacity of at least 150 million instructions per second. The DSPs are used to decode a Dolby 5.1 AC3 bit stream and Dolby True HD. They are also used to perform virtual surround sound and EQ (equalizer) functions, and to compute the generated frequency array and its digital output for both the BodyNumber™ and FeelNumber™ functions, which are discussed below.

Figure 2:
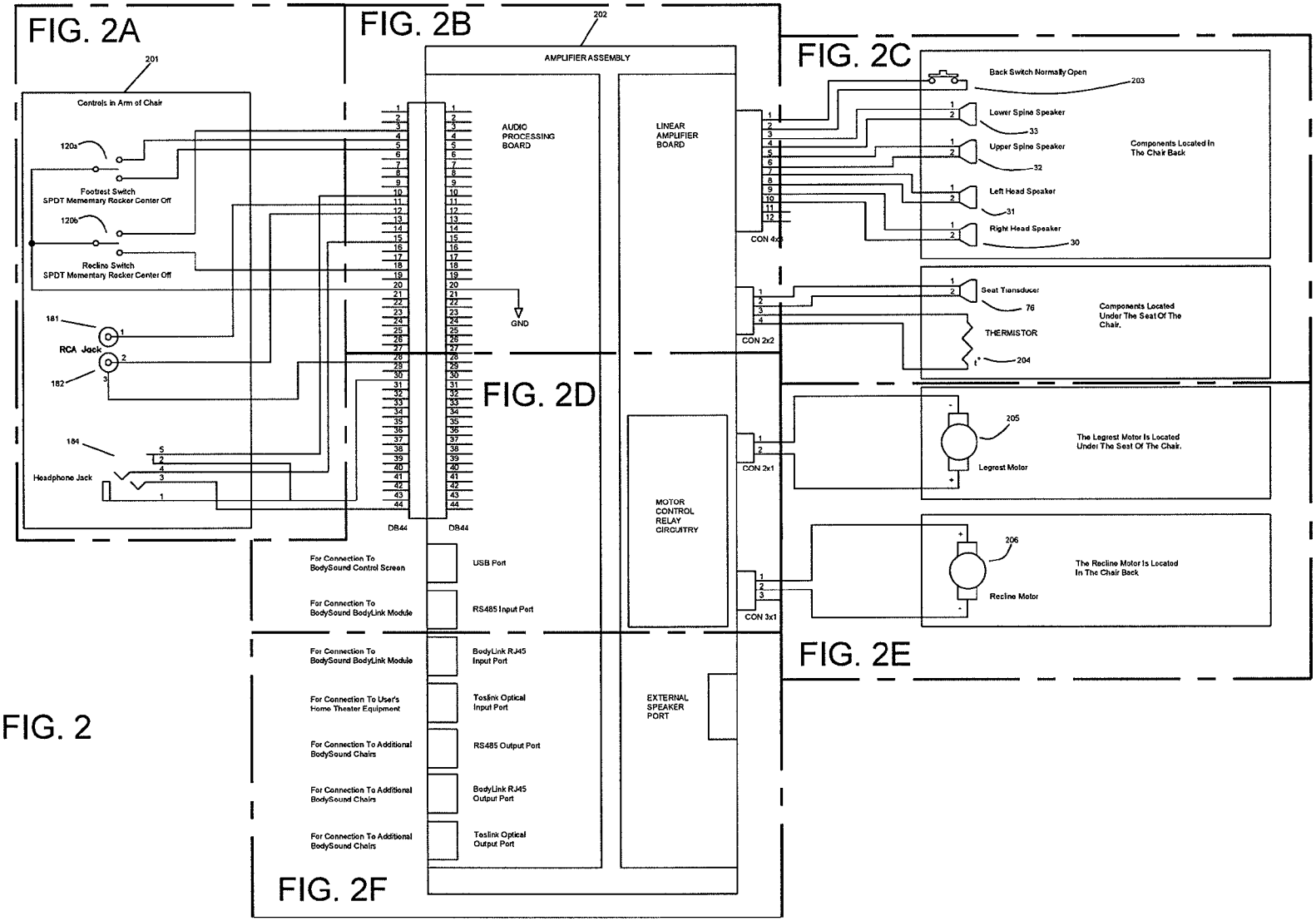
FIG. 2 is a schematic wiring diagram of a chair made in accordance with the present invention.
Figure 2A:
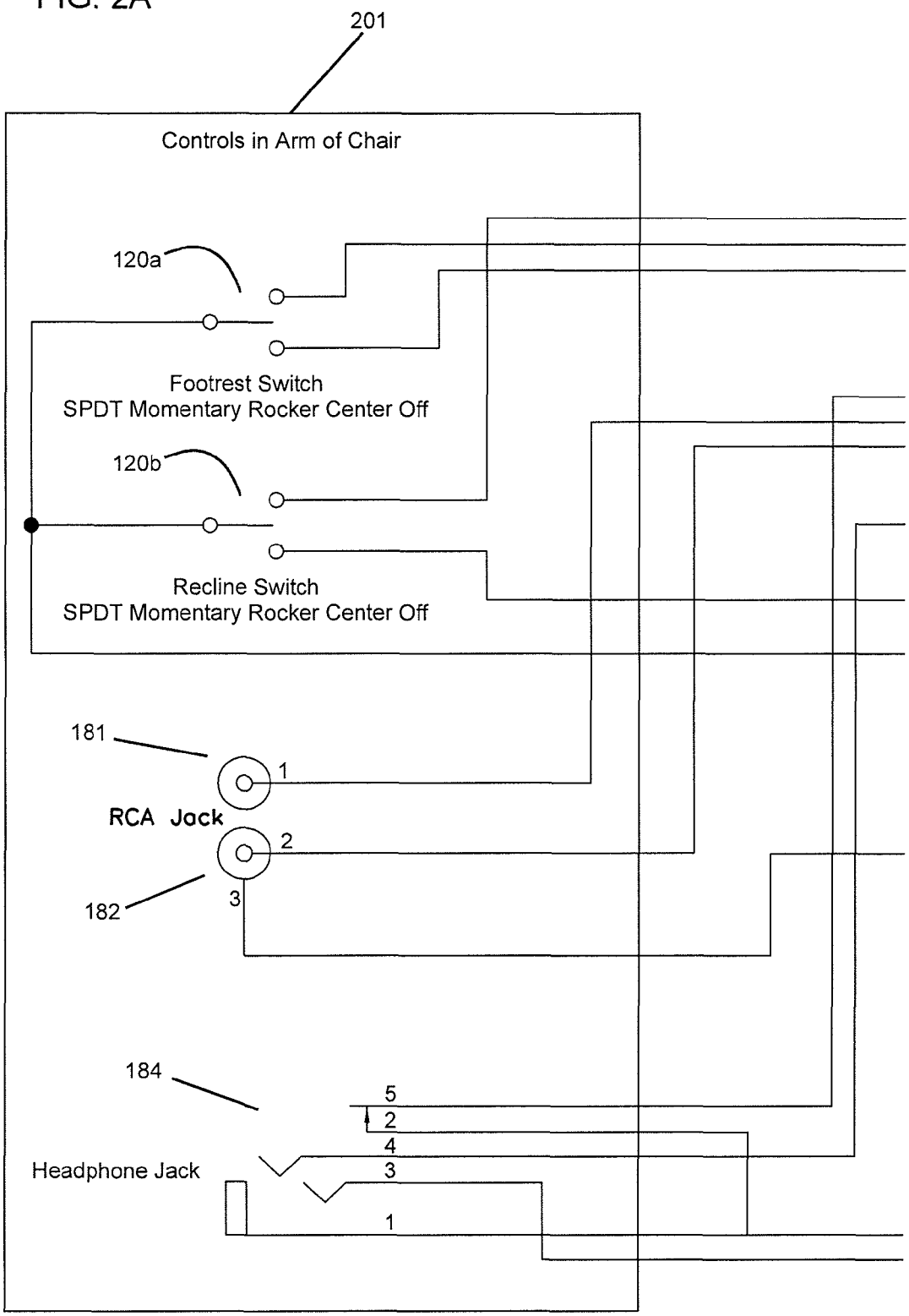
Figure 2B:
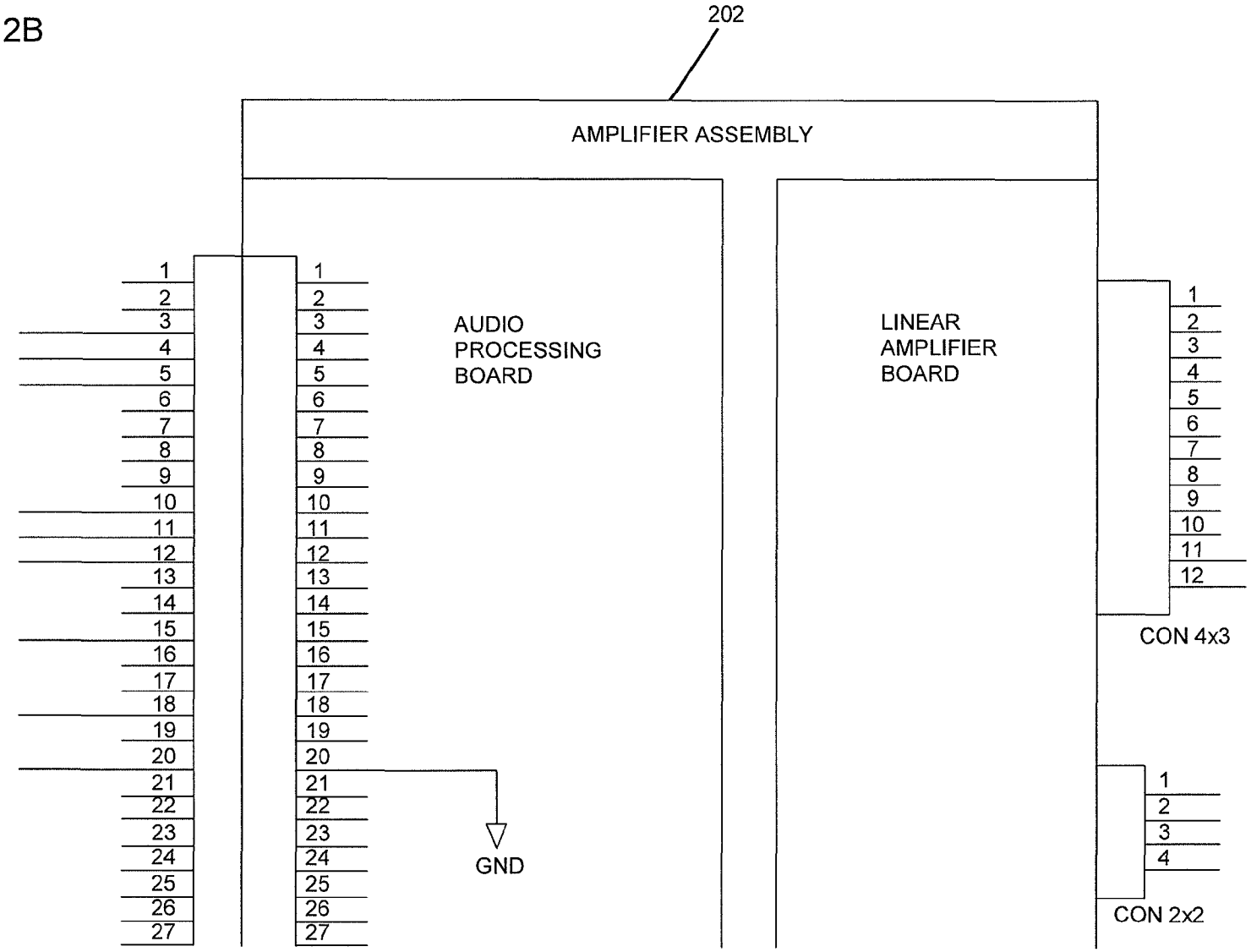
Figure 2C:
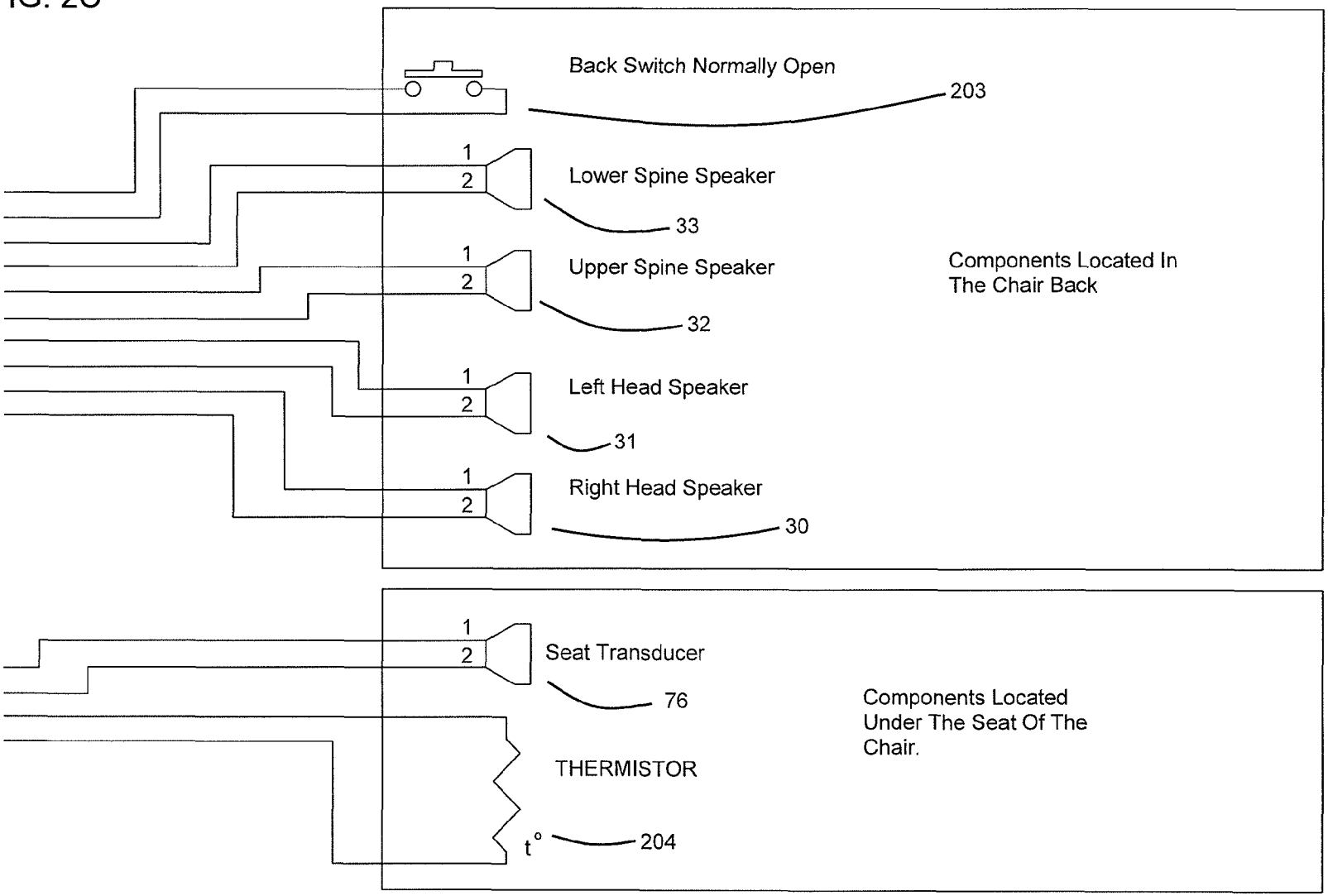
Figure 2D:
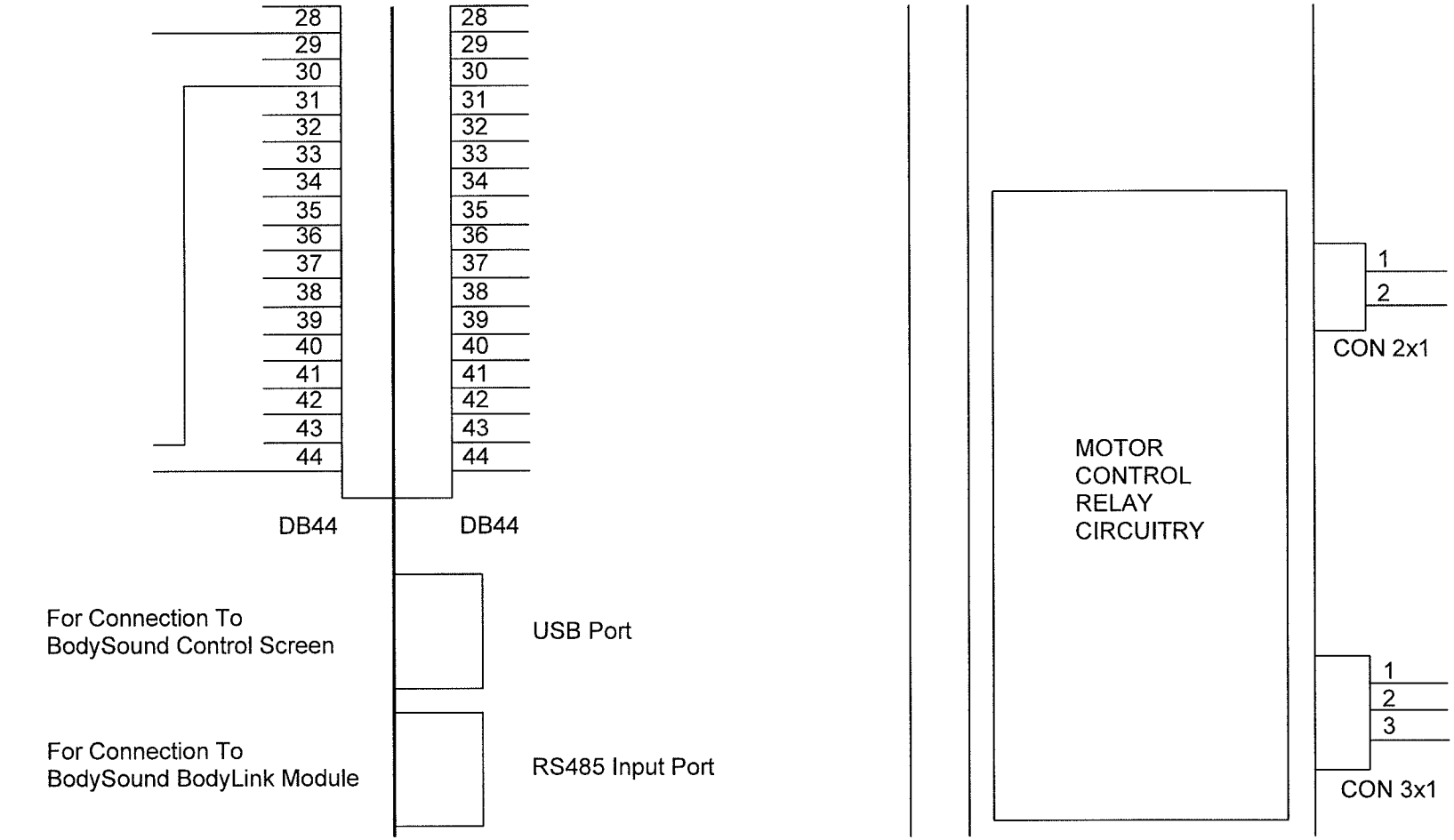
Figure 2E:
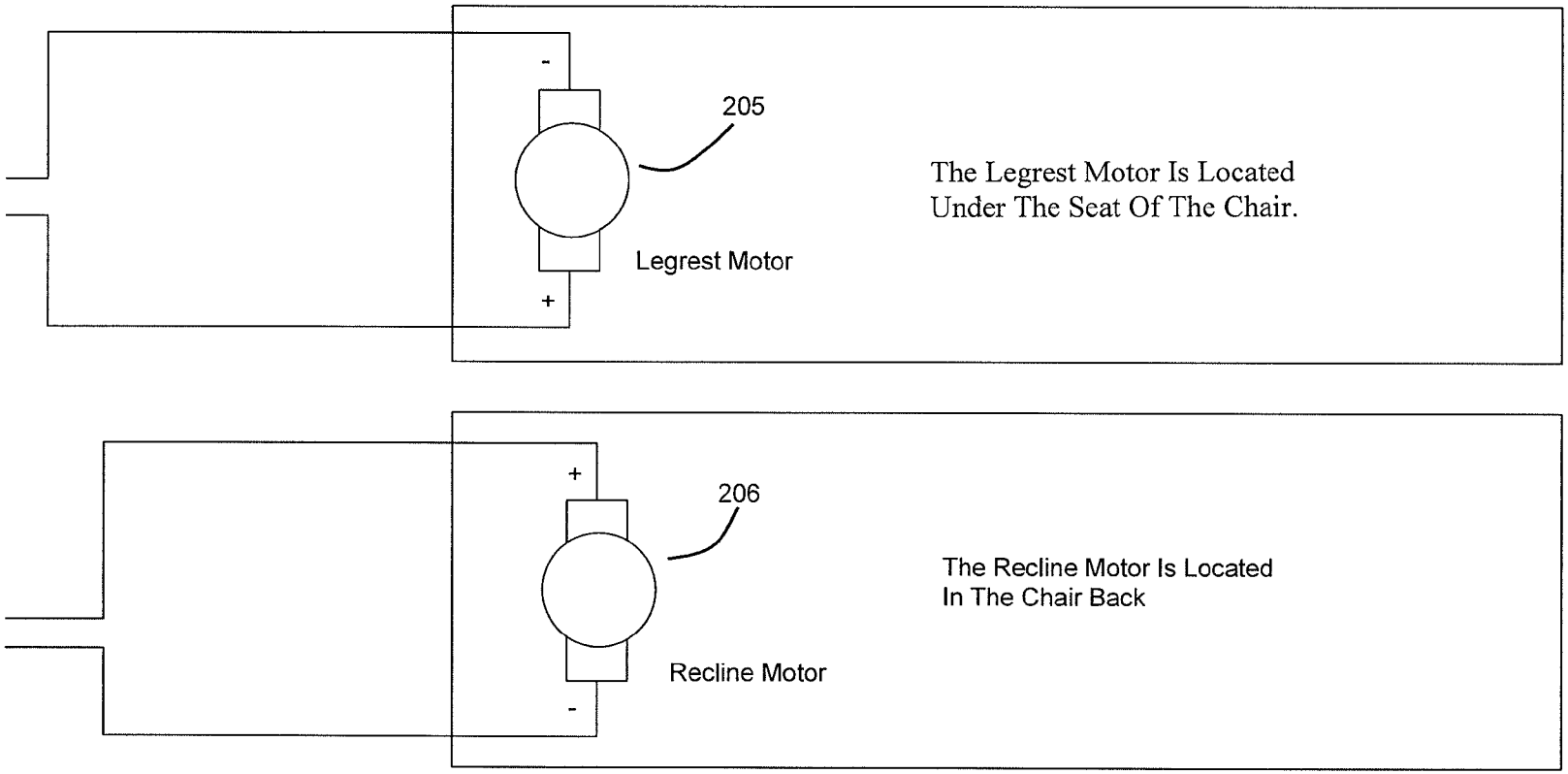
Figure 2F:
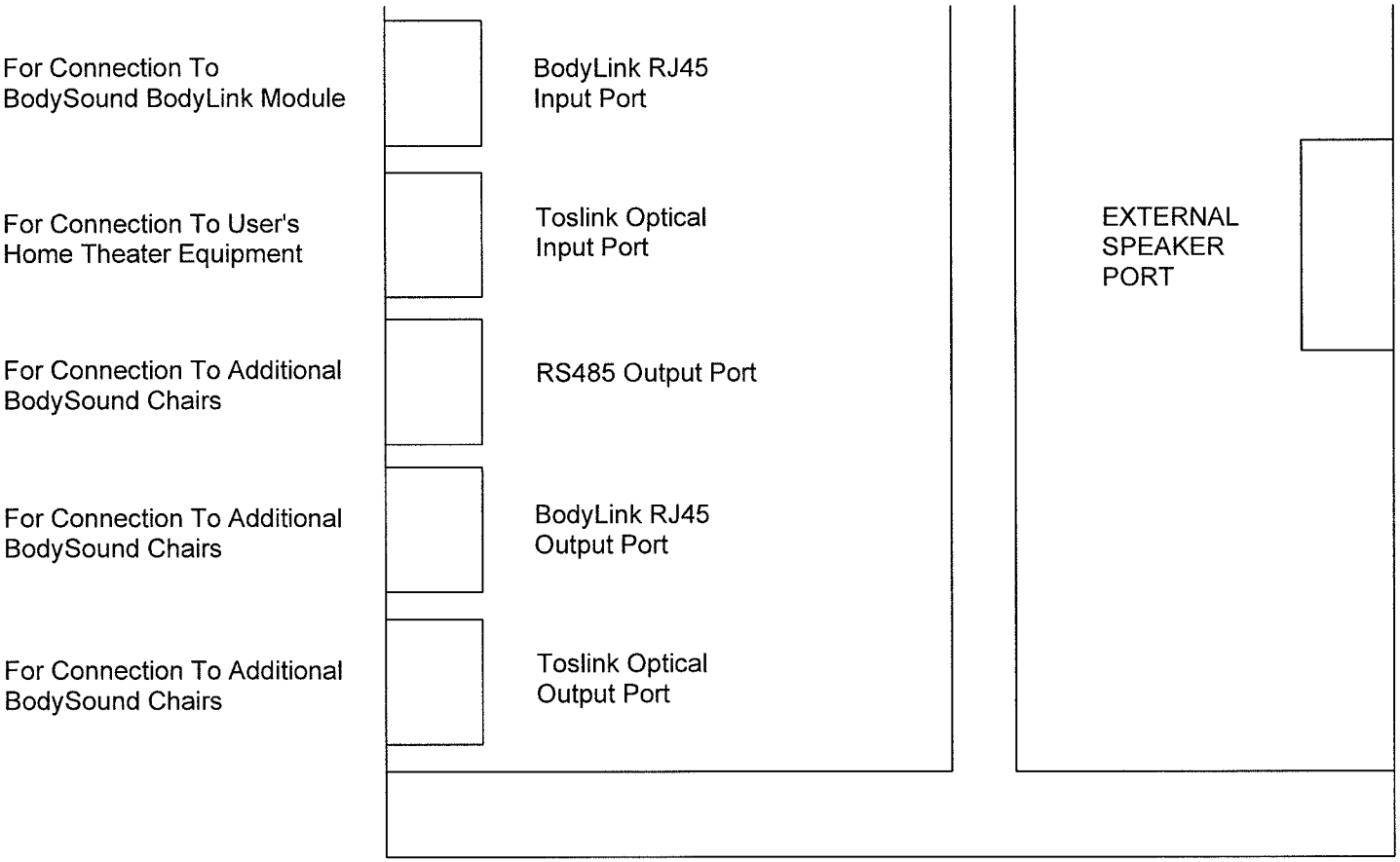

FIG. 2 is a schematic wiring diagram of a chair made in accordance with the present invention. FIGS. 2A-2F are magnified partial views of the schematic wiring diagram, while FIG. 2 shows the whole diagram formed by the partial views of FIGS. 2A-2F. This diagram includes the controls 201 in the arm of the chair; the amplifier assembly 202, which is located in the amplifier box under the seat of the chair; the seat switch 203 and spine speakers 32 and 33 located in the back of the chair; the transducer 76 and thermistor 204 located under the seat of the chair; the footrest motor 205, which is located under the seat of the chair; and the recline motor 206, which is located in the back of the chair.

The array of speakers/drivers consists of a pair of small (approximately 2.5 inches in diameter) speakers ("head speakers") positioned approximately at ear level of a seated person and angled toward the user (approximately 20 to 30 degrees) to project sound in front of the user's face; a pair of spine speakers (4 to 6.5 inches in diameter), the lower one positioned near the base of the spine and the higher one positioned approximately 8.5 inches (on center) above the lower one; a pair of external speakers (optional and positioned by the user); and a large (approximately 8 inches in diameter), mass-loaded, sound/vibration transducer attached to the underside of a seat pad.

Specifications of speakers and drivers that may be used in one embodiment of a seating configuration in accordance with the present invention are provided in Table 1.

TABLE 1

| System Type | Low Frequency Driver | Mid Frequency Driver | High Frequency Driver | HF Driver Upgrade |
|---|---|---|---|---|
| Configuration | Direct Coupled Transducer | Acoustic Suspension | Acoustic Suspension | Acoustic Suspension |
| Size | 8" | 5.25" | 2" | 2" with 3 pc 19 mm array |
| Impedance Nominal | 4 Ω | 4 Ω | 4 Ω | 4 Ω |
| Crossover Type | Acoustic LF Bandpass | Acoustic MF Bandpass | Acoustic HF Bandpass | Acoustic HF Bandpass |
| Crossover Frequency | 14 Hz-75 Hz | 60 Hz-8000 Hz | 110 Hz | 110 Hz |
| Power RMS | 250 W | 50 W | 25 W | 25 W |
| Power Peak | 350 W | 75 W | 40 W | 40 W |
| Sensitivity | Tactile | 85 dB @ 2.83 V @ 1 m | 80 dB @ 2.83 V @ 1 m | 80 dB @ 2.83 V @ 1 m |
| Height, Width, Depth | 8" × 4¼" | 15" × 14.125" × 3.25" | 5" × 5" × 6⅝" × 3¾" | 5" × 5" × 6⅝" × 3¾" |
| Weight | 8.6 lbs. | 9.4 lbs. | 1.9 lbs. | 1.9 lbs. |

Figures 3, 3A, 3B, 3C, 3D:
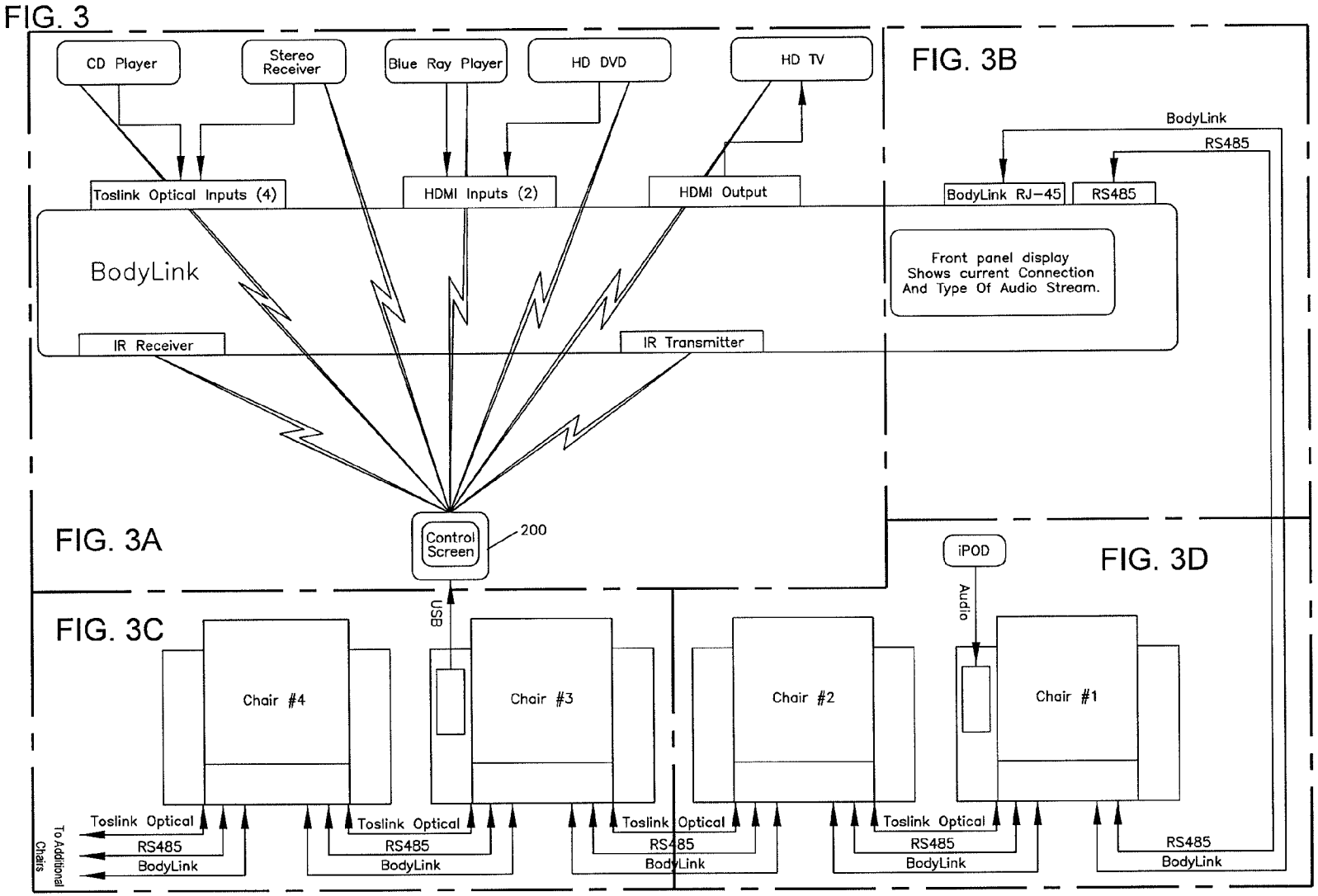
Figure 3A:
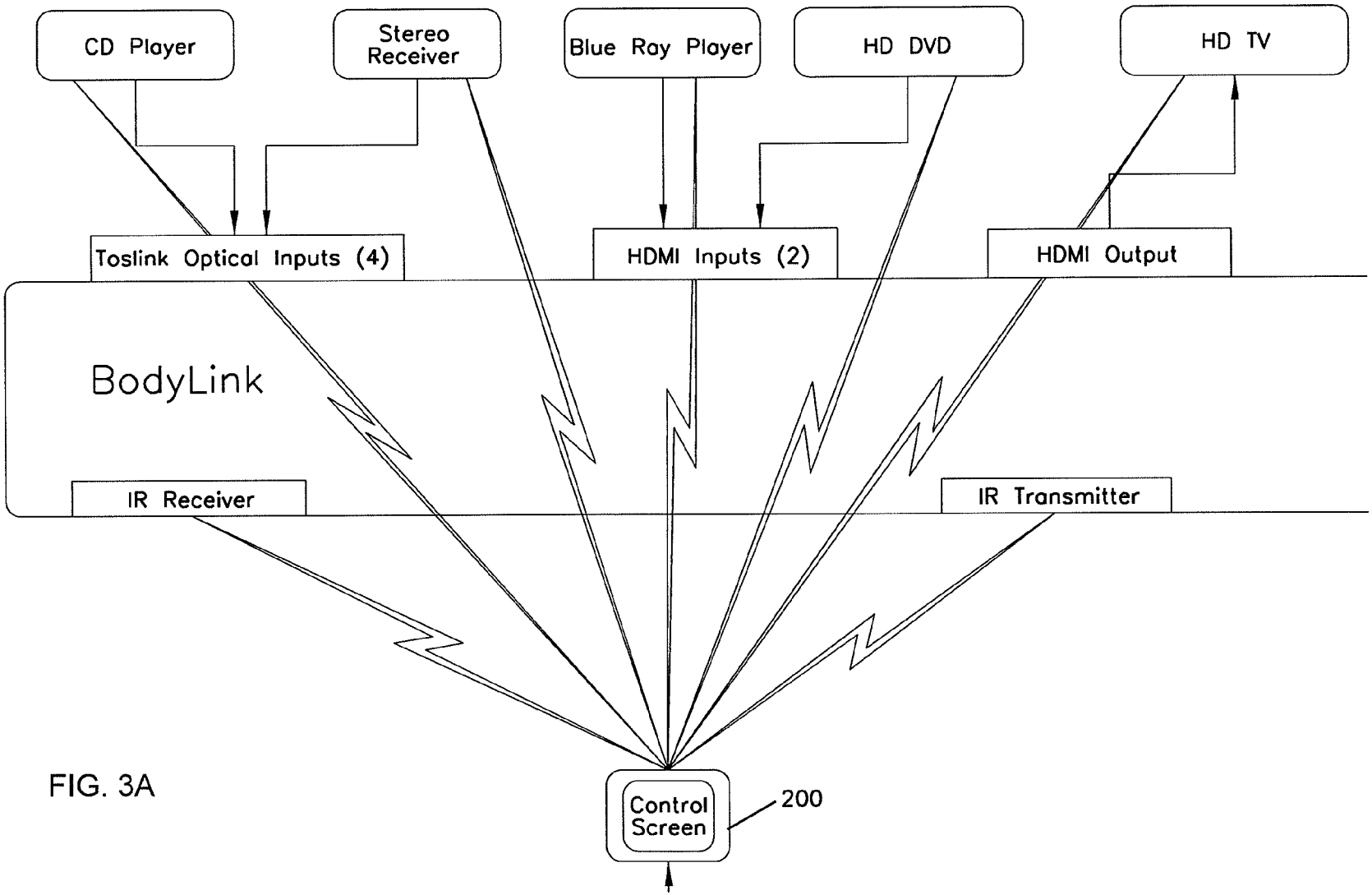
Figure 3B:
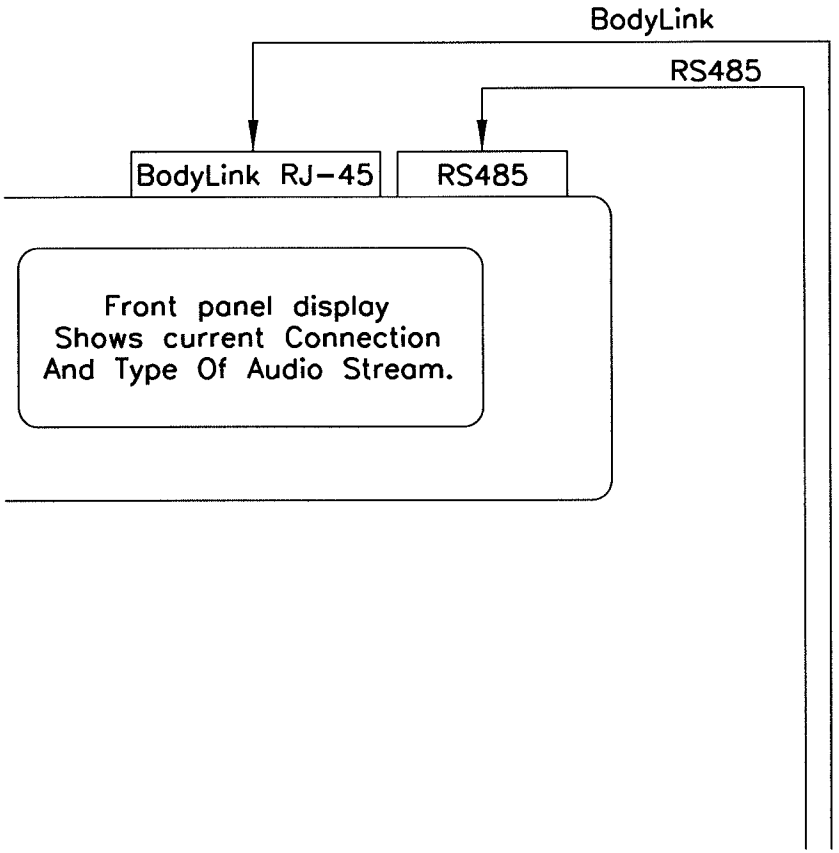
Figure 3C:
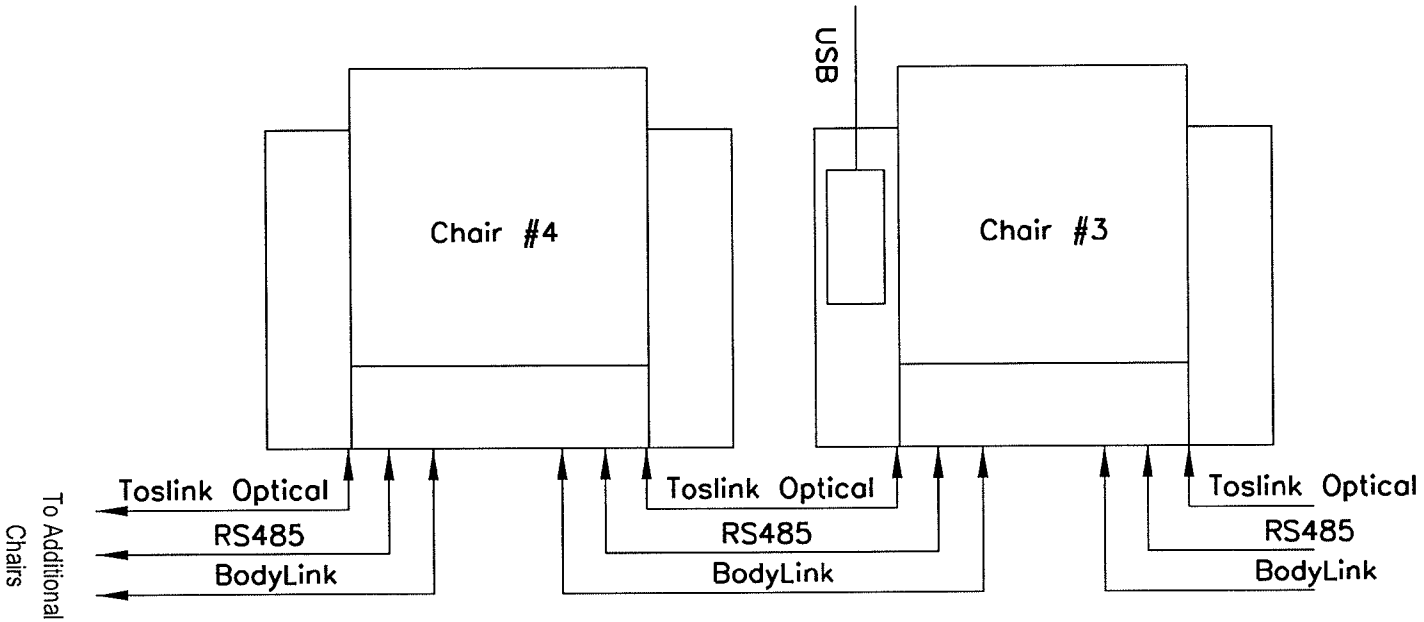
Figure 3D:
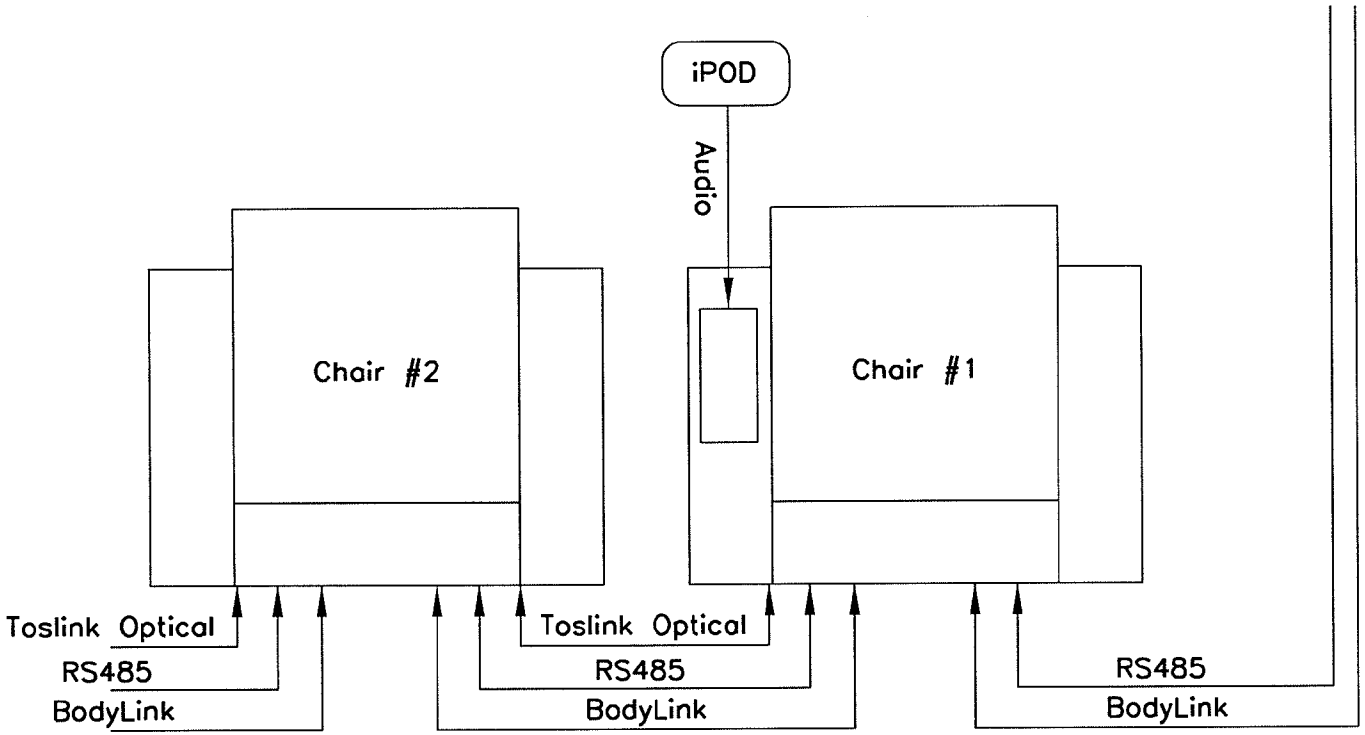
Figure 4:
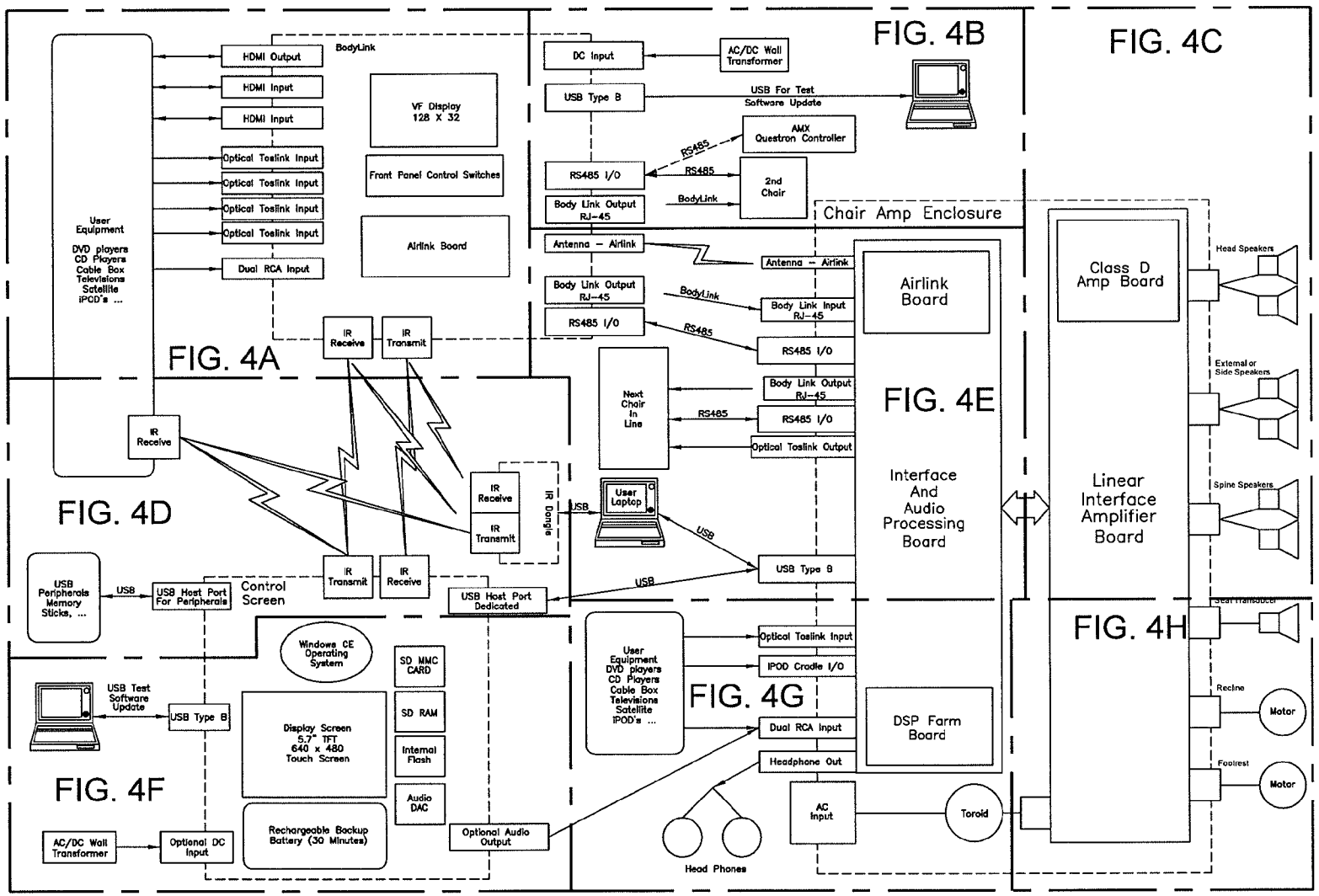
FIG. 4 is a diagram of the electronics of chairs linked to a BodyLink™ receiver in accordance with the present invention.
Figure 4A:
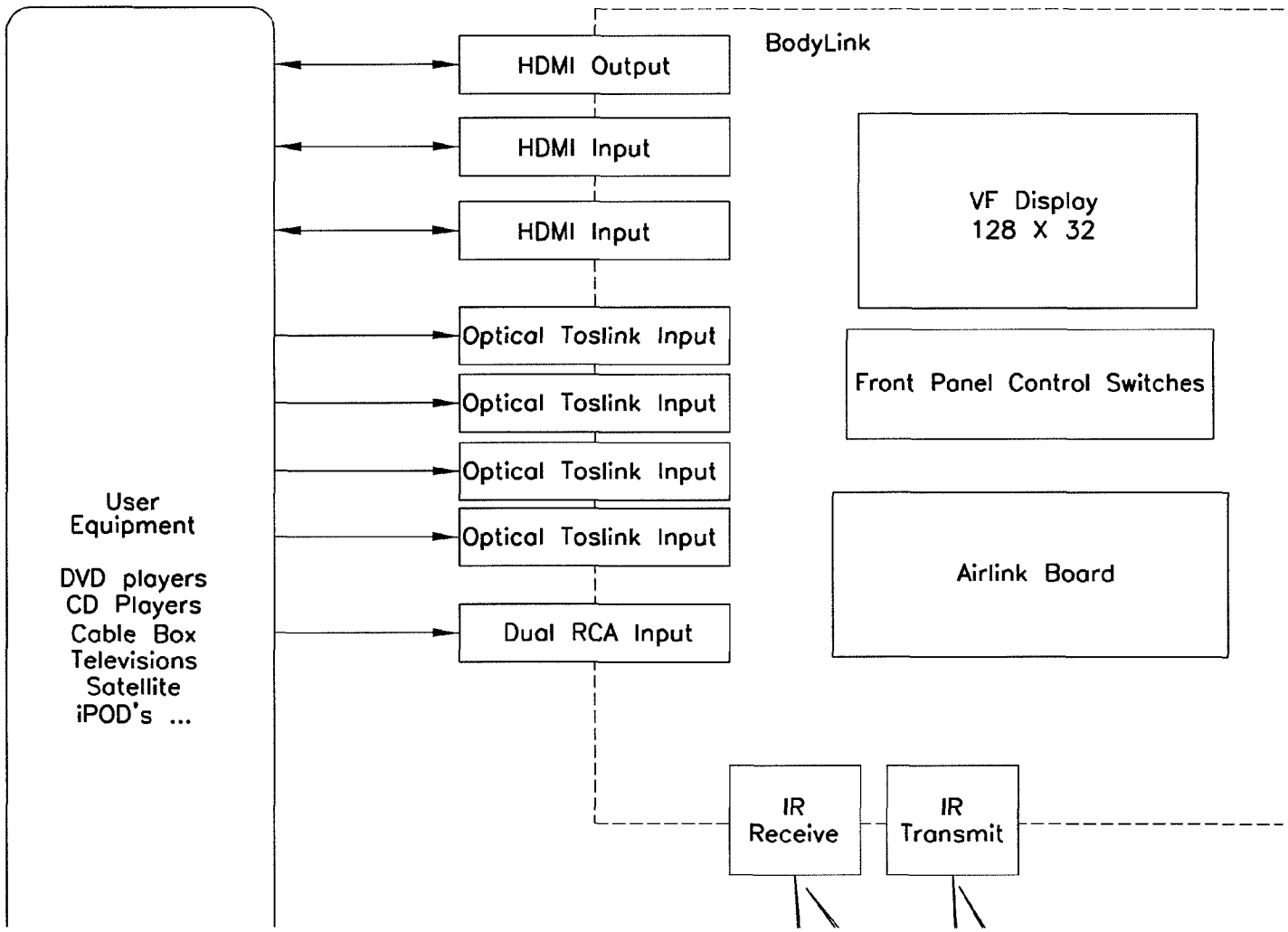
Figure 4B:
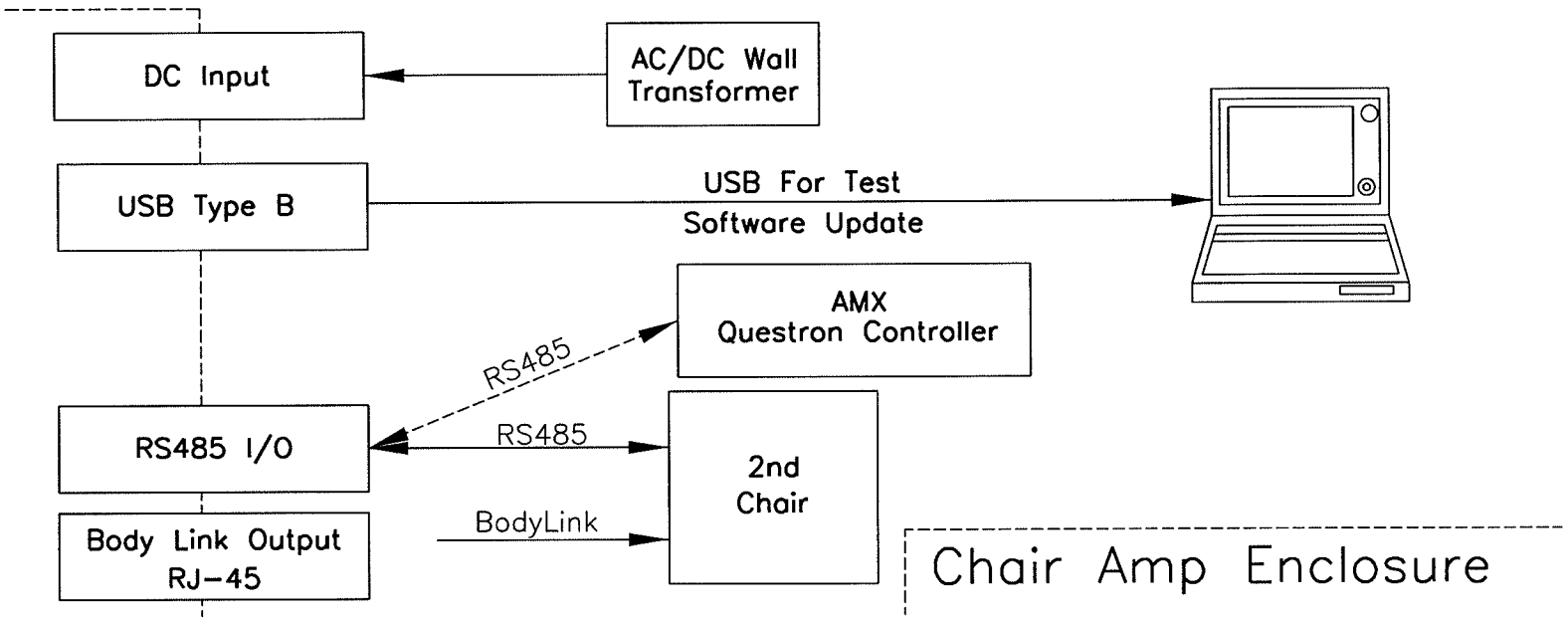
Figure 4C:
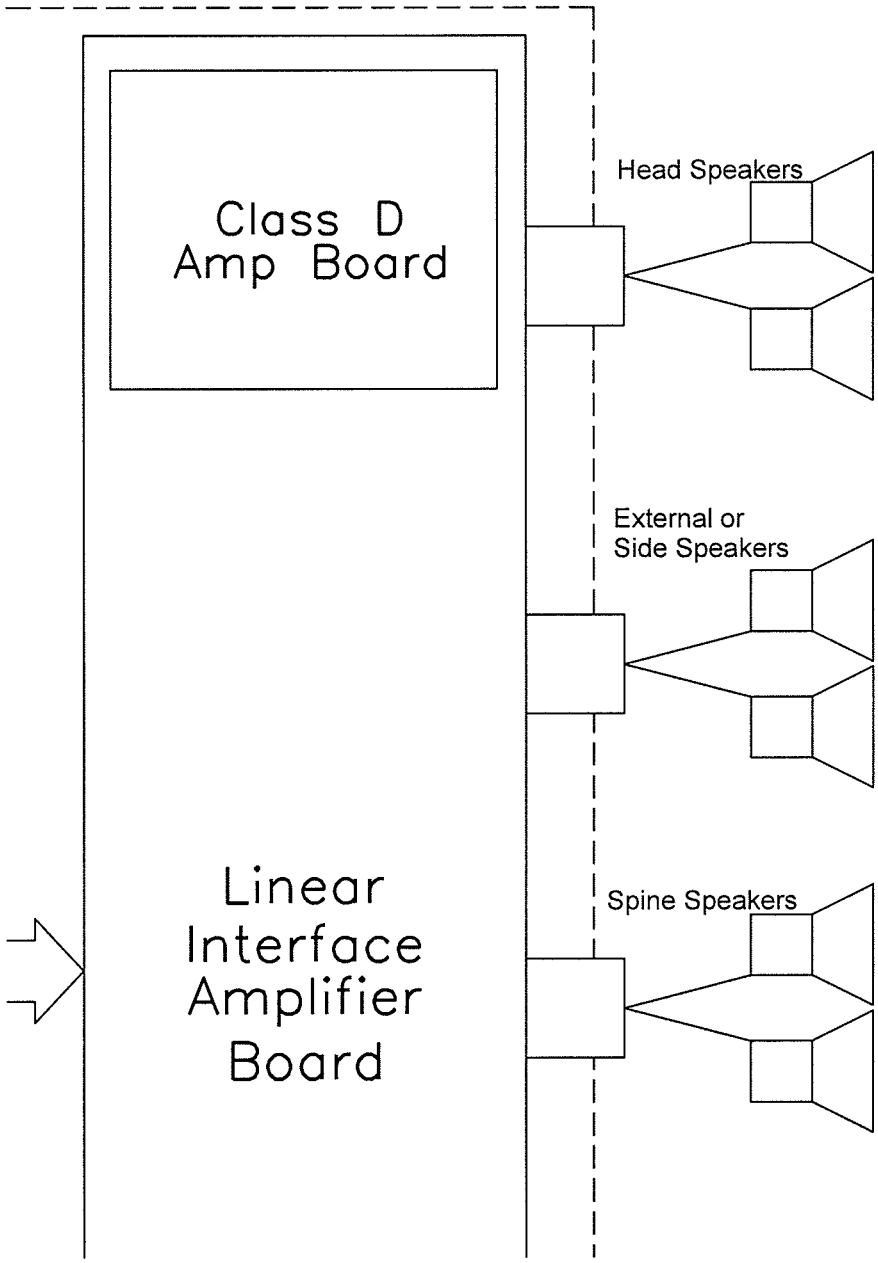
Figure 4D:
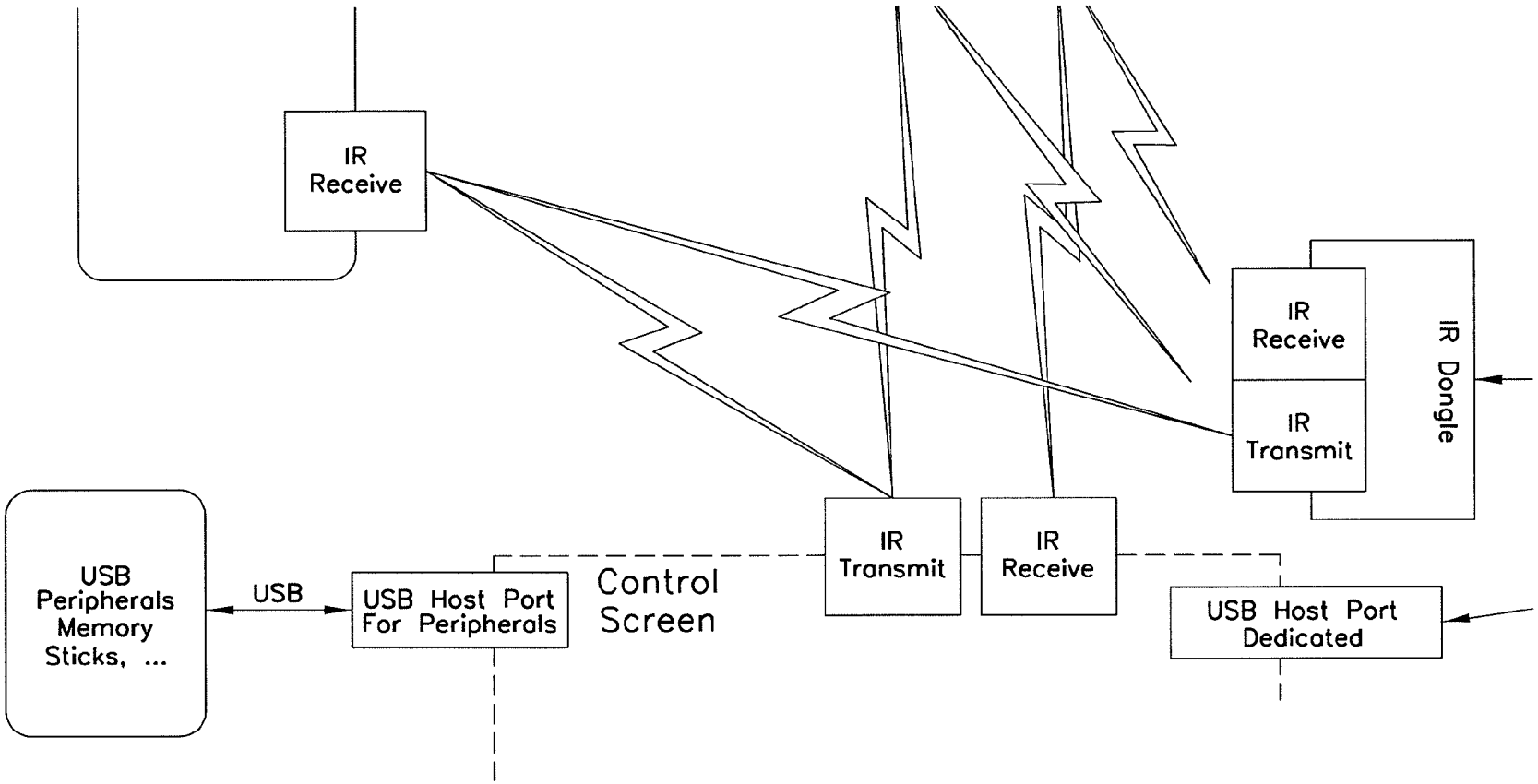
Figure 4E:
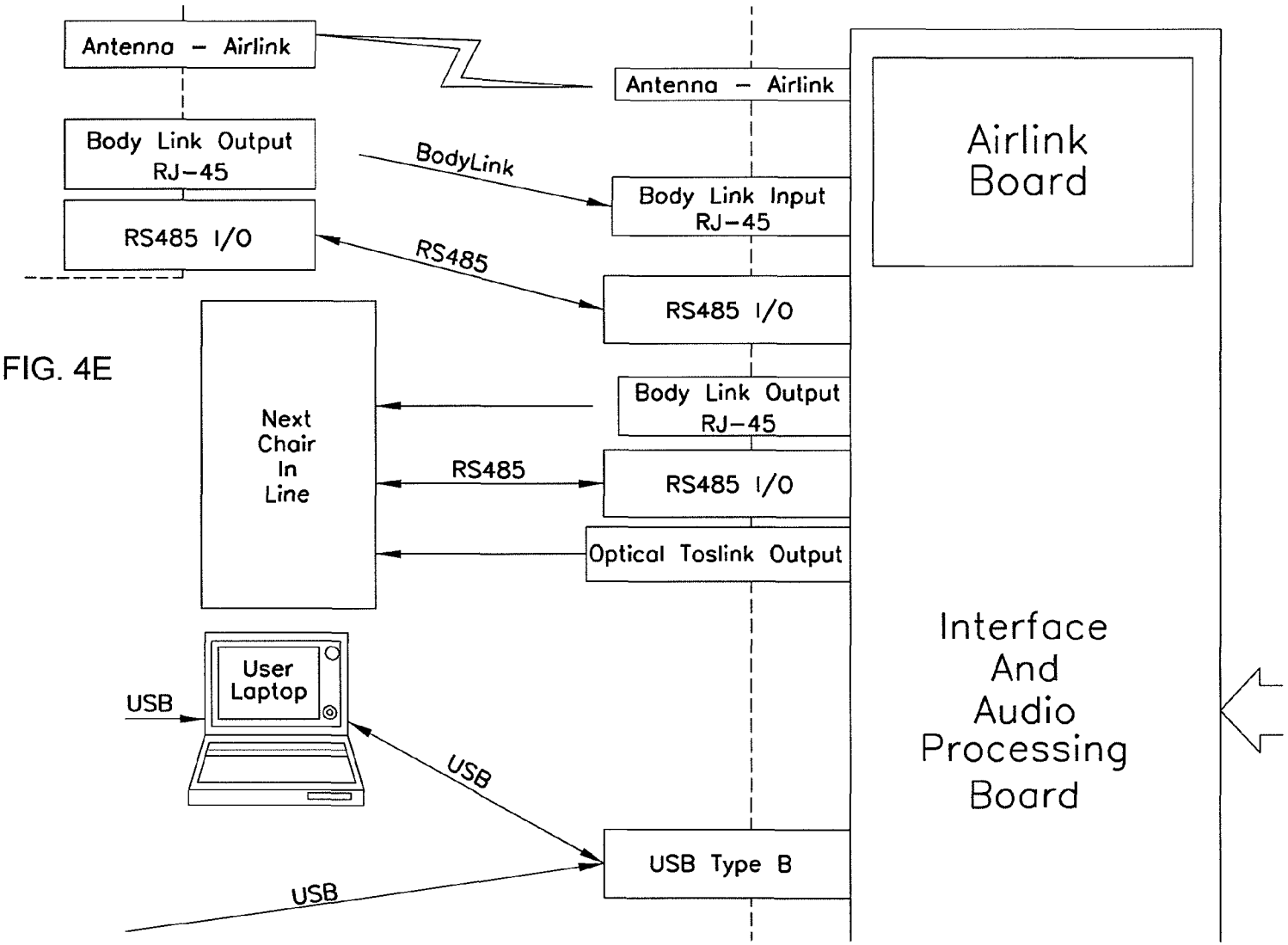
Figure 4F:
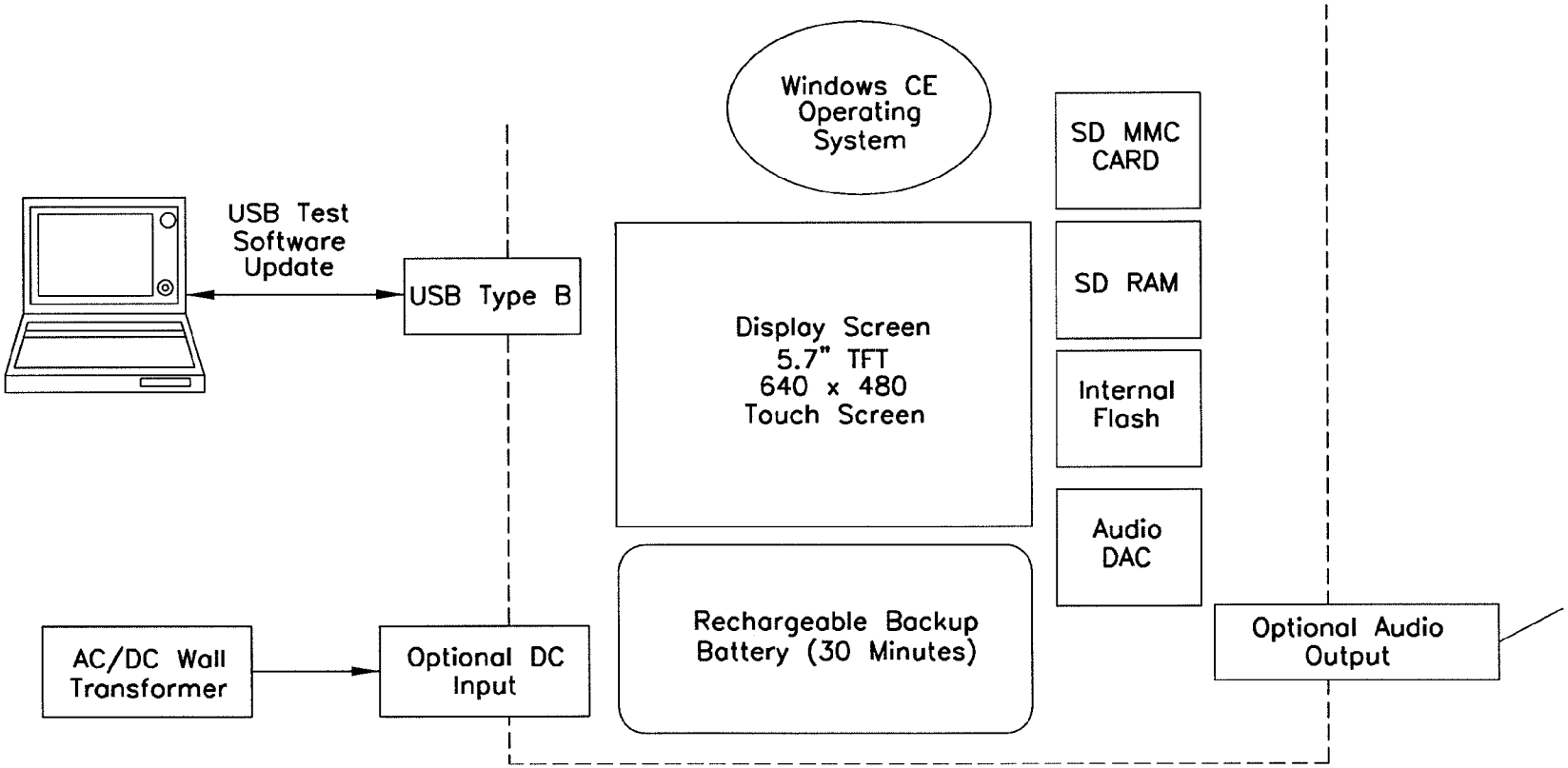
Figure 4G:
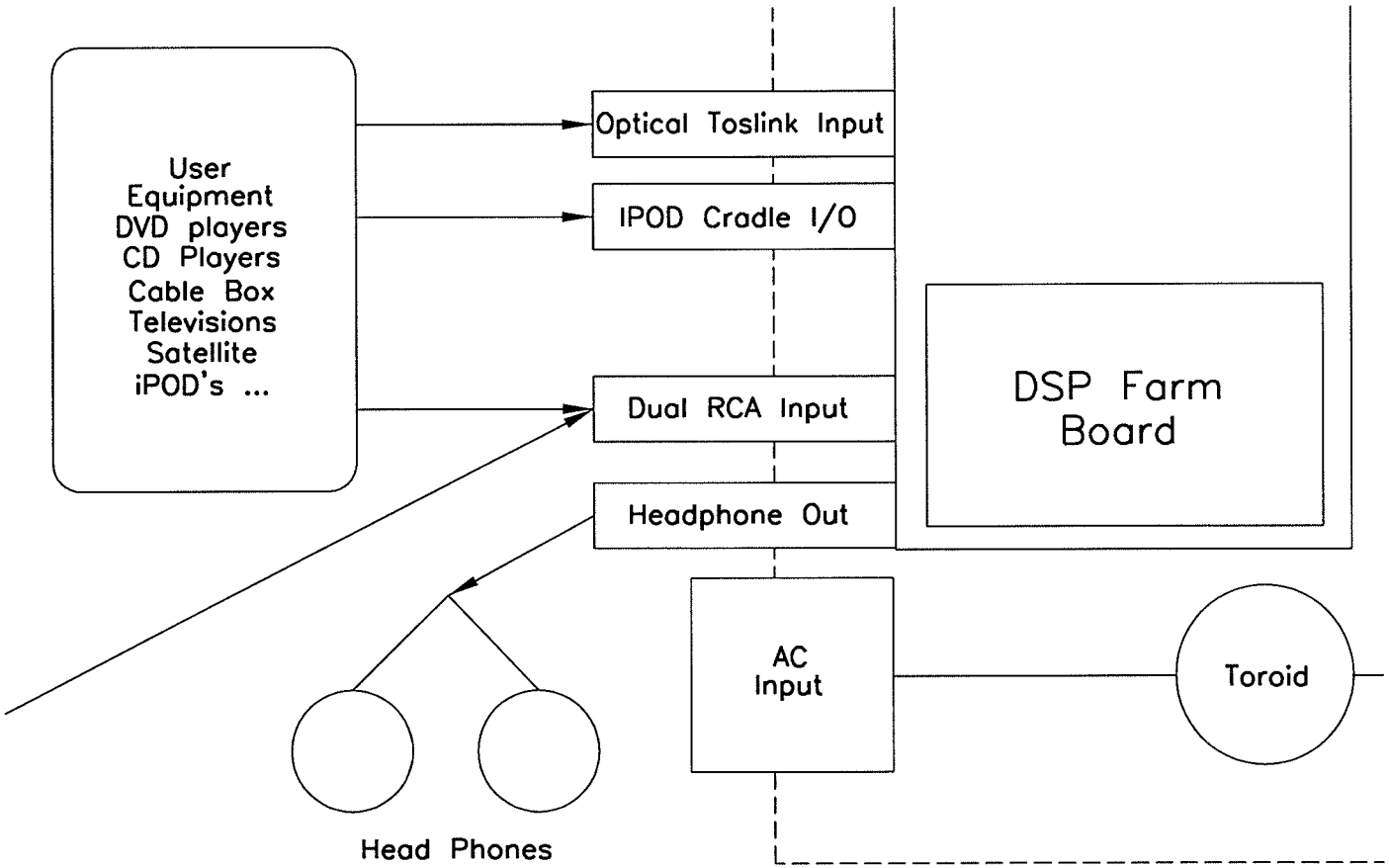
Figure 4H:
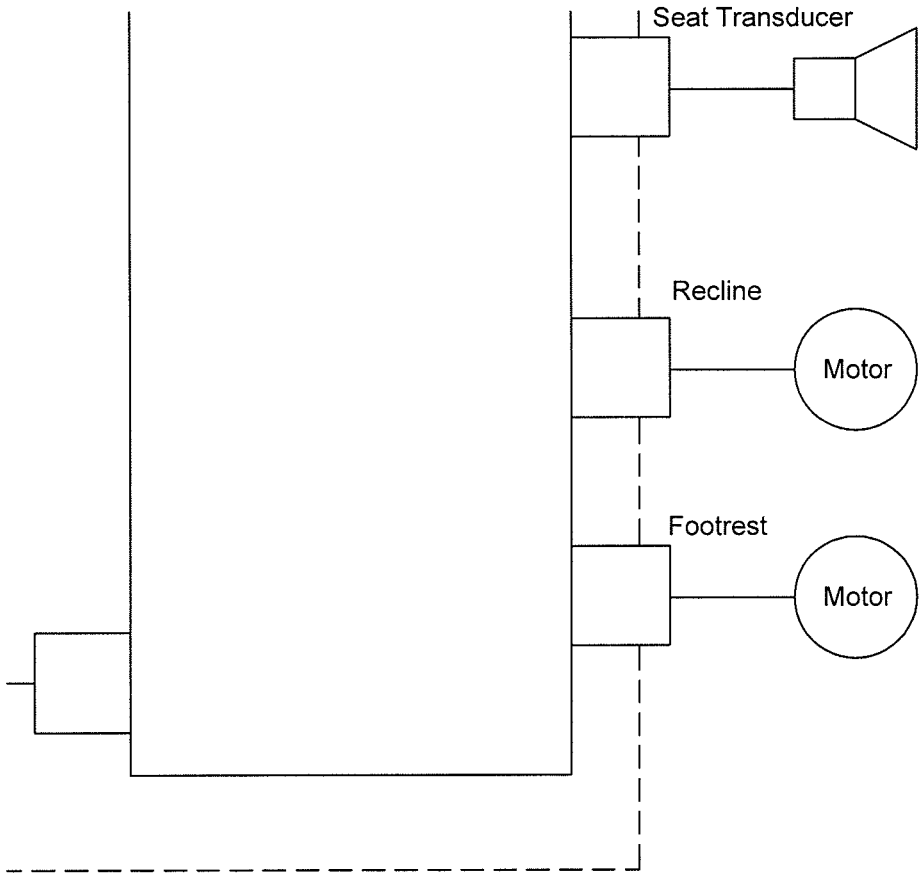

Amplifiers on nearby seats may be connected in a daisy-chain format via optical, Cat5, and/or RS485 cables. One of the seat amplifiers can be connected to a transmission unit (BodyLink™ receiver, typically positioned with the user's other audio equipment—DVD, CD, AV Surround receiver, TV, etc.), for example by Cat5 cable, to receive audio signals. The BodyLink™ receiver is an audio/video router providing connection between entertainment equipment and the seating configuration. In one embodiment, it can receive up to seven inputs, which include two HDMI, four Optical, and Analog right and left stereo inputs. The receiver's main function is to transmit audio signals. However, depending upon the connections made, video content may also pass through it (using the HDMI connection) en route to a television set. The BodyLink™ receiver is also equipped with a wireless transmitter used to transmit audio signals to the amplifier. A diagram showing multiple chairs linked to a BodyLink™ receiver is shown in FIG. 3. FIGS. 3A-3D are magnified partial views of this diagram, while FIG. 3 shows the whole diagram formed by the partial views of FIGS. 3A-3D. A diagram of the electronics of chairs linked to a BodyLink™ receiver is shown in FIG. 4. FIGS. 4A-4H are magnified partial views of this diagram, while FIG. 4 shows the whole diagram formed by the partial views of FIGS. 4A-4H. A BodyLink™ receiver is available from BodySound Technologies, Inc., Eden Prairie, Minn., United States.

The BodyLink™ receiver and amplifier are capable of processing up to 8 simultaneous channels of audio data at a sampling rate of 96 kHz with 24 bit resolution per channel. These sampling rates and bit resolution are compatible with HD (HiDef) audio signals associated with the new Blu-ray and HD DVD audio formats allowing the invention to be compatible with state of the art audio equipment.

In one embodiment, any or all of the channels of audio data may be sent to any or all of the speakers and/or transducers of the system, in a proportion that may be selected by a user. Additionally, two created audio signals (one associated with a generated frequency array, discussed below, and one associated with a massage function) may be mixed with the primary audio channels. Before the mixed audio signal is sent to the speakers and/or transducers, it is filtered based upon filter settings that may be defined by the user. In one embodiment, a 31-band equalizer function is used for the head speakers, and 4-band filters are used for the spine and external speakers and the seat driver.

The seating also includes a seat switch positioned in the back pad of each seat which detects the presence of a user via pressure. The seat switch 203 is shown in the schematic wiring diagram of FIG. 2. It is cabled to the amplifier box which registers the presence of a user. When the seat switch is enabled, sound will play when a user is leaning back in the seat. When the user leans forward and is no longer applying pressure to the back of the seat, the sound will be muted. The mute/un-mute function can be automatically controlled using this seat switch or it can be disabled using the user interface of the Control Screen.

Figure 5:
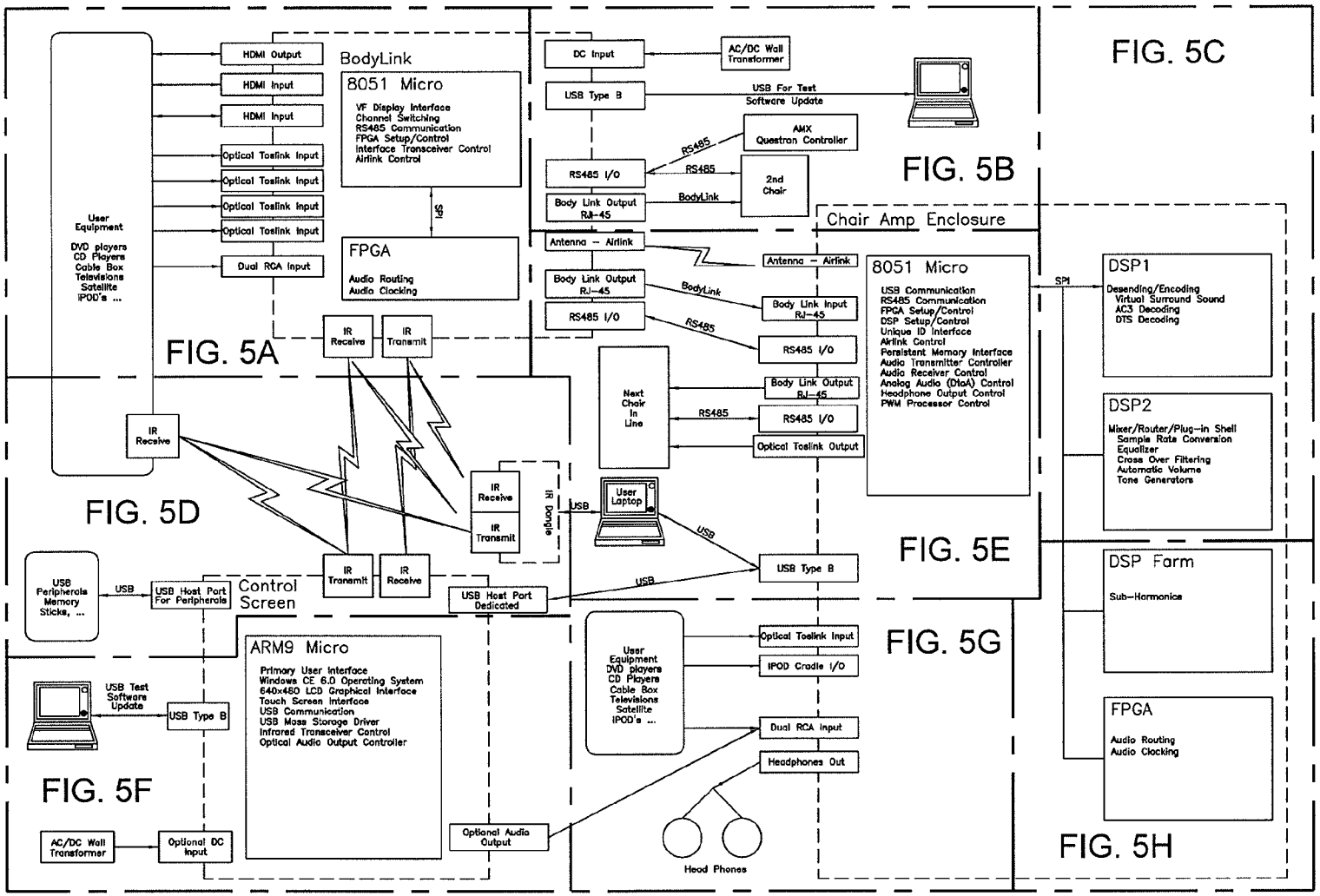
FIG. 5 is a diagram showing various components of a system in accordance with the present invention.
Figure 5A:
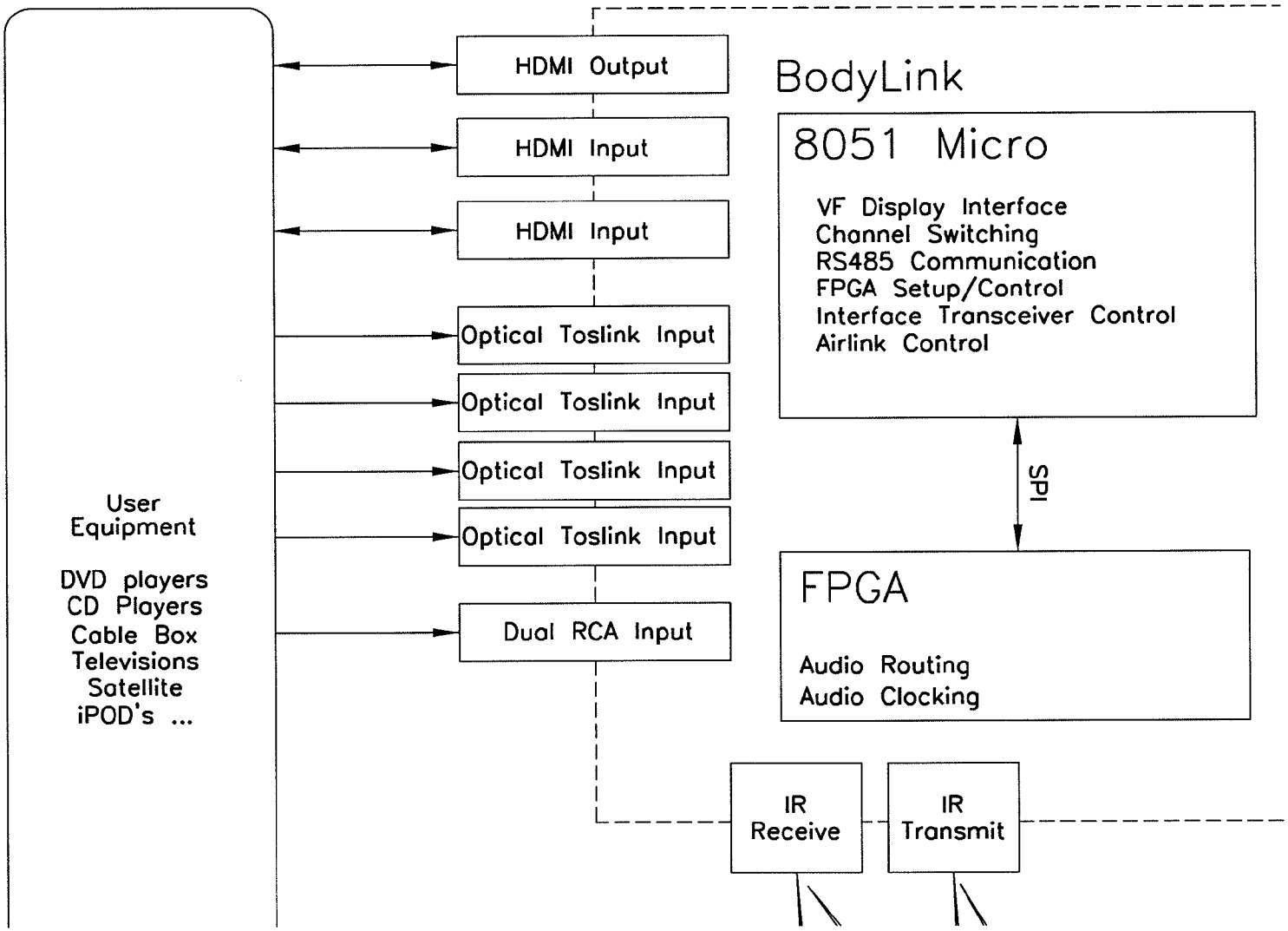
Figure 5B:
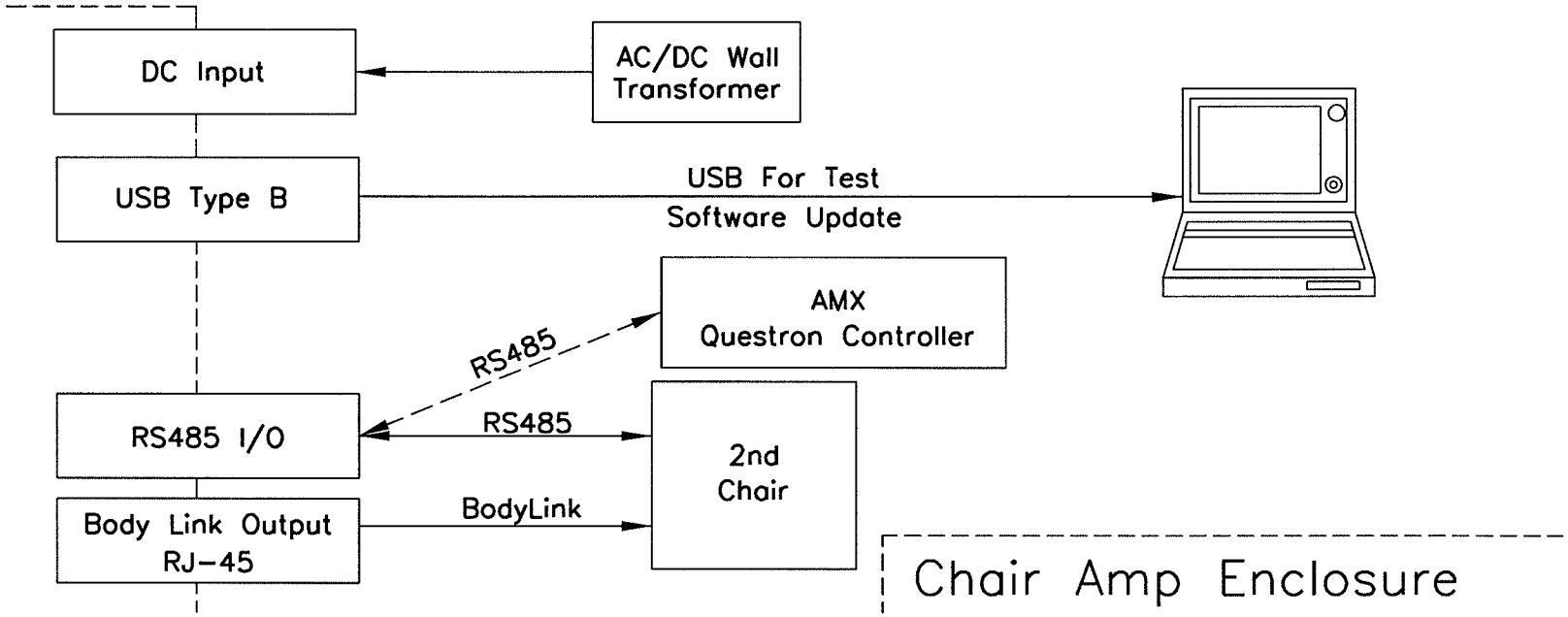
Figure 5C:
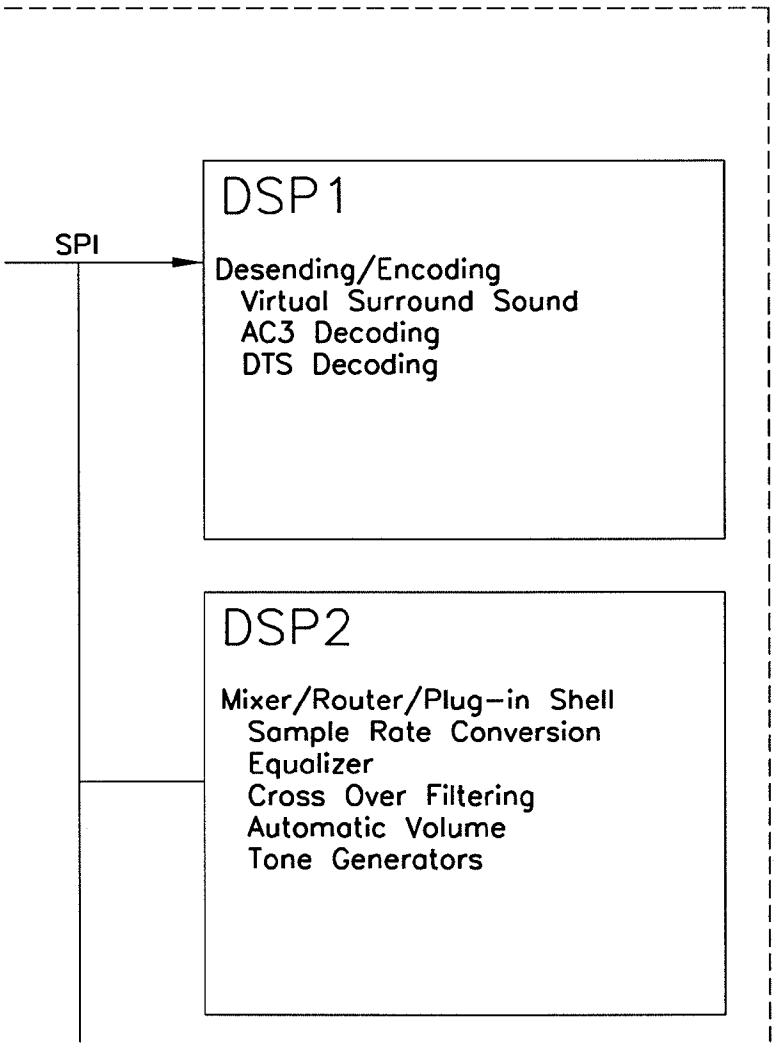
Figure 5D:
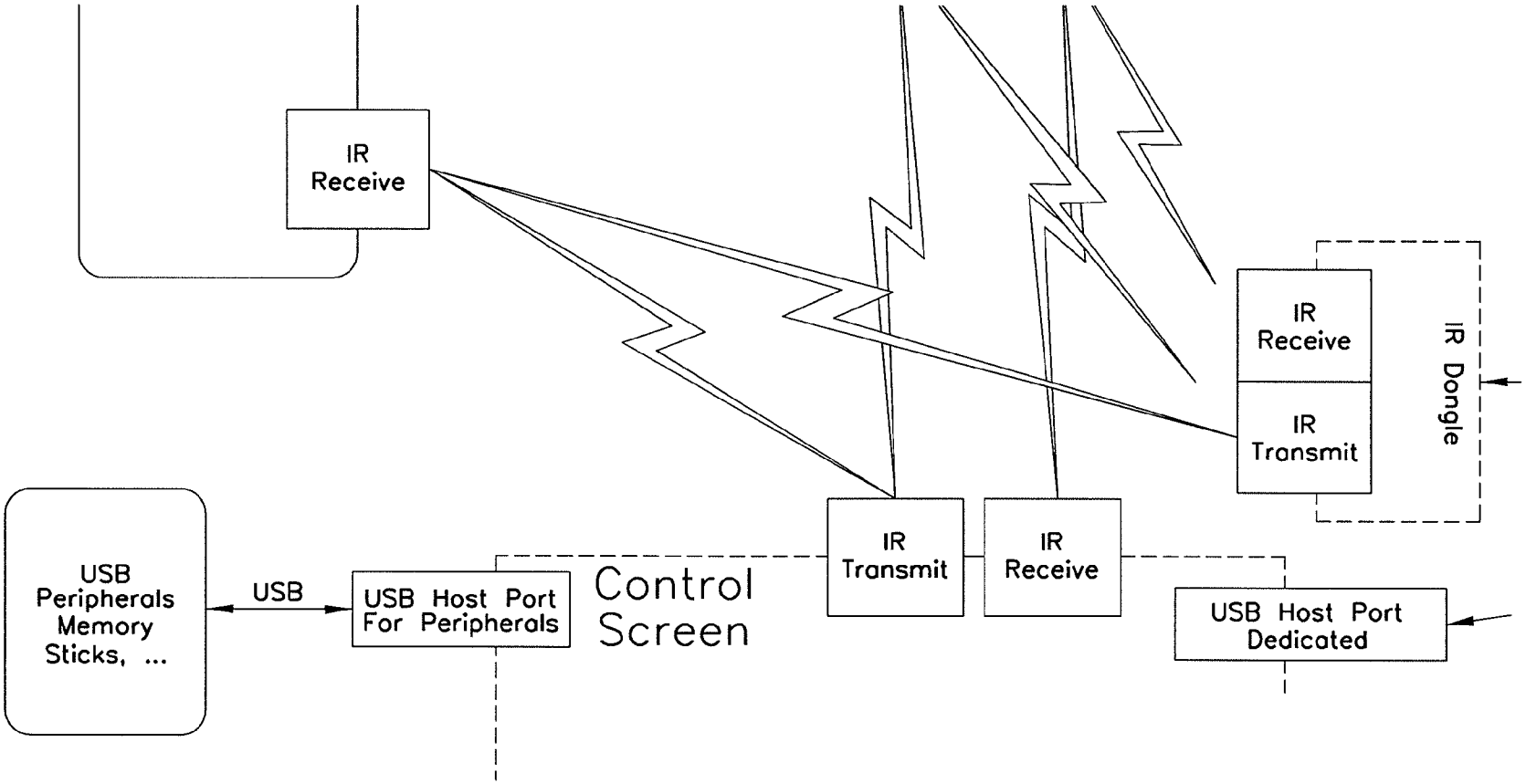
Figure 5E:
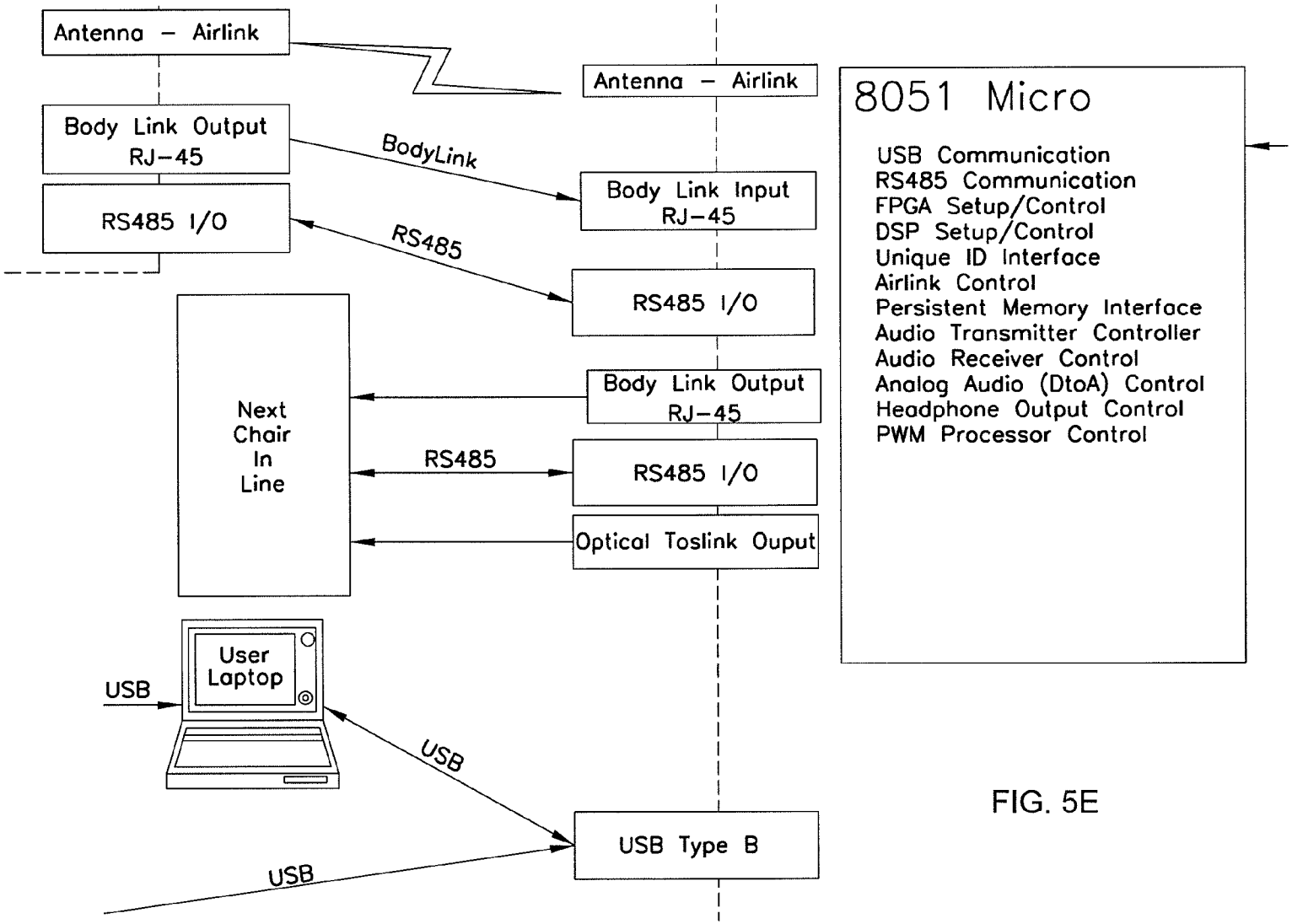
Figure 5F:
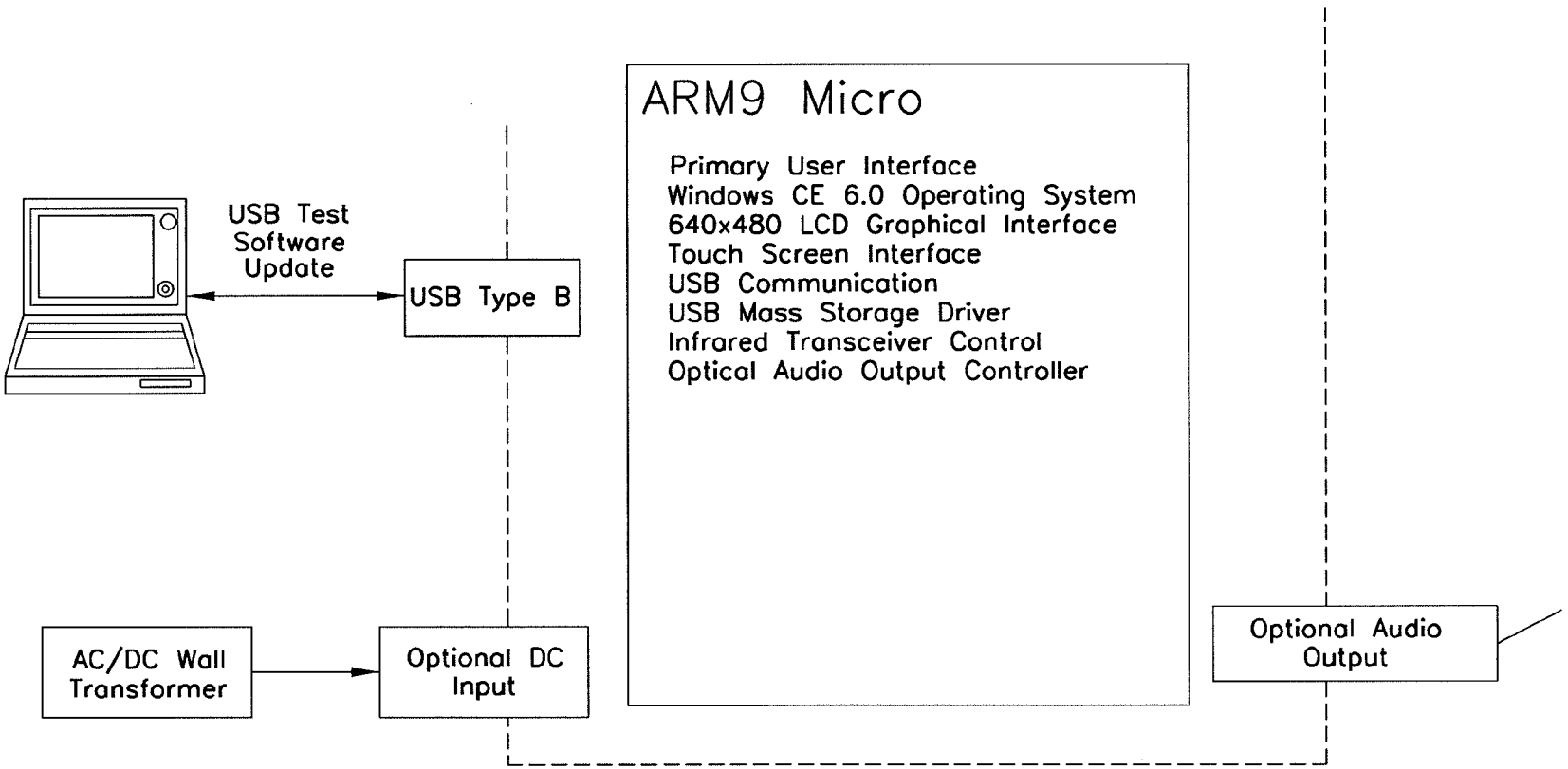
Figure 5G:
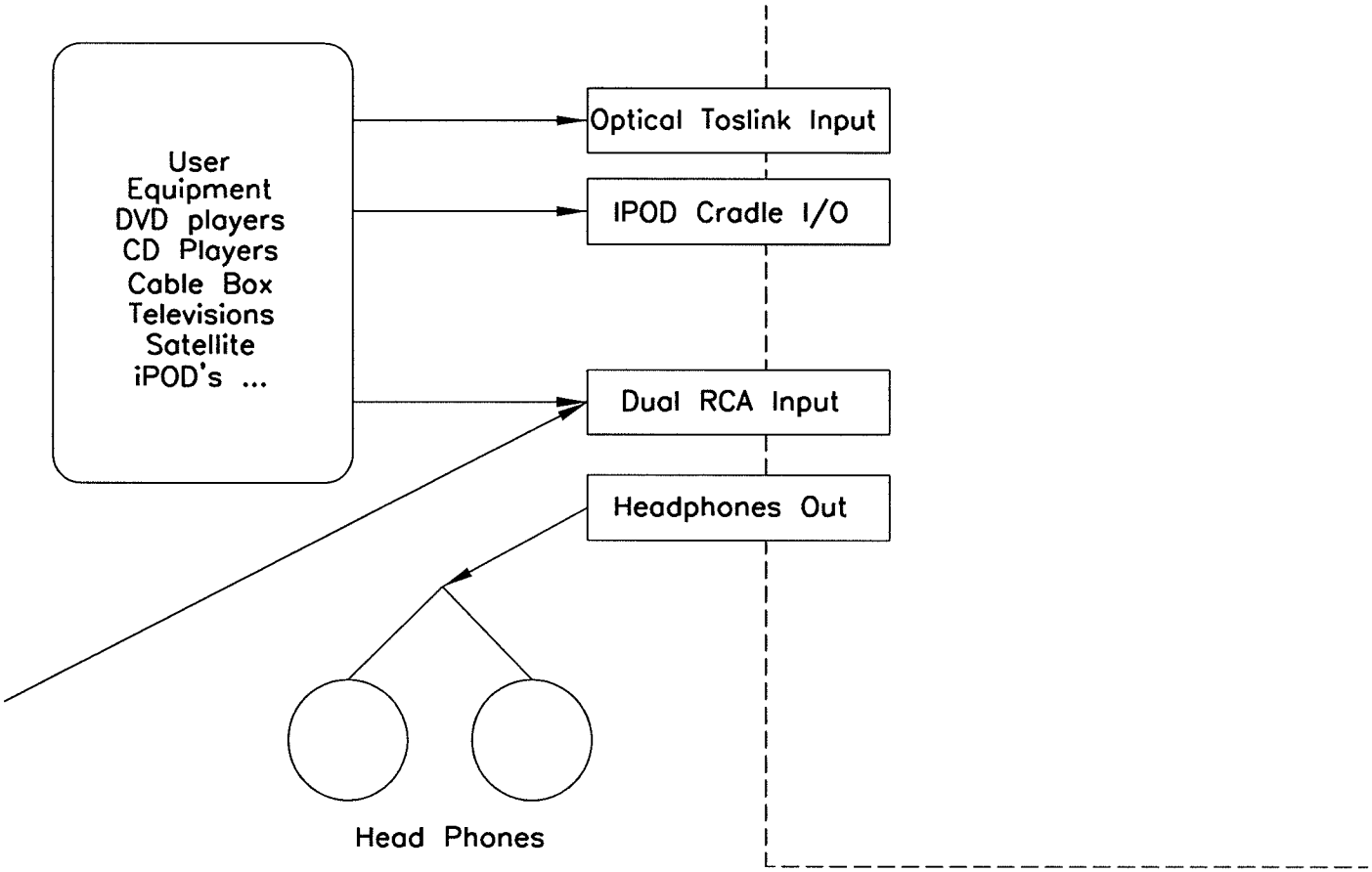
Figure 5H:
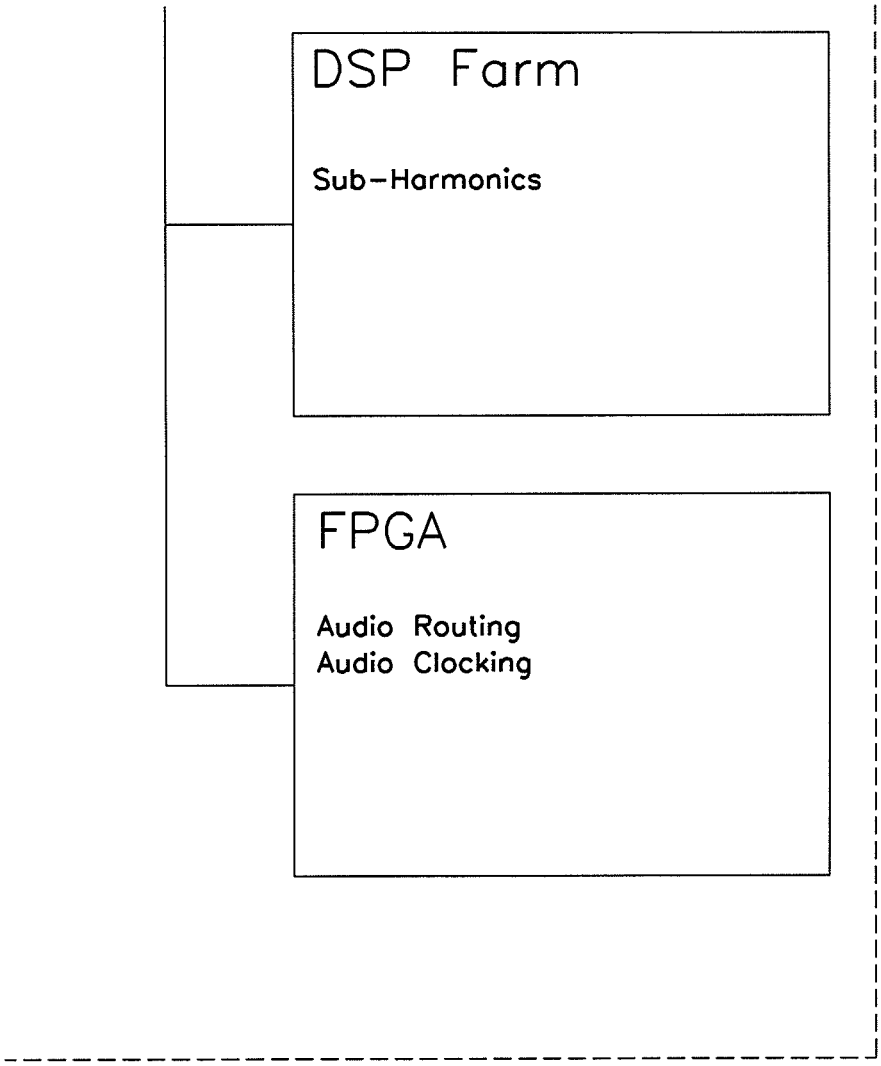

A Control Screen (touch screen with a microprocessor) is also available with software defining a graphical user interface used to control the amplifier in the seat and any other amplifiers cabled to that amplifier as well as the BodyLink™ receiver via an infrared signal. A diagram showing various system components is shown in FIG. 5. FIGS. 5A-5H are magnified partial views of this diagram, while FIG. 5 shows the whole diagram formed by the partial views of FIGS. 5A-5H. Alternatively, the system can be controlled via the user's own laptop computer, which can be cabled into the amplifier through a USB port in the console of the arm. That is the same port that can be used by the Control Screen.

The Control Screen contains a rechargeable battery for use without being directly cabled to the chair's amplifier. It is equipped with an infrared transmitter and receiver and can function without a direct connection to the amplifier by sending IR signals to the BodyLink™ receiver, which can be transmitted to the chair's amplifier via Cat5 cable or through wireless transmission. These features facilitate the use of the Control Screen by more than one user in a multiple seat configuration. Due to the aforementioned components, the Control Screen can also be programmed and used as a universal remote control device for use with the user's other IR remote-controllable entertainment equipment.

Amplifier Features

In one embodiment, the amplifier has the following connectors: AC power, chair in and out, optical in and out, internal control, external control, USB port, left and right auxiliary input, external speaker connector, console control, speakers, seat driver, recline, and leg rest.

The field programmable gate array (FPGA) in the amplifier allows any or all of the possible 8 channels of audio signal data specified by the user to be directed to each of the speakers or drivers. The user can also specify the relative strength (volume) of each of the audio signals before the signals are combined. In this way the user can specify exactly how the audio signals are to be mixed for each speaker or driver. The user can also subject each of the mixed signals to a user-defined band-pass filter individually specified for each speaker or driver.

In addition the user can independently set volume levels for each speaker or driver output independently. Alternatively, the user can coordinate the volume levels across all speakers using the SoundNumber™ system (BodySound Technologies, Inc., Eden Prairie, Minn., United States)—a method for automatically determining the volume settings based upon the user's setting. Using this system, the user sets a decibel level that the amplifier uses to automatically make volume adjustments for the head speaker outputs so that the volume they produce will approximate the desired decibel setting. The other speaker volume settings are adjusted to match user predetermined percentages of the SoundNumber™ value. For instance, if the user-defined SoundNumber™ setting is set to 70 decibels and the user has set the lower spine speaker to be 110% of that value, then the amplifier will regulate the lower spine speaker to be at a volume level 110% of that of the head speakers, by adjusting the gain of the lower spine speaker to be 110% of the gain of the head speakers. This same method can be used for each of the non-head speakers.

The SoundNumber™ system, based upon the user's settings, can be more or less rapid in its responsiveness. For instance, if the user abhors the rapid change in volume that often accompanies commercials (TV ads), the user can use the rapidly adjusting setting. On the other hand, with slower volume shifts during musical scores it is often preferable to use the slower adapting setting to avoid making any abrupt volume adjustments.

The user can choose to use the SoundNumber™ setting or independently set volume ratio levels for the speakers and drivers separately in a more static manner such that automatic adjustments are not made by the amplifier. If the user chooses to use equal volume settings for both head speakers, and/or both external speakers, he or she can vary the volume between each of those pairs of speakers by using balance settings between the speakers of each pair.

The user also controls a unique setting that relates to the amount of vibration that he or she desires to experience. This is called the BodyNumber™ setting (BodySound Technologies, Inc., Eden Prairie, Minn., United States), ranging from 0 (off) to 100. This is an amplitude setting applied to an array of frequencies generated by the amplifier's processor circuitry. These generated frequencies may be sub-harmonic frequencies. The creation of the frequency array is driven by a number of user-defined parameters. Two examples of algorithms used to generate the frequency array are as follows.

Generating the Frequency Array

Algorithm for Generating the Frequency Array

Example I

In the first example, the BodyNumber™ setting is used with an equalizer function applied to an array of sub-harmonic frequencies generated by the amplifier's processor circuitry.

The audio data that the person is listening to from the head speakers are subjected to a frequency analysis in real-time (in the form of successive, overlapped FFTs after the data have been conditioned by a window function to reduce edge effects) so that peak frequencies can be identified within defined bandwidths (e.g. 100-300, 300-500, 500-1 k, 1 k-2 k, 2 k-3 k, 3 k-4 k, 4 k-5 k, 5 k-6 k, 6 k-8 k, 8 k-10 k, 10 k-12 k, 12 k-15 k, 15 k-20 k). The relative power (or amplitude) of the peak(s), as compared to the background activity within that bandwidth in addition to other peaks in all bandwidths is also identified. The user may not choose to identify peaks in all bandwidths. Default parameter values for various types of audio content (sports—to identify fan noise, auto-racing, movies, music, etc.) will be provided.

Once the peaks are identified they are used to derive a set of sub-frequencies by dividing each of the peak frequencies by a user-defined set of prime numbers (e.g. 2, 3, 5, 7, 11, and 13). Each of the sub-frequencies is successively halved until the quotient is less than 5 yielding numerous sub-harmonics of the sub-frequencies at successively lower octaves. In this way the frequencies contained within the sub-harmonic frequency array contain the initial set of sub-frequencies plus every sub-harmonic value.

Power or amplitude values are assigned to each of the initial sub-frequencies and each of the sub-harmonic frequencies based upon the original peak's amplitude, the relative amplitude of the background activity in its bandwidth, the amplitudes of other peak frequencies, and the relative amplitude of the background in the bandwidth that the sub-frequency or sub-harmonic falls within or adjacent to for the sub-harmonics.

The resultant sub-harmonic frequency spectrum is subjected to either an inverse FFT or some other algorithm to generate a digital waveform. The digital waveform is subjected to a user defined equalizer (EQ) function to filter the data before it is mixed with any other audio signals destined for the same speaker/driver. The mixing percentage (relative volume) is user-defined. As mentioned above, the summed (mixed) waveform is filtered based on the user-defined EQ filter for the specific speaker/driver and then amplified and played through the seat transducer and potentially either or both spine speakers depending upon the user-defined settings.

The shape of the EQ curve may also change to emphasize certain frequency bands more than others.

An example of an algorithm that may be used to generate the sub-harmonic frequency array is as follows:

Algorithm Variable Declarations:

hop=2048 samples (sequence hop size)

span=4 (hops per window)

N=hop*span (window length and FFT size)

bands=100 300 500 1000 2000 3000 4000 5000 6000 8000 10000 12000 15000 20000 (edge frequencies for the 13 bands of interest)

npeaks=0 1 2 3 3 3 2 2 1 0 0 0 0 (number of peaks in each of the 13 bands)

divs=2 3 5 7 9 11 13 17 19 (set of prime numbers less than 20)

subharmonics=divs*2 divs*4 divs*8 divs*16 divs*32 divs*64 divs*128 divs*256 divs*512 divs*1024 (cascading set of divisors to create the subharmonics)

Algorithm:

1. Read the entire input data set (.wav file)
2. Zero-pad the input data with zeros at the beginning and end such that the input data is a multiple of N
3. Normalize the data set to values between −1 and +1
4. Map the band edges to corresponding FFT bin numbers
5. Initialize a new data sequence for storage of sub-harmonic frequency array to 0
6. For each hop in the input data set
   a. Copy span amount of data to temporary storage
   b. Perform the Hann window for the span data
   c. Swap the upper and lower halves of the span data
   d. Perform an FFT of the reordered span data
   e. Calculate and save the magnitude and phase values
   f. For each of the 13 bands of interest
      i. Find and save the mean amplitude for this band
      ii. Initialize a cascade accumulation vector for this band to 0
      iii. For each peak in the band to examine
         1. Find the location of the next largest peak
   2. Calculate the subharmonic array for peak frequency and concatenate to accumulation vector for this band
   g. Initialize an overall vector to hold the contributions from each band
   h. For each of the 13 bands of interest
      i. Concatenate the accumulation vector to the overall vector (build the vector symmetrically to that the inverse FFT will produce a real-valued time-domain output sequence)
   i. Use the BodyNumber™ setting to emphasize the lower sub-harmonics by raising the vector to the power of (BodyNumber™ setting/50)
   j. Swap the upper and lower halves of the data (undo previous swap)
   k. Perform the inverse FFT on the block of data
   l. Append the inverse FFT to the new data sequence
7. Save the new data sequence (sub-harmonic frequency array)

A separate EQ function may be applied to the sub-harmonic frequency array defined by the FeelNumber™ setting (BodySound Technologies, Inc., Eden Prairie, Minn., United States). The resultant signal is mixed with the signals destined for the external speakers (or arm speakers) and treated in a similar manner to the waveform generated in the BodyNumber™ system. In this way different effects can be generated for different speakers.

Algorithm for Generating the Frequency Array

Example II

In a second example of an algorithm that may be used to generate the frequency array, the generated frequencies are created differently to allow greater specificity in maintaining a tighter relationship between high frequencies that one can hear and frequencies that one can feel. These generated frequency are a translation of a higher frequencies that one mainly hears to lower frequencies that one can feel. This example of an algorithm is as follows:

1. The input signal is selected. When the sound transmitted to the chair is in Dolby 5.1 mode, the input signal is selected from the head channel or external channel. The input signal may be selected by the user.

2. The input audio signal is low pass filtered at 20% of the signal frequency, and then the signal is down sampled to 50% of the signal frequency. For example, a 48 kHz signal is low pass filtered at 9600 Hz, and then the signal is down sampled to 24 kHz.

3. The root mean square (RMS) of each sample is calculated; for example, the RMS of 1024 samples is determined.

4. The RMS value is multiplied by a normalizing factor, such as 1/gain, to normalize the RMS value, thereby generating a Total RMS value.

5. The Hanning Window ($\omega(i)=0.5(1-\cos((2\pi i)/n))$ is applied to the samples of data, e.g. from i=0 to 1023. When the Hanning Window is applied, the data is smoothed so there are no edge effects.

6. Data samples are swapped, e.g. samples 512 to 1023 become samples 0 to 511, and samples 0 to 511 become samples 512 to 1023. This data sample swap is an ordering technique that allows the first bin created in the Fast Fourier Transform (see step 7) to become a DC signal.

7. Fast Fourier Transform (FFT) is performed using the modified data samples. For example, data samples may each be 42.6 msec (if the sampling frequency is 24 kHz) or 46.4 msec (if the sampling frequency is 22.05 kHz).

8. The input frequency data is divided into a plurality of segments. Each segment includes one or more bins, wherein the bins are determined by the FFT performed on the 1024 data samples in step 7. The minimum and maximum frequencies of the input frequency data were previously defined by the user. For example, if the user defined the minimum frequency as 500 Hz and the maximum frequency as 4 kHz, the input frequency range would be from 500 Hz to 4 kHz, and the input frequency data from 500 HZ to 4 kHz would be divided into a plurality of segments. For, example, the input frequency data may be divided into 20 segments. Preferably, the data is divided into logarithmically equal segments, rather than segments that are equal according to a linear scale, in order to more closely match the manner in which the ear hears.

9. The power per bin and the total power in all bins are calculated. The percentage of the total power associated with each bin is also calculated; i.e., the power per bin is divided by the total power and multiplied by 100%.

10. For each of the plurality of segments (e.g. 20 segments) of input frequency data, the percentage of the total power associated with each segment is calculated. In other words, if a segment contains 10 bins, the sum of the power of the 10 bins is calculated, and this sum is divided by the total power and multiplied by 100%. Also, for each of the segments, the bin within each segment that has the greatest amount of power is identified. This bin is the "peak power bin."

11. An output frequency range of an output signal is defined. For example, the output frequency range could be defined between 0 and 400 Hz. The output frequency range is then divided into a plurality of output frequency segments. If the output frequency range is from 0 to 400 Hz, a plurality of output frequency segments are defined (programmatically) between 0 and 400 Hz. In one embodiment, these segments are all equal on a linear scale. For example, if the output frequency range is divided into 20 segments, each output frequency segment consists of 20 Hz.

Figure 6:
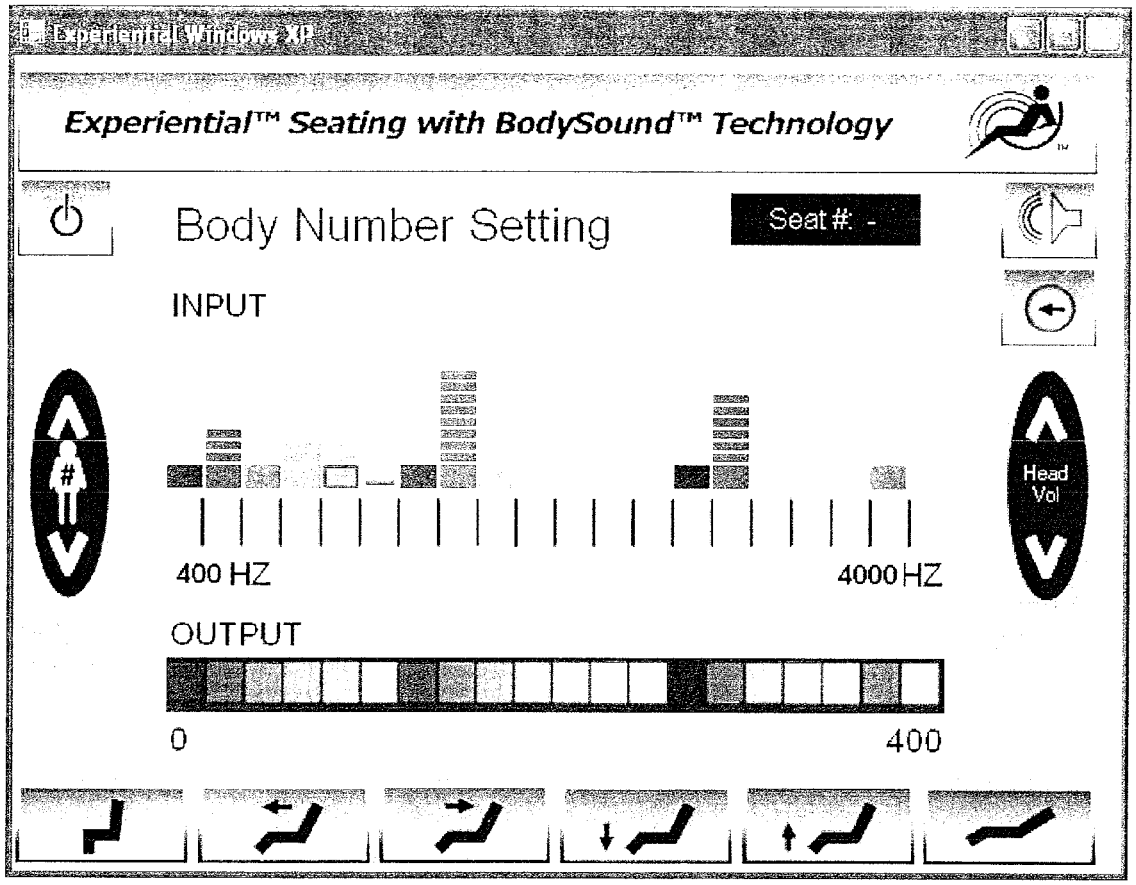
FIG. 6 is a view of a user interface screen that can be used in accordance with the present invention.
Figure 7:
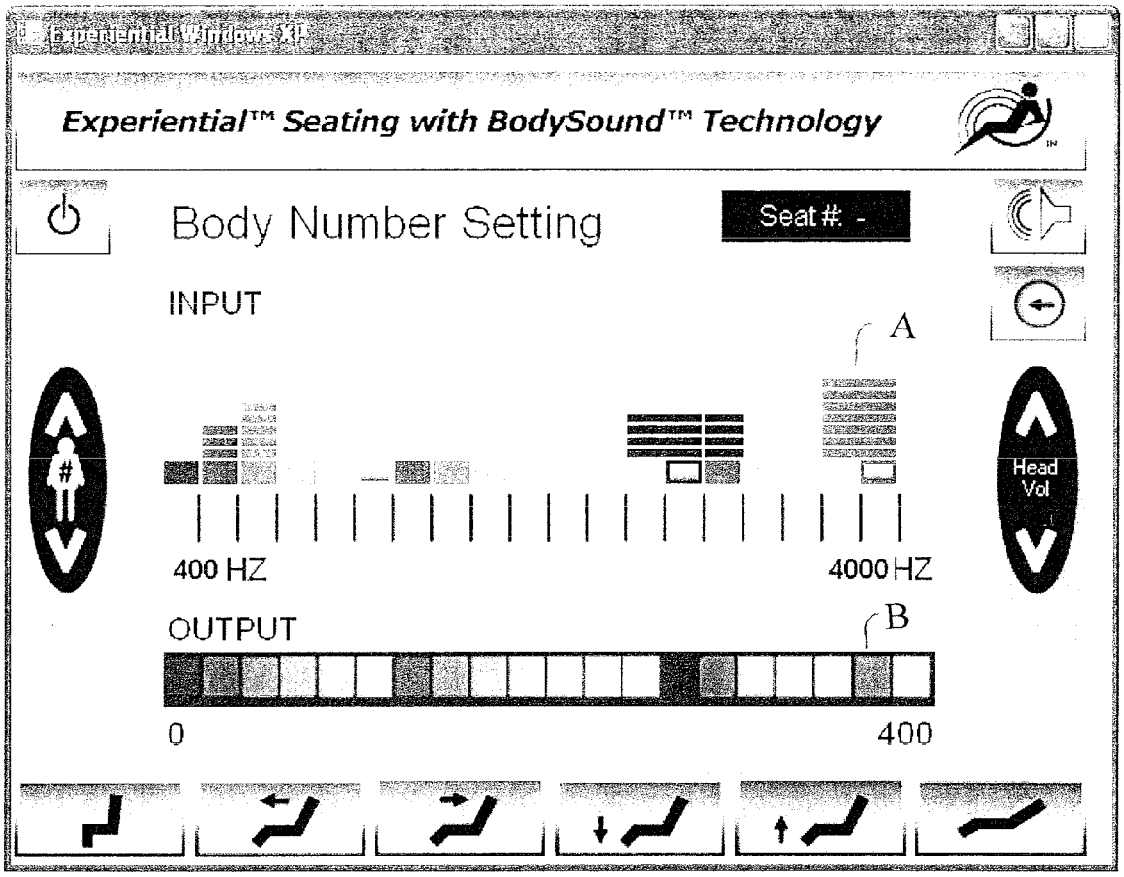
FIG. 7 is a view of a user interface screen that can be used in accordance with the present invention.

12. In the default setting there is a one to one correlation between input frequency segments and output frequency segments. Instead of using the default setting, a user may correlate certain input frequency segments to certain output frequency segments. Also, term "correlation" does not necessarily imply a one-to-one correlation. Instead of using a one to one correlation, a user may correlate a number of input frequency segments to one output frequency segment, or vice versa. A user may also correlate any number of the input frequency segments to any number of the output frequency segments. Examples of user interface screens, which can be viewed on the Control Screen, are shown in FIGS. 6 and 7. These figures are in black and white, but on a user interface screen, the bars above the input scale, and the squares representing the output scale, are in color. Content represented by a certain color in an input frequency segment, or segments, is correlated to the output frequency segment, or segments, represented by that same color. FIG. 7 shows an example of a user interface screen in which more than one input frequency segment is correlated to one output frequency segment. For example, the content represented by a column of seven bars labeled "A," which stretch across two adjacent input frequency segments, is correlated to the one output frequency segment labeled "B." On a user interface screen, both the column of bars labeled "A" and the output frequency segment labeled "B" would be of the same color, such as the same shade of green.

13. One output frequency component is generated per output frequency segment. The output frequency component is determined by the relative placement of the peak power bin within the input frequency segment assigned to that output frequency segment. For example, an input frequency segment ranging from 4 kHz to 5 kHz, with a peak power bin at 4.5 kHz, may be correlated to an output frequency segment of 300 Hz to 320 Hz. In this example, the peak power bin is in the middle of the range of the input frequency segment. Because the peak power bin is in the middle of the range of the input frequency segment, the output frequency component will be 310 Hz, which is in the middle of the range of the output frequency segment. All of the output frequency components are combined to form a single output waveform.

14. The amplitude of each output frequency component is determined by the following formula: amplitude=(percent of total power in correlated input frequency segment)×(Total RMS)×(user-defined gain bias for said correlated input frequency segment)×(user-defined BodyNumber™ setting). The BodyNumber™ setting may range between 1 and 100. A user may also adjust relative amplitudes via a user interface that can be accessed through the Control Screen.

15. The output waveform is transmitted through the spine and seat speakers. The mix levels per speaker may be set at default or user-defined levels.

This second example of an algorithm may also be used to generate a sub-harmonic frequency array defined by the FeelNumber™ setting. The resultant signal is mixed with the signals destined for the external speakers (or arm speakers) and treated in a similar manner to the waveform generated in the BodyNumber™ system. In this way different effects can be generated for different speakers.

For either of the above examples of algorithms, there may be different default settings, or templates, for use with different content. For example, a template may determine the BodyNumber™ setting, and/or the minimum and maximum frequencies of the input frequency data, and/or the correlation between input frequency segment and output frequency range, etc. Examples of different content for which templates may be available include various types of television shows, such as sporting events and auto racing, various movie genres, such as action films, and various musical genres, such as classical music, jazz music, and rock music.

When either of the above examples of algorithms is used, all user controls are accomplished through the graphical user interface using the Control Screen or another computer using the software provided.

Chair Assembly: Back

Figure 8:
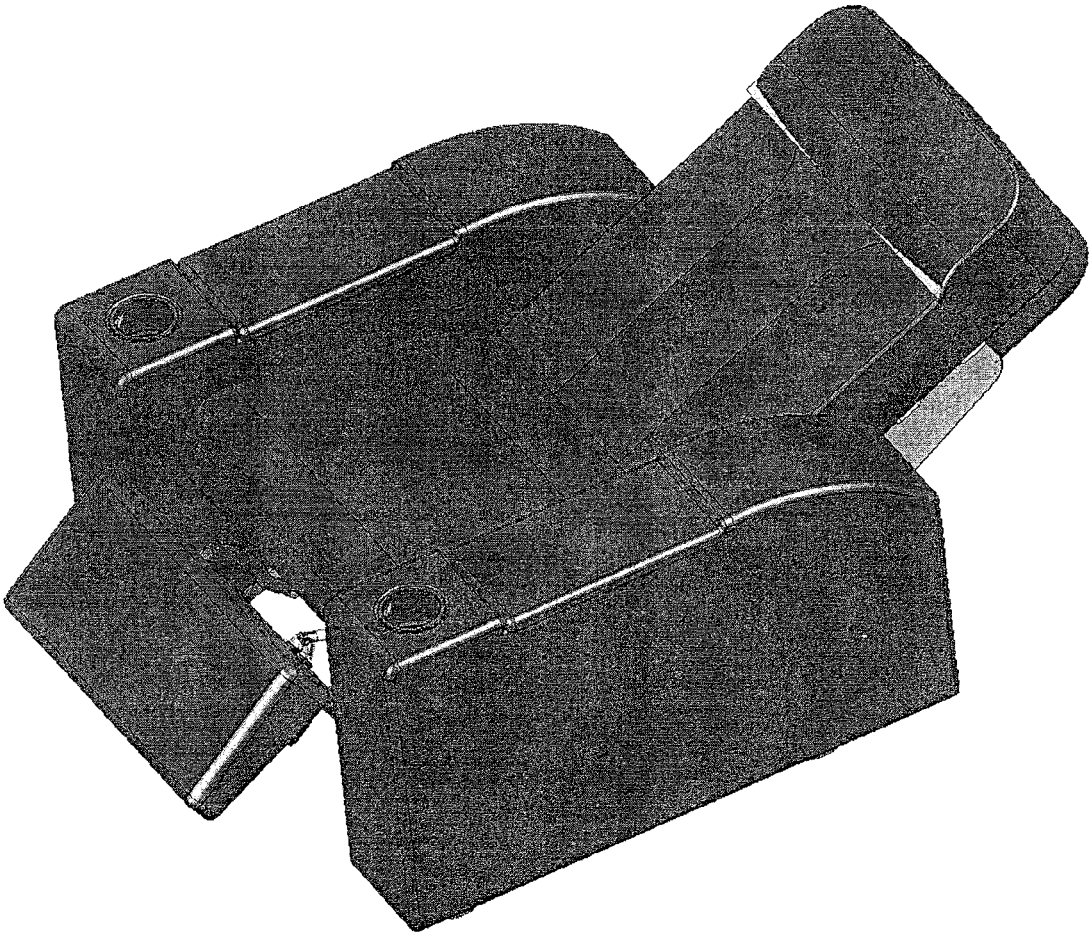
FIG. 8 is a perspective view of an embodiment of a chair according to the present invention.
Figure 9:
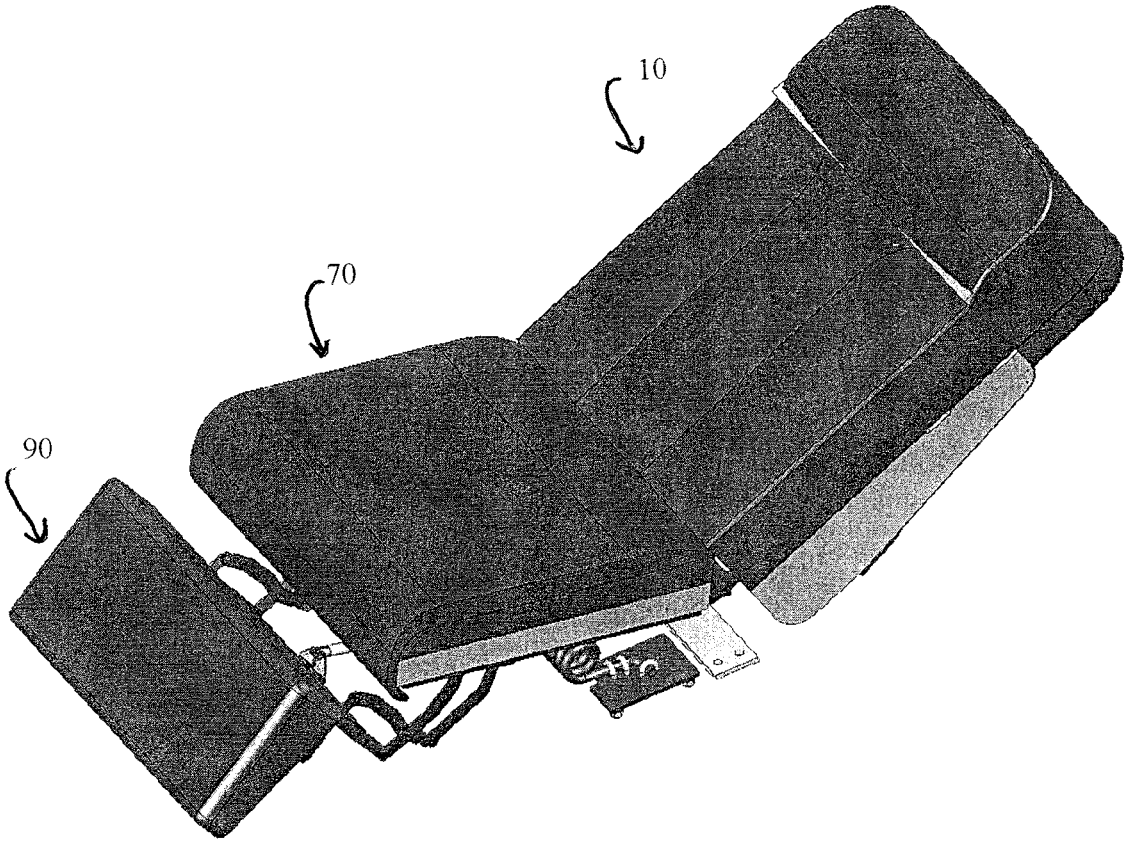
FIG. 9 is a perspective view of a partially disassembled chair. It shows the chair of FIG. 8 after the arms have been removed.

An embodiment of a chair made in accordance with the present invention is shown in FIG. 8. FIG. 9 shows the chair of FIG. 8 without the arms. The arms of the chair are not shown in FIG. 9 so that the view of the back 10 and the seat 70 of the chair is not obstructed. The footrest 90 is also shown in FIG. 9.

Figure 10:
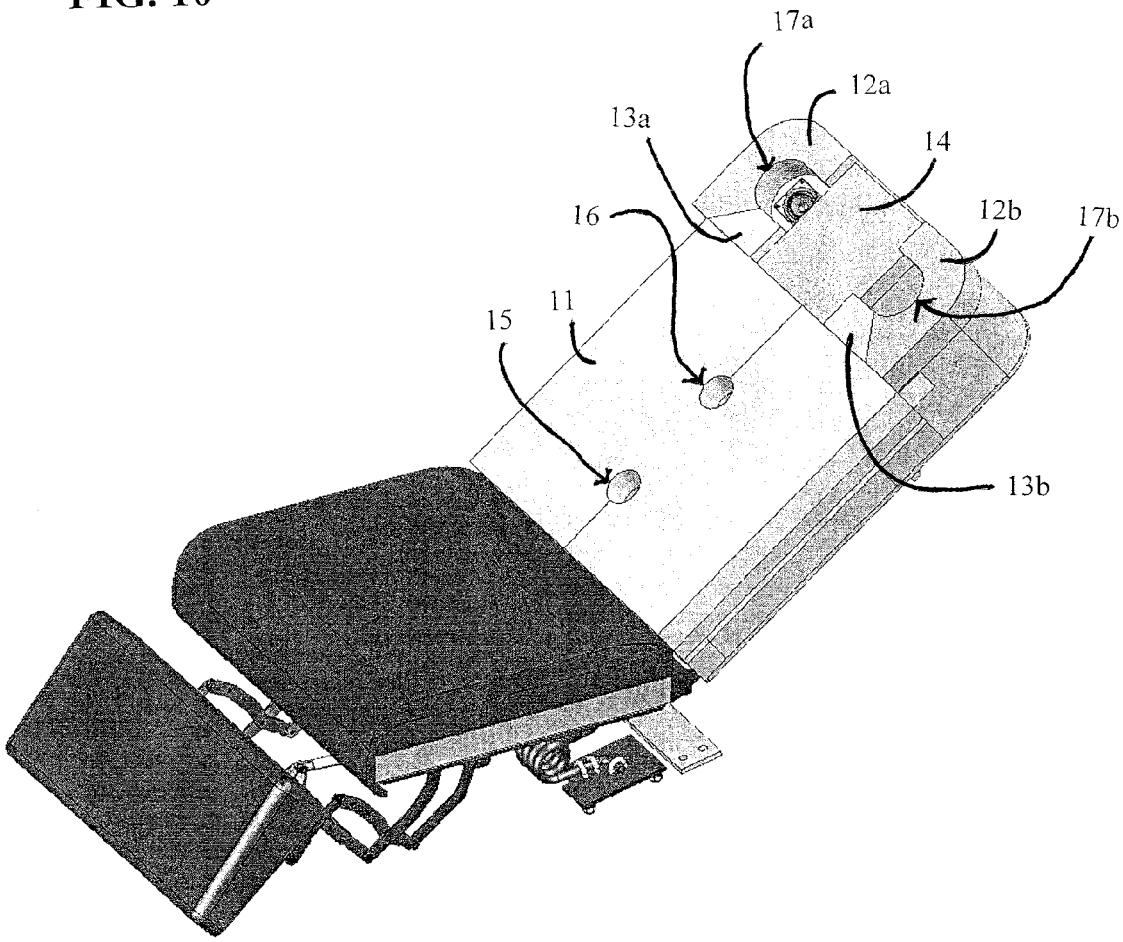
FIG. 10 is a perspective view of a partially disassembled chair. It shows the partially disassembled chair of FIG. 9 after the upholstery has been removed from the back of the chair.

FIG. 10 shows the chair of FIG. 9 after the upholstery has been removed from the back 10. The upholstery consists of a layer of leather over a layer of Dacron® material. The layer of leather may be perforated leather. Alternatively, portions of the leather located over the speakers may be perforated leather, while the remainder of the leather is not perforated. Layers of foam are located underneath the upholstery. The layers of foam used may have different degrees of acoustic conductance and compressibility. Layer 11 is a piece of flexible polyurethane foam that is approximately 2 inches thick, which is located in the backrest portion of the back 10 of the chair. There are two circular holes 15 and 16 in layer 11, located above the spine speakers of the chair. The foam of layer 11 is a high resiliency foam that has the following physical properties: a density of 2.3-2.5 lb/ft$^3$; an indent force deflection at 25% of 15-21; a compression set at 75% compression of 10%; a tensile strength of 10 psi; a tear strength of 1.0 pli (pounds per linear inch); and an elongation of 100%. The physical properties were measured in accordance with the test methods of ASTM D-3574-01. The foam also passes the flame resistance test of Cal 117.

Layers 12*a* and 12*b* are pieces of flexible polyurethane foam that are approximately 2 inches thick, which are located in the headrest portion of the back 10 of the chair. The front view of layer 12*a* is also a back view of layer 12*b*, since layers 12*a* and 12*b* are mirror images of each other. The foam of layers 12*a* and 12*b* has the following physical properties: a density of 1.05-1.25 lb/ft$^3$; an indent force deflection at 25% of 33-39; a compression set at 50% compression of 10%; a tensile strength of 10 psi; a tear strength of 1 pli (pounds per linear inch); and an elongation of 100%. The physical properties were measured in accordance with the test methods of ASTM D-3574-01. The foam also passes the flame resistance test of Cal 117.

Layers 13*a* and 13*b* are pieces of flexible polyurethane foam that are approximately 2 inches thick, which are located in the headrest portion of the back 10 of the chair. The front view of layer 13*b* is also the back view of layer 13*a*, since layers 13*a* and 13*b* are mirror images of each other. The foam of layers 13*a* and 13*b* is a high resiliency foam that has the following physical properties: a density of 2.3-2.5 lb/ft$^3$; an indent force deflection at 25% of 15-21; a compression set at 75% compression of 10%; a tensile strength of 10 psi; a tear strength of 1.0 pli (pounds per linear inch); and an elongation of 100%. The physical properties were measured in accordance with the test methods of ASTM D-3574-01. The foam also passes the flame resistance test of Cal 117.

Layer 14 is a piece of flexible polyurethane foam that is approximately 1.25 inches thick, which is located in the headrest portion of the back 10 of the chair. The foam of layer 14 is a high resiliency foam that has the following physical properties: a density of 2.3-2.5 lb/ft$^3$; an indent force deflection at 25% of 15-21; a compression set at 75% compression of 10%; a tensile strength of 10 psi; a tear strength of 1.0 pli (pounds per linear inch); and an elongation of 100%. The physical properties were measured in accordance with the test methods of ASTM D-3574-01. The foam also passes the flame resistance test of Cal 117. A softer foam is used for layer 14 than for layers 12*a* and 12*b* in order to increase the comfort of the chair, because the user's head will be resting on layer 14.

Foam layers 12*a* and 12*b*, 13*a* and 13*b*, and 14 are cut and arranged such that the headrest contains cavities 17*a* and 17*b*, so that these foam layers do not cover the head speakers.

Figure 11:
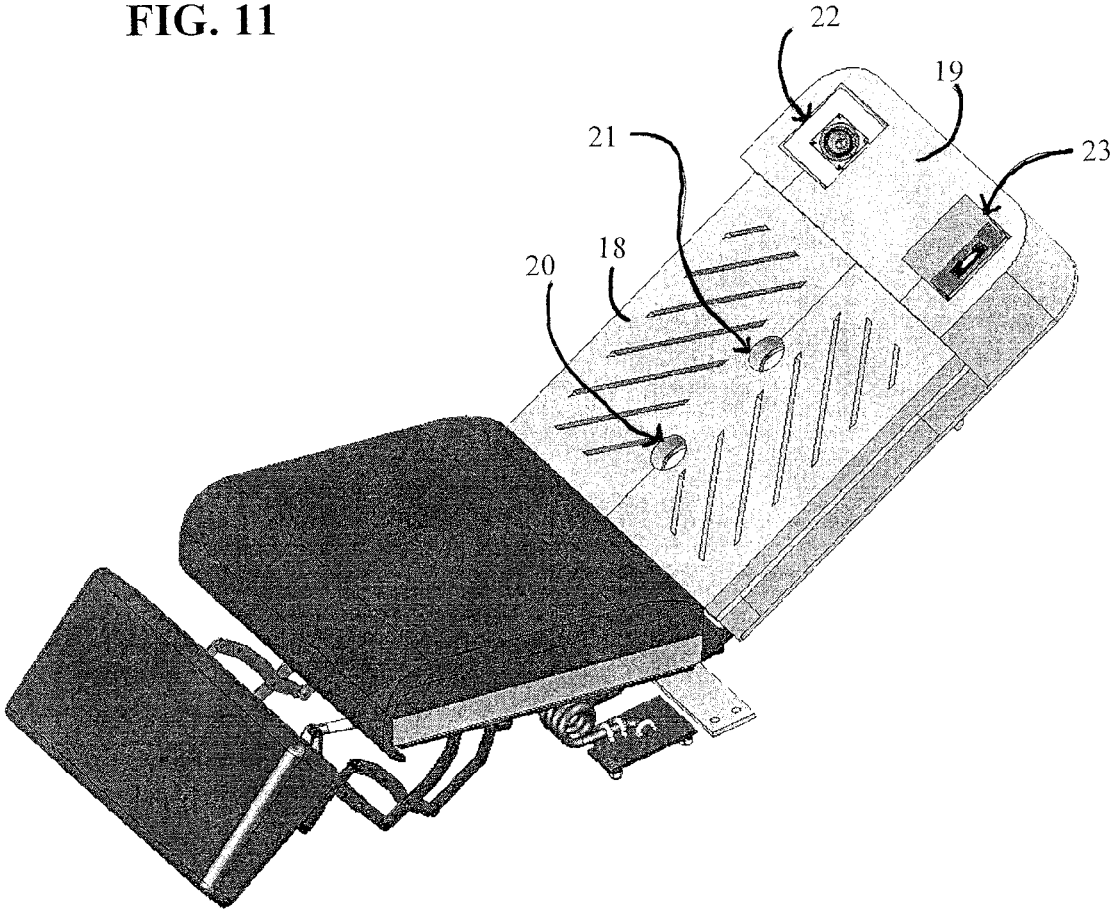
FIG. 11 is a perspective view of a partially disassembled chair. It shows the partially disassembled chair of FIG. 10 after foam layers and foam components have been removed from the back of the chair.

FIG. 11 is a view of the chair of FIG. 10 after foam layers 11, 12*a* and 12*b*, 13*a* and 13*b*, and 14 have been removed. Layer 18 is a piece of flexible polyurethane foam that is approximately 1.25 inches thick, which is located in the backrest portion of the back 10 of the chair. There are two circular holes 20 and 21 in layer 18, located above the spine speakers of the chair. Layer 18 also includes a row of slits on both the left side and the right side of the layer. These slits are arranged at a 45 degree angle from the top and bottom edges. The slits extend throughout the thickness of the foam, and assist in dispersing the vibrations emanating from the speakers. The foam of layer 18 has the following physical properties: a density of 1.05-1.25 lb/ft$^3$; an indent force deflection at 25% of 33-39; a compression set at 50% compression of 10%; a tensile strength of 10 psi; a tear strength of 1 pli (pounds per linear inch); and an elongation of 100%. The physical properties were measured in accordance with the test methods of ASTM D-3574-01. The foam also passes the flame resistance test of Cal 117.

Layer 19 is a piece of flexible polyurethane foam that is approximately 5.75 inches thick, which is located in the headrest portion of the back 10 of the chair. There are two square holes 22 and 23 in layer 19. These holes are located above the head speakers of the assembled chair. The foam of layer 19 has the following physical properties: a density of 1.05-1.25 lb/ft$^3$; an indent force deflection at 25% of 33-39; a compression set at 50% compression of 10%; a tensile strength of 10 psi; a tear strength of 1 pli (pounds per linear inch); and an elongation of 100%. The physical properties were measured in accordance with the test methods of ASTM D-3574-01. The foam also passes the flame resistance test of Cal 117.

Figure 12:
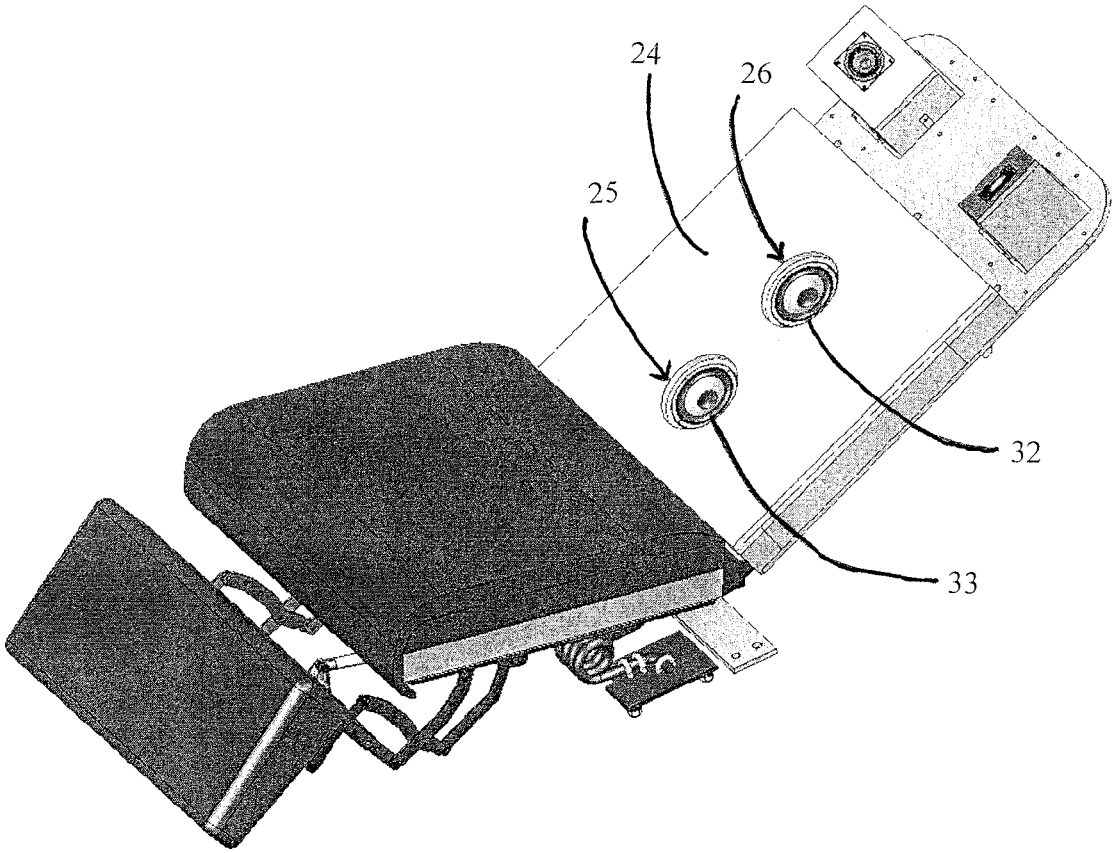
FIG. 12 is a perspective view of a partially disassembled chair. It shows the partially disassembled chair of FIG. 11 after foam layers have been removed from the back of the chair.

FIG. 12 is a view of the chair of FIG. 11 after foam layers 18 and 19 have been removed. Layer 24 is a piece of foam made from expanded polyethylene beads. Layer 24 is approximately 0.50 inches thick, and is located in the backrest portion of the back 10 of the chair. There are two circular holes 25 and 26 in layer 24, located above the spine speakers of the chair. The foam of layer 24 has the following physical properties: a density of 1.5 lb/ft$^3$; a compressive strength at 25% of 10.5 psi; a compressive strength at 50%, in the vertical direction, of 19.0 psi; a compression set at 25% compression of 4.2%; a compression set at 50% compression of 12.5%; a compression creep of 3.0% at 1.0 psi; a tensile strength of 44.7 psi; a tear resistance of 15.5 lb/in; a buoyancy of 60.2 pcf; a water absorption of approximately 1.0%; a tensile elongation of 30.0%; a thermal conductivity k-Value of 0.25; and a thermal resistance R-value of 4.0. The density, buoyancy, and water absorption were measured in accordance with ASTM D 3575; the compressive strength was measured in accordance with ASTM D 3575-93 Suffix D; the compression set was measured in accordance with ASTM D 3575-93 Suffix B; the compression creep was measured in accordance with ASTM D 3575-93 Suffix BB; the tensile strength was measured in accordance with ASTM D 3575-93 Suffix T; the tear resistance was measured in accordance with ASTM D 3575-93 Suffix G; the tensile elongation was measured in accordance with ASTM D 3575-93 Suffix S; and the thermal conductivity k-Value and the thermal resistance R-value were measured in accordance with ASTM C177. The foam also passes burn resistance requirements, as tested according to the FMVSS302 standard.

The aperture 26 in layer 24, aperture 21 in layer 18, and aperture 16 in layer 11 form a chamber positioned above the upper spine speaker 32. The aperture 25 in layer 24, aperture 20 in layer 18, and aperture 15 in layer 11 form a chamber positioned above the lower spine speaker 33. These apertures aid in the transmission of sound and vibrational energy, and create a resonant space for sound and vibration.

Figure 13:
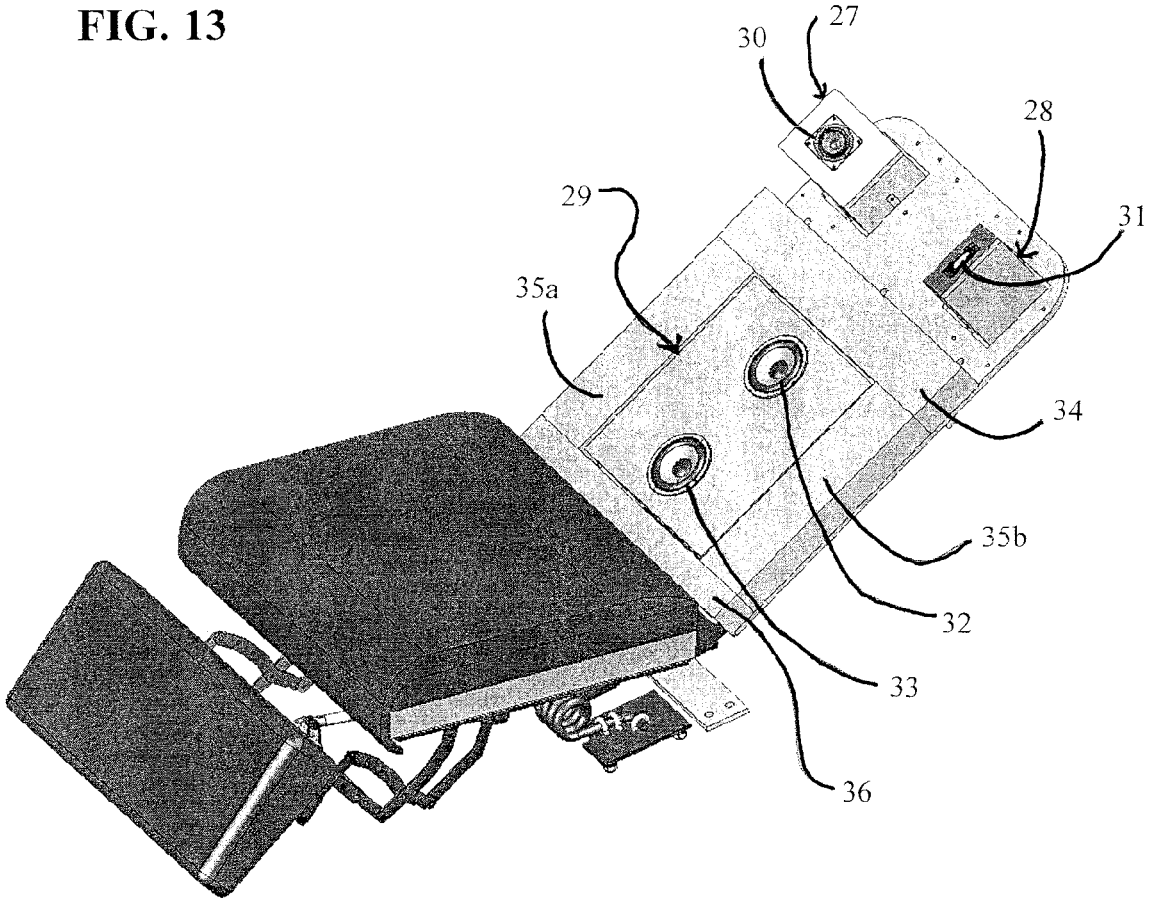
FIG. 13 is a perspective view of a partially disassembled chair. It shows the partially disassembled chair of FIG. 12 after a foam layer has been removed from the back of the chair.

FIG. 13 is a view of the chair of FIG. 12 after foam layer 24 has been removed. Housings 27 and 28 house head speakers 30 and 31. Housing 29 houses spine speakers 32 and 33. The housings 27, 28, and 29 are made from wood. The housings are filled with Dacron® fibers and are sealed with silicon. The housings includes holes to accommodate the wires that connect the speakers to the amplifier assembly. Silicon may be used to seal these holes in the housings. A two channel amplifier may be used to power the head speakers, so that the volume of each head speaker may be adjusted independently.

Housing 29 is surrounded by foam components 34, 35*a* and 35*b*, and 36. Foam component 34 is adjacent to the top side of housing 29, and is approximately 2.125 inches thick. The foam of foam component 34 is made from flexible polyurethane foam and has the following physical properties: a density of 1.4-1.6 lb/ft$^3$; an indent force deflection at 25% of 45-55; a compression set at 50% compression of 10%; a tensile strength of 12 psi; a tear strength of 1.5 pli (pounds per linear inch); and an elongation of 150%. The physical properties were measured in accordance with the test methods of ASTM D-3574-01. The foam also passes the flame resistance test of Cal 117.

Foam components 35*a* and 35*b* are located on either side of housing 29. These foam components are approximately 2.125 inches thick. The foam of foam components 35*a* and 35*b* is made from flexible polyurethane foam and has the following physical properties: a density of 1.4-1.6 lb/ft$^3$; an indent force deflection at 25% of 45-55; a compression set at 50% compression of 10%; a tensile strength of 12 psi; a tear strength of 1.5 pli (pounds per linear inch); and an elongation of 150%. The physical properties were measured in accordance with the test methods of ASTM D-3574-01. The foam also passes the flame resistance test of Cal 117.

Foam component 36 is adjacent to the bottom edge of housing 29, and is approximately 2.125 inches thick. The foam of foam component 34 is made from flexible polyurethane foam and has the following physical properties: a density of 1.4-1.6 lb/ft$^3$; an indent force deflection at 25% of 45-55; a compression set at 50% compression of 10%; a tensile strength of 12 psi; a tear strength of 1.5 pli (pounds per linear inch); and an elongation of 150%. The physical properties were measured in accordance with the test methods of ASTM D-3574-01. The foam also passes the flame resistance test of Cal 117.

Figure 14:
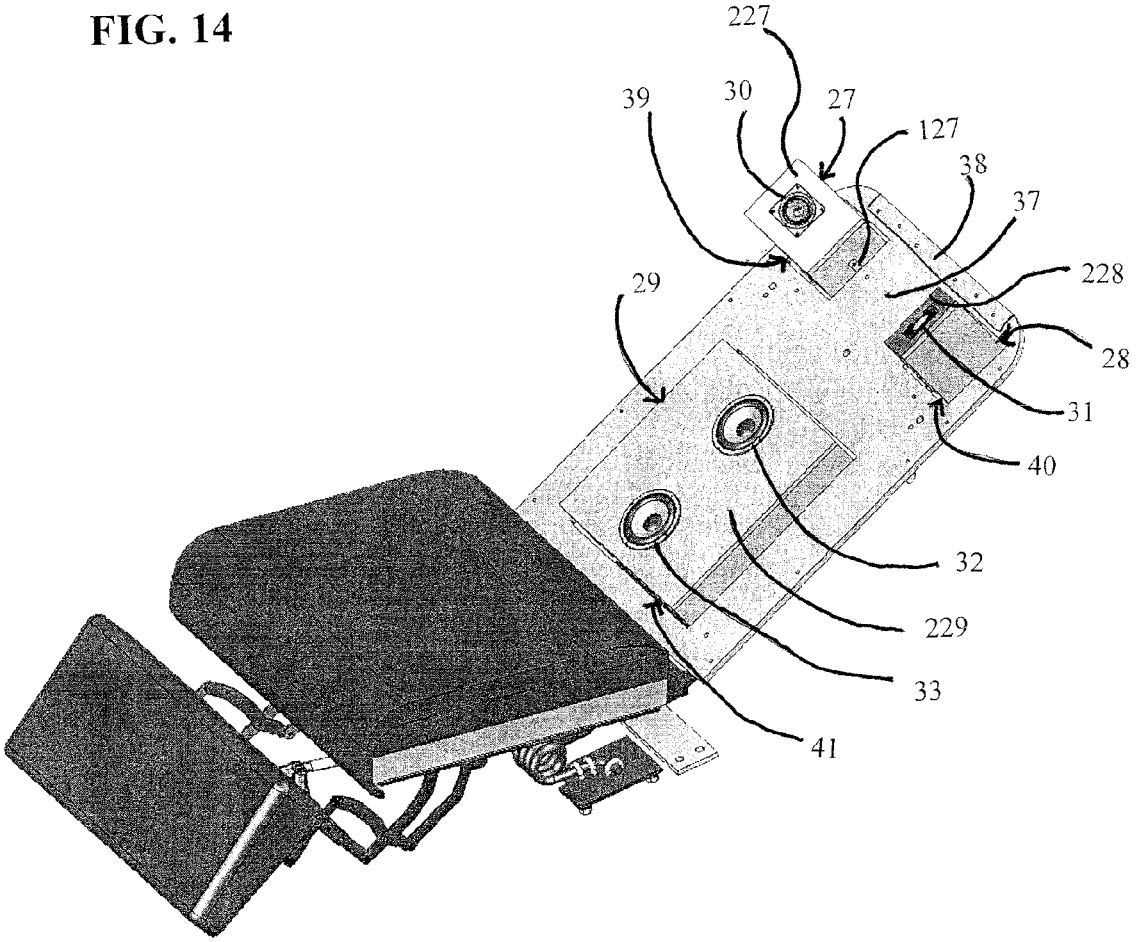
FIG. 14 is a perspective view of a partially disassembled chair. It shows the partially disassembled chair of FIG. 13 after foam components have been removed from the back of the chair.
Figure 15:
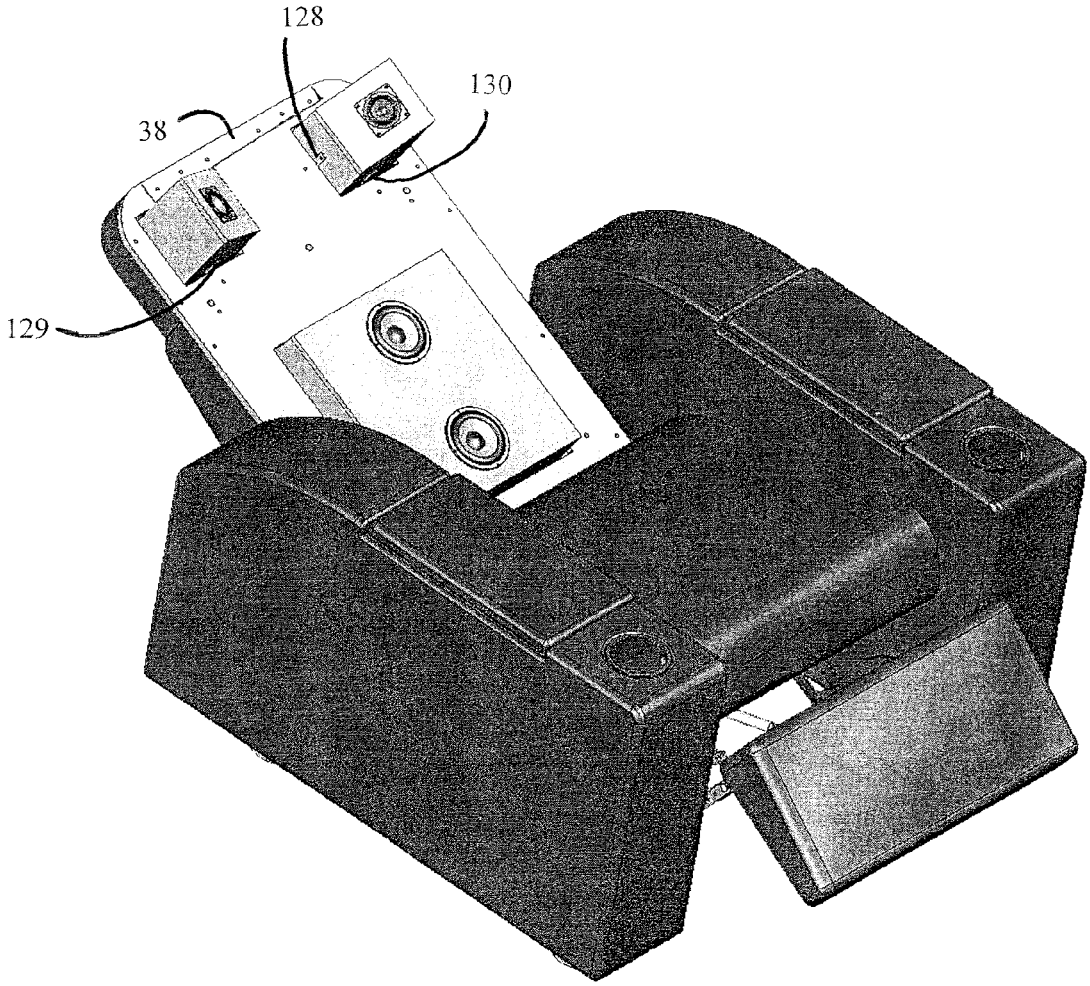
FIG. 15 is a perspective view of a partially disassembled chair. It shows the chair of FIG. 8 after upholstery and foam layers and components have been removed from the back of the chair.
Figure 16:
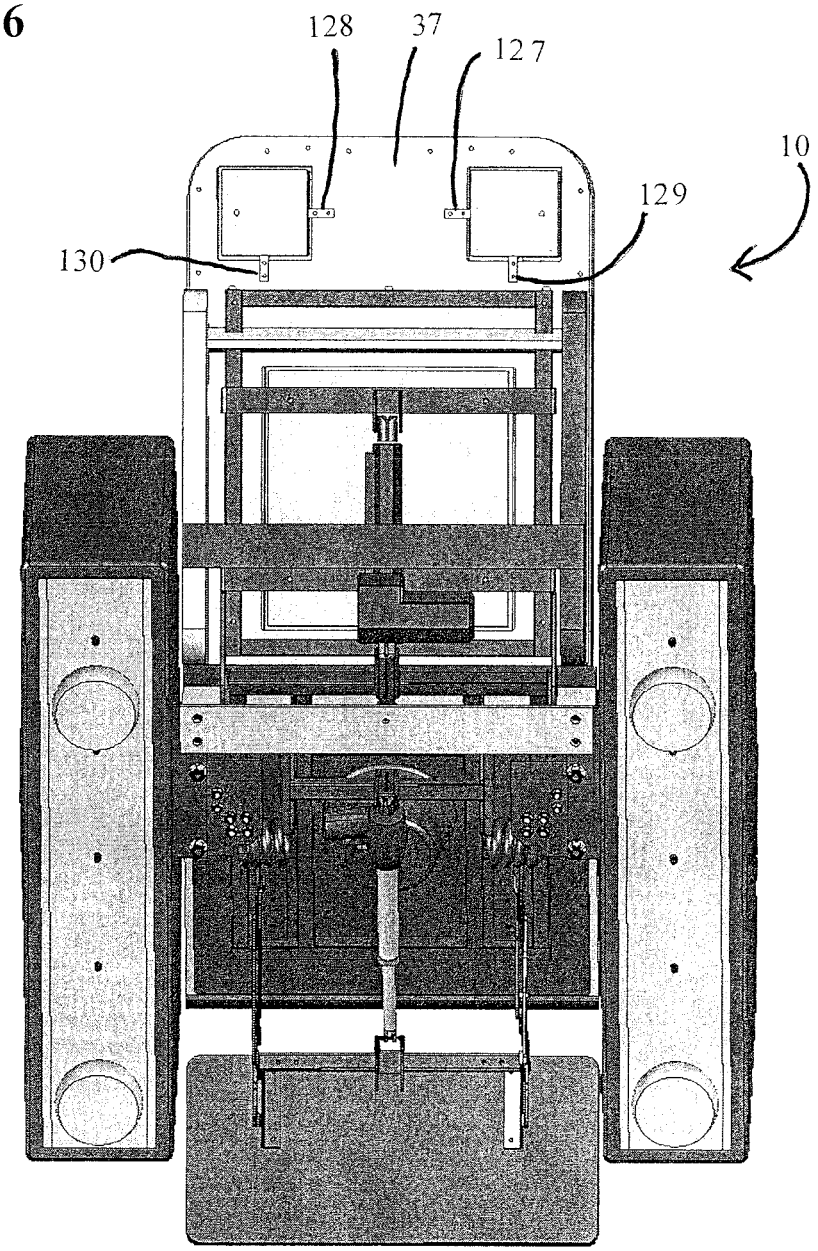
FIG. 16 is bottom perspective view of the chair of FIG. 8 after the upholstery has been removed from the back of the chair.

FIG. 14 is a view of the chair of FIG. 13 after foam components 34, 35*a* and 35*b*, and 36 have been removed. Component 37 is a wooden support. Wooden component 37 includes rectangular holes 39 and 40 which receive portions of the housings 27 and 28, respectively, of the head speakers 30 and 31. Housing 27 is secured to wooden component 37 by brackets 127 and 129. Bracket 129 is shown in FIG. 15. Housing 28 is secured to wooden component 37 by brackets 128 and 130. Brackets 128 and 130 can be seen in FIG. 15. FIG. 15 is a perspective view of the chair of FIG. 8, after the back upholstery, and the foam layers and components of the back 10, have been removed. The brackets 127, 128, 129, and 130 are secured to the back of component 37, as shown in FIG. 16, which is a view of the back of the chair of FIG. 8 after the upholstery has been removed from the back 10.

With reference to FIG. 14, the component 37 also includes a rectangular hole 41 to contain the housing 29 of the spine speakers 32 and 33. Moreover, the front 227 of housing 27 includes a hole for the head speaker 30. The front 228 of housing 28 includes a hole for the head speaker 31. The front 229 of housing 29 includes two holes for spine speakers 32 and 33.

A metal brace 38 is attached to the top of component 37, to prevent component 37 from deforming when the foam layers, foam components, and upholstery is added to the back 10 of the chair, or from deforming during manufacture or use.

Figure 17:
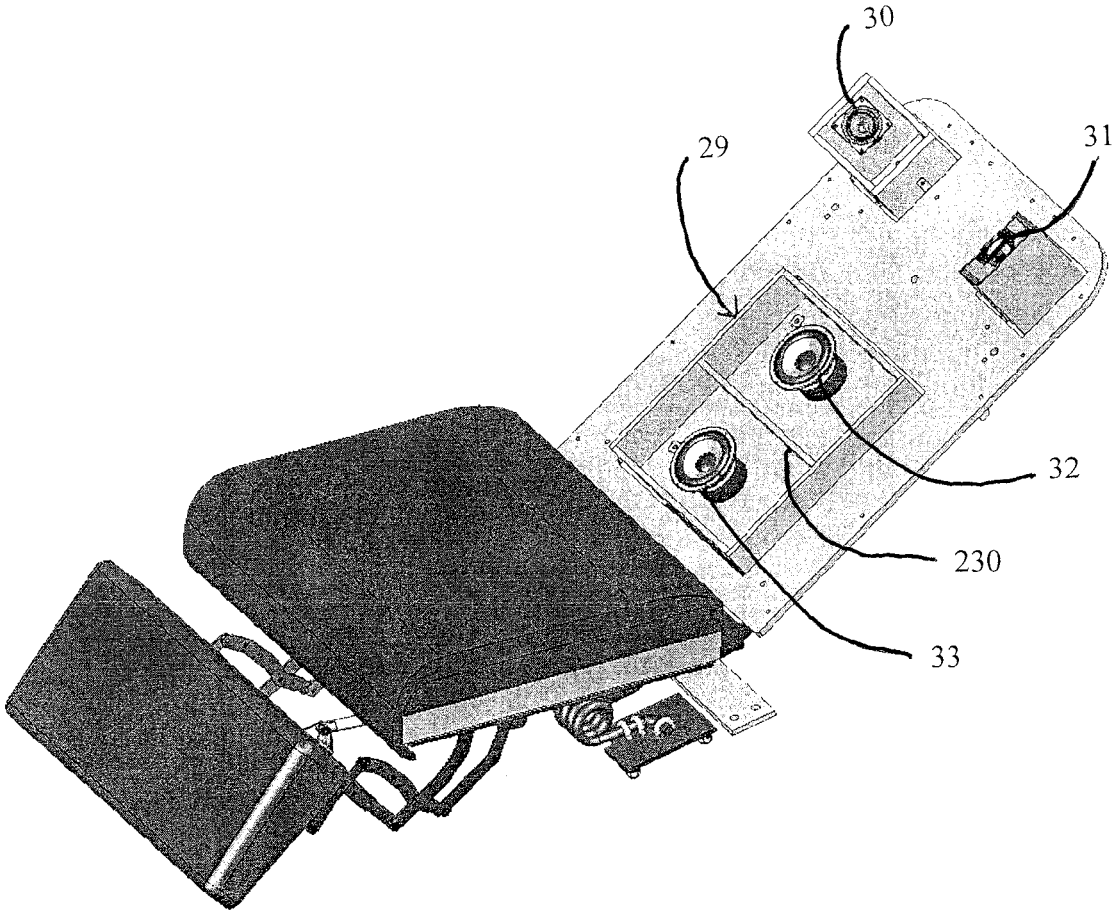
FIG. 17 is a perspective view of a partially disassembled chair. It shows the partially disassembled chair of FIG. 14 after speaker housing components and a brace have been removed from the back of the chair.

FIG. 17 is a view of the chair of FIG. 14 after the front 227 of housing 27, the front 228 of housing 28, the front 229 of housing 29, and the metal brace 38 have been removed. FIG. 17 shows that a wooden baffle 230 bisects the housing 29. This baffle 230 is located between spine speaker 32 and spine speaker 33.

A two channel amplifier may be used to power the spine speakers, so that the volume of each spine speaker may be adjusted independently.

Figure 18:
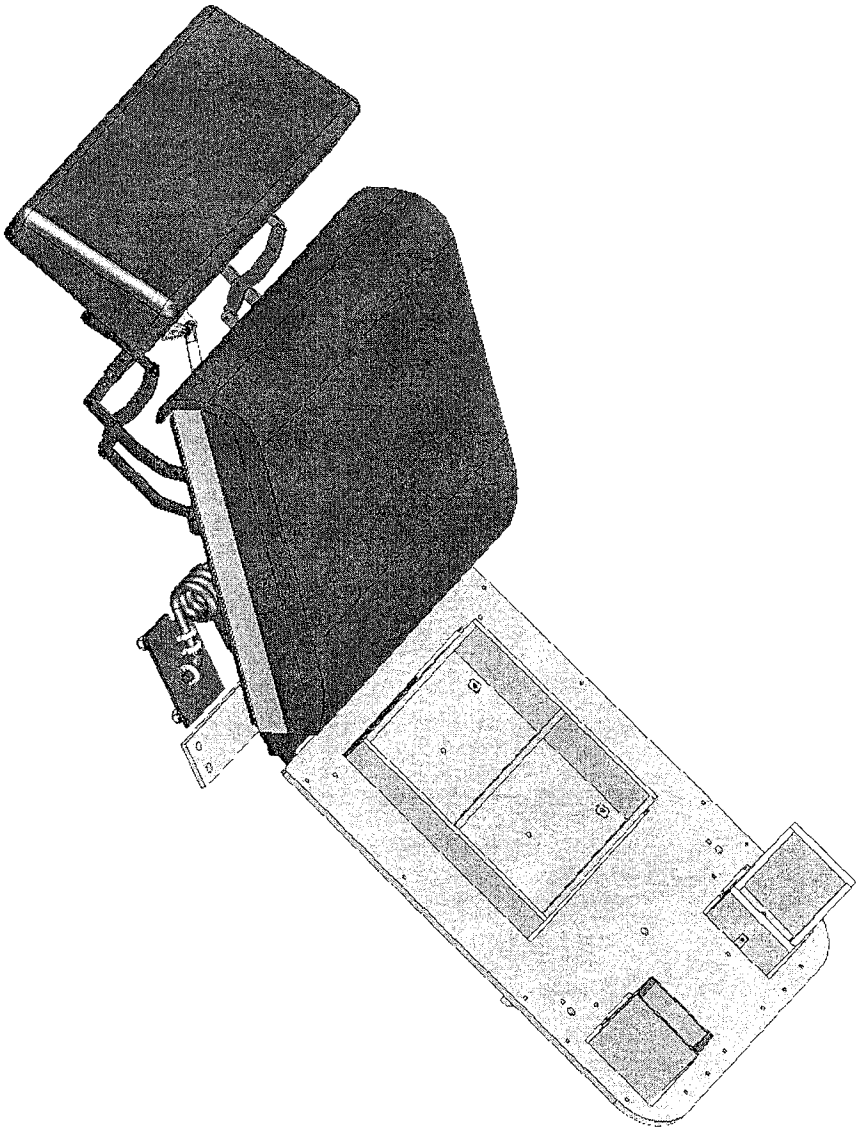
FIG. 18 is a perspective view of a partially disassembled chair. It shows the partially disassembled chair of FIG. 17 after the head speakers and spine speakers have been removed.

FIG. 18 is a view of the chair of FIG. 17 after the head speakers 30 and 31 and the spine speakers 32 and 33 have been removed.

Figure 19:
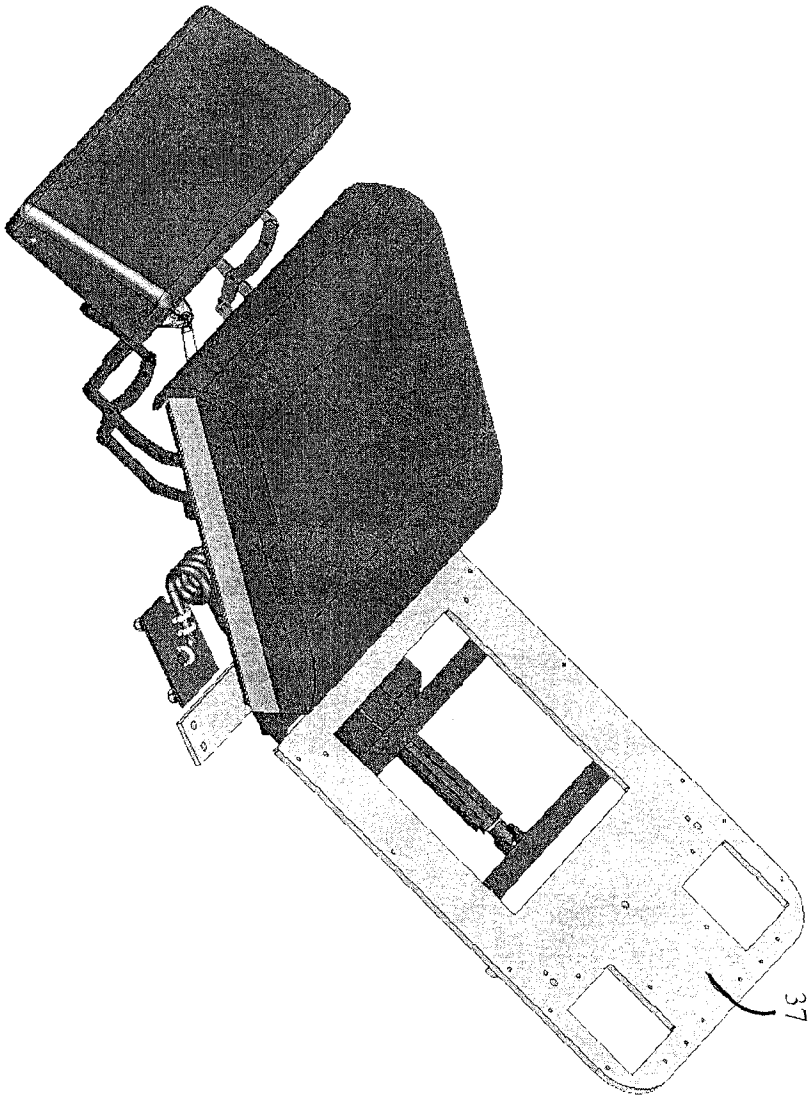
FIG. 19 is a perspective view of a partially disassembled chair. It shows the partially disassembled chair of FIG. 18 after speaker housing components have been removed from the back of the chair.

FIG. 19 is a view of the chair of FIG. 18 after the housings 27 and 28 of the head speakers, and the housing 29 of the spine speakers, have been removed.

Figure 20:
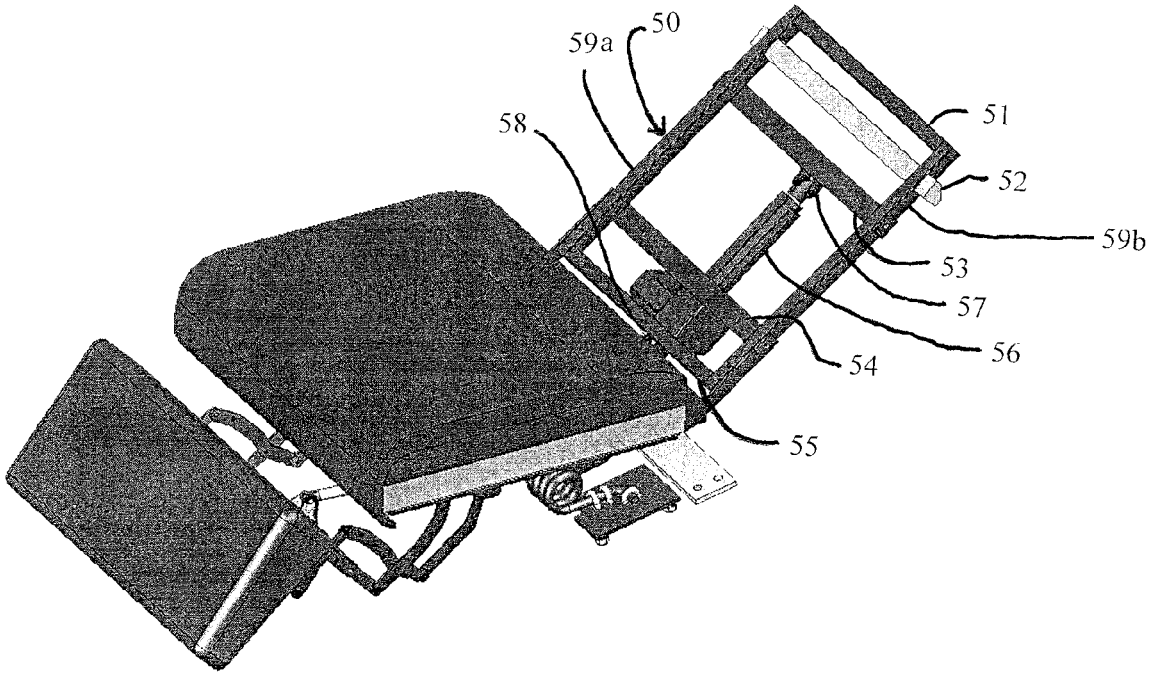
FIG. 20 is a perspective view of a partially disassembled chair. It shows the partially disassembled chair of FIG. 19 after the wooden base has been removed from the back of the chair.

FIG. 20 is a view of the chair of FIG. 19 after the component 37 has been removed. Frame 50 of the back 10 of the chair is made from steel. The frame 50 consists of two parallel bars 59*a* and 59*b* which are braced by four or five bars that are perpendicular to bars 59*a* and 59*b*. In an individual free-standing chair, four bars are perpendicular to bars 59*a* and 59*b*. These four bars, which are parallel to each other, are bars 51, 53, 54, and 55. Therefore, in an individual free-standing chair, bar 52 is not included. When a chair is present in a sectional arrangement with a gap filler, bar 52 is included. Consequently, when a chair is present in a sectional arrangement, five bars are perpendicular to bars 59*a* and 59*b*. These five bars, which are bars 51, 52, 53, 54, and 55, are parallel to each other.

Figure 21:
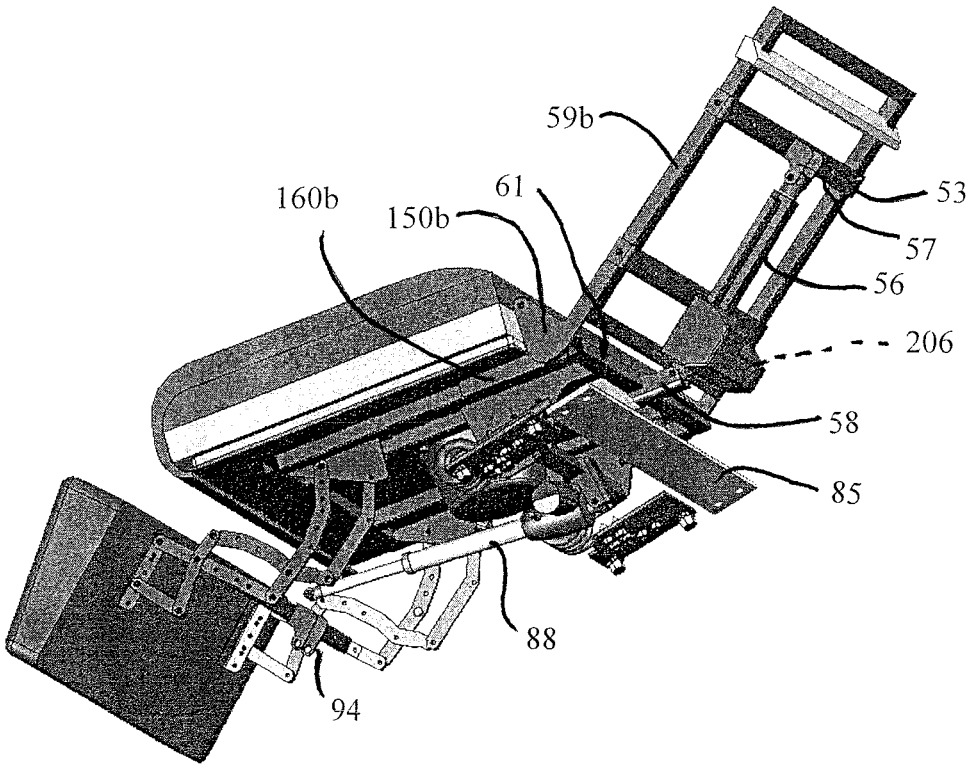
FIG. 21 is a back perspective view of the partially disassembled chair of FIG. 20, after the pin securing the linear actuator under the seat of the chair to the frame of the footrest has been removed.

Linear actuator 56 acts to recline the back 10 of the chair. The linear actuator 56 includes the recline motor 206 shown in the schematic wiring diagram of FIG. 2. As can be seen more clearly in FIG. 21, linear actuator 56 is attached to bar 53 of the frame 50 of the back by actuator support 57. FIG. 21 is a back perspective view of the partially disassembled chair of FIG. 20, after the pin securing linear actuator 88 to actuator support 94 of the frame of the footrest has been removed. Linear actuator 56 is attached to the frame of the seat of the chair by actuator support 58, which connects the linear actuator 56 to bar 61 of the frame. Bar 61 is parallel to bars 51, 52, 53, 54, and 55.

FIG. 21 also shows mount 150*b*, which is secured to bar 59*b* and to mount 160*b*. Mount 160*b* is a part of the seat frame 60. On the opposite side of the chair, mount 150*a* is secured to bar 59*a* and to mount 160*a*, which is also part of the seat frame 60. Therefore, back frame 50 and seat frame 60 are connected via mounts 150*a* and 150*b* and mounts 160*a* and 160*b*.

Figure 37:
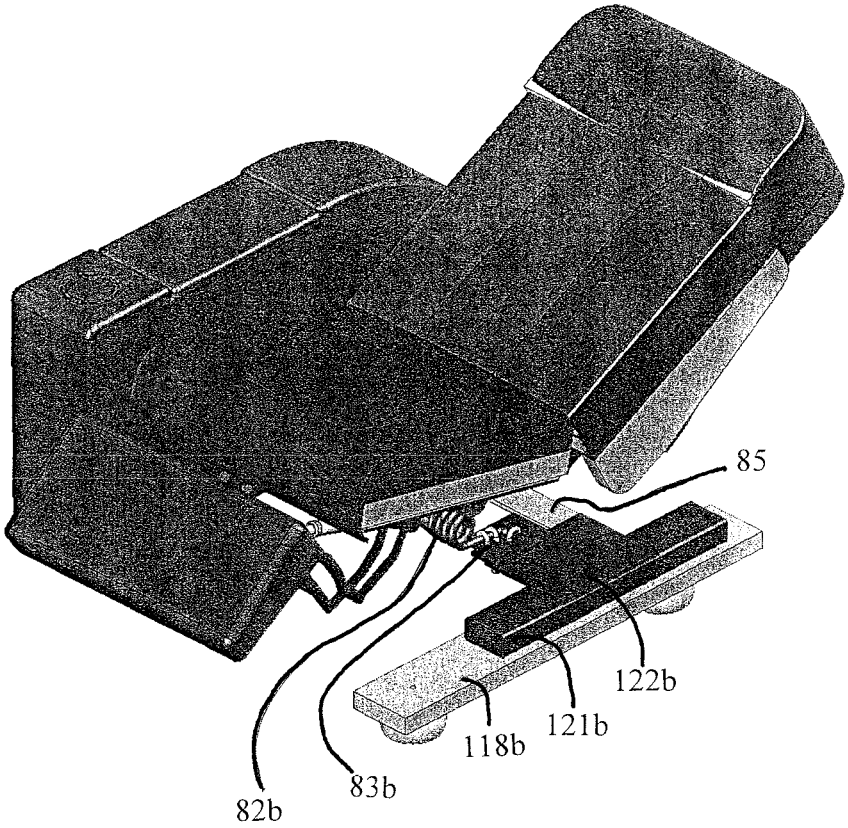
FIG. 37 is a perspective view of a partially disassembled chair. It shows the partially disassembled chair of FIG. 36 after components of one arm have been removed.
Figure 38:
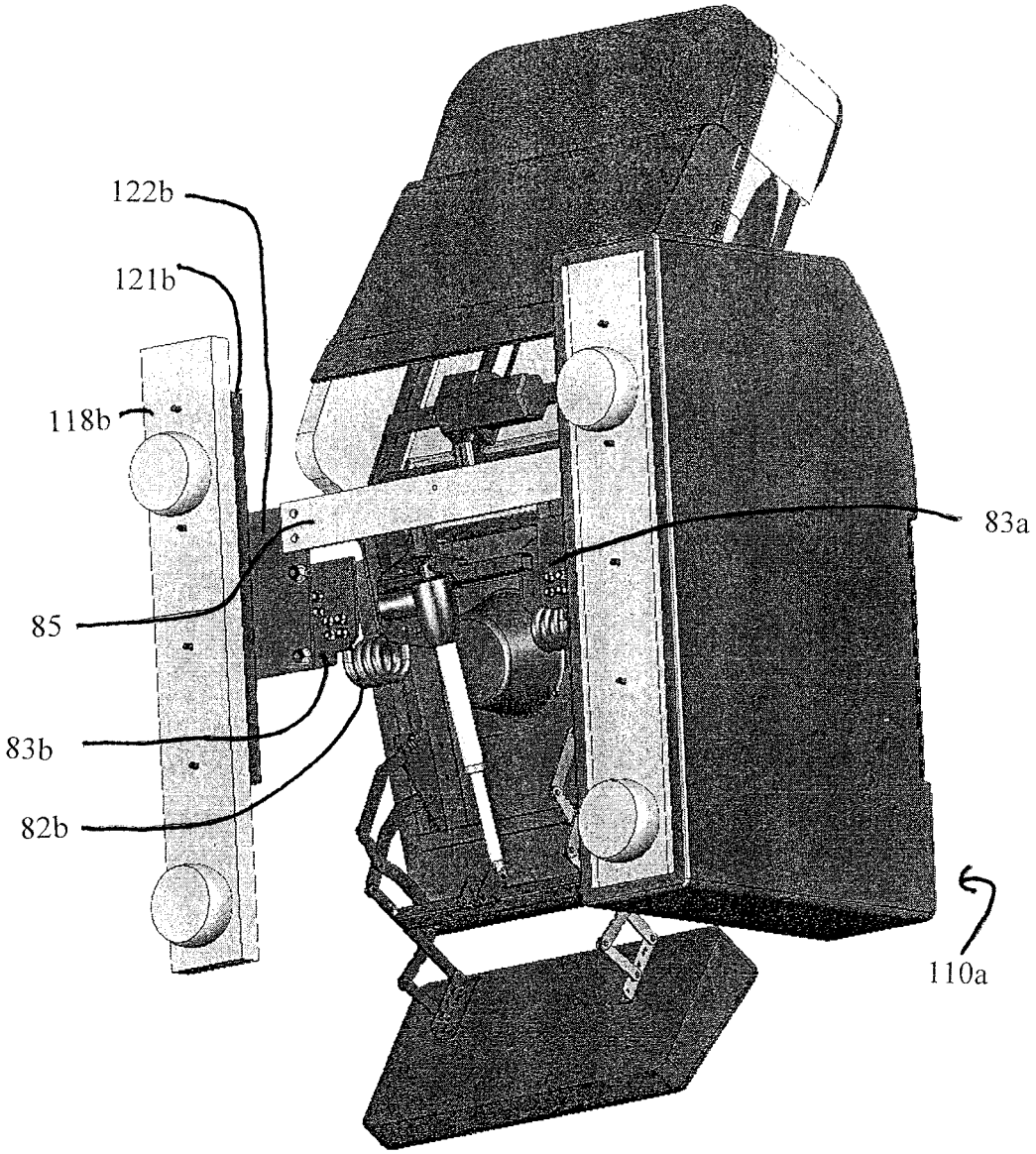
FIG. 38 is a bottom perspective view of the partially disassembled chair of FIG. 37, after the pin securing the linear actuator under the seat of the chair to the frame of the footrest has been removed.

Component 85 appears to be floating in FIG. 21 because component 85 is attached to the frames of the arms of the chair, which are not shown in FIG. 21. The manner in which component 85 is connected to the frames of the arms is shown in FIGS. 37 and 38.

Chair Assembly: Seat

As stated above, FIG. 9 shows the chair of FIG. 8 without the arms. The arms of the chair are not shown in FIG. 9 so that the view of the back 10 and the seat 70 of the chair is not obstructed.

Figure 22:
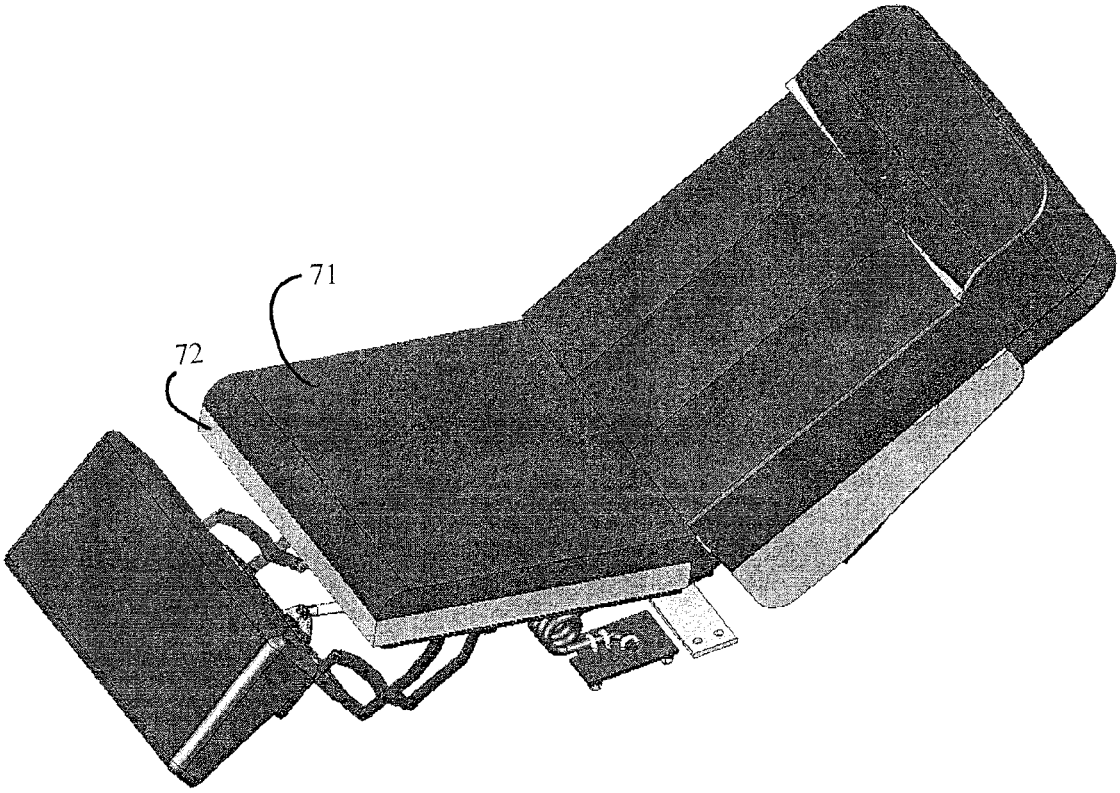
FIG. 22 is a perspective view of a partially disassembled chair. It shows the partially disassembled chair of FIG. 9 after the upholstery has been removed from the seat of the chair.

FIG. 22 shows the chair of FIG. 9 after the upholstery has been removed from the seat 70. The upholstery consists of a layer of leather over a layer of Dacron® material. A layer of foam 71 is located in the seat 70, underneath the upholstery. Layer 71 is a rectangular piece of flexible polyurethane foam that is approximately 2 inches thick. The foam of layer 71 is a high resiliency foam that has the following physical properties: a density of 2.3-2.5 lb/ft$^3$; an indent force deflection at 25% of 15-21; a compression set at 75% compression of 10%; a tensile strength of 10 psi; a tear strength of 1.0 pli (pounds per linear inch); and an elongation of 100%. The physical properties were measured in accordance with the test methods of ASTM D-3574-01. The foam also passes the flame resistance test of Cal 117.

Figure 23:
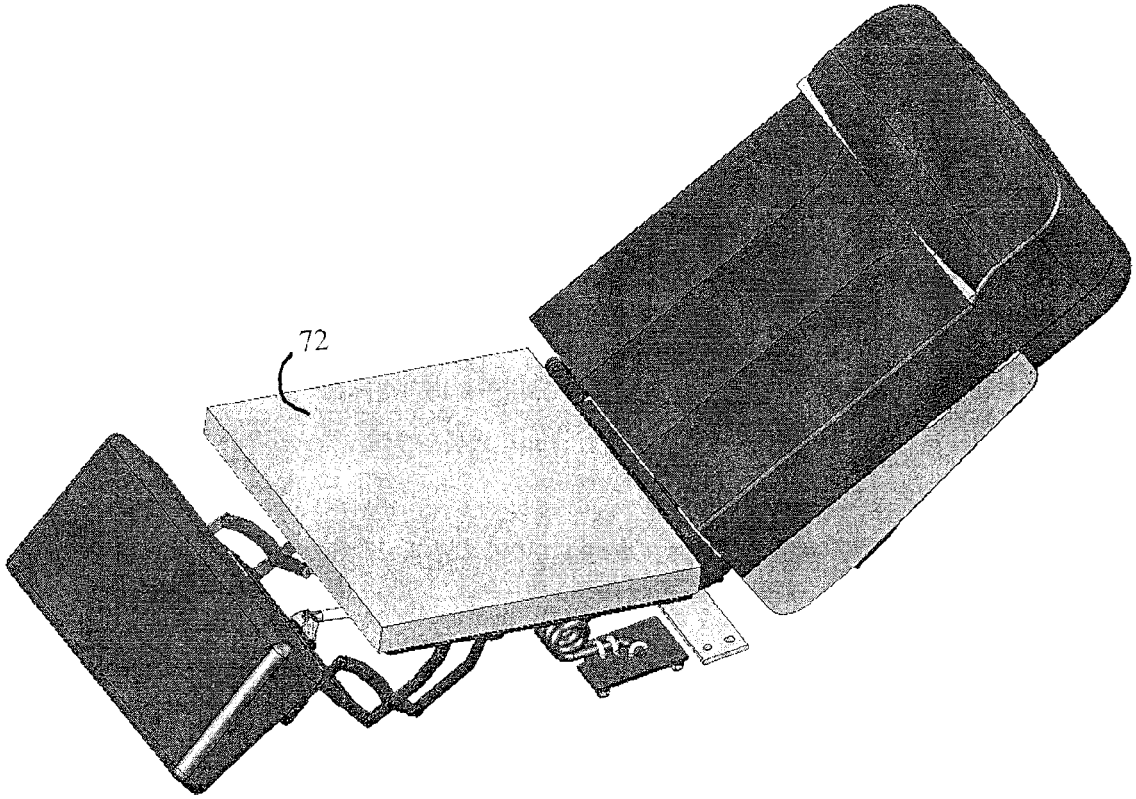
FIG. 23 is a perspective view of a partially disassembled chair. It shows the partially disassembled chair of FIG. 22 after a foam layer has been removed from the seat of the chair.

FIG. 23 is a view of the chair of FIG. 22 after foam layer 71 has been removed from the seat 70. Layer 72 is a rectangular piece of flexible polyurethane foam that is approximately 2 inches thick, which is located underneath foam layer 71. The foam of layer 72 is a high resiliency foam that has the following physical properties: a density of at least 2.85 lb/ft$^3$; an indent force deflection at 25% of 30-36; a compression set at 75% compression of 10%; a tensile strength of 10 psi; a tear strength of 1.0 pli (pounds per linear inch); and an elongation of 100%. The physical properties were measured in accordance with the test methods of ASTM D-3574-01. The foam also passes the flame resistance test of Cal 117.

Figure 24:
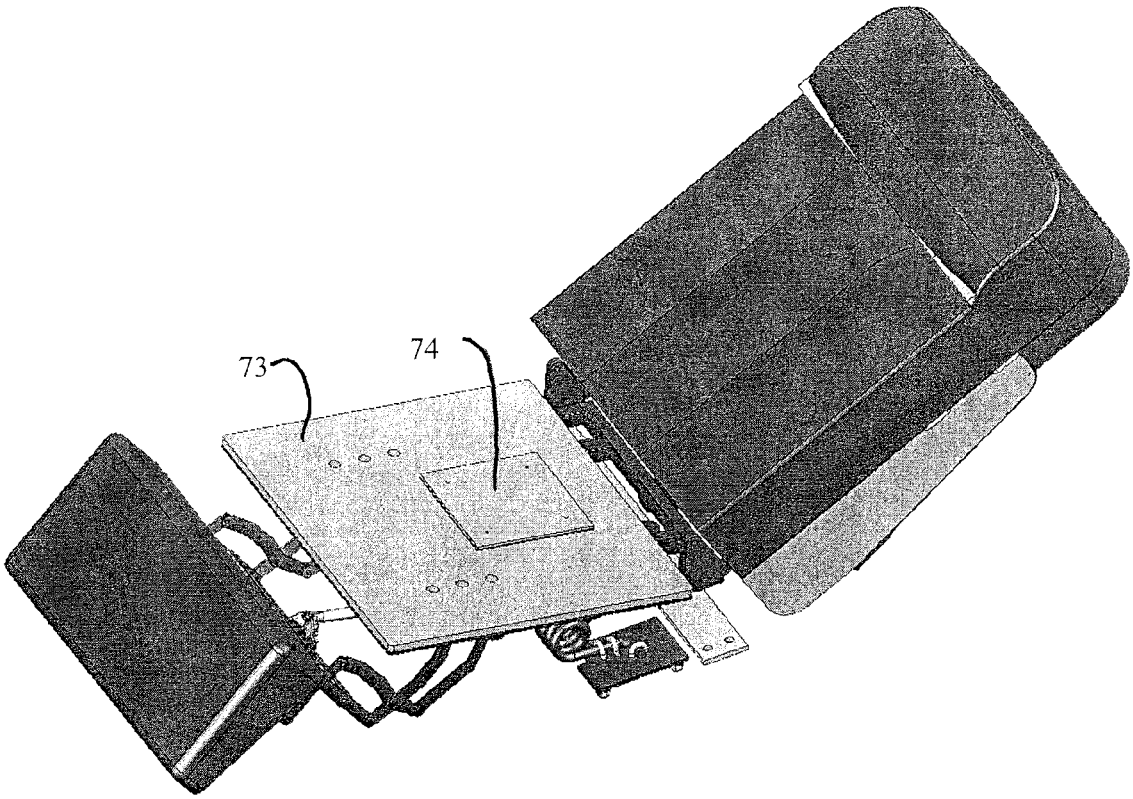
FIG. 24 is a perspective view of a partially disassembled chair. It shows the partially disassembled chair of FIG. 23 after a foam layer has been removed from the seat of the chair.

FIG. 24 is a view of the chair of FIG. 23 after foam layer 72 has been removed from the seat 70. A wooden board 73 is underneath foam layer 72. This board 73 is 22.5 inches long along the top edge (the edge nearest to the back 10) and the bottom edge (the edge nearest to the footrest). The board 73 is 20.5 inches long along both side edges, and is between about 0.5 and about 1.5 inches thick. A transducer mounting plate 74 is attached to the board 73. The transducer mounting plate 74 is a square piece of steel that measures 8 inches on each side and which is 0.187 inches thick.

Figure 25:
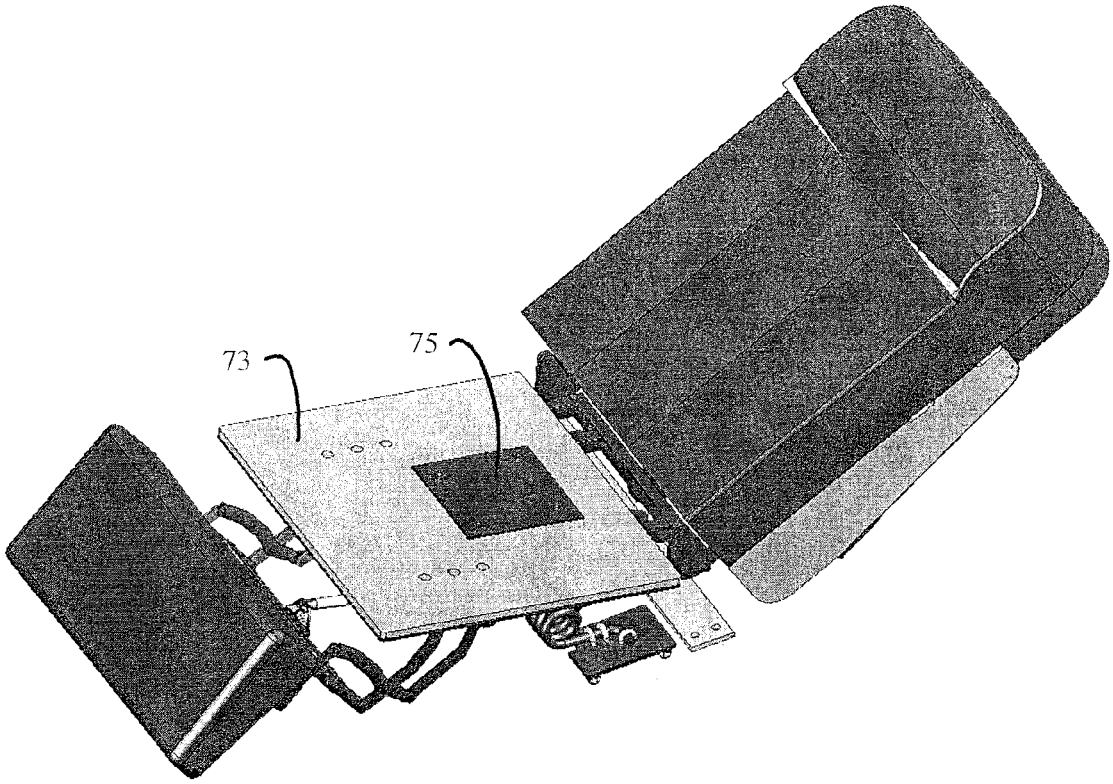
FIG. 25 is a perspective view of a partially disassembled chair. It shows the partially disassembled chair of FIG. 24 after the transducer mounting plate has been removed from the seat of the chair.

FIG. 25 is a view of the chair of FIG. 24 after the transducer mounting plate 74 has been removed. Layer 75 is a square piece of closed cell foam located underneath transducer mounting plate 74. Layer 75 measures 8 inches on each side and is 0.125 inches thick. There is one hole near each corner of the foam, in order to accommodate the four bolts that secure the transducer mounting plate 74 to the board 73. The foam of layer 75 is made from cross linked polyethylene foam and has the following physical properties: a density of 2.0 lb/ft$^3$; a compressive strength at 25% of 9 psi; a compression set of 15%; a tensile strength of 35 psi; a tear resistance of 8 lb/in; a water absorption of less than 0.04 lb/ft$^2$; a working temperature range of −70 to 175° F.; a thermal conductivity of 0.26 btu/hr/inch ft/° F.; and an elongation of 231%. The density and elongation were measure in accordance with ASTM D 3575-93; the compressive strength was measured in accordance with ASTM D 3575-93 Suffix D; the compression set was measured in accordance with ASTM D 3575-93 Suffix B; the tensile strength was measured in accordance with ASTM D 3575-93 Suffix T; the tear resistance was measured in accordance with ASTM D 3575-93 Suffix G; the water absorption was measured in accordance with ASTM D 3575-93 Suffix L; and the thermal conductivity was measured in accordance with ASTM C 177.

Figure 26:
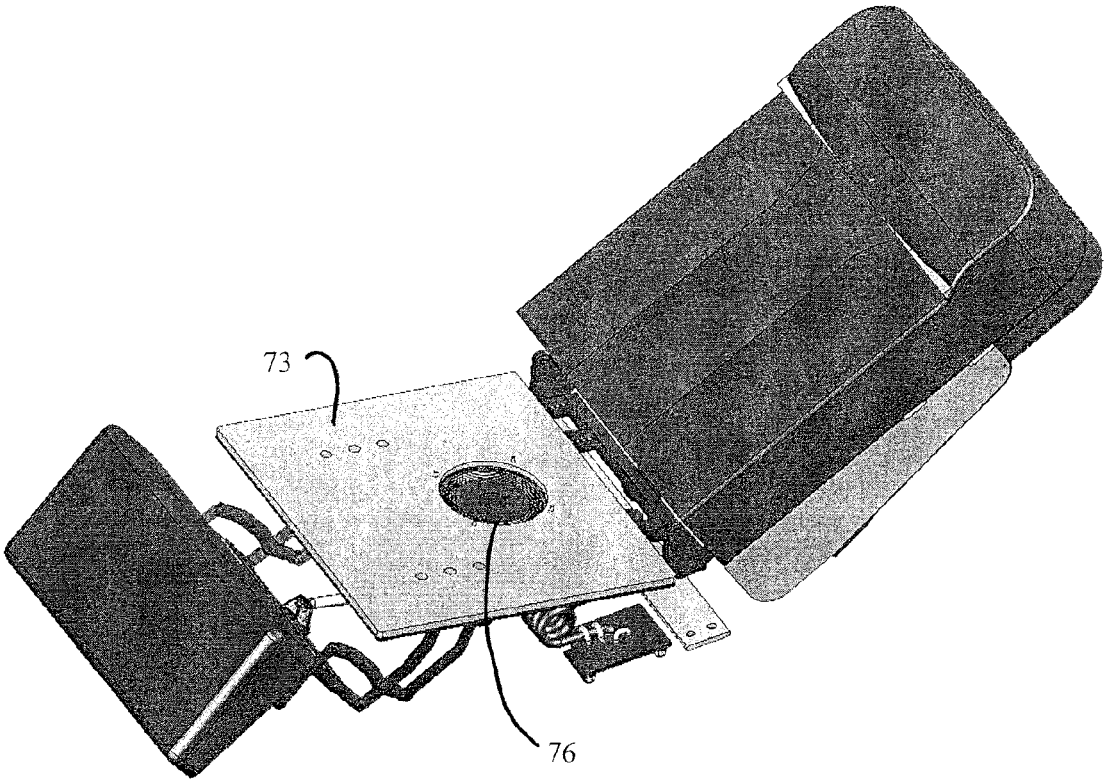
FIG. 26 is a perspective view of a partially disassembled chair. It shows the partially disassembled chair of FIG. 25 after a foam layer has been removed from the seat of the chair.

FIG. 26 is a view of the chair of FIG. 25 after layer 75 has been removed. Seat transducer 76 is located underneath foam layer 75. A cable connects the seat transducer 76 to the amplifier assembly.

Figure 27:
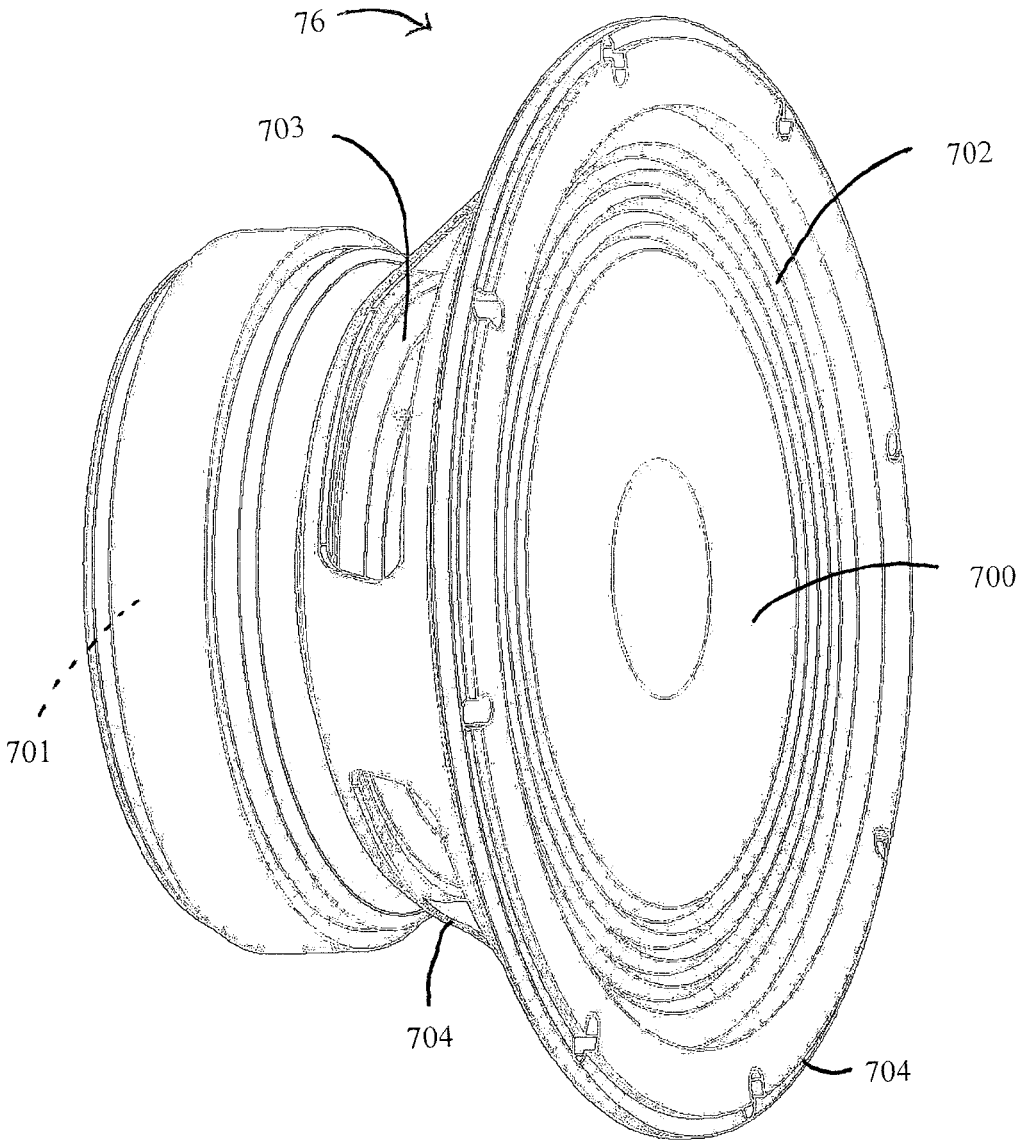
FIG. 27 is a perspective view of the seat transducer located in the chair of FIG. 8.

A view of seat transducer 76 is shown in FIG. 27. The transducer 76 is approximately 8 inches in diameter. It does not include a speaker cone. Instead of a cone, the transducer includes an aluminum mass 700, which moves when the transducer is operating. The aluminum mass is attached the voice coil 701 of the transducer using a double spider suspension. The transducer includes an upper spider 702 and a lower spider 703. The spider suspension is made from a cloth that has been stiffened with epoxy. The transducer also includes a frame 704. The RMS power of the transducer is 250 watts, and the peak to peak power of the transducer is 350 watts.

The primary purpose of the transducer is to generate vibrations in the chair, rather than to generate sound. However, some sound is emitted by the transducer. The transducer is capable of producing frequencies from approximately 0.5 Hz to approximately 1,000 Hz, and has a crossover frequency of 14 Hz to 75 Hz. At approximately 75 Hz, the frequency starts to roll off (i.e. begins to attenuate). Sound at a frequency at or above approximately 500 Hz is filtered out.

Figure 28:
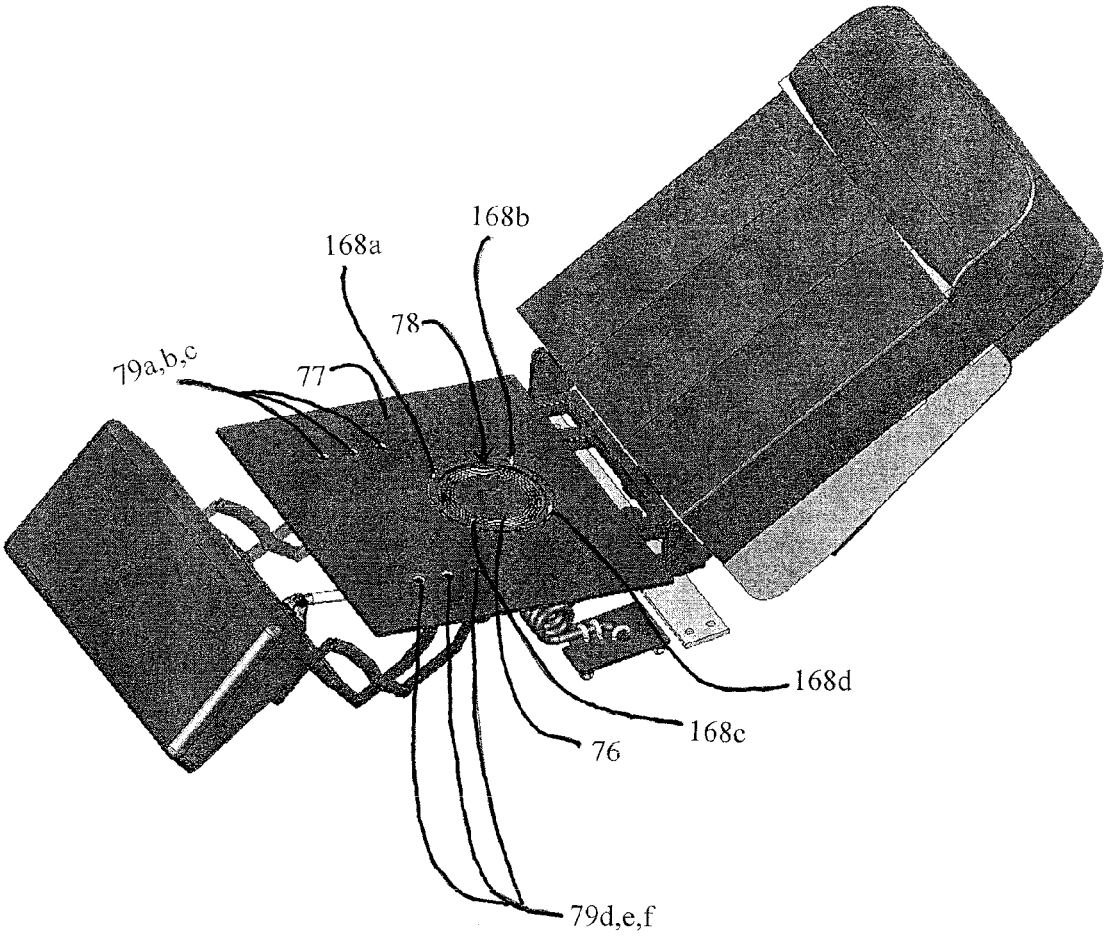
FIG. 28 is a perspective view of a partially disassembled chair. It shows the partially disassembled chair of FIG. 26 after the wooden base has been removed from the seat of the chair.
Figure 29:
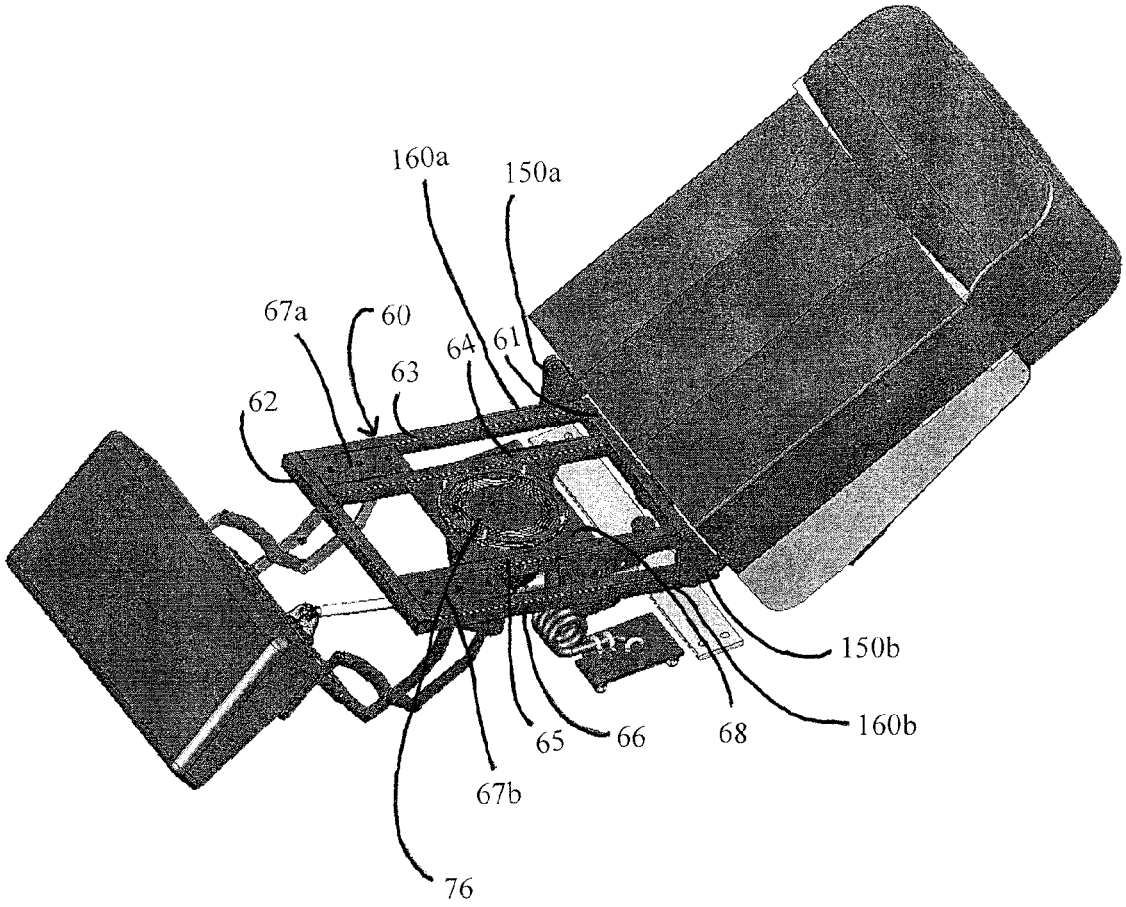
FIG. 29 is a perspective view of a partially disassembled chair. It shows the partially disassembled chair of FIG. 28 after a foam layer has been removed from the seat of the chair.

FIG. 28 is a view of the chair of FIG. 26 after the wooden board 73 has been removed. Layer 77 is a foam layer located between the wooden board 73 and the seat is frame 60, which is shown in FIG. 29. Layer 77 is a rectangular piece of dense foam that is 0.25 inches thick. It includes one large hole 78 to accommodate the seat transducer 76. It also includes six smaller holes 79*a, b, c, d, e*, and *f* (three holes on each side of layer 77) to accommodate the six threaded fasteners that secure the wooden board 73 to the seat frame 60. The wooden board 73 is not bolted down to the seat frame 60. In other words, the threaded fasteners do not prevent the wooden board 73 from moving up and down. However, the threaded fasteners do prevent the wooden board from sliding forward (i.e. away from the back of the chair).

The foam of layer 77 is made from cross linked polyethylene foam and has the following physical properties: a density of 2.0 lb/ft$^3$; a compressive strength at 25% of 9 psi; a compression set of 15%; a tensile strength of 35 psi; a tear resistance of 8 lb/in; a water absorption of less than 0.04 lb/ft$^2$; a working temperature range of −70 to 175° F.; a thermal conductivity of 0.26 btu/hr/inch ft/° F.; and an elongation of 231%. The density and elongation were measure in accordance with ASTM D 3575-93; the compressive strength was measured in accordance with ASTM D 3575-93 Suffix D; the compression set was measured in accordance with ASTM D 3575-93 Suffix B; the tensile strength was measured in accordance with ASTM D 3575-93 Suffix T; the tear resistance was measured in accordance with ASTM D 3575-93 Suffix G; the water absorption was measured in accordance with ASTM D 3575-93 Suffix L; and the thermal conductivity was measured in accordance with ASTM C 177.

FIG. 29 is a view of the chair of FIG. 28 after the layer 77 has been removed. Frame 60 of the seat 70 of the chair is made from steel. The frame 60 consists of two parallel bars 61 and 62 which are braced by five bars that are perpendicular to bars 61 and 62. These four bars, which are bars 63, 64, 65, and 66, are parallel to each other. Linear actuator 56 acts to recline the back 10 of the chair. As can be seen more clearly in FIG. 21, linear actuator 56 is pivotally connected to bar 53 of the frame 50 of the back by actuator support 57. At the other end, linear actuator 56 is pivotally connected to the frame of the seat of the chair by actuator support 58, which connects the linear actuator 56 to bar 61 of the frame. Bar 61 is parallel to bars 51, 52, 53, 54, and 55. Rectangular mounting plate 67*a* is connected to bars 62, 63, and 64, while rectangular mounting plate 67*b* is connected to bars 62, 65, and 66. Mounting plates 67*a* and 67*b* each include three holes. Threaded fasteners which secure the frame 60 to the wooden board 73 fit through these holes. As stated above, the wooden board 73 is not bolted down to the seat frame 60. In other words, the threaded fasteners do not prevent the wooden board 73 from moving up and down. However, the threaded fasteners do prevent the wooden board from sliding forward (i.e. away from the back of the chair).

Flange 68 surrounds seat transducer 76. Four bolts 168*a*, 168*b*, 168*c*, and 168*d*, as labeled in FIG. 28, pass through flange 68. These bolts also pass through foam layer 77, shown in FIG. 28, wooden board 73, shown in FIG. 26, foam layer 75, shown in FIG. 25, and transducer mounting plate 74, shown in FIG. 24. Bolts 168*a*, 168*b*, 168*c*, and 168*d* secure the seat transducer 76 to the transducer mounting plate 74.

FIG. 29 also shows mounts 160*a* and 160*b*, which are secured to bars 63 and 66, respectively, of the seat frame 60. Mounts 160*a* and 160*b* are also secured to mounts 150*a* and 150*b*, respectively, of the back frame 50. Therefore, back frame 50 and seat frame 60 are connected via mounts 150*a* and 150*b* and mounts 160*a* and 160*b*.

Figure 30:
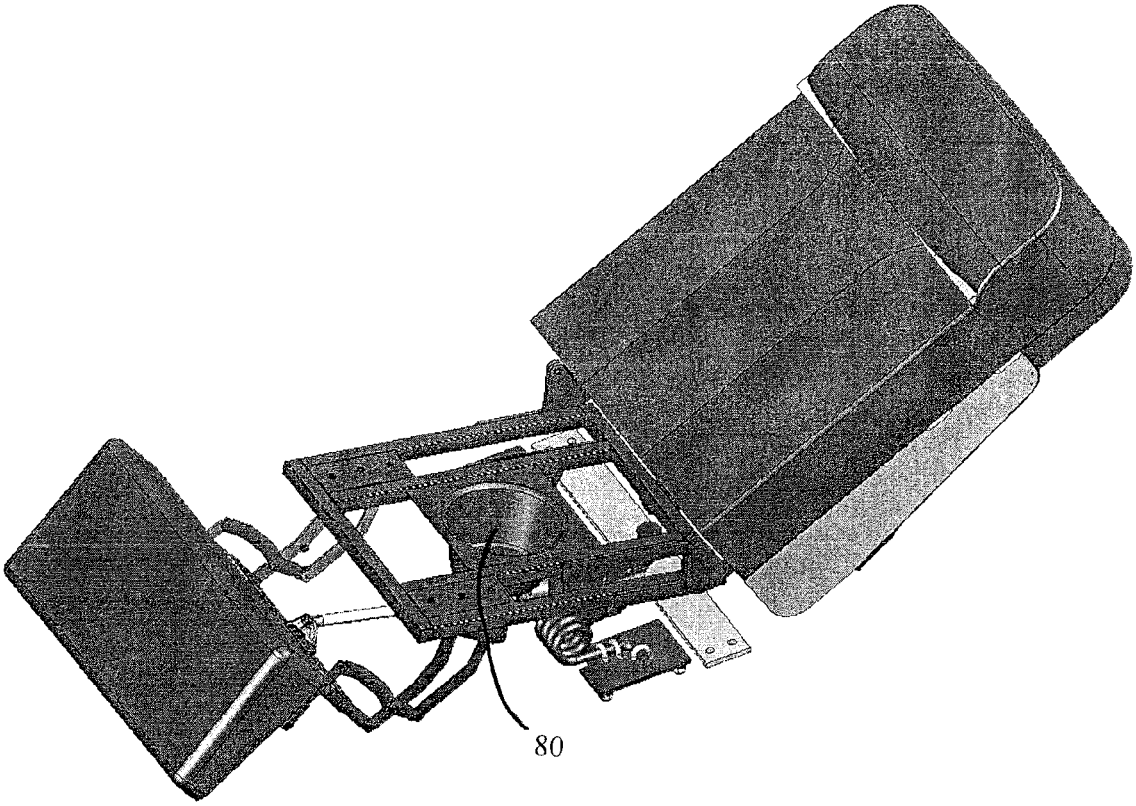
FIG. 30 is a perspective view of a partially disassembled chair. It shows the partially disassembled chair of FIG. 29 after the seat transducer has been removed.

FIG. 30 is a view of the chair of FIG. 29 after the seat transducer 76 and the bolts 168*a*, 168*b*, 168*c*, and 168*d* have been removed. Housing 80 is located underneath the seat transducer 76. This housing can be made from a foam material.

Figure 31:
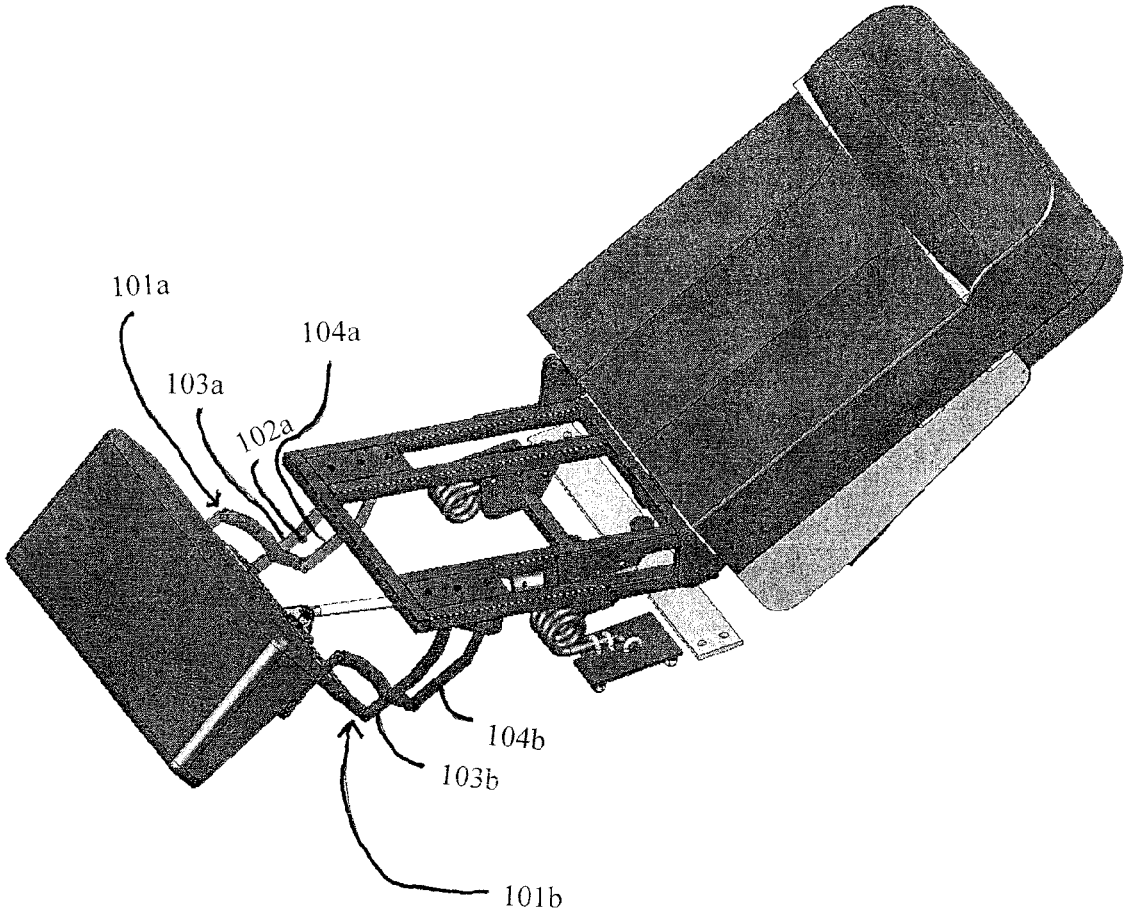
FIG. 31 is a perspective view of a partially disassembled chair. It shows the partially disassembled chair of FIG. 30 after the seat transducer housing has been removed.

FIG. 31 is a view of the chair of FIG. 30 after housing 80 has been removed. Footrest extension assemblies 101*a* and 101*b* include the components that allow the footrest 90 to extend outward from the seat 70. A cylindrical stop 102*a* is located on component 103*a* of the footrest extension assembly 101*a*. Component 104*a* rests against this stop 102*a* when the footrest is fully extended. A cylindrical stop 102*b* is also located on component 103*b*. However, stop 102*b* is not visible in FIG. 31. Component 104*b* rests against stop 102*b* when the footrest is fully extended.

Figure 32:
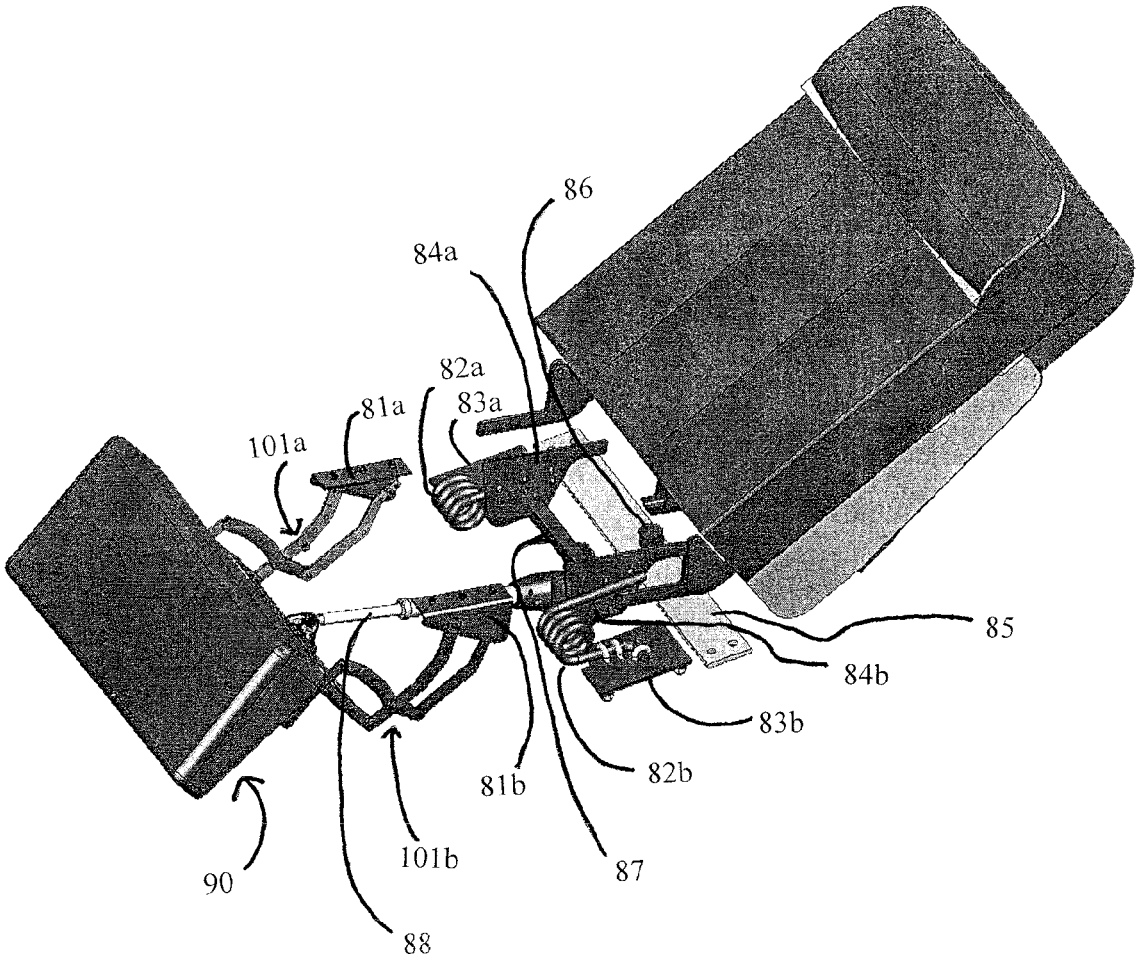
FIG. 32 is a perspective view of a partially disassembled chair. It shows the partially disassembled chair of FIG. 31 after components of the seat frame have been removed.

FIG. 32 is a view of the chair of FIG. 31 after bars 61, 62, 63, 64, 65, and 66, as well as mounting plates 67*a* and 67*b*, have been removed. Mounts 81*a* and 81*b* are located underneath, and are bolted to, mounting plates 67*a* and 67*b*, respectively. Mounts 81*a* and 81*b* are also attached to the footrest extension assemblies 101*a* and 101*b*, which are attached to the footrest 90. Therefore, mounts 81*a* and 81*b* connect the seat frame 60 to the footrest 90.

The chair pivots on springs 82*a* and 82*b*. Spring 82*a* is attached to mount 83*a* and mount 84*a*, while spring 82*b* is attached to mount 83*b* and mount 84*b*. Bar 87 connects mount 84*a* to mount 84*b*. Linear actuator 88 is pivotally connected to bar 87. At its other end, linear actuator 88 is pivotally connected to the frame of the footrest 90. This linear actuator 88 allows the footrest to be extended. Linear actuator 88 includes the footrest motor 205 shown in the schematic wiring diagram of FIG. 2.

Component 85 includes a cylindrical stopper 86. The back of the chair rests against this stopper 86 if the weight on the back of the chair compresses the springs to the maximum degree allowable.

Chair Assembly: Footrest

Figure 33:
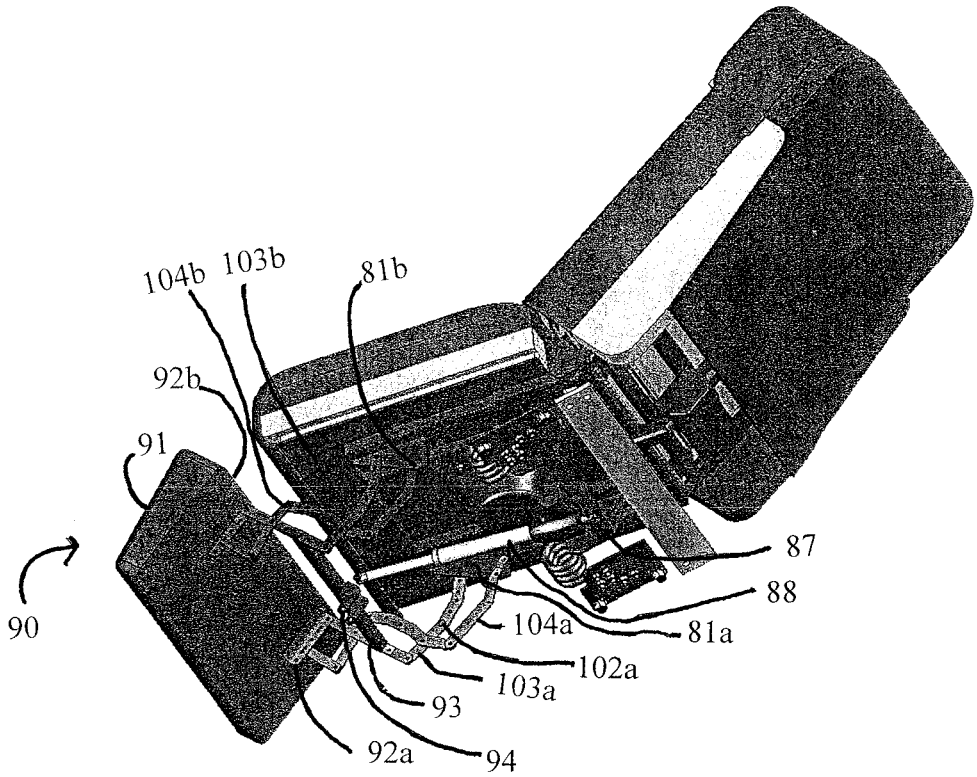
FIG. 33 is a bottom perspective view of the partially disassembled chair of FIG. 9, after the pin securing the linear actuator under the seat of the chair to the frame of the footrest has been removed.

FIG. 33 shows a view of the chair of FIG. 9, after the pin securing linear actuator 88 to actuator support 94 of the frame of the footrest has been removed. As was the case with the chair of FIG. 9, the arms have been removed from the chair of FIG. 33. Footrest 90 includes the footrest pad 91. Pad 91 consists of foam placed on top of a wooden board. The foam and wooden board are covered with leather upholstery. Pad mounts 92*a* and 92*b* are bolted to the wooden board of footrest pad 91. Pad mount 92*a* is bolted to components 103*a* and 104*a* of the footrest extension assembly 101*a*. Pad mount 92*b* is bolted to components 103*b* and 104*b* of the footrest extension assembly 101*b*. A bar 93 is connected to, and extends between, component 103*a* and component 103*b*. Actuator support 94 is secured to bar 93. This actuator support 94 is connected to linear actuator 88. At its other end, linear actuator 88 is connected to bar 87 of the seat frame 60. Therefore, linear actuator 88 extends between bar 93 and the seat frame 60. This linear actuator 88 allows the footrest 90 to be extended from the seat 70 of the chair.

Chair Assembly: Arms

Figure 34:
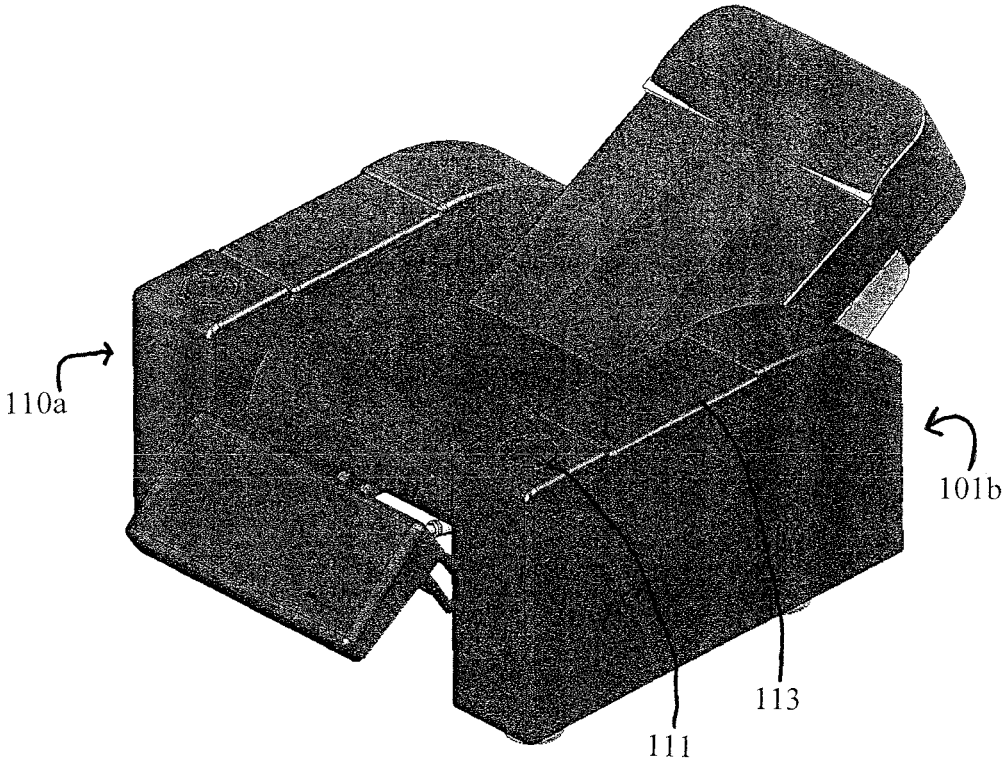
FIG. 34 is a perspective view of the chair of FIG. 8.

FIG. 34 shows a view of the chair of FIG. 8, which is a chair made in accordance with the present invention. The arms 110*a* and 110*b* of the chair are included in this figure. Each arm of the chair includes a cup holder 111 and a console lid 113. The upholstery of the arms consists of a layer of Dacron® material covered with leather.

Figure 35:
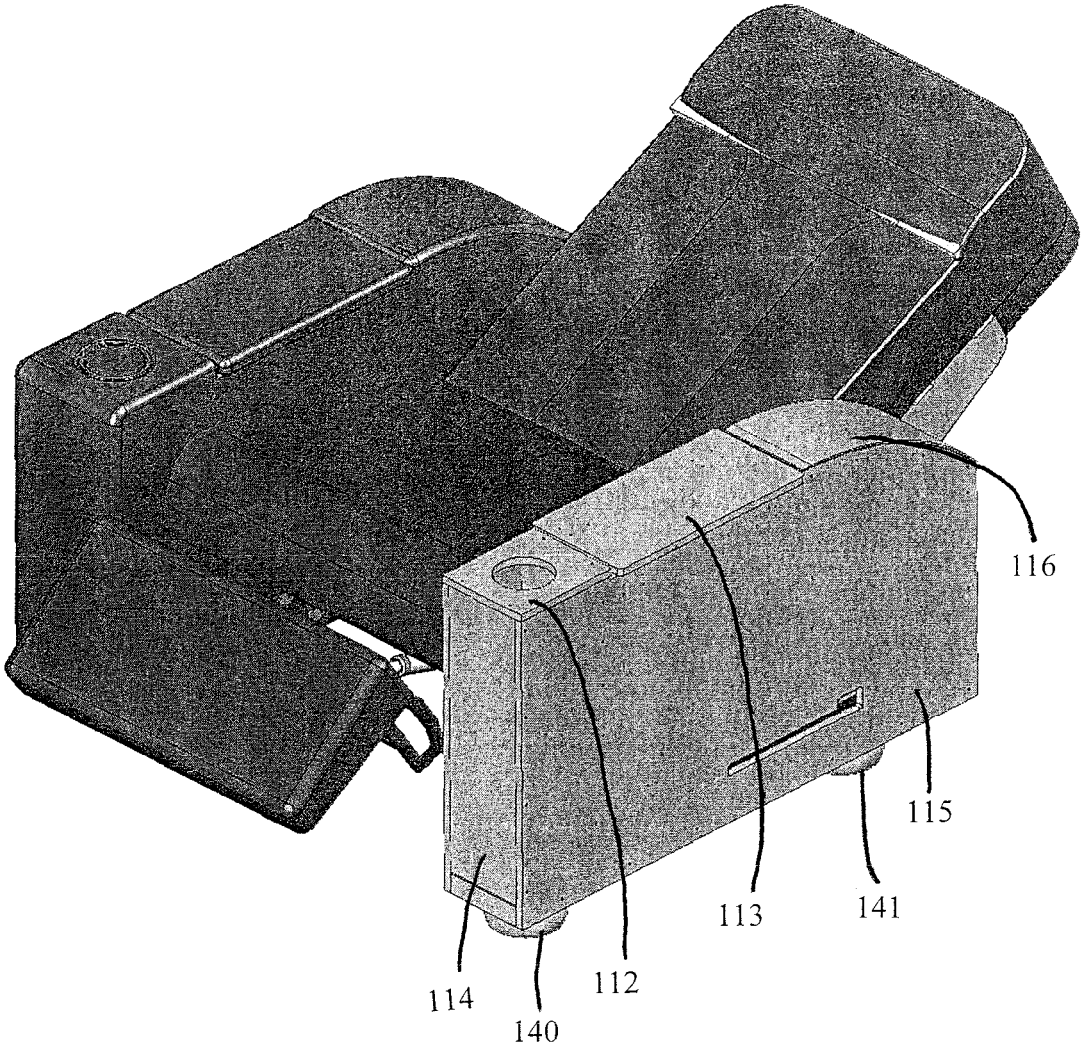
FIG. 35 is a perspective view of a partially disassembled chair. It shows the chair of FIG. 34 after the cup holder and upholstery have been removed from one arm of the chair.

FIG. 35 shows the chair of FIG. 34 after the cup holder 111 and the upholstery have been removed from one arm 110*b* of the chair. Components 112, 113, 114, and 115 are made from wood, while component 116 is made from upholsterer's cardboard. Component 112 includes a circular hole which can receive the cup holder 111. Circular feet 140 and 141 are located underneath the arm of the chair. The entire chair rests on feet 140 and 141 and on the feet of the other arm of the chair.

Figure 36:
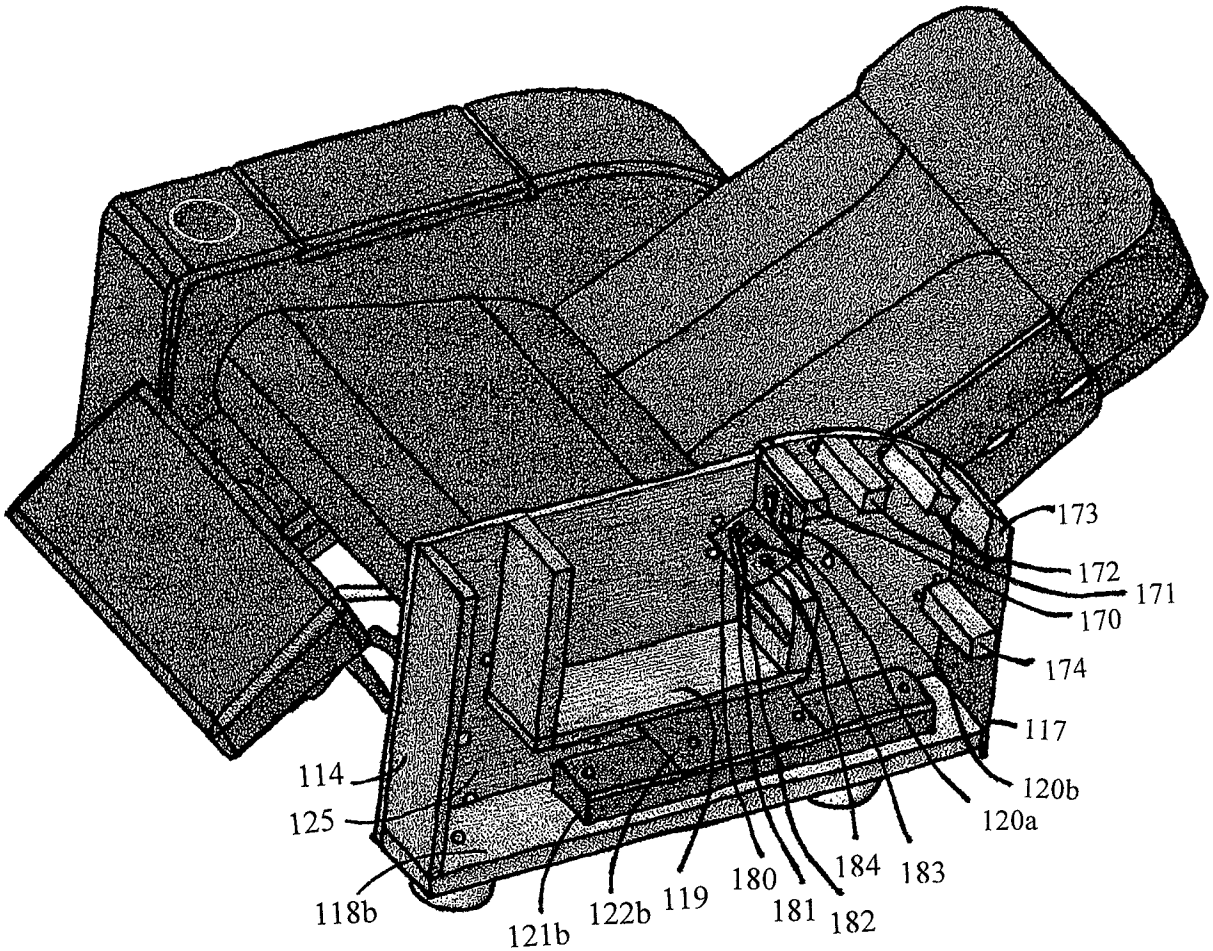
FIG. 36 is a perspective view of a partially disassembled chair. It shows the partially disassembled chair of FIG. 35 after components of one arm have been removed.

FIG. 36 shows the chair of FIG. 35 after the console lid 113, the hinges of the console lid, component 112, and the side 115 of the arm 110*b* have been removed. The back 117, the base 118, the inner wall 125 of the arm, and support 174 are made from wood. Components 170, 171, 172, and 173 are wooden supports over which the upholsterer's cardboard 116 is stretched in the finished chair. Component 119 is the console interior, which is made from wood. Rocker switches 120*a* and 120*b* are included in the console. One rocker switch causes the chair to recline, while the other rocker switch operates the footrest.

The console shown in FIG. 36 also includes connections to entertainment systems, in plate 180. Connections 181 and 182 are RCA jacks, connection 183 is a USB port, and connection 184 is a headphone jack. Other connections, such as a telephone jack or an iPod cradle, may also be included in the console. A console cable is connected to the amplifier assembly. The connection between the console and the amplifier assembly conveys signals from components of the console. For example, the connection may convey signals from the recline and leg rest switches, the USB port, the auxiliary stereo input, and the headphone jack that may be located in the console.

The chair could be made with a console in either one or both arms.

Metal support 121*b* is bolted to the base 118*b*. Metal support 122*b*, which connects the arm of the chair to the seat frame 60, is welded to support 121*b*.

FIG. 37 shows the chair of FIG. 36 after the front 114 of the arm, the back 117 of the arm, the inner wall 125, the console interior 119, the components located within the console interior, and components 170, 171, 172, 173, and 174 have been removed. Therefore, the manner in which the arm 110*b* is connected to the seat frame 60 can be seen in FIG. 37. Metal support 121*b* is bolted to wooden base 118*b* of the arm, and metal support 122*b* is welded to support 121*b*. Mount 83*b*, to which spring 82*b* is attached, is bolted to the top side of support 122*b*. Component 85 of the seat frame 60 is bolted to the bottom side of support 122*b*. The connections between the arm 110*b* and the seat frame 60 can also be seen in FIG. 38, which is another view of the chair of FIG. 37 after the pin securing linear actuator 88 to actuator support 94 of the frame of the footrest has been removed.

Except for components in the interior of the console, arm 110*a* is the mirror image of arm 110*b*. Arm 110*a* is connected to the seat frame 60 in the same manner that arm 110*b* is connected to the seat frame. Specifically, metal support 122*a* of arm 110*a* is welded to metal support 121*a* of arm 110*a*, which is bolted to wooden base 118*a* of arm 110*a*. Mount 83*a*, which is shown in FIGS. 38 and 32, is bolted to the top side of support 122*a*. Component 85 of the seat frame 60 is bolted to the bottom side of support 122*a*.

In an alternative embodiment, an arm speaker may be located within the console of one or both of the arms of the chair. Arm speakers may be used instead of, or in addition to, external speakers. In one embodiment, an arm speaker is attached to the underside of a hinged door located at the front end of the top of the arm. This hinged door is located where the cup holder 111 was located in the embodiment shown in FIG. 34. When the hinged door is closed, the speaker is housed inside the arm and cannot be seen. The top of the hinged door is upholstered with foam and covering materials such as leather. Therefore, when arm speakers are incorporated into the chair, the look of fine furniture is preserved.

When the hinged door is opened, the speaker is exposed. This speaker faces the user. The arm speakers may be configured to allow a user to change the position of the speakers, so that the position of the arm speakers may be changed based on the user's position. In one embodiment, two pairs of magnets embedded in the side walls of the arms maintain each arm speaker in one of two open positions: fully open, which is a convenient position for each arm speaker when a user is seated upright, and partially open, which is a convenient position for each arm speaker when a user is reclined. Because the arm speakers are positioned in such a way that the sound from these speakers is projected directly to the user's ears, the arm speakers facilitate the projection of sound to the user, while minimizing sound spread.

For example, the arm speakers can be used when a user is watching a movie, with the center and front channels of the sound of the movie playing through the arm speakers. When the arm speakers are used in this way, the sound from the arm speakers is located in front of the user, but the sound is still personalized due to the proximity of the speakers and the directionality of the sound projection.

When the arm speakers are not in use, they can be hidden by simply closing the hinged door, thereby preserving the look of fine furniture. When the hinged door is open and the arm speakers are in use, the sound from the arm speakers is unobstructed. Acoustically transparent foam may be placed in front of the speakers. Sound from the arm speakers is able to pass through acoustically transparent foam without being obstructed. It is preferred that if a material is placed in front of the arm speakers, it is a material such as an acoustically transparent foam, so that the sound from the arm speakers remains unobstructed.

When the arm speakers are used for movies in, for example, Dolby 5.1 mode, more center channel content may be directed to the arm speakers than to the head speakers. In one embodiment, when more center channel content is directed to the arm speakers than to the head speakers, the master volume setting and SoundNumber™ system automatically use the arm speakers as the reference speakers for volume level calculations, rather than the head speakers. All other speakers (i.e. the speakers that are not in the arms of the chair) are then volume adjusted based upon the user-defined percent setting used in the calculation. For example, if the lower spine speaker setting is 200%, then the volume of the lower spine speaker will be twice that of the arm speakers.

When more central channel content is directed to the head speakers than to the arm speakers, then the head speakers are used as the reference speakers for volume level calculations. In stereo mode, it is preferred that the head speakers be used as the reference speakers, since the head speakers are closer to the user's ears than the arm speakers.

Seating Configuration Containing Multiple Seats

Figure 39:
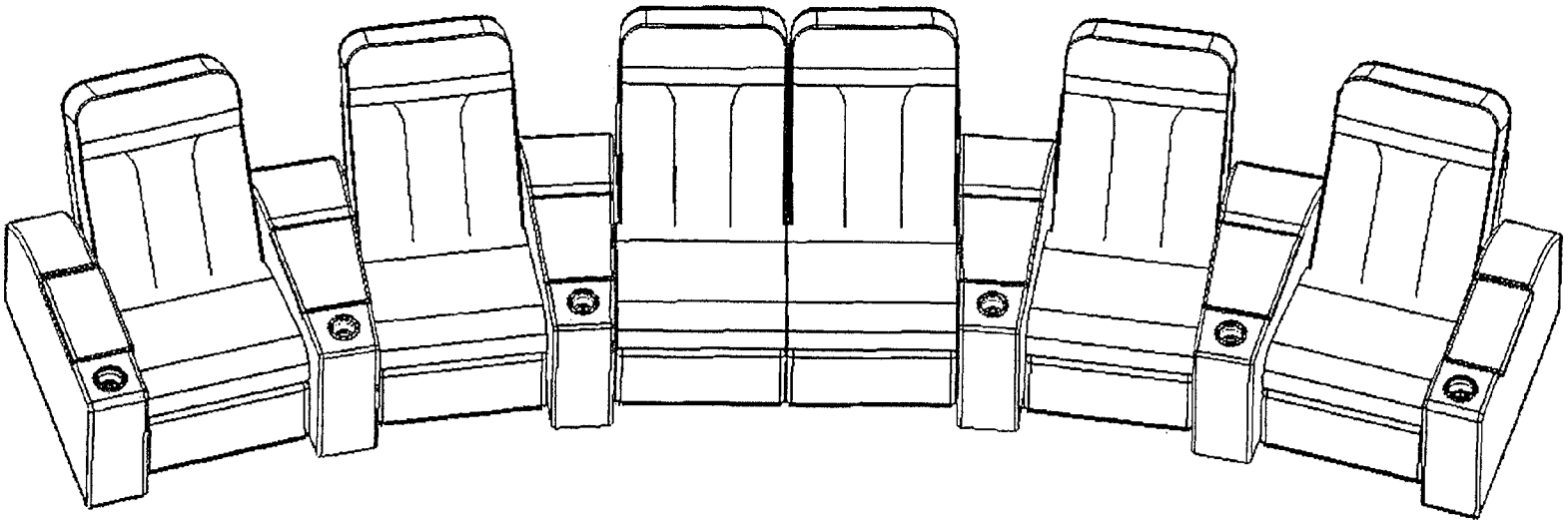
FIG. 39 is a top perspective view of a seating configuration with multiple seats made in accordance with the present invention.
Figure 40:
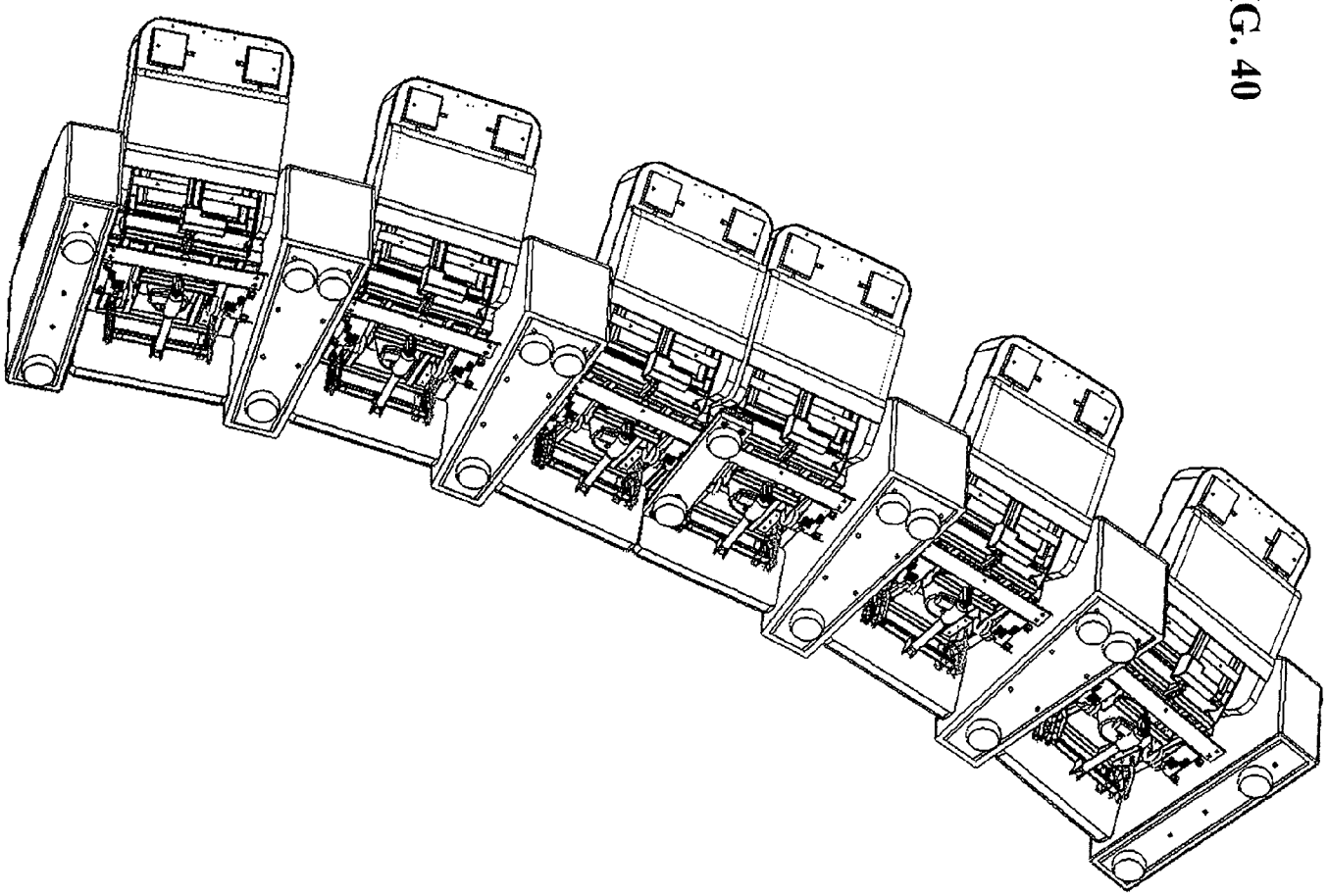
FIG. 40 is a bottom perspective view of the seating configuration shown in FIG. 39.

A seating configuration can contain multiple seats. An example of a seating configuration with multiple seats is shown in FIG. 39. FIG. 40 shows a bottom perspective view of this seating configuration. As stated above, and as depicted in the diagram of FIG. 3, amplifiers on nearby seats are cabled in a daisy chain format connected by up to three cables (optical, Cat5, and RS485). One of the seat amplifiers can be cabled to a transmission unit (BodyLink™ receiver, typically positioned with the user's other audio equipment—DVD, CD, AV Surround receiver, TV, etc.) by Cat5 cable to receive audio signals. The BodyLink™ receiver is also equipped with a wireless transmitter used to transmit audio signals to the amplifier. A diagram of the electronics of chairs linked to a BodyLink™ receiver is shown in FIG. 4.

In one embodiment of a seating configuration containing multiple seats, one seat of the seating configuration is identified as the lead seat. This seat is typically located at one end of the configuration. The lead seat is capable of receiving signals from the BodyLink™ receiver in both a wired and wireless format. Audio signals from the lead seat are transmitted to the adjacent seat and down the row of seats via the cables connecting the amplifiers.

Figure 41:
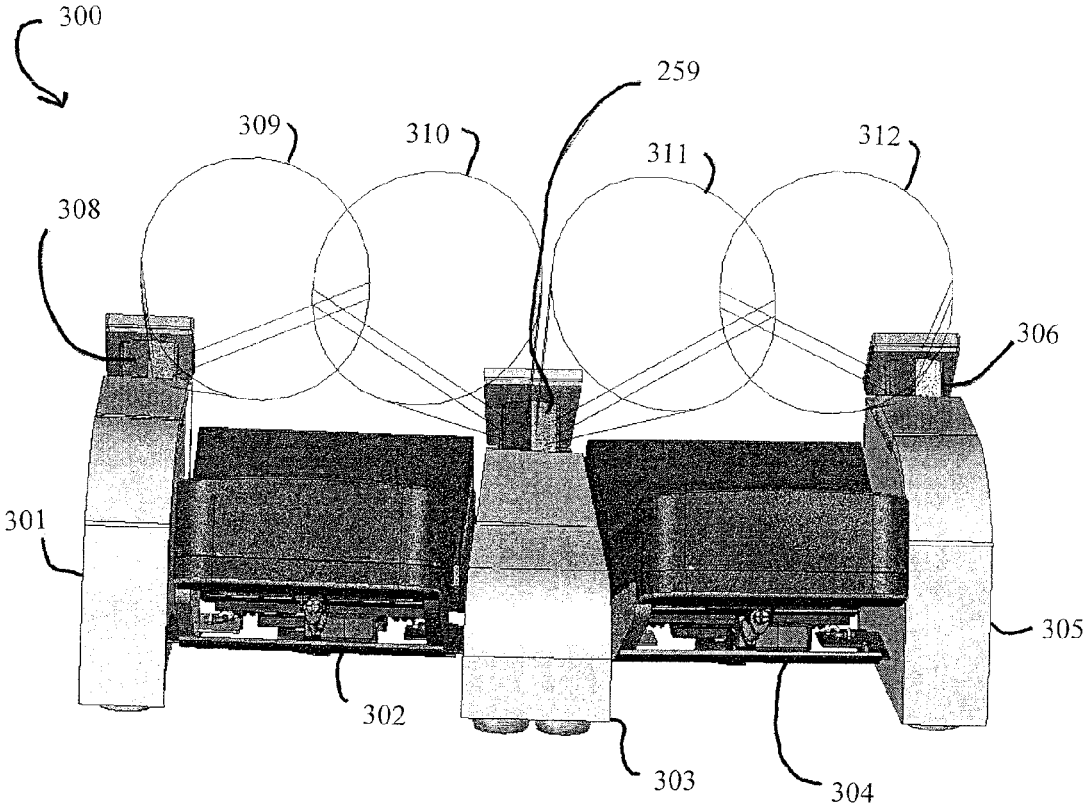
FIG. 41 is a back perspective view of a seating configuration with two seats made in accordance with the present invention.

A seating configuration containing multiple seats may include arm speakers. A back perspective view of a seating configuration 300 including two seats 302 and 304 and arm speakers is shown in. FIG. 41. The cone 309 represents the projection of sound from the arm speaker located in arm 301; cones 310 and 311 represent the projection of sound from the two arm speakers located in arm 303; and cone 312 represents the projection of sound from the arm speaker located in arm 305.

Figure 42:
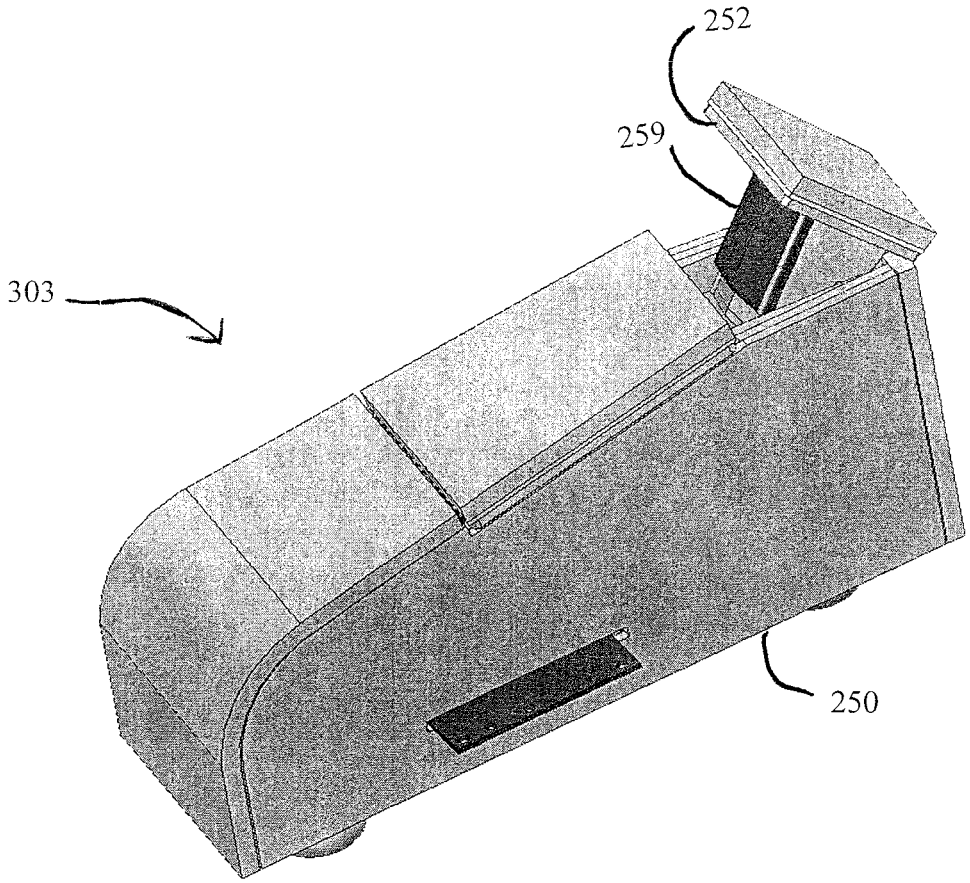
FIG. 42 is a side perspective view of a chair arm of the seating configuration of FIG. 41, after the leather layer of the upholstery has been removed.
Figure 43:
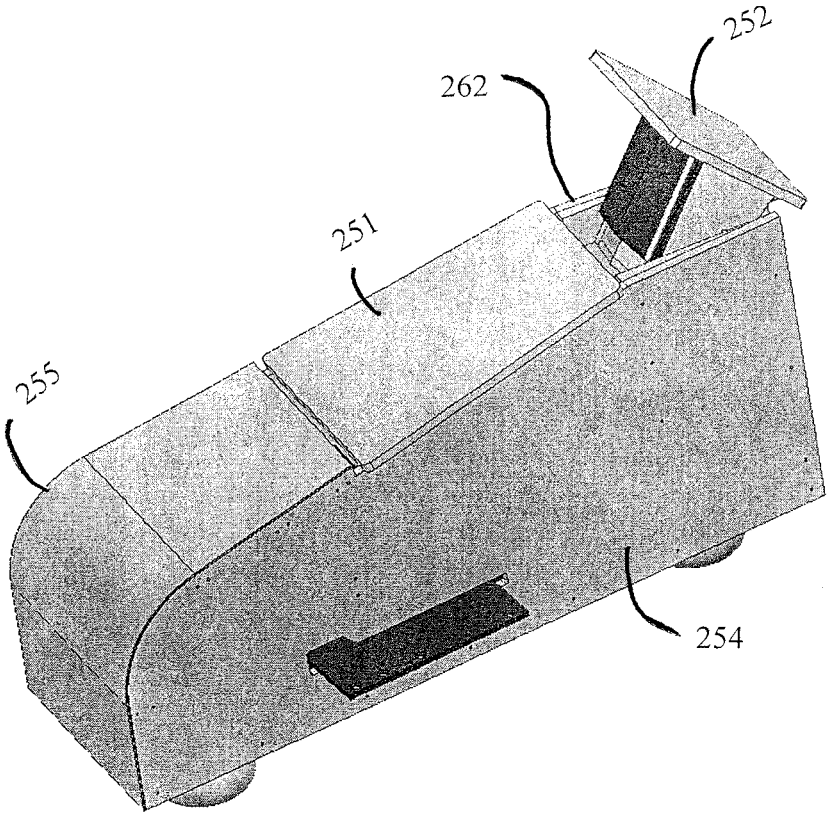
FIG. 43 is a side perspective view of the partially disassembled arm of FIG. 42, after the foam layers of the upholstery have been removed.
Figure 44:
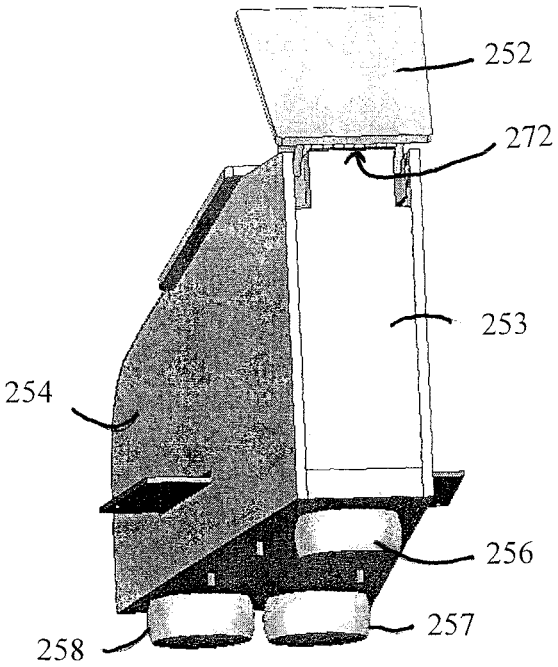
FIG. 44 is a front perspective view of the partially disassembled arm FIG. 43.

A side perspective view of one embodiment of an arm 303 located between two seats in a multiple seating configuration, after the leather layer of the upholstery has been removed, is shown in FIG. 42. FIG. 43 shows the arm of FIG. 42 after the foam layers of the upholstery have been removed. The arm 303 includes a console lid 251 and a hinged door 252, which are made from wood. Component 255 is upholsterer's cardboard which covers the back of the arm 303. A front perspective view of the arm of FIG. 43 is illustrated in FIG. 44, which shows the hinge 272 of the hinged door 252. The front 253 and side panel 254 of the arm are made from wood. A circular foot 256 is located underneath the front of the arm of the chair, while circular feet 257 and 258 are located underneath the back of the arm of the chair.

Figure 45:
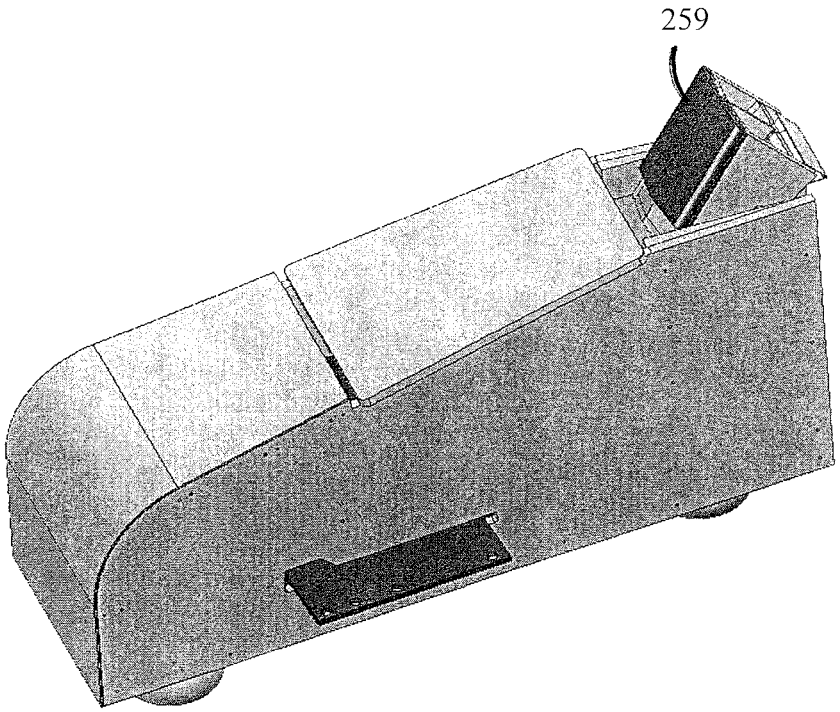
FIG. 45 is a side perspective view of the partially disassembled arm of FIG. 43, after the hinged door has been removed.

FIG. 45 shows the arm of FIG. 43, after the hinged door 252 has been removed. Component 259 is a piece of acoustically transparent foam. Foam component 259 does not have a uniform thickness, when viewed from the top, and the thickness ranges from approximately 5 mm to approximately 15 mm. Foam component 259 is made from polyurethane foam and has the following physical properties: a density of 1.33-1.57 $lb/ft^3$; a compression deflection at 25% of at least 0.25 psi; a tensile strength of at least 8 psi; a tear strength of at least 3.0 pli (pounds per linear inch); and an elongation of at least 100%. The physical properties were measured in accordance with the test methods of ASTM D-3574-01. The foam also has a pore size of 13-23 ppi (pores per inch). The foam is available from American Coverters, Inc., of Fridley, Minn.

Figure 46:
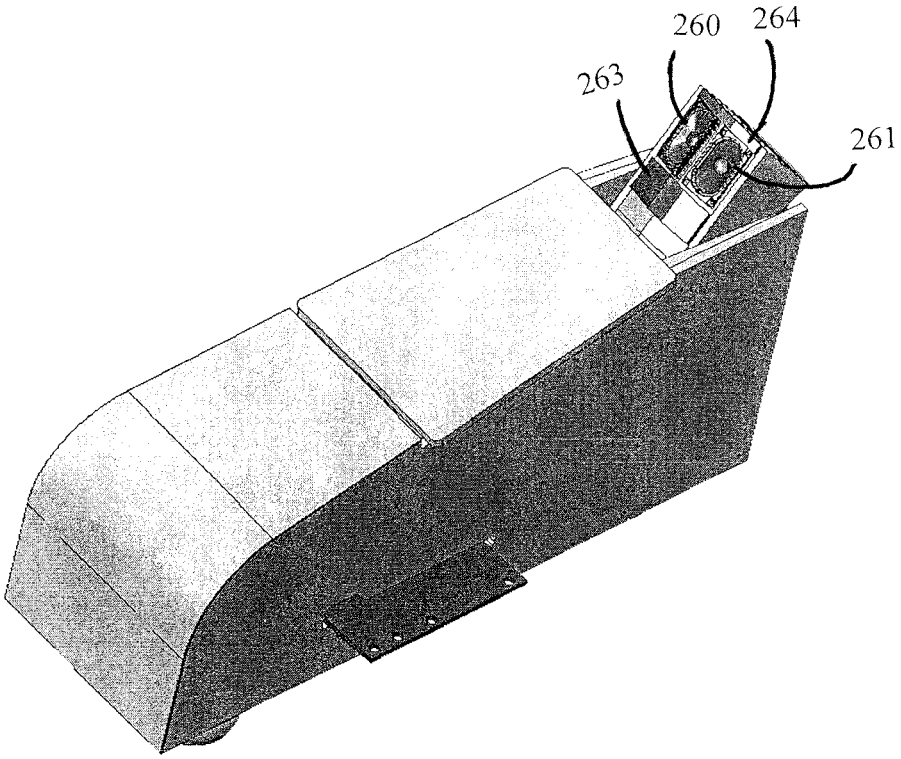
FIG. 46 is a side perspective view of the partially disassembled arm of FIG. 45, after a foam component has been removed.
Figure 47:
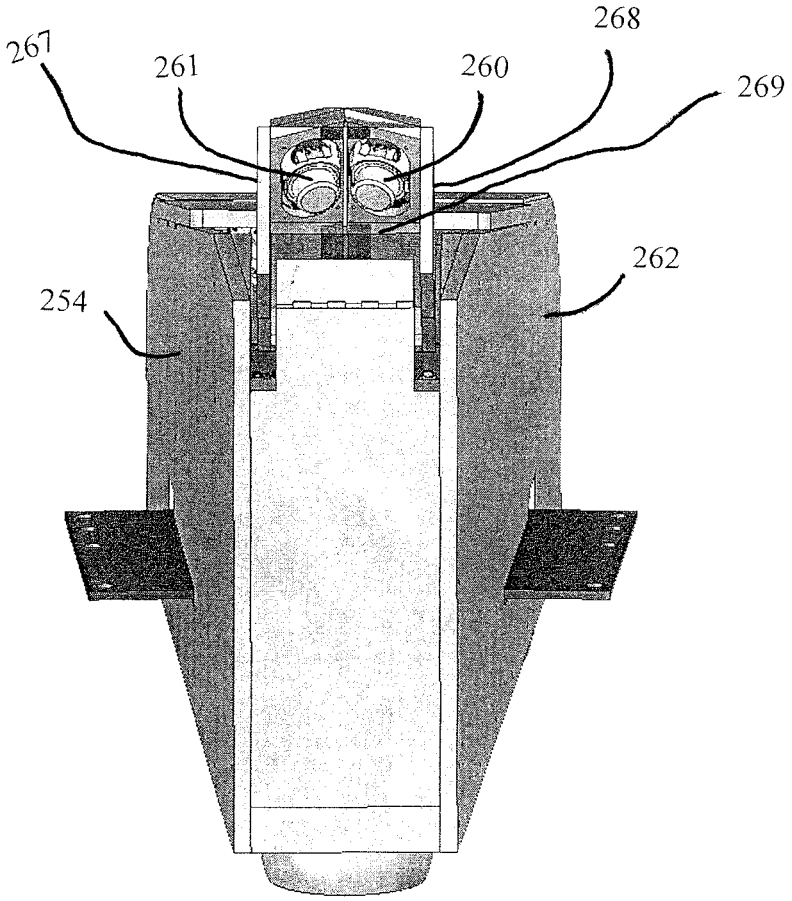
FIG. 47 is a front view of the partially disassembled arm of FIG. 46.

The arm speakers 260 and 261 are behind the layer 259 of foam, as shown in FIG. 46, which shows the arm of FIG. 45 after foam component 259 has been removed. Foam component 263 is located below the speakers, and foam component 264 is located above the speakers. As can be seen in FIG. 47, which shows a front view of the arm of FIG. 46, the arm speakers 260 and 261 are tilted slightly away from each other, so that arm speaker 260 is tilted toward the user sitting in the chair next to side panel 262, while arm speaker 261 is tilted toward the user sitting in the chair next to side panel 254. The speakers are oval, with a long diameter of approximately 3 in and a short diameter of approximately 1.5 in.

Figure 48:
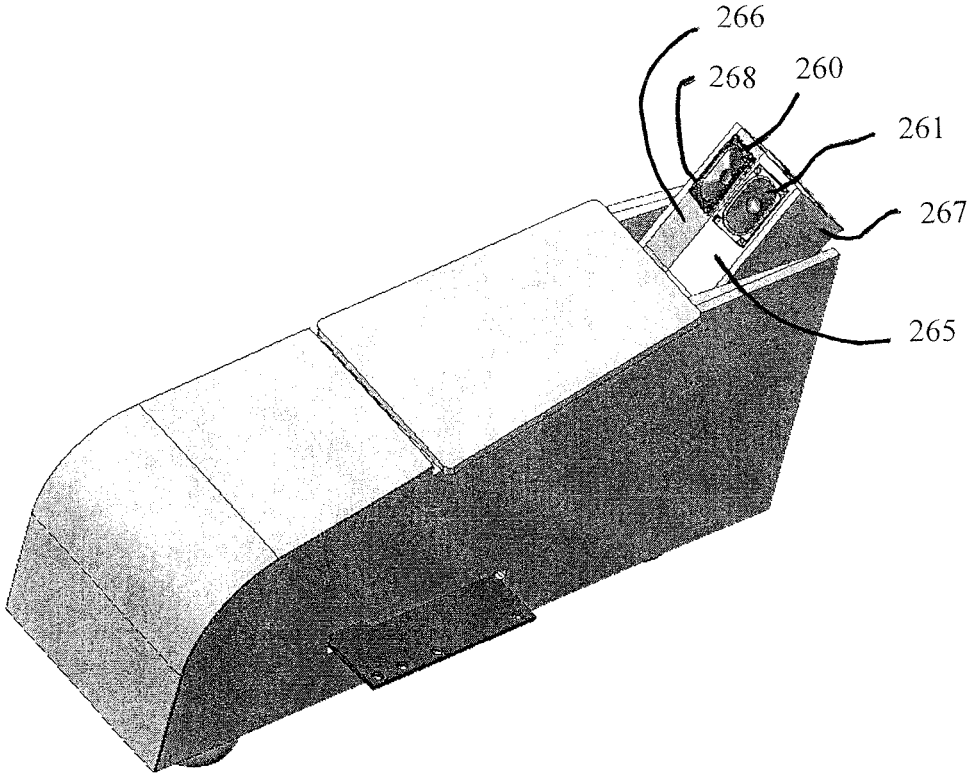
FIG. 48 is a side perspective view of the partially disassembled arm of FIG. 46, after foam components have been removed.
Figure 49:
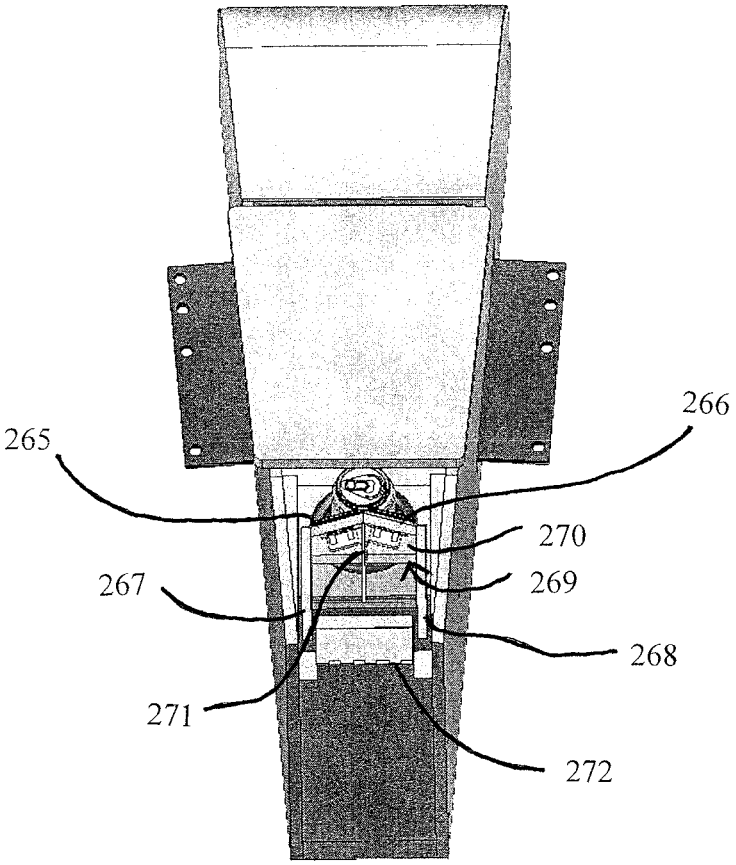
FIG. 49 is a top perspective view of the partially disassembled arm of FIG. 48.

FIG. 48 is a view of the arm of FIG. 46 after foam components 263 and 264 have been removed. FIG. 49 is a top perspective view of the arm of FIG. 48. The arm speakers 260 and 261 are located in an arm speaker housing. With reference to FIGS. 48 and 49, the housing is comprised of front panels 265 and 266, side panels 267 and 268, back panel 269, and bottom panel 270. The top panel of the housing is the hinged door 252, which is shown in FIG. 42. The housing panels 265, 266, 267, 268, 269, 270, and 252 are made from wood. Front panel 265 includes a hole to accommodate arm speaker 261, while front panel 266 includes a hole to accommodate arm speaker 260. The housing is filled with Dacron® fibers and is sealed with silicon. The housing includes holes to accommodate the wires that connect the arm speakers to the amplifier assembly. Silicon may be used to seal these holes in the housing.

The hinged door 252 is the top panel of the arm speaker housing. The front panels 265 and 266, the side panels 267 and 268, and the back panel 269 of the arm speaker housing are attached to the hinged lid 252. The bottom panel 270 of the housing is attached to the front panels 265 and 266, the side panels 267 and 268, and the back panel 269. Therefore, the entire arm speaker housing moves with hinged door 252, and the arm speaker housing pivots on the axis of the hinge 272.

As shown in FIG. 49, a wooden baffle 271 bisects the housing of the arm speakers. This baffle 271 is located between arm speaker 260 and arm speaker 261.

Figure 50:
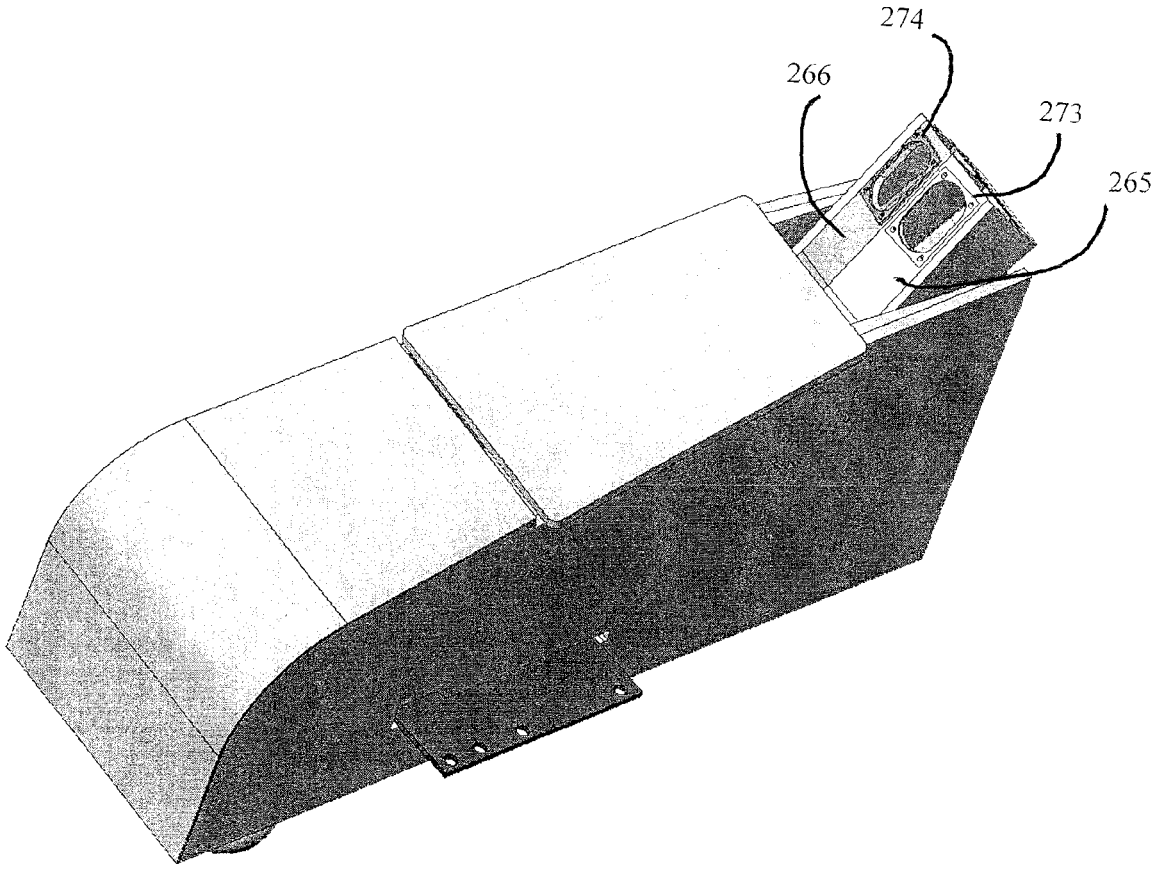
FIG. 50 is a side perspective view of the partially disassembled arm of FIG. 48, after the arm speakers have been removed.

FIG. 50 is a view of the arm of FIG. 48, after the speakers 260 and 261 have been removed. Component 273 is a piece of foam located between arm speaker 261 and front panel 265. Component 274 is a piece of foam located between arm speaker 260 and front panel 266.

Figure 51:
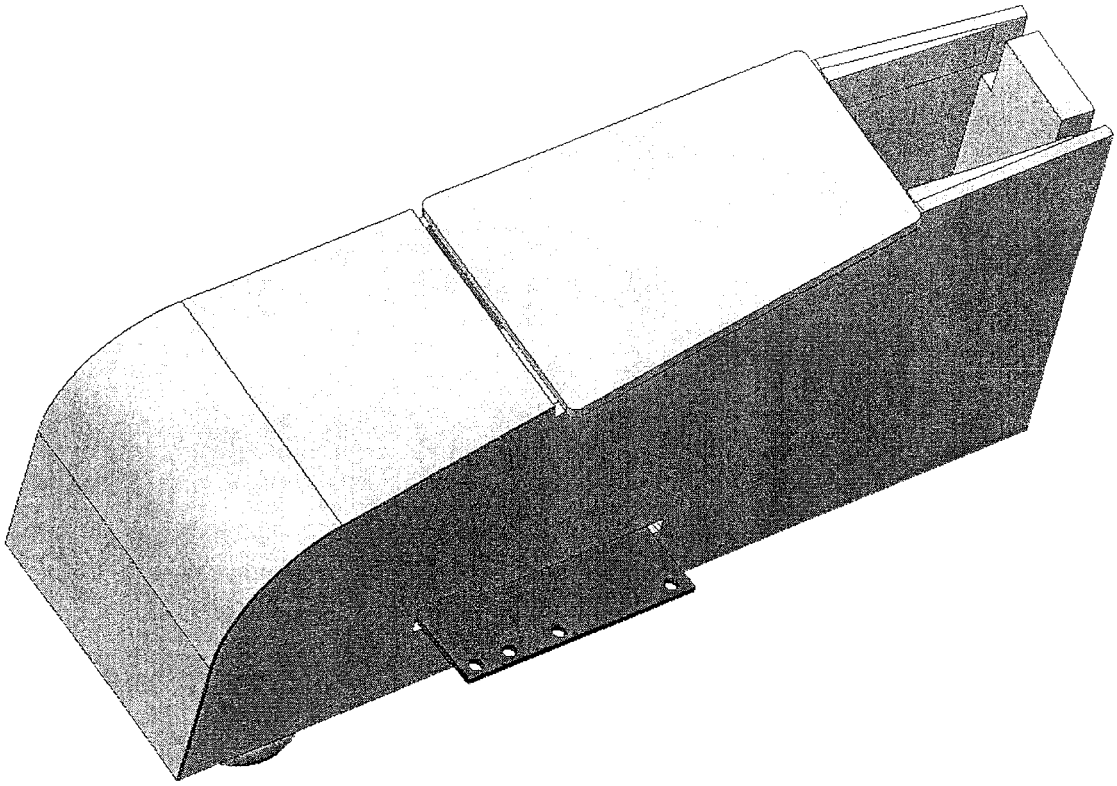
FIG. 51 is a side perspective view of the partially disassembled arm of FIG. 50, after components around the arm speakers have been removed.
Figure 52:
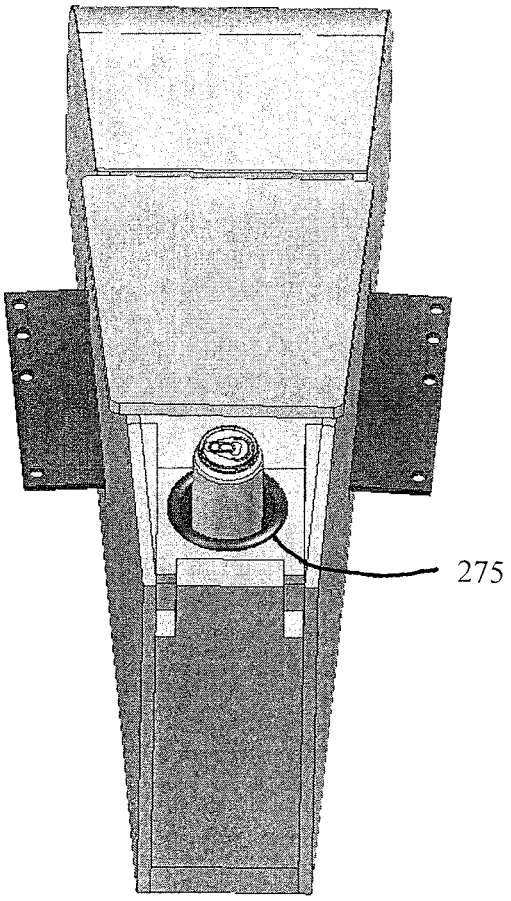
FIG. 52 is a top perspective view of the partially disassembled arm of FIG. 51.

FIG. 51 is a view of the arm of FIG. 50, after the front panels 265 and 266, side panels 267 and 268, baffle 271, back panel 269, bottom panel 270, hinge 272, and foam components 273 and 274 have been removed. FIG. 52 is a top perspective view of the arm of FIG. 51. The arm includes a cup-holder 275.

As shown in FIG. 46, there are two arm speakers 260 and 261 located in arm 303, underneath foam component 259. The sound projection of these two arm speakers 260 and 261 is shown in FIG. 41. Also with reference to FIG. 41, the outside arms 301 and 305 each include only one arm speaker. Arm 301 includes one arm speaker underneath foam component 308, which is a layer of acoustically transparent foam with the same specifications as foam component 259, discussed above. This arm speaker projects sound directed to the left ear of a user sitting in seat 302. Arm 305 includes one arm speaker underneath foam component 306, which is a layer of acoustically transparent foam with the same specification as foam component 259. This arm speaker projects sound directed to the right ear of a person sitting in seat 304.

The arm speakers may be configured to allow a user to change the position of the speakers, so that the position of the arm speakers may be changed based on the user's position. In one embodiment, two pairs of magnets embedded in the side walls of the arms maintain the hinged door, and consequently the arm speakers, in one of two open positions: fully open, which is a convenient position for the arm speakers when a user is seated upright, and partially open, which is a convenient position for the arm speakers when a user is reclined.

Figure 53:
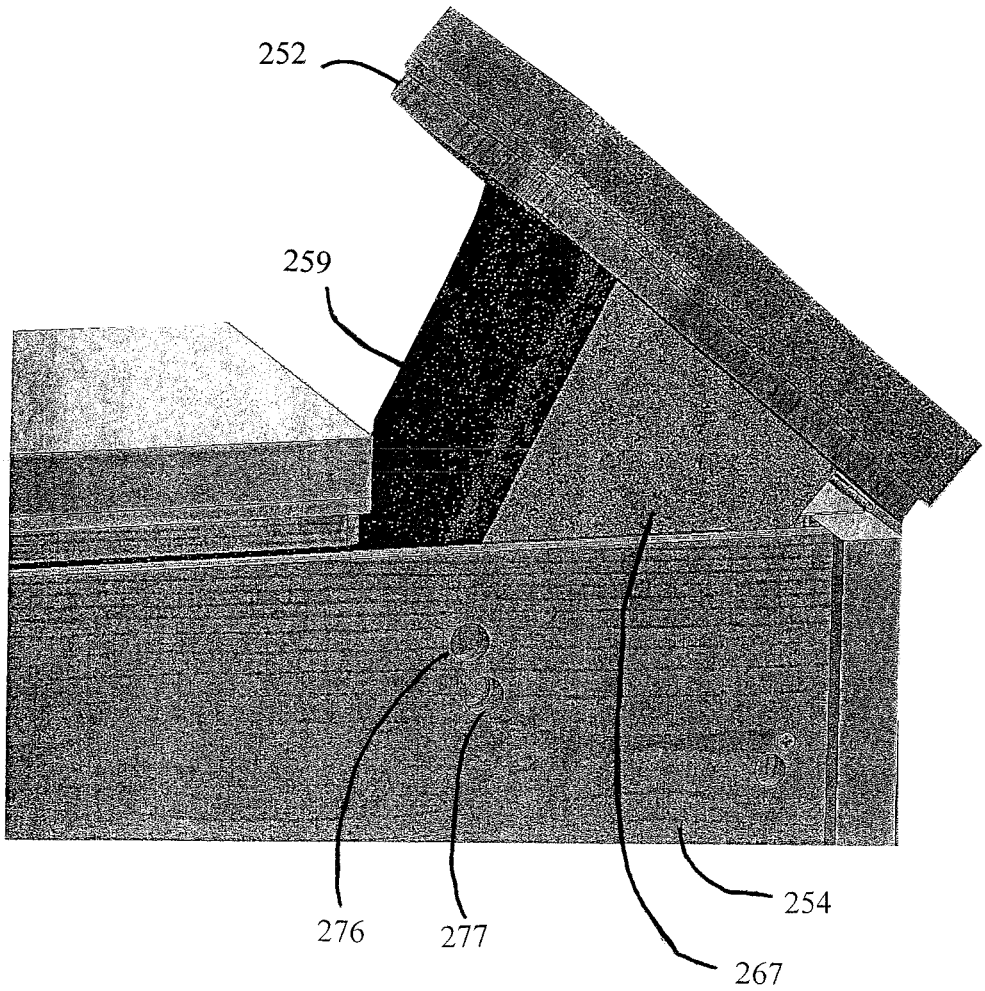
FIG. 53 shows a portion of an arm of a chair made in accordance with the present invention, after components of the arm have been removed. The hinged door above the arm speakers is in a partially open position
Figure 54:
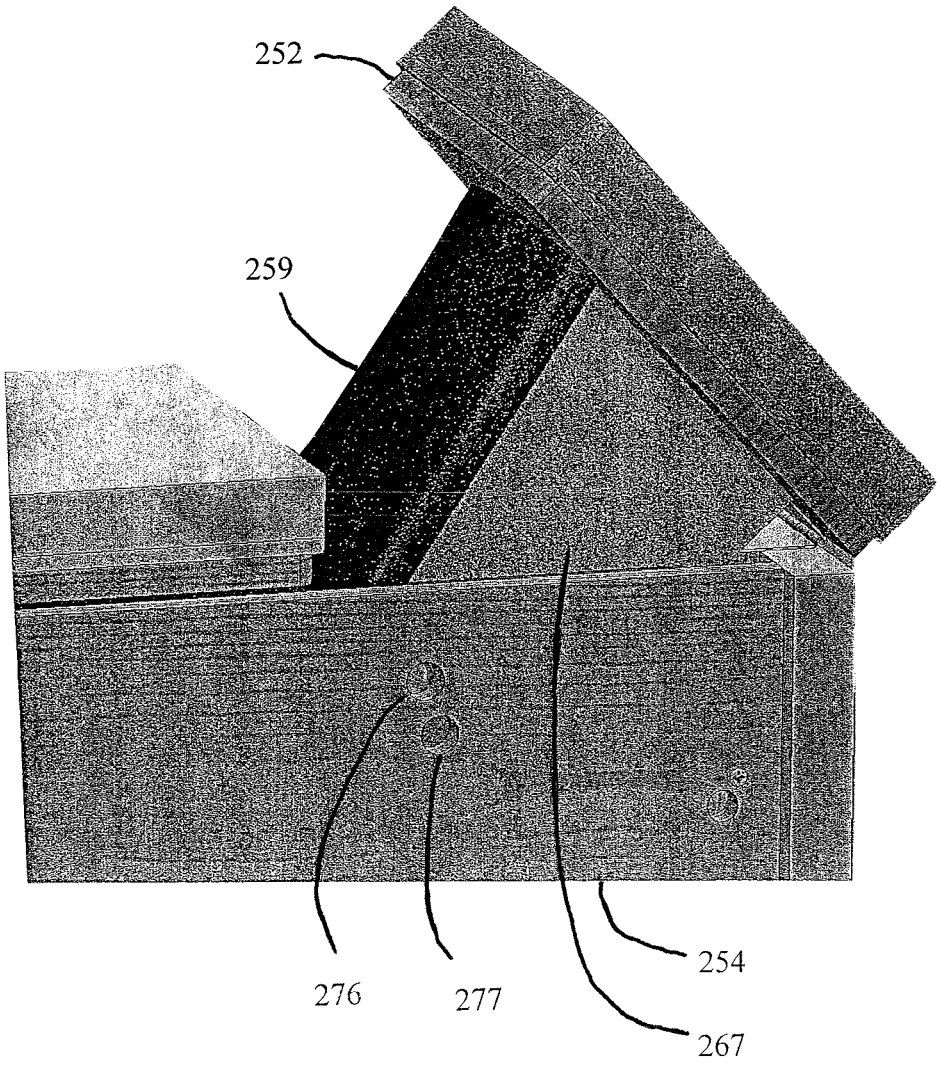
FIG. 54 shows a portion of an arm of a chair made in accordance with the present invention, after components of the arm have been removed. The hinged door above the arm speakers is in a fully open position.

FIGS. 53 and 54 show a portion of an arm of a chair in accordance with the present invention, after the following components have been removed: the leather layer of the upholstery; the foam component 250, shown in FIG. 42, which covers the side panel 254 of the arm; and the two magnets embedded in the side panel 254. The magnets were located in holes 276 and 277. These two magnets correspond to two magnets that are located in the other side panel 262 of the arm, which is shown in FIG. 43. The holes for to magnets in side panel 262 are located in the same position as the holes 276 and 277 of side panel 254.

In FIG. 53, the hinged door 252 is in a partially open position. In FIG. 54, the hinged door 252 is in a fully open position.

Figure 55:
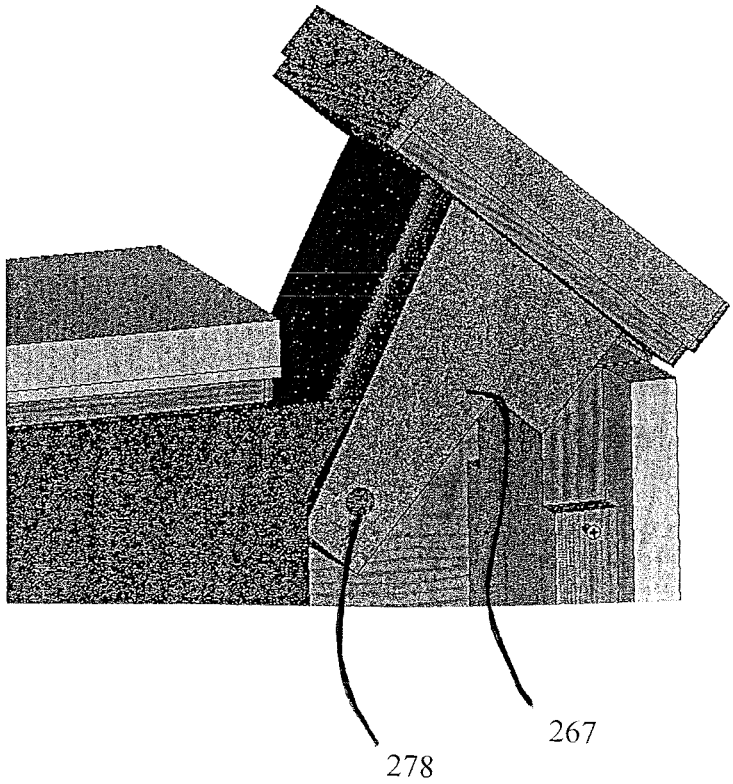
FIG. 55 shows the portion of the arm shown in FIGS. 53 and 54 after the side panel of the chair and the magnet embedded in the side panel of the speaker housing have been removed.

FIG. 55 shows the portion of the arm shown in FIGS. 53 and 54 after side panel 254 of the chair has been removed. The magnet embedded in the side panel 267 of the speaker housing has also been removed. This magnet was located in the hole 278 in the side panel 267. This magnet corresponds to a magnet located in the other side panel 268 of the speaker housing, which is shown in FIGS. 47 and 48.

When the hinged door 252 is in the partially open position, as in FIG. 53, the magnet in the lower hole 277 of the arm side panel 254 is aligned with the magnet embedded in side panel 267 of the speaker housing. The magnet in the lower hole of the opposite arm side panel 262 is aligned with the magnet embedded in side panel 268 of the speaker housing. The alignment of the lower pair of magnets in the arm side panels with the pair of magnets in the speaker housing maintains the hinged door 252 in a partially open position.

When the hinged door 252 is in the fully open position, as in FIG. 54, the magnet in the upper hole 276 of the arm side panel 254 is aligned with the magnet embedded in side panel 267 of the speaker housing. The magnet in the upper hole of the opposite arm side panel 262 is aligned with the magnet embedded in side panel 268 of the speaker housing. The alignment of the upper pair of magnets in the arm side panels with the pair of magnets in the speaker housing maintains the hinged door 252 in a fully open position.

When the hinged door 252 is in a partially open position, the arm speakers are in a position that facilitates directing sound to a user in a reclined chair. When the hinged door 252 is in a fully open position, the arm speakers are in a position that facilitates directing sound to a user in an upright chair. A user may switch the hinged door 252, and consequently the arm speakers, between the two positions, depending on whether the user is reclined or seated upright in the chair.

In some embodiments, the number of different orientations in which the arm speakers can be positioned could be changed depending on the height of the chair arm. For example, in the seating configuration shown in FIG. 41, the center arm 303 is shorter than the side arms 301 and 305. In such a seating configuration, the side arms could have two pairs of magnets located in the side panels of the arms, as discussed above, so that the hinged door 252, when opened, could be maintained in either a partially open or fully open position. In contrast, the center arm could have only one pair of magnets located in the side panels of the arm, so that the hinged door, when opened, could be maintained in only one open position.

The chair arm could be adapted so that the hinged door 252 could be maintained in more than two open positions. Moreover, positions of the arm speakers could be maintained by a mechanical means such as a latch, rather than by a magnetic means. For example, a detent structure could be used to position the arm speakers in a variety of different orientations.

Arm speakers can also be included in single stand-alone chairs that are not a part of a multiple seating configuration. For example, one skilled in the art could adapt the arm 303 to serve as the arm of a single chair. If arm 303 were adapted to serve as the arm of a single chair, one of the arm speakers 260 and 261 of arm 303, shown in FIG. 46, could be disabled or not included at all. For example, an arm that would be at a user's right side during use could include only arm speaker 260. An arm that would be at a user's left side during use could include only arm speaker 261. Or, with reference to FIG. 41, arm 301 could be used as an arm of a single chair that would be on a user's left side, while arm 305 could be used as an arm of a single chair that would be on a user's right side.

Arm speakers could be located in different locations than those discussed above. For example, with reference to FIG. 43, a speaker door could be located in component 255, which is located at the back portion of the arm. A speaker, facing upwards, could be located beneath said speaker door. Arm speakers located beneath speaker doors at the back portion of the arms of a chair could be used in place of head speakers.

Such an arrangement would allow more flexibility in the design of the back of the chair, in terms of shape and upholstery.

Effectiveness of Seating Configuration Design

The effect of a seating configuration in accordance with the present invention on a user results from the fusion of hearing and feeling, allowing users to feel what they hear. Users are accustomed to hearing sound, but are not accustomed to feeling full spectrum sound. The sense of feeling provides much more intimacy than the sense of hearing. As a result, the system in accordance with the present invention creates more physical and emotional engagement as users watch a movie, listen to music, or play games.

Low frequency transducers have attempted to produce this phenomenon. However, only full spectrum sound transmitted to and through the body allows users to perceive, low, mid-range, and even higher frequencies. In this way users feel the same frequencies that they hear.

To further increase the effectiveness of a chair made in accordance with the present invention, the chair may be constructed with a continuous steel frame to enhance harmonic resonance, creating a richer and more consistent sound envelope.

It is possible that the seat transducer and spine speakers of the present invention act synergistically to provide greater than expected emotive and healing effects, by providing a greater "dose" of broad spectrum sound energy to the body and its interior spaces than would be provided by speakers and transducers acting independently from each other. While not intending to be bound by theory, it is possible that the much greater low frequency amplitude/impact transmitted from the seat transducer to the frame of the chair and then to the user's body acts as a carrier wave for the higher frequencies from the spine speakers, and that the sound waves penetrate the body to a greater degree due to the longer wavelength of the lower frequencies. The spine speakers, which are attached to the frame, vibrate as a result of the lower frequency content from the seat transducer. The spine speakers transmit their sound waves, which are of higher frequency than the sound waves transmitted from the seat transducer, and the sound waves from the spine speakers are then carried farther into the body. It is possible that the sound waves are therefore transmitted deeper into the body's tissues than would be possible without the synergistic effect of the seat transducer acting with the spine speakers.

It is also possible that, besides transmitting more high-frequency content into the body cavities, the present invention also transmits more high-frequency content into the spine, which can then radiate those frequencies throughout the body through transmission through the skeletal system. Transmission through the skeletal system is possible because sound is able to travel well through bones and joints. See Boyd, Jade, "Your Wrist Bone's Connected to your Cell Phone," found at http://www.media.rice.edu/media/NewsBot.asp?MODE=VIEW&ID=9758.

When sub-harmonic frequency array generation, as discussed above, is used in conjunction with an embodiment of the present invention, the sub-harmonic frequency array generation creates potential carrier waves directly from the original sound, such as the sound from television or music. This sub-harmonic frequency array generation is particularly important when there is little low frequency content in the original sound.

Entertainment Features and Benefits

The entertainment benefits of the present invention relate to seating comfort and configuration, personalization of sound and vibration level, ability to easily control aspects of the technology, and an overall enhanced entertainment experience deriving from all of the above. These entertainment features and benefits are discussed below.

Seating Comfort and Configuration

The seating is modular (identical or near identical frame components for the back and seat frames, and identical seat and back pads) and can take the form of a single chair with two straight arms, a love seat (two seats and backs together with straight arms on the outer aspect of each seat with no arm in between the seats), a couch with three or more adjoining seats and backs without intervening arms with straight arms at both ends, a row or curve of seats (intervening straight or wedge shaped arms respectively with straight arms at both ends) or a sectional sofa with any or all of the above elements variously arranged. Multiple seating arrangements facilitate user compliance by allowing users to sit apart or together in close proximity depending upon their preference.

Each seat and back combination has two electric motors to independently recline the back of the seat and position the leg rest. These motors may have attached power cords that plug into the amplifier assembly. Each motor can infinitely position its respective movable part between its limits. The seat frame of each seat is connected to base plates using large diameter wire (approximately 0.5 to 0.6 inch) single torsion springs on both sides. These springs improve the softness of the "sit" (less upward pressure exerted on the buttocks by the seat structure upon sitting) and also allow for rocking action. They also facilitate improved performance of the invention as mentioned below. All pads (seat and back) are heavily cushioned (6 inches of high resilient foam in the seat pad) maximizing comfort and avoiding bottoming out on a hard surface. Each pad is upholstered to improve aesthetics and wear.

The seat frame and seat pad of each seat is tilted back at a 12.5 degree angle relative to the floor to comfortably position the user against the back pad so that the user will be well positioned against the spine speakers. This is necessary in order to accomplish the following goals: 1) to improve seating comfort by reducing pressure in the low back (lumbar spine); 2) to maximize the transmission of sound energy into the spine by more directly opposing the user's back against the spine speakers and; 3) to reduce the illumination of the ambient space in the room with sound by eliminating the gap between the user's body and the back pad of the chair, thereby muffling the sound.

Typical seat angles for chairs and furniture range from 0 degrees to approximately 7.5 degrees. Adirondack chairs have a more severe tilt, but tend to be rigid structures making them difficult to get in and out of. This invention accomplishes the above three goals, while facilitating getting in and out of the seat, despite the more severe sitting angle. It does so because the torsion springs allow the seat to bend forward, eliminating the tilt angle upon getting in and getting out of the seat as more pressure tends to be applied to the front of the seat in the process.

Personalization of Sound Level

Personalization of a user's sound space is a very desirable feature while watching and listening to TV and movies, listening to music, and playing video games because people prefer to listen to sound at different volume (sound pressure or decibel) levels. In more typical entertainment venues all of the viewers/listeners are exposed to a single sound source at the same volume level. Even with the advent of Surround Sound, all listeners are exposed to about the same volume levels, although some of the listener's that are not centrally located in the room and at various distances from the sound sources may be exposed to slightly different representations of the sound and decibel levels.

Using this invention and placing each user close to his or her individual sound source allows for much greater customization of the volume level that they each can experience. Sound pressure levels decrease by the fourth power of distance. As a result the user is principally influenced by the speakers closest to them and less influenced by those farther away. Furthermore, since the head speakers are only inches away from the user's ears and oriented toward the user, they are typically used to produce relatively low volume levels which further reduces the sound pressure level that emanates a distance from them.

However, placing the user in close proximity to the sound source while providing the frequency content and vibrations (including low frequencies) that are necessary to confer medical benefits, creates obstacles to the design of this invention. For instance, placing speakers that are required to generate frequencies significantly lower than 100 Hz in close proximity to the ear would lead to listening fatigue.

Listening fatigue has been defined as a psychoacoustic phenomenon from prolonged listening to sound whose distortion content is too low to be audible as such, but is high enough to be perceived subliminally. The physical and psychological discomfort can induce headaches and nervous tension.

Listening fatigue is believed to result from the brain's attempt to reconcile perceived spatial differences between low and high frequencies emanating from the same sound source. This could result if speakers too close to the ear, produce high and low frequencies from different parts of the speaker cone separated too far in space from one another. Users do not tend to experience listening fatigue when using small speakers, headphones, or ear buds in close proximity to their ears because the power/frequency curve of those speaker types, unlike larger speakers, prevent this type of distortion.

This is one reason why the present invention utilizes only small speakers by the ear with a frequency range of approximately 80 Hz to 20,000 Hz, but there is another reason which has a bearing on personalizing a user's sound space. Psychoacoustically, the perception of loudness is influenced by higher frequency sound content more than by lower frequency content. Since the head speakers provide mainly high frequency content and since they are the closest speakers to the user's ears, the user will typically set volume levels proportionally lower for these speakers. Since the volume settings for these speakers are likely to be set lower and since they provide sound emissions directly into the ambient space around the user's head, the ambient space would contain less sound.

Therefore, other users nearby or in the same room will be less influenced by the sound they produce, particularly when the volume of the head speakers is set lower because as mentioned sound diminishes by the 4th power of the distance from the sound source. This phenomenon assists all in the room in personalizing their respective sound spaces. The ambient sound levels can be further lessened by the use of headphones or similar devices, which when used in this invention automatically cause sound emissions from the head speakers to cease.

The positioning of the spine speakers also plays a role in personalizing a user's sound space. Hearing, and thereby the perception of loudness, manifests through both air and bone conduction. The spine speakers are oriented so that the sound emissions are directed into the user's spine. Conduction of that sound up the spine and through the skull and ossicles of the middle ear and cochlea of the inner ear can be heard by the user, although much less so as compared to the head speakers by the user's ears. Since the majority (in excess of 90% in some individuals) of the sound energy is absorbed by the user's body there is less sound energy available to affect the ambient space and other listeners. However, due to the proximity of these speakers to the body, the fullness of low sound frequencies cannot be transmitted well to the user for the purposes of sound (hearing) perception particularly as compared to the longer wavelengths of sound that can develop in the room from the driver under the seat pad.

The lowest sound frequencies (down to 20 Hz) that are audibly perceptible are supplied mainly by the driver attached to the underside of the seat pad. This driver is designed to emit mainly low frequencies to fill out the full spectrum hearing experience so that low frequencies in addition to higher frequencies (up to 20,000 Hz) are available to the listener to be heard. Although these lower frequencies will emanate into the ambient space and illuminate the room, they have the least influence on the user's perception of loudness and the least impact on the personalization of a user's sound space. Some of the volume from this transducer, particular as it relates to the higher frequencies that this driver can produce, is filtered by the surrounding foam wrap.

The user can further customize their sound space by using the SoundNumber™ system settings and the balance and EQ functions provided for the signals destined for the head speakers and other speakers, including the seat driver.

In addition, to provide additional entertainment value the amplifier and head speakers can be used to produce virtual surround sound using software licensed from Dolby Laboratories, Inc. The six channels (Dolby 5.1) of audio data that typically comprise the surround sound signal content (center, left and right front, left and right back, and subwoofer) can be encoded and played through the head speakers to create this effect.

Personalization of Vibration Level

Similar to volume levels, different people prefer to experience vibration at different levels. The user has multiple ways to customize their vibratory experience apart from either turning the sound level higher in general or altering the EQ function (increasing bass) in general and thereby altering much of what is heard. In this way the user can alter their vibratory and sound experience somewhat independently. This is important because the user doesn't want to sacrifice high quality sound in order to feel more vibration.

The vibrations result primarily from the seat transducer, the spine speakers, and the metal frame and its attachments. As previously mentioned, the seat transducer and spine speakers influence sound perception less than the head speakers. As such, there is partial independence between the drivers creating vibration and those creating much of the audible sound. Therefore, by only adjusting the volume and EQ of the seat transducer and possibly the lower spine speaker, the user can dramatically alter the vibratory experience without significantly changing the auditory experience.

The user's sensory experience is made possible by a number of specialized nerve endings in the skin and deeper structures of the body. Several peripheral nerve endings are able to respond to vibrational stimuli. These include Pacinian corpuscles and Meissner's corpuscles.

Pacinian corpuscles are the largest peripheral mechanoreceptors in mammals (Stark et al., 2001). They are found in the dermis layer of human skin, in mesentery which lines the body's cavities, in lymph nodes, certain organs, and are often found near joints. These corpuscles are especially susceptible to vibrations (reported ranges are as large as 70 Hz to 1000 Hz with peak frequencies in the range of 200 Hz to 400 Hz), which they can sense even centimeters away (Kandel et al., 2000). Pacinian corpuscles cause action potentials (nerve impulses) when the skin is rapidly indented, but not when the pressure is steady, due to the layers of connective tissue that cover the nerve ending (Kandel et al., 2000). It is thought that they also respond to high velocity changes in joint position.

Pacinian corpuscles are deeply placed whereas the Meissner corpuscles or touch receptors, are more superficially located in the skin. They are velocity-sensitive discharging only during skin movement, with a vibration sensitivity ranging between 10 Hz and 200 Hz.

Given the sensitivity and location of these receptors, it can be seen that the user can feel vibrations from sound both on the surface of the body and internally and ranging in frequency from very low into the mid-range. To provide the user with vibrational stimuli that can stimulate these receptors it is important to vibrate the seating configuration in its entirety to stimulate the user's external surface as well as to infuse sound and vibrational energy into the body so the user's internal receptors can also be stimulated.

The transducer, bolted to the underside of the seat pad, is capable of vibrating below 10 Hz with an upper range in excess of 1000 Hz. This specialized transducer has a mass-loaded cone consisting of approximately one pound of aluminum, which is attached to the voice coil. As such, the energy dissipated by the transducer imparts much more vibration than sound. In addition, the transducer is wrapped in foam to reduce air transmission of sound, particularly of higher frequency sound into the ambient space. Because the seat pad rests on the seat frame a significant amount of the vibrational energy from the transducer is transferred from the wood on the underside of the pad to the continuous steel frame of the seating configuration.

There are several attachment points between the steel-containing modules of the seating configuration that aid in distributing the vibrational energy more uniformly. This helps to provide a more generalized and homogeneous vibratory stimulus to the external surface of the user's body. Perceptible point source vibrations tend to be distracting and less enjoyable. The attachment points include the torsion springs between the underside of the seat frames and the base plates in the arms of the seating, the recline motor and hinges, which connect the seat frame to the back frame, and the leg rest motor and leg rest extensions, which connect the seat frame to the leg rest.

The spine speaker (drivers and enclosure) creates vibratory stimuli that impact the user's back and spine directly. Holes cut in the overlying foam allow more sound and vibrational energy to be infused directly into the user's spine, as the drivers are positioned at a midline location. In this way the spine and skeletal structure can be used to transmit the vibrational stimuli throughout the internal space of the body. These speakers have a frequency range of approximately 40 Hz to 20,000 Hz. However, the drivers are placed in roughly a 15 inch wide by 15 inch tall cabinet, which also distributes vibratory stimuli across most if not all of the user's back, further avoiding any point source vibrational stimuli.

It is important to note that the under the seat transducer is best used to mainly influence the seat pad and steel frame of the seating to provide a general level of vibration to the user. This transducer undoubtedly provides some level of vibrational stimulus to the internal body space. However, in order for this transducer to provide more significant stimulation throughout the internal aspect of the body, excessive shaking would be necessary, which would be bothersome and reduce the entertainment value. Therefore, the spine speakers, strategically located to infuse sound and vibrational energy into the spine, which can then radiate those frequencies throughout the body, are better equipped to primarily serve this function. Also, they can supply a higher frequency range of stimulation. There is an observable feeling difference attributed to the seat transducer alone versus the spine speakers alone. Working synergistically they produce a much more complete and homogenous experience.

Given the wide disparity between the audible frequency range (20 Hz to 20,000 Hz) and the perceptible range of vibrational sensing (10 Hz to 1000 Hz), there are many sounds the user can hear, but not feel. Both the entertainment and medical benefits of this invention can be substantially improved by translating some of the higher frequency audible content into lower frequency vibrational stimuli that can be felt and infused into the body. This can be accomplished by use of the method that creates the sub-harmonic frequency array and then manifested according to the user's preference by using the BodyNumber™ and FeelNumber™ settings and applicable mixing and EQ functions.

Some examples of added entertainment value are use of the method of the present invention while watching and listening to sporting events, auto-racing, and special effects, as well as when listening to music with mainly high frequency content. For instance, when watching a baseball game, without this methodology the user would essentially only feel the announcer's voice if it was resonant and deep enough in tone. The fan noise is too high in frequency to feel. However, with this methodology, a sub-harmonic array of lower frequencies is created from the fan noise when they cheer and those vibrations can be directed to the seat transducer to vibrate the seating. This causes the user to experience the event as if he or she is actually seated in the stands.

Similarly, the sense of feeling the racing car and special effects are enhanced. In addition, feeling music that otherwise could only be heard adds an entirely new dimension to the experience that is entirely under the user's control based upon the settings chosen. Because the user can hear details within the soundtrack, music, or broadcast so well by virtue of the user's proximity to the sound source (including the affect of HD sound) and because the user can now feel the sound content, which adds an entirely new dimension to the experience, the level of realism that is imparted to the user is considerably greater. These factors cause the user to become far more engaged in the experience with a heightened sense of presence and awareness.

Easy Control

The entire system made in accordance with the present invention can be controlled with the Control Screen, which provides a graphical user interface implemented using a touch screen. A Control Screen 200 is shown in the diagram of FIG. 3. This system can be operated in two main modes, automatic and manual.

Given the high degree of interconnectivity between the BodyLink™ receiver, seating, and Control Screen, the user can opt for the Play mode. In this mode the Control Screen will turn on the relevant devices and track and display the audio signals received by the BodyLink™ receiver and then transmitted to the seating. Based upon the type of audio signal being transmitted, the device will automatically select the correct mode of operation (e.g. stereo versus 5.1) and then based upon presets, select the proper program to run. The selections made by the software are displayed to the user and can be overridden. If the user decides to do more than change the SoundNumber™ or BodyNumber™ settings, he or she can move into manual mode and make individual adjustments. Within the manual mode the features are layered such that basic functions such as volume or balance appear before more advanced features such as mixing and the EQ functions.

Still more advanced features such as defining the parameters associated with the sub-harmonic frequency array, are nested deeper within the system.

The program is written in Windows CE (compact framework) so that the look, feel, and operation will be familiar to most users. The software can run on the Control Screen or a user's laptop, including Apple's Mac.

The Control Screen can be wirelessly connected to the Internet. Video and audio signals can be received and viewed. They can also be listened to through the seating by way of a stereo connection between the Control Screen and the amplifier, making a connection within the console of the arm.

Control Screen Overview

In one embodiment of a system for transmitting sound and vibration in accordance with the present invention, the system may be controlled using a Control Screen in the manner described below. In the below description, the terms "Control Screen" and "Controller" are used interchangeably.

The Control Screen allows the user to control the seat functions, all audio functions, and other entertainment equipment, since it can function as a universal remote control. It can also provide connectivity to the Internet. The Controller is essentially a hand-held computer running software related to the system. It is equivalent to running the software on a laptop.

The Control Screen contains a touch screen that can be used to navigate through the functional screens. On either side of the touch screen are square navigation buttons that surround a central select button. One can use the navigation buttons to highlight the various active buttons on the screen. The navigation buttons allow one to move the active focus up/down and left/right. After the user has selected (pressed the central button) a function/button on the screen, the user can use the up/down or left/right aspects of the navigation buttons to change the value or setting of the selected function.

Connections

The Controller connects to the amplifier by connecting a square USB port at the top of the device to the USB port in the console of the arm. The Controller can be disconnected from the USB cable and be battery powered for about an hour of use. When used in this un-tethered manner it cannot communicate with the amplifier. However, it can still control the BodyLink™ receiver and other entertainment equipment through its infra-red transceiver and also, still provide Internet connectivity.

The Controller can be connected to the USB port in the console of the arm in order to be recharged. When plugged into the USB port, and if all of the amplifiers in the seating configuration are connected together, the Controller can operate any and all seat amplifier(s), including the seat amplifiers of a seating configuration including multiple seats. In this manner, one Controller can operate an entire seating configuration.

A stereo audio output port, located also on the top of the device, can be connected to the left and right auxiliary stereo input jacks in the console of the arm. Audio content received from the Internet can be transmitted to the amplifier in this way. An additional rectangular USB port, on the top of the Controller, is available for software upgrades and for storage of Program settings and other data, when connected to a USB memory device.

Chair Control

The Controller's screen displays pictographs of the chair along the bottom of the display. These pictographs illustrate the direction that the chair back and/or leg rest will move when they are pressed. To activate these buttons, the user may either press them directly or highlight one with the navigation buttons and press and hold the center select button. The chair part will move only when the button is pressed and held.

Universal Remote Control

The Controller can function as a universal remote control device to control other entertainment equipment. The programming of the universal remote function can be performed at the time of installation or any time thereafter. The remote control screens are described in depth within this help function.

Wireless Internet Access

The Controller can access the Internet provided there is a wireless router in close proximity to the seating configuration. The user will need to plug an 802.11 wireless adapter into the USB port on the top of the Controller.

Screen Descriptions

Main Menu

Figure 56:
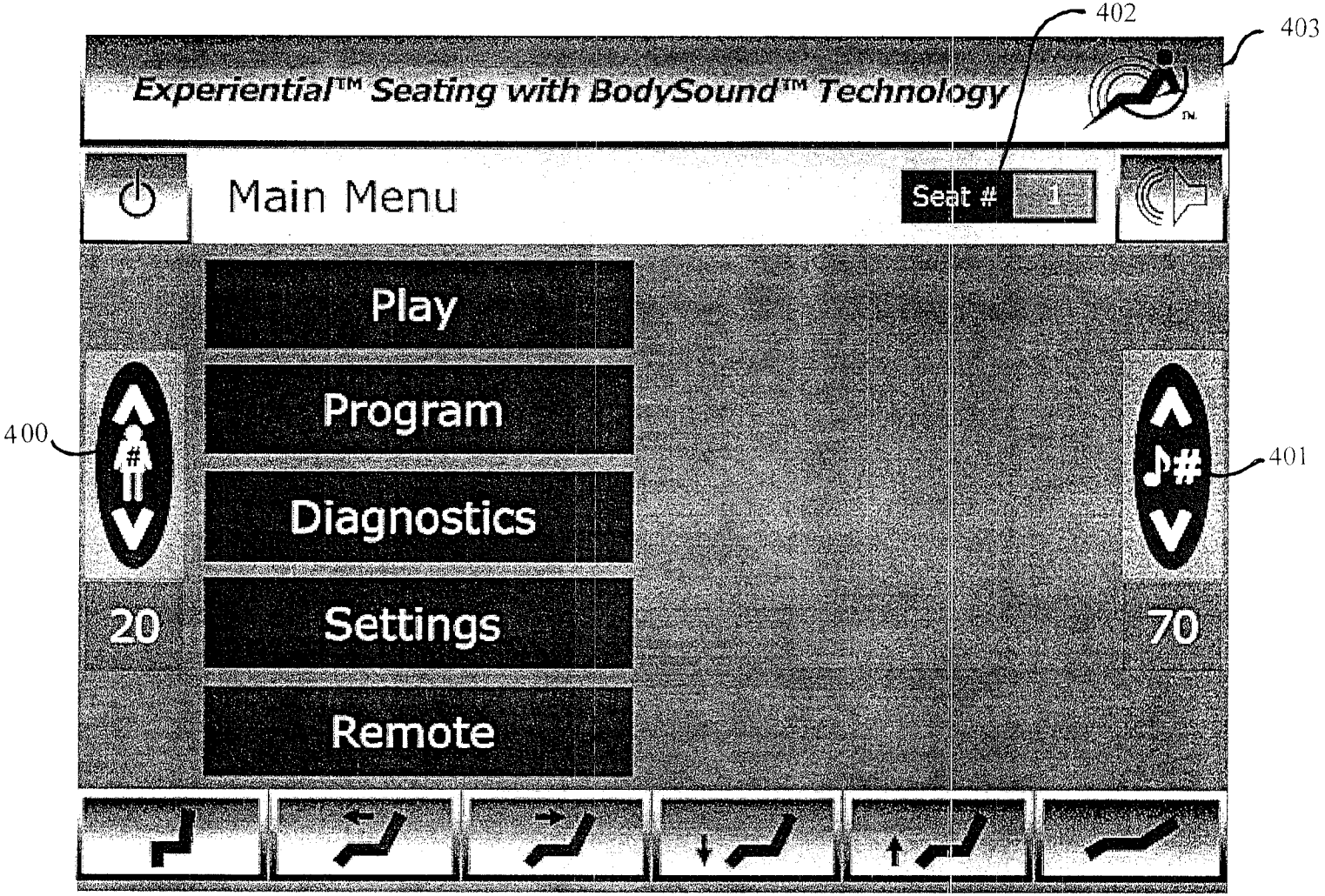
FIG. 56 is a view of a user interface Main Menu screen that can be used in accordance with the present invention.

From the Main Menu screen and any other screen, a user can access help text by pressing the banner section 403 of the screen. From time to time a message will flash in that part of the screen reminding the user of this help function. A view of the Main Menu screen is shown in FIG. 56.

The oval button 400 to adjust the BodyNumber™ setting and the oval button 401 to adjust the SoundNumber™ or Volume setting are used by pressing on the upper part of the buttons (arrow up) to increase the settings or the lower part of the buttons (arrow down) to decrease the settings. The numeric settings are shown below the buttons. Alternatively, the oval buttons can be highlighted by using the left or right square navigation buttons to the left and right of the touch screen and then pressing the center select button. Then the up and down portions of the square buttons may be used to adjust either setting.

The five rectangular buttons direct the user to the main functions of the system.

The Play selection guides the user through the process of running the system using a number of built-in checks and defaults. The user can begin running the system in Play mode and then access the settings for the various functions. The user can always restore the default settings.

The Program option allows the user to run the technology of the system from saved Programs. Once the user or the installer has created some Programs, this is the fastest way to setup and operate the system.

The Diagnostics (Diagnostic) button takes the user to the Diagnostics Menu, used primarily for troubleshooting.

The Settings button allows the user to perform the BodyLink™ receiver setup procedure, customize the system settings, and transfer settings amongst multiple seat amplifiers, or save the settings and Programs to a USB memory device.

The Remote button allows the user to program and use the Control Screen as a universal remote control device.

The last active button is the Seat # button 402 and the button next to it. If the seating configuration has more than one seat and they are connected to each other using the RS485 connections, the user has the ability to run all the seat amplifiers of the seating configuration. To do so, the user may change the Seat number to the number of the chair amplifier that the user wishes to operate. Seats are typically numbered sequentially from the lead seat. The user can change the Seat # by both pressing the Seat # button and selecting from a menu, or sequentially step through the seat numbers by pressing the button next to the Seat # button, which will be labeled with a number or "All."

Icons

There are eight icons and pictographs that are always present and active on the Control Screen. Six of them are located along the bottom of the screen, which deal exclusively with the recline and footrest motor controls, and two are located in the upper corners of the main section of the screen just below the banner 403. These two are for turning the Control Screen off and muting/un-muting the sound.

The Control Screen turns on whenever it is touched or moved. The on/off icon in the left upper corner is used to turn off the Control Screen and the amplifier(s). The fan in the amplifier(s) will continue to run for about fifteen minutes after it has been turned off. The amplifier will also turn itself off fifteen minutes after it has last been in use.

The speaker icon in the upper right corner mutes the sound that the seat is producing. When that icon is pressed an X appears over the speaker showing that the seat has been muted. To un-mute, the user can press that icon again.

Pictographs

Pressing and holding the pictograph of the seat in an upright position in the lower left corner of the screen causes it to return to its neutral position. Pressing and holding the pictograph of the seat in full recline in the lower right corner of the screen causes the chair to move into a fully reclined position. Pressing and holding any of the bottom four pictographs that move a discreet part of the seat cause that part of the seat to move in the direction indicated. While pressing a button, the aspect(s) of the seat will continue to move until the button is released or until the limit switch is engaged in the motor moving that part of the seat.

Play Mode

When Play is pressed from the Main Menu the system first checks the BodyLink™ connections (to the home entertainment equipment), as long as the system includes a BodyLink™ receiver. During this time the Control Screen will be communicating with the BodyLink™ receiver to change its settings to search for active signal inputs. The Control Screen communication occurs either through the seat amplifier to the BodyLink™ receiver via an RS485 connection, if that connection is present, or using its line-of-sight infra-red transceiver with that of the BodyLink™ receiver's. If the line-of-sight infra-red transceiver is used, the Control Screen should be pointed at the BodyLink™ receiver.

If one active signal is being received by the BodyLink™ receiver (from one of the home entertainment components) then that selection is automatically selected. This may occur so quickly that a user may not even see the BodyLink™ Screen display showing this process. On the other hand, if no or two or more active signals are detected, then the user will see that screen. The BodyLink™ Screen will show a top line of buttons corresponding to the home entertainment equipment that should be connected to the BodyLink™ receiver. Below that line of buttons will be another line of buttons that correspond to the BodyLink™ inputs on the back panel of the BodyLink™ receiver.

When two or more signals are detected the user will be prompted to select one of the BodyLink™ inputs. The color coded speaker icons will reveal which BodyLink™ active signal inputs correspond to which entertainment devices. The user may press the BodyLink™ input button corresponding to the entertainment device from which the user wisher to receive the signal.

Note: If there is an active Analog signal present and the user does not select it, that signal will be transmitted to the lead seat amplifier together with the signal that the user has selected, provided there is a Cat5 connection between the BodyLink™ receiver and the lead seat amplifier. However, to play that Analog signal together with the signal selected, the Mixer must be set to also play the Analog signals. If the user has selected the Analog signal in the BodyLink™ Screen, then only that signal will be transmitted.

When two or more signals are detected or if no signal is detected, one can use the Control Screen as a remote control for any of the entertainment devices by pressing one of the device buttons on the top line. This is useful when the user wants to turn off a device that the user is not using, or if the user wants to turn a device on from which the user wishes to receive a signal.

If no active signals are detected the user will receive a message stating that no active inputs are found. The user can either turn on the entertainment device of interest by pressing that device button on the top line and using the Control Screen as a remote control, or by pressing the Troubleshooting Tip button below the message to view a Troubleshooting screen.

After the BodyLink™ receiver input has been selected the amplifier is checked to determine if it is receiving active signals. If a single input is found, that input is selected automatically, the system begins to play, and the screen changes to the Play Mode Controls Screen.

If two or more amplifier inputs are detected the user will be prompted to select an input or press preview to hear the inputs (the user will be in the Amp Input Screen). If the Preview button is pressed the active input signals will play sequentially. During this time the Preview box remains highlighted. The user may press the highlighted Preview button when it is highlighted to stop previewing. To select an amplifier input, one may simply press the corresponding button. After an amplifier input has been selected, the system begins to play and the screen changes to the Play Mode Controls Screen.

When both the BodyLink™ wire (BLWire) and BodyLink™ wireless (BLAir) Inputs are active the system will default to BLWire due to its greater reliability and capability.

If a user has been using either the Optical, BLWire or BLAir input, and the user plugs a portable device into the Aux input in the Console of the arm or directly into the BodySound™ amplifier, the amplifier Input will automatically switch to Aux for just the seat that the portable device has been plugged into. If the downstream seats wish to receive that signal as well, they must access the Amp Input screen and change the Input to Optical.

If no active amplifier Inputs are detected the user will receive a message that no active Inputs are found. The user may press the Troubleshooting Tip button below the message to view the Troubleshooting screen.

Settings Menu

There are three active buttons to choose form: BodyLink™ Setup, Systems settings, and Transfer settings. The BodyLink™ Setup should be performed during installation. It provides the Controller with information about the connections between the home entertainment equipment and the BodyLink™ receiver. The System settings button allows one to customize a number of System settings, some of which also should be set at the time of installation. The Transfer settings button allows one to transfer the settings files (including System and Program files) from one seat amplifier to another or all others, provided all of the seats are connected via RS485 connections. One can also transfer information to a USB memory stick.

BodyLink™ Setup

This procedure can only be accomplished after one has connected the BodyLink™ receiver to the other entertainment equipment components. Performing this procedure will allow the Controller to know, and the user to see, which devices are providing active inputs to the BodyLink™ receiver when viewing the Controller during normal operation. It is also an essential step required in order to use the Controller as a universal remote control device. From the BodyLink™ Setup screen one can Add or Clear BodyLink™ input connections and change the descriptors used for up to six entertainment devices. The following steps should be followed:

a. Press the entertainment device button of interest;

b. Press the button to change the description if desired;

c. Press the BodyLink™ input button to which the device is connected;

d. Repeat steps a. thru c. until all (or up to six) devices connected to the BodyLink™ receiver are accounted for.

System Settings

The System settings are general settings that are not Program specific. When these settings are changed they take effect immediately and are automatically saved for future use.

The total number of seats button tells the system how many seats are linked together.

The Seat Identification # setting lets the chair and those connected to it, know what its unique identifier is. The seats should be numbered sequentially beginning with the lead seat. A seat numbering procedure should be performed during installation and must be done in order for the Controller to communicate amongst different seats.

The BodyLink™ setting tells the Control Screen whether or not a BodyLink™ receiver is part of the system.

The Airlink button allows one to turn the Airlink function in the BodyLink™ receiver ON or OFF. If the BodyLink™ receiver is connected to the lead seat amplifier using a CAT5 cable, then Airlink transmission is redundant and potentially can interfere with other radio frequency signals in the home.

The External Speakers button allows one to inform the Controller whether or not the system includes External Speakers. If the system does include External Speakers, then this button should be turned ON so that the External Speaker buttons displayed on the Controller will not be "grayed out."

The Pressure Switch refers to a sensor in the chair back that tells the amplifier that a user is in the chair, when it senses that a user is leaning against the back of the chair. This is how the chair senses a user's presence. One can turn this switch on or off by pressing the Seat Switch button. When the button reads "On", the switch is on and one must press the button to turn it off and vice versa.

The "Sound off in" box refers to how quickly the amplifier mutes the sound once pressure is removed from the sensor. One may use the navigation Up/Down arrow buttons to make adjustments to this setting. If this setting is too low one may experience an intermittent sound signal that sounds like static or white noise whenever pressure is removed from the Switch.

If the Seat Switch is turned off one will need to turn the amplifier on by using the Control Screen. One will also need to turn the amplifier off using the Control Screen once it is on. When the Seat Switch is turned on, the amplifier will activate automatically when it senses a user's presence. It will also turn itself off 15 minutes after it senses the user has left.

The Enlarge button (ON or OFF) specifies whether or not a shaded block (not grayed-out) of the screen will become enlarged when selected. This is particularly noteworthy in the Programs Control or PC screen which contains a lot of content.

The Help reminder settings refer to the flashing reminder on the top of the screen. One can turn it on or off and set the reminder interval ("Remind every") using the up/down arrow buttons.

The Help Text size refers to the font size for text in the Help screens. One can change the font size by using the up/down arrow buttons.

The Language button allows one to select the text language.

The Color Scheme setting allows one to change the display screen colors.

Transfer Settings

To transfer System settings from one seat to another, the seats must be connected via RS485 connections. One can select the System Settings file to transfer to another or all other seats or select Program setting files and transfer them to a USB memory stick. Program files reside in the Controller and so there is no reason to transfer a Program file to another seat amplifier. During normal operation any Controller can operate any seat it is connected to via RS485 connections using any of its Programs.

One may press the button associated with the type of file(s) the user wishes to transfer (System or Program). One may then select the source seat/Controller and destination (a specific Seat #, or All Seats, or USB Memory) and then press the Transfer button. Note that System settings are transferred between seats and Programs are transferred to a USB memory device from the Controller.

Play Mode Controls (PMC)

The Play Mode Controls screen or PMC screen provides access to the seat and audio functions. The familiar Icons and Pictographs are present as well as the Head Volume or SoundNumber™ button and the BodyNumber™ button. Central within this screen is the Speaker button array, which provides access to the various functions associated with the different types of speakers. Pressing any of the Head, Spine, Seat, or External speaker buttons will take the user to the specific screens that will allow the user to change the associated settings for those speaker types.

The BodyLink™ button will take the user to the BodyLink™ Screen so that the user can change the BodyLink™ receiver input setting or access the universal remote control functions for the entertainment devices.

The Amp Input button will take the user to the Amp Input Screen, allowing the user to select a different input signal.

The Program button will take the user to the Program Screen, allowing the user to rename or save a Program or select a Program to operate the system. If the user has been operating the user's seat in Play Mode and has changed various default settings that the user wishes to save, the user may save and name them as a Program for future use.

The Seat # button has been previously described in the Main Menu section. The Back button at the top of the screen will return the user to the Main Menu screen. The PC button at the top of the screen will take the user to the Program Controls (PC) screen. This screen, like the PMC screen, provides access to the system functions, but it is a more detailed screen designed for individuals who enjoy seeing more details on the screen.

Speaker Volume

Figure 57:
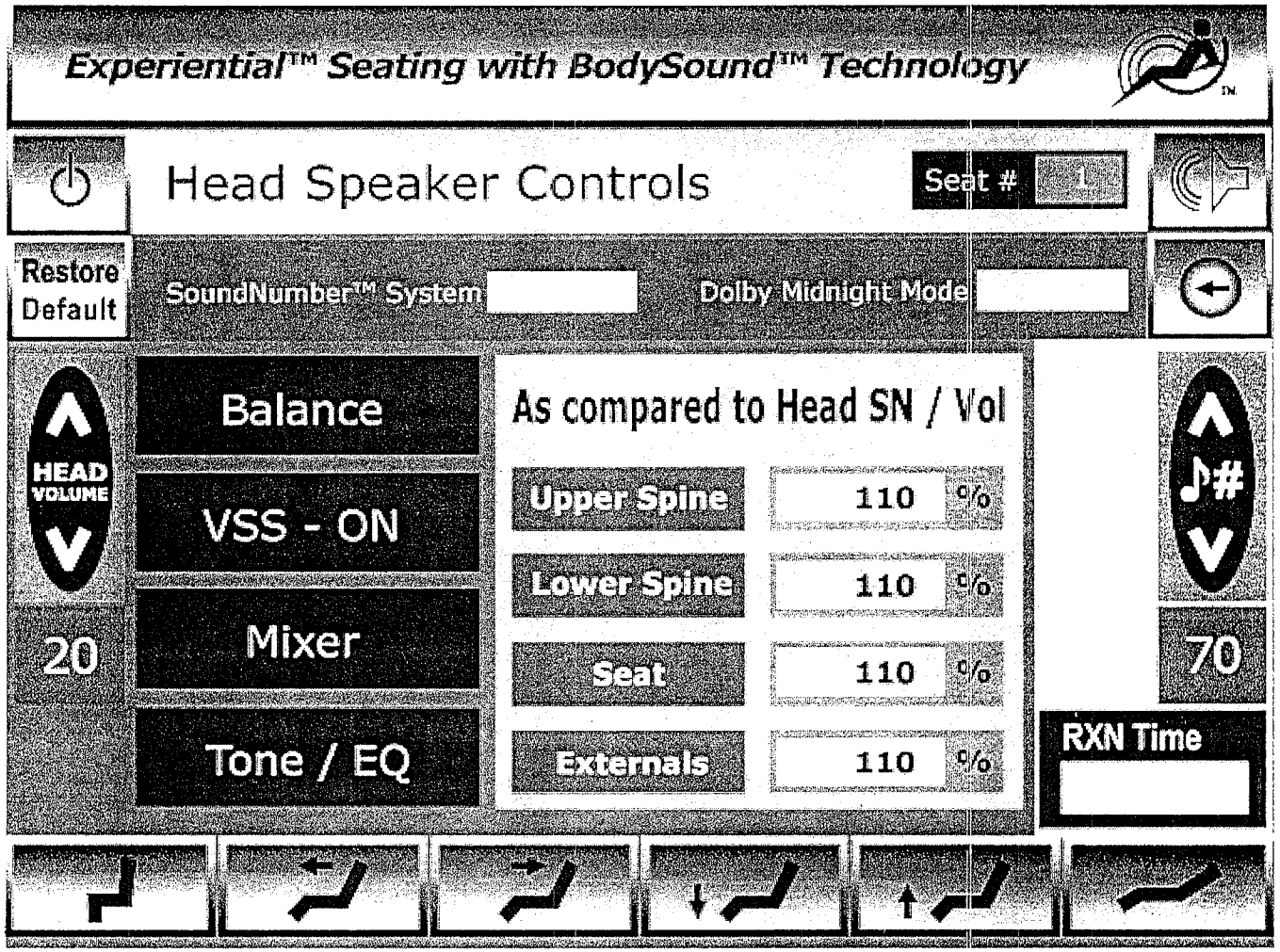
FIG. 57 is a view of a user interface Head Speaker Controls screen that can be used in accordance with the present invention.

Pressing any of the Head, Spine, Seat, or External speaker buttons will take the user to the Volume screen where the user can regulate the volume level across all speakers manually (using the Head Vol master button) or automatically using the SoundNumber™ system. Settings are available to allow the user to regulate exactly how much sound is produced with each speaker. From this screen the user can also select the buttons above the seat pictographs to access the other functions that are specific to each of the speaker types. A view of a Volume screen is shown in FIG. 57.

The SoundNumber™ system is an integral component to personalizing the sound space. The user will no longer have to increase or decrease the volume setting whenever the commercials become too loud or the movie soundtrack too low. The technology of the SoundNumber™ system will make the volume adjustments automatically. The user can customize the sound level by simply setting it with the Controller, and the system will regulate it for the user.

The status of the SoundNumber™ (SN) System ON/OFF button (when SN is ON the button will show ON and when SN is OFF the button will show OFF) determines whether the user is using the automatic SoundNumber™ system or using the oval button to regulate system volume in a manual mode (when the button is labeled Head Vol). Pressing the SoundNumber™ System ON/OFF button will toggle the SN system ON or OFF and change the label on the button.

When the SoundNumber™ system is ON, the oval button will be labeled with the musical note (international symbol for sound) followed by the number sign (♪ #) versus labeled "Head Vol", when it is OFF. Regardless of whether the oval button regulating sound level is labeled "Head Vol" or "♪ #" it works as a master volume control for all of the speakers. The difference is whether or not volume adjustments are continuously made automatically by the amplifier to achieve a user-defined volume (decibel) level. When using the SoundNumber™ system one is providing the amplifier with a setting so that it can regulate the volume level within a certain range, although sudden changes will still occur.

When the SoundNumber™ system is ON, automatic volume adjustments are continuously made based upon the decibel setting (the number shown in the circle under the oval "♪ #" button) that is being used for the Head speakers (range 45 to 85 db—decibels). When the sound level is too high, the amplifier will automatically adjust it downward and when it is too low it will automatically adjust it upward. When the SoundNumber™ system is OFF, the number shown in the circle under the oval "Head Vol" button reveals the static volume setting for the Head speaker (range 0 to 100). When using the oval button labeled "Head Vol", no automatic volume adjustments are made—the user is the adjuster.

Pressing the oval button will adjust the SoundNumber™ or Head Volume setting up or down depending upon which end of the button is pressed. If the user highlights the oval button using the navigation buttons and presses select, the user can then use the up/down part of the navigation buttons to change the SoundNumber™ or Head Volume setting up or down.

The RXN Time (reaction time) button underneath the oval ♪ # button can be changed between TV, Movie, and Music. These modes reflect the speed with which automatic adjustments are made. When RXN Time is set to TV the adjustments will be fast (to decrease the volume of commercials mainly) and when it is set to Music the adjustments will be the slowest to minimally influence the artist's intentions.

The ♪ # or Head Vol button operates as a master volume controller as the number setting (circled) for the Head speakers is related to the other speakers as shown by the percentages in the center box. For instance, if the Head speaker ♪ # setting is 70 db and the user has set the lower spine speaker to be 110% of that value, then the amplifier will regulate the lower spine speaker to be at a volume level 110% of that of the head speakers, by adjusting the gain of the lower spine speaker to be 110% of the gain of the head speakers. This same method can be used for each of the non-head speakers. Although each speaker has a different (independent) volume setting there will be no automatic volume adjustments as long as the SoundNumber™ system is turned OFF.

The oval buttons affect the head speaker setting directly and the spine, seat, and external speakers indirectly. Therefore, it is important to note that if one wishes to change only the volume of the spine, seat, or external speakers, one must adjust the percentages in the center box on the screen. For instance if the user wishes to decrease the lower spine speaker volume, then the user should lower the percentage for that speaker only.

The Dolby Midnight Mode button can toggle between ON and OFF. When this function is turned ON, it compresses the higher frequencies and expands the lower frequencies. Since people tend to perceive higher frequencies as louder, this function lowers the perceived ambient volume level. Users may consider using this function late at night when they don't want to disturb others.

Changing the SN or Head Volume settings will take effect in the Program that is being used. To save these settings for future use, the user must select Program from the PMC or PC screen and save these changes. If the user wishes to restore the defaults of a Program being used, the user may press the Restore Default button. It will restore the defaults of only those settings contained in the screen that the user is viewing.

Speaker Balance

Independent Balance settings are available for the Head and External speakers since each pair of speakers tend to be used side by side. A Balance setting is not available for the pair of Spine speakers because they are positioned vertically, one on top of the other. Each of the Spine speakers has a separate ♪ # or Volume control and as a result a Balance function would be redundant.

From the respective Head or External Speaker Control screen, the user may press the Balance button. The user may then use the left or right sides of the navigation buttons to position the balance in the desired location.

Changing the Balance settings will take effect in the Program being used. To save these settings for future use, the user must select Program from the PMC or PC screen and save these changes. If the user wishes to restore the defaults of a Program being used, the user may press the Restore Default button. It will restore the defaults of only those settings contained in the screen that the user is viewing.

Speaker Mixer

Figure 58:
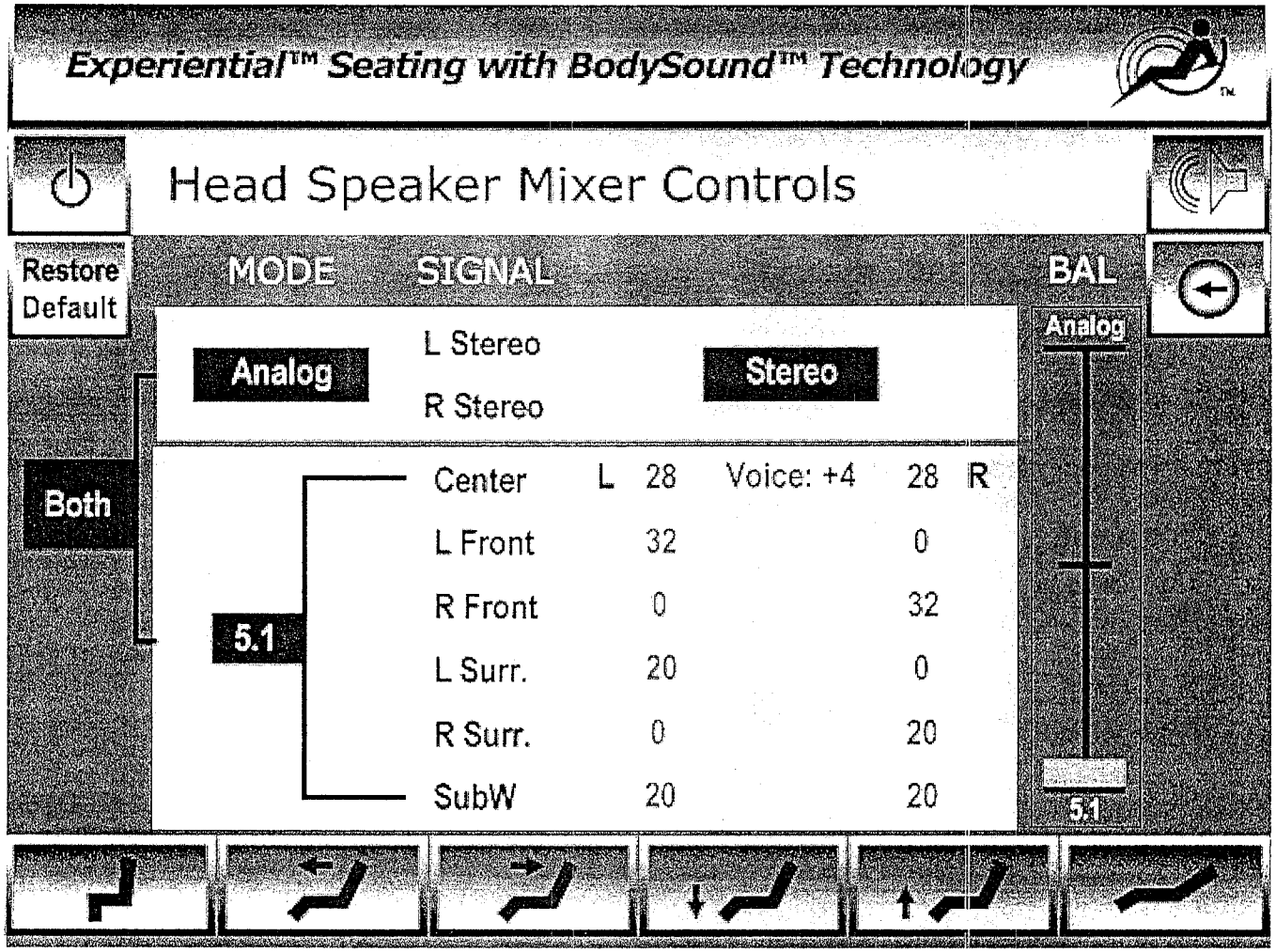
FIG. 58 is a view of a user interface Head Speaker Mixer Controls screen that can be used in accordance with the present invention.

The Mixer is used to assign the audio input signals or channels of a given Mode (Analog, Dolby 5.1, or Both) to the speaker outputs. From the respective Head, Spine, Seat, or External Speaker Control screen, one may press the Mixer button to access this speaker specific function. A view of a Head Speaker Mixer Control screen is shown in FIG. 58.

If the audio signal received by the BodySound™ amplifier is Analog then only the L Stereo and R Stereo audio input Mode signals will be active. The user has the ability to assign that signal to the respective speakers in a stereo format or change it to a Mono format. If the audio signal received is only Dolby 5.1 then the six Dolby 5.1 audio input Mode channels (center, L front, R front, L surround, R surround, and subwoofer) will be active.

Note: When an active Analog input is received by the BodyLink™ receiver, that signal is always sent to the lead seat amplifier in addition to any other input signal that has been selected.

If both Analog (that is inputted through the BodyLink™ Analog input) and Dolby 5.1 audio Modes are received by the BodySound™ amplifier, then all eight input channels will be active in the Mixer. In this instance the user will have a choice as to which Mode the user wishes to operate (Analog, 5.1, or Both). In this situation when eight channels of audio data are being received by the amplifier, the Mixer settings will default to the non-Analog signal selected at the BodyLink™ receiver. For instance, if the user selected to receive a signal from a DVD player that contained a 5.1 signal, and the user also had a stereo signal inputted into the Analog inputs that was also sent to the amplifier, the Mixer defaults would only be set for the 5.1 signal.

However, the user has the option of making changes to the Mixer settings to incorporate the stereo signal into the mix by pressing the Both button, since that button will also be active. If the user selects Both, then the Balance bar will become active. The Balance bar will allow the user to set the relative contribution of sound between the Analog and 5.1 inputs so that they will both play at the relative volume the user has set using the balance bar.

If a stereo signal has been selected that is routed through one of the BodyLink™ inputs (other than Analog) and another stereo signal is also being inputted into the Analog BodyLink™ inputs then both stereo signals will be sent to the lead BodySound™ amplifier. In this instance the Mixer's Mode selection will be Analog, Stereo, or Both. In this situation when four channels of audio data are being received by the lead BodySound™ amplifier the Mixer defaults will be set to correspond to the signal selected at the BodyLink™ receiver (the non-Analog input).

The user has the option of making changes at the level of the Mixer to incorporate the second stereo signal into the mix by pressing the Both button. If the user selects Both, then the Balance bar will become active. The Balance bar will allow the user to set the relative contribution of sound between the Analog and Stereo inputs so that they will both play at the relative volume the user sets. Once the user has made any changes in Play mode, the user can save these settings as one of the Programs, so that the Mixer will be set properly when the saved Program is used in the future.

To operate the Mixer, one selects a button in one of the speaker columns to be highlighted. Then one uses the up/down portion of the navigation button to adjust the value up or down. The value selected represents the proportion of the speaker output that is derived from that particular Channel (signal source). If the value selected for Subwoofer contribution is set to 50 in the Lower Spine speaker column, then 50% of the output of the Lower Spine speaker is derived from the Subwoofer signal.

When the user leaves this screen, if the numbers in each of the Analog and 5.1 portions of the speaker columns do not add up to 100, the system will divide the number in each box in those parts of the columns by the sum of all the numbers in those parts and multiply the quotients by 100 to obtain a percent value for every box. The numbers displayed are integer values and as a result the total may appear to be somewhat less than 100.

Changing the Mixer settings will take effect in the Program being used. To save these settings for future use, the user must select Program from the PMC or PC screen and save these changes. If the user wishes to restore the defaults of a Program being used, the user may press the Restore Default button. It will restore the defaults of only those settings contained in the screen that the user is viewing.

Speaker EQ (Equalizer)

The Equalizer (EQ) function allows the user to filter the mixed audio signal before it is outputted by the speakers. This function can be independently applied to the audio signals sent to each of the Head, Spine, and External speakers and the seat driver.

Note: If the user is adjusting the EQ filter to create more bass for the purpose of feeling more, the user should first make sure that the volume setting for the seat speaker is set high enough for the user. Making the seat speaker louder will create more vibration than simply increasing the low frequency content of the sound. The user should also consider increasing the BodyNumber™ setting before increasing the bass frequencies.

To access the EQ function to filter the speaker output, the user may press the EQ button from the respective Head, Spine, Seat, or External Speaker Control screen.

Note: the user has the ability to filter the generated Frequency Array for the BodyNumber™ System twice. It is filtered once before it is mixed with the audio content to the respective speakers and then again when the EQ function is applied to that speaker. The same applies to the generated Frequency Array associated with the FeelNumber™ System for output through the External speakers. To filter the SHF Arrays, the user may press the EQ button from the respective SHFA-BN or SHFA-FN screen.

To operate the Equalizer, one can press a single frequency bar in the chart shown on the screen by touching it (it will be highlighted). When a single frequency bar is highlighted and the user wishes to move to an adjacent bar, the Left/Right function of the navigation buttons may be used. Once the bar of interest is highlighted, the user may press Select on the navigation button and then use the Up/Down function of the navigation buttons to make the adjustments.

The EQ screen also contains buttons that will allow the user to choose a specific speaker within a pair of speakers when the user is applying this function to the Head, Spine, or External speakers. If the user selects the button labeled Both, the changes made will be applied to both speakers of the pair. The user can also select the Display button to compare the EQ settings between the pair of speakers.

Changing the EQ settings will take effect in the Program being used. To save these settings for future use, the user must select Program from the PMC or PC screen and save these changes. If the user wishes to restore the defaults of a Program being used, the user may press the Restore Default button. It will restore the defaults of only those settings contained in the screen that the user is viewing.

Virtual Surround Sound

Virtual Surround Sound or VSS is the virtual creation of surround sound using the audio data supplied to the head speakers. One can access this function by pressing the VSS button in one of the Head Speaker Control Screens. The user can turn the VSS function on or off by pressing the Virtual Surround Sound status button (it will be labeled "ON" or "OFF" depending on whether this function is turned "ON" or "OFF" respectively). One may press this button to change the status.

The user should use the factory default settings in the Mixer when in 5.1 Mode for VSS to function best, but the user should not hesitate to experiment because the user can always press the RD button and restore the default settings.

The Voice setting either adds or subtracts audio volume from the center channel in the 5.1 Mode, which conveys dialogue, by adding to or subtracting some of that signal from the Mix. One may use the Up/Down function of the navigation buttons once the Voice button is highlighted to adjust whether the user wants to hear the dialogue louder or softer respectively. Whatever change the user adds or subtracts from the center channel using the Voice setting will be reflected and also displayed in the Mixer settings.

When using VSS the user can also adjust the spatial characteristics of the sound. The user is able to reduce or expand the horizontal and vertical sound space. The user may press either the box containing the horizontal or vertical bar located in the head pictographs. Once selected, the box will be highlighted. Then the Up/Down function of the navigation buttons may be used to expand or reduce the sound space respectively.

Changing the VSS settings will take effect in the Program being used. To save these settings for future use, the user must select Program from the PMC or PC screen and save these changes. If the user wishes to restore the defaults of a Program being used, the user may press the Restore Default button. It will restore the defaults of only those settings contained in the screen that the user is viewing.

Generated Frequency Array, or SHFA (Sub-Harmonic Frequency Array)

The technology of the system in accordance with the present invention allows the seat of a seating configuration to vibrate without forcing the user to turn up the volume. The user determines how much vibrational energy the seat generates. Other technologies exist that transfer only low frequency sound energy into the seat. This only allows the user to feel certain parts of the soundtrack, typically explosions or crashes. However, the BodyNumber™ system can translate all of the sound frequencies found in the soundtrack (low, mid, & high) into frequencies that the body can feel. A user can feel the music and the voices, the rush of the wind, the trickle of rain, and the rhythm of ocean waves. The user may even notice how much more dramatic silence feels.

To access the BodyNumber™ System screen, the user may press the Body # button on the Seat Speaker Control Screen.

The BodyNumber™ setting (range 0 to 100) is used to specify the amount and magnitude of the sub-harmonic or translated frequencies that can be played through the speakers. The circled number below the oval BodyNumber™ button shows the setting. The BodyNumber™ setting must be above "0" in order for this function to be turned on. The higher the setting, the more the user will feel as a result. The content of what the user is hearing from the head speakers will remain unchanged since the SHFA or translated Frequency Array content cannot be added to the Head speaker signal in the Mixer.

The user can adjust the BodyNumber™ setting by pressing the up or down sections of the oval button or by highlighting the BodyNumber™ button with the navigation buttons, pressing the center select button, and then using the Up/Down function of the navigation buttons.

There are a number of BodyNumber™ templates to choose from. These templates are designed to maximize vibration from each of the specific types of programming. The user may select the template that best matches the program material the user is listening to. Examples of templates include Movies, Music, Sports, and Games.

To customize how the Sub-Harmonic Frequency Array or translated Frequency Array is calculated, the user may press the "Peak Detection" button. This will take the user to a new screen with a number of options. The user can also change the EQ applied to the Frequency Array to reduce the higher frequency content within the Frequency Array. In addition the user can determine how much BodyNumber™ content to Mix into the Spine speakers and seat driver.

Changing the Peak Detection settings will take effect in the Program being used. To save these settings for future use, the user may select Program from the PMC or PC screen and save these changes. If the user wishes to restore the defaults of a Program being used, the user may press the Restore Default button. It will restore the defaults of only those settings contained in the screen the user is viewing.

BodyNumber™ Mixer

Figure 59:
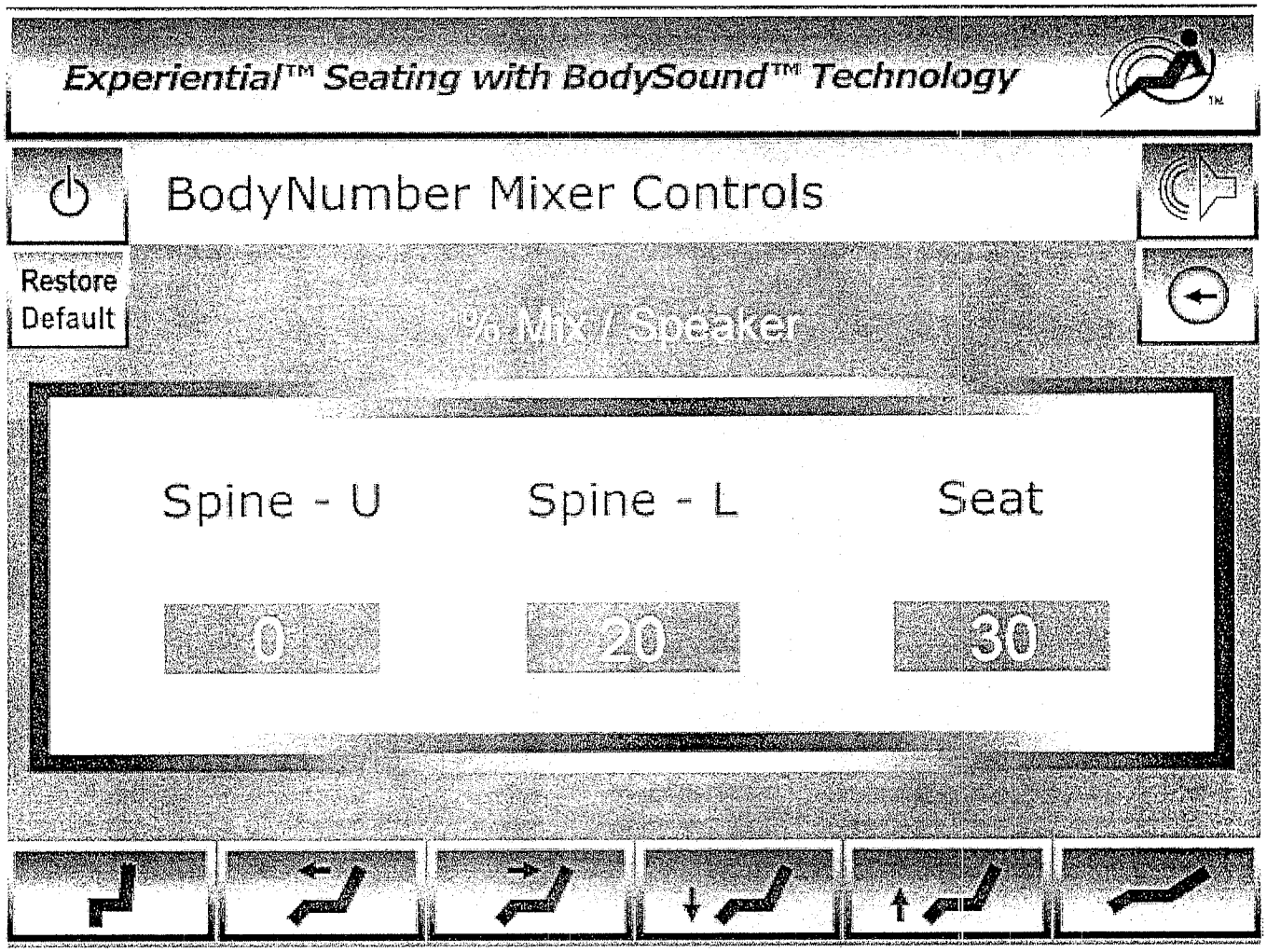
FIG. 59 is a view of a user interface BodyNumber™ Mixer Controls screen that can be used in accordance with the present invention.

For the Spine and Seat speakers there is the ability to mix in the generated sub-harmonic Frequency Array or translated Frequency Array associated with the BodyNumber™ system. The generated Frequency Array contribution into the mix will be additive to the other signals. A view of a BodyNumber™ Mixer Control screen is shown in FIG. 59.

The higher the user chooses to make the BodyNumber™ contribution, the more likely the user is to experience sound distortion through the respective speaker. If the user hears distortion, the user should reduce the BodyNumber™ contribution.

Changing the BodyNumber™ Mixer settings will take effect in the Program being used. To save these settings for future use, BodyNumber™ may select Program from the PMC or PC screen and save these changes. If the user wishes to restore the defaults of a Program being used, the user may press the Restore Default button. It will restore the defaults of only those settings contained in the screen that the user is viewing.

FeelNumber™ Mixer

For the External speakers there is the ability to mix in the generated sub-harmonic Frequency Array or translated Frequency Array associated with the FeelNumber™ system. The generated Frequency Array contribution into the mix will be additive to the other signals.

The higher the user chooses to make the FeelNumber™ contribution, the more likely the user is to experience sound distortion through the respective speaker. If the user hears distortion, the user should reduce the FeelNumber™ contribution.

Changing the FeelNumber™ Mixer settings will take effect in the Program being used. To save these settings for future use, the user may select Program from the PMC or PC screen and save these changes. If the user wishes to restore the defaults of a Program being used, the user may press the Restore Default button. It will restore the defaults of only those settings contained in the screen that the user is viewing.

EQ Filter

The EQ Filter function allows the user to filter the generated BodyNumber™ and FeelNumber™ signals before they are mixed with the other audio signals in the Mixer. To access the EQ Filter function, the user may press the EQ Filter button from the respective SHFA-BN or SHFA-FN screen.

To operate the EQ filter, the user may first press the BN or FN button toward the top of the screen depending upon whether the user wishes to filter the BodyNumber™ or FeelNumber™ signal. If the user wants to filter them both using the same EQ Filter settings, the user may press the Both button. If the user wants to display both of them, the user may press the Display button to visualize and compare their respective filter settings.

Once the user has the desired group of settings on the screen, the user can press a single frequency bar in the chart shown on the screen by touching it (it will be highlighted). When a single frequency bar is highlighted and the user wishes to move to an adjacent bar, the Left/Right function of the navigation buttons may be used. Once the user has the bar of interest highlighted, the user may press Select on the navigation button and then use the Up/Down function of the navigation buttons to make adjustments.

Changing the EQ Filter settings will take effect in the Program being used. To save these settings for future use, the user may select Program from the PMC or PC screen and save these changes. If the user wishes to restore the defaults of a Program being used, the user may press the Restore Default button. It will restore the defaults of only those settings contained in the screen that the user is viewing.

Generated Frequency Array Peak Detection

The technology of the system of the present invention enables the creation of a set of generated sub-harmonic or translated frequencies (SHF) from music, soundtracks, or TV broadcasts that a user is listening to. These generated frequencies are a translation of higher frequencies that a user mainly hears to lower frequencies that a user can feel. This process dramatically enhances the user's experience.

Figure 60:
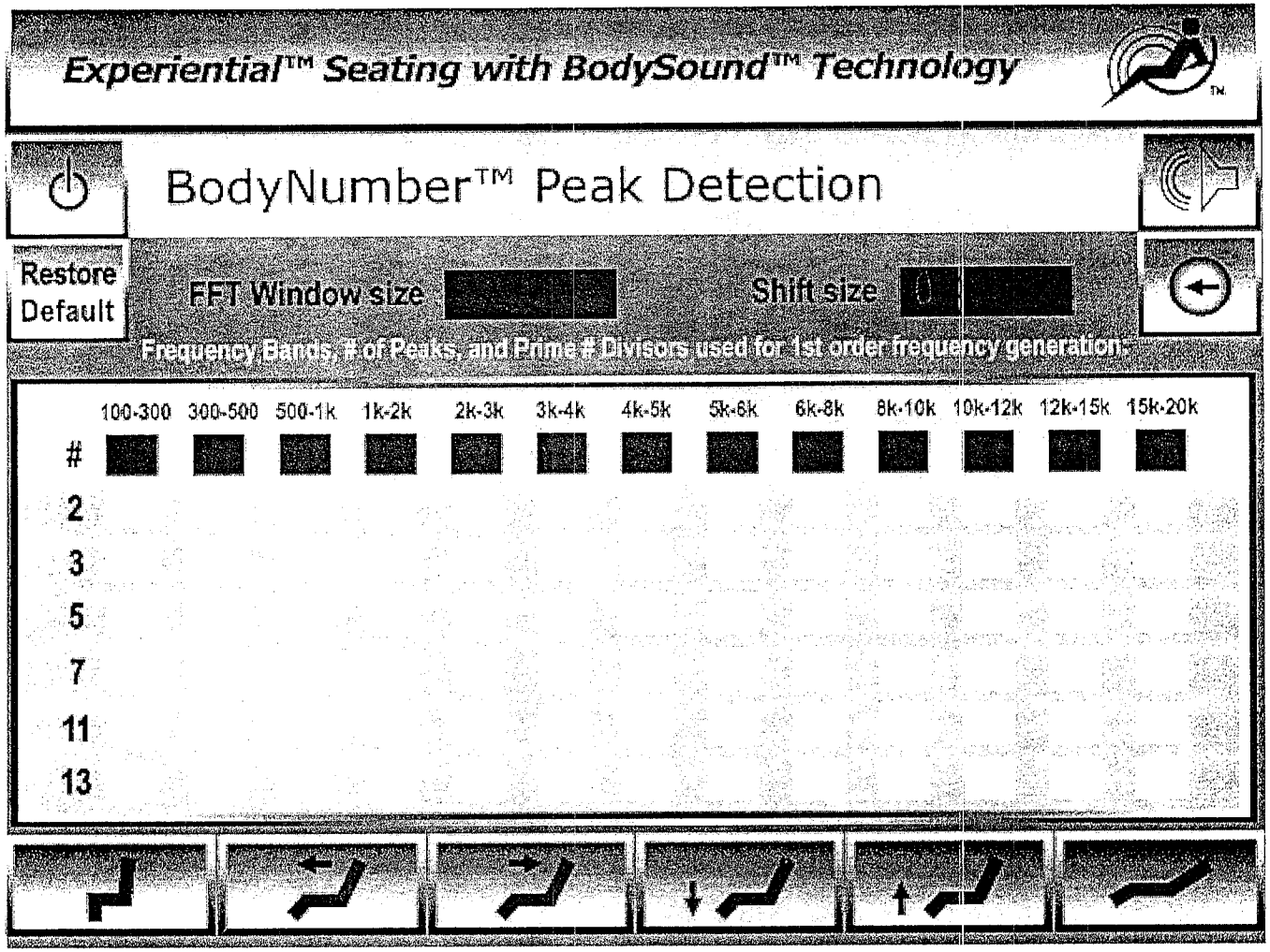
FIG. 60 is a view of a user interface BodyNumber™ Peak Detection screen that can be used in accordance with the present invention.

Using the BodyNumber™ Peak Detection screen allows the user to modify the number and type of SHF that are generated. A view of a BodyNumber™ Peak Detection screen is shown in FIG. 60. There are two ways to increase the number of SHF. The first is to increase the number of peaks detected within any of the frequency bands. The higher the number of peaks detected, the greater the number of primary frequencies that will be used from which the SHF array will be created. Pressing directly on the button below each frequency band will change the number of peaks (range=0 to 3).

If an algorithm that uses prime numbers as divisors in the creation of the SHF array is used, increasing the number of prime numbers used as divisors in the creation of the SHF array is the second way to increase the size of the SHF array. Each of the peaks identified within the frequency bands are divided by the prime numbers (2, 3, 5, 7, 11, and 13) selected in order to generate $1^{st}$ order sub-frequencies. These $1^{st}$ order frequencies are subsequently halved repeatedly until the quotient is less than ten Hz (hertz=cycles/second), thereby creating the SHF array. The SHF array is then band-pass filtered (EQ Filter button on a previous screen) and then played through the spine speakers and seat driver and the external speakers if present, provided that Body# and Feel# functions are set to "On" respectively. The Body# and Feel# settings adjust the magnitude of the SHF played through the respective speakers/drivers.

The Window size and Shift size settings affect the degree of frequency resolution and the timing and specificity between the SHF and the original audio data, respectively. Increasing the window size increases the frequency resolution. Increasing the shift size causes more of a delay between what is heard and what is felt, but the resultant SHF array is a better representation of what has just been heard. The timing delay is approximately one-third to one-half of the window size in milliseconds, so the delays are minor, particularly since users are used to hearing things before they can feel them. The Window size must be a multiple of the shift size, so when one setting changes, the other automatically changes too.

The Peak Detection settings are used for both the BodyNumber™ and FeelNumber™ systems. Changing these settings for one system changes them for the other.

Changing the Peak Detection settings will take effect in the Program being used. To save these settings for future use, the user may select Program from the PMC or PC screen and save these changes. If the user wishes to restore the defaults of a Program being used, the user may press the Restore Default button. It will restore the defaults of only those settings contained in the screen that the user is viewing.

Massage

Pressing the Massage button from any of the Seat Speaker Control screens will take the user to the first of three Massage Controls screens. The user has the option of using one or two different massage generators (each can deliver a different frequency and amplitude). To turn on either or both Massage generators, the user may press the corresponding Massage generator button until the label on the button is ON.

The wave(s) generated can be shaped as either sine or triangle wave(s) (the user may press the button to toggle wave shape). The frequency and amplitude of the wave(s) can be changed by pressing the corresponding button or highlighting it with the navigation buttons and using the up/down portion of the navigation buttons to change the values.

If the Modulation generators are OFF (Massage Modulation Controls screen—press the Modulation button in the Massage Controls screen) then the resultant waves will reflect the static frequency and amplitude settings that are available on the Massage Controls screen. Turning on the Modulation Generators in the Modulation Controls screen allows the user to both frequency and amplitude modulate each of the generated signals. When the Modulation Generator buttons are ON the static frequency and amplitude settings in the initial Massage Controls screen will be disregarded and grayed-out.

If the Massage Generator button is OFF for either Generator 1 or 2, then the Modulation and Mixer settings for that Generator will be grayed-out. The modulation controls allow the user to ramp the frequency and or amplitude of the waves up and/or down. The user can ramp the frequency one way and the amplitude the other way. The user has the ability to set the cycle time, making it longer or shorter, and the user can alter the shape of the ramp (sine, triangle, square, saw-tooth up, and saw-tooth down).

The Massage Mixer screen can be accessed by pressing the Massage Mixer button on the initial Massage Controls screen. These values are applicable regardless of whether the Massage Generators are operating in static or modulation modes.

Changing the Massage settings will take effect in the Program being used. To save these settings for future use, the user must select Program from the PMC or PC screen and save these changes. If the user wishes to restore the defaults of a Program being used, the user may press the Restore Default button. It will restore the defaults of only those settings contained in the screen that the user is viewing.

FeelNumber™ System

The FeelNumber™ system is very similar to the BodyNumber™ system with one main difference—the resultant generated waveform is played through the External speakers and not the seat or spine speakers. Additionally, the EQ Filter settings that are applied to this waveform can be different from those that are used for the BodyNumber™ system. It is important to note that the Peak Detection settings are the same for both systems so if a user makes a change to them for the FeelNumber™ system, they will also change for the BodyNumber™ system.

To access the generated sub-harmonic Frequency Array or translated Frequency Array for the FeelNumber™ System screen, the user may press the Feel # button on the External Speaker Control Screen. The FeelNumber™ setting (range 0 to 100) is used to specify the amount and magnitude of the generated frequencies that can be played through the External speakers. The circled number below the oval FeelNumber™ button shows the setting. The FeelNumber™ setting must be above "0" in order for this function to be turned on. The higher the setting, the more the user will feel as a result. The content of what the user is hearing from the head speakers will remain unchanged since the generated Frequency Array content cannot be added to the Head speaker signal.

The user can adjust the FeelNumber™ setting by pressing the up or down sections of the oval button or by highlighting the FeelNumber™ button with the navigation buttons, pressing the center select button, and then using the Up/Down function of the navigation buttons.

There are a number of FeelNumber™ templates to choose from. These templates are designed to maximize sound from each of the specific types of programming. The user may select the template that best matches the program material the user is listening to. Examples of templates include Movies, Music, Sports, and Games.

To customize how the sub-harmonic or translated Frequency Array is calculated, the user may press the "Peak Detection" button. This will take the user to a new screen with a number of options. The user can also change the EQ applied to the generated Frequency Array to reduce the higher frequency content within the generated Frequency Array. In addition the user can determine how much FeelNumber™ content to Mix into the External speakers.

Changing the FeelNumber™ settings will take effect in the Program being used. To save these settings for future use, the user may select Program from the PMC or PC screen and save these changes. If the user wishes to restore the defaults of a Program being used, the user may press the Restore Default button. It will restore the defaults of only those settings contained in the screen that the user is viewing.

Program Controls (PC)

The Programs Control or PC screen provides access to many of the system functions on-screen at the same time. This screen is useful to gain a quick overview of how most of the system is working. It also provides direct access to the universal remote control via the entertainment device buttons, BodyLink™ and Amp Input control, Sound#, Body#, and Feel# settings, and access to the other amplifier functions through the speaker array buttons. Additionally, by pressing the Programs button the user can access the Programs Screen to save, name, and select Programs.

This screen is organized in functional blocks. Selecting a block can enlarge it depending upon the Enlarge setting in the System Settings screen. The user may turn Enlarge to ON if the user is having difficulty viewing or operating this screen.

Programs

The Programs screen allows the user to save, select, and name Programs. If the user started in Play mode and changed a number of settings that the user wishes to save for future use, the user may press Programs in the Play Mode Controls screen (PMC Screen). If the user was using the Program Controls screen (PC Screen), the user can also press the Programs button to save a new Program or re-save a Program in which the user has changed some settings. When saving a Program for the first time it, the user may give it a unique name so that the user can recognize it in the future. The user can re-name a saved Program at any time.

If the user has previously saved Programs and wishes to select one, the user may press Program from the Main Menu. If the user has been operating one program and wishes to select another, the user can do so at any time from the Main Menu, PMC Screen or PC Screen.

Diagnostics Menu

Pressing the Diagnostic button in the Main Menu takes you to the Diagnostic Menu. From this menu the user can access Test Inputs, Test Outputs, or Test Analysis functions.

The Test Inputs button allows the user to test the inputs to the amplifier for any seat the user is connected to in the configuration, to test inputs to the BodyLink™ receiver, and to check the Mode of the audio signal(s) entering the amplifier.

The Test Outputs button allows the user to test the function of each of the speakers independently.

The Test Analysis allows the user to perform a frequency analysis of a signal to determine that the processing function of the amplifier is operating correctly.

Test Inputs Menu

Pressing the Test Inputs button from the Diagnostic Menu will take the user to this screen. Testing Inputs allows the user to test the inputs to the amplifier for any seat the user is connected to in the configuration, to test inputs to the BodyLink™ receiver, and to check the Mode of the audio signal(s) entering the amplifier.

Pressing the Amp Inputs button will take the user to the same Amp Input Screen that is used in Play Mode (when the user selects Play from the Main Menu) with one addition. On this screen the user can change the seat amplifier of interest so that while the user is using this screen, the user can check the input signal to all of the amplifiers that the user is connected to.

Pressing the BodyLink™ button will take the user to the same BodyLink™ Screen that is used in Play Mode (when Play is selected from the Main Menu). This screen will show the user the active inputs that are being received by the BodyLink™ receiver.

Pressing the Signal Mode button will take the user to the Test Signal Mode screen, which allows the user to check the type(s) of signal(s) received by the amplifier of choice and the current mode setting.

Test Signal Mode

Pressing the Signal Mode button from the Test Inputs Menu will take the user to the Test Signal Mode screen. This screen allows the user to check the type(s) of signal(s) received by the amplifier, the current mode setting, and the Line Level Input Voltages for the Analog and Auxiliary audio signals.

Also on this screen is the BodyLink™ Analog Gain button, which allows the user to increase the gain (unity, 2×, 4×, and 8×) of the Analog signal, which the user will want to do if the Line Level Input Voltage of the Analog signal is less than 25% of full scale. This gain button does not amplify the Auxiliary signal.

Test Outputs

Pressing the Outputs button from the Diagnostic Menu will allow the user to test each of the speakers independently from any seat amplifier that the user is connected to.

The user may select a signal source (a 1000 Hz tone or the current source that has been selected as the Amp Input) and then choose a speaker. If the seat driver is chosen with the 1000 Hz tone, a 100 Hz tone will play instead. The user may listen to that speaker to ensure that it is working properly. In this situation, the Mixer settings the user was using will be by-passed in order to send the chosen signal source directly to the speaker being tested.

Test Analysis

Pressing the Analysis button from the Diagnostic Menu will allow the user to perform a frequency analysis of a signal to determine that the processing function of the amplifier of interest is operating correctly.

The user may press either the 1000 Hz button or the Current Source button to choose the signal to be analyzed. The screen will update approximately once per second with a spectral plot of power (y-axis) over frequency (x-axis). Each line plotted represents one second of data. As the analysis proceeds new lines of data will appear at the bottom of the display and the older data will be shifted upward.

If the user wishes to also see a plot of the analysis of the generated sub-harmonic or translated Frequency Array, the user may press the "+" button and the display graph will subdivide showing both results. If the user only wishes to see a plot of the analysis of the generated Frequency Array, the user may press the SHF Array button.

To save (to a USB memory stick which will need to be inserted into the USB port on the top of the Control Screen) the analysis results, the user may press the Save Analysis button.

BodyLink™ Receiver

Once turned on, using an on/off switch or the Controller, the BodyLink™ receiver can be operated using the selection buttons on the front panel or the Controller remotely. Turning the BodyLink™ receiver off using the on/off button on the front panel puts the receiver in a low power state, still capable of being turned on remotely with the Controller. The left and right select buttons on the Controller scroll through the seven input choices. As a user scrolls through the possible selections, they will appear on the display followed by the signal status for that input. If there is an active signal found for that input, the status will read "Active" versus "No signal" when no signal is found. The audio signal that is associated with the input selected is transmitted to the amplifier under the lead seat.

If the wired Cat5 connection between the BodyLink™ receiver and the amplifier is used, up to eight channels of audio signals can be transmitted. When HDMI 1 or 2 or Optical 1-4 is selected and there is an active Analog signal present as well, the status indicator will show "Active+Analog" and the Analog signal will also be transmitted. The Analog signal will only be audible if one chooses to add those signals in the Mixer. If a user only wishes to transmit the Analog signal, the user may select Analog Only.

When using wireless transmission, only a six channel Dolby 5.1 AC3 bit stream or a two channel stereo signal can be transmitted to the amplifier. Even when the status indicator shows "Active+Analog," only the active selected input (and not the Analog signal) will be transmitted unless one selects Analog Only, and then only the Analog signal will be transmitted.

Alternative Embodiments

Figure 61:
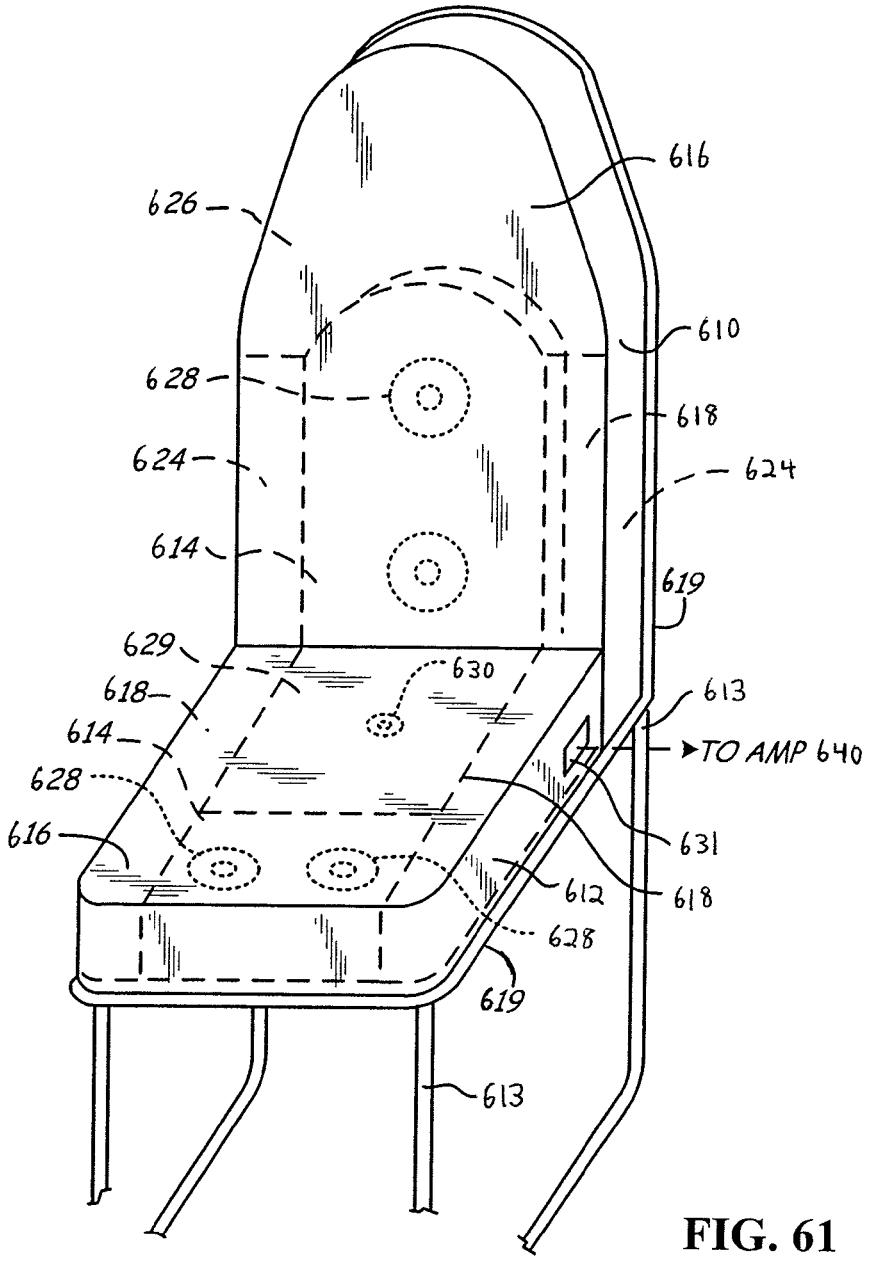
FIG. 61 is a perspective view of a chair incorporating aspects of the present invention.

As shown in FIG. 61, in an alternative embodiment the subject invention includes a chair having a back pad 610 and a seat pad 612 and frame 613. Each pad 610, 612 is comprised of a covering layer 616, surrounding foam 618, and a speaker module 614. The speaker module 614 is disposed within the pad 610, 612 and is surrounded by the covering layer 616 and the surrounding foam 618. Speaker modules 614 each include a pair of speakers 628. In a preferred embodiment of the invention, a user's thighs would be located approximately above the two speakers 628 of seat pad 612, and a user's lower and upper spine would align with two speakers 628 of the back pad 610. A base 619 forms a lower layer of the pads 610, 612. In the illustrated embodiment, base 619 is a plywood element. In the illustrated embodiment, pads 610, 612 are adapted to be secured to a chair frame 613 using known securement devices, such as threaded fasteners engaging base 619, etc. In alternative embodiments, pads 610, 612 may simply rest upon an underlying support.

Embodiments of the present invention may be adapted for use with an electronics package including one or more activation switches 630, volume control switches (such as potentiometers) 631, and an amplifier 640. Amplifier 640 and/or volume control switches 631 may be internally disposed within pads 610, 612 or may be external to the pads and in electrical communication therewith. Those of ordinary skill in the art would appreciate a variety of different electronics packages useful to power the speaker 628 of pad 610, 612. For example, a wireless remote control may be utilized to control operation of an amplifier 640. In another example, amplifier 640 may be utilized to power additional speakers external to the pads 610, 612. The routing approaches of various cables necessary to power the speakers 628 and to communicate with switches 630, 631 within pads 610, 612 would be within the skills held by those of ordinary skill in the art.

Back Pad 10

Figure 62:
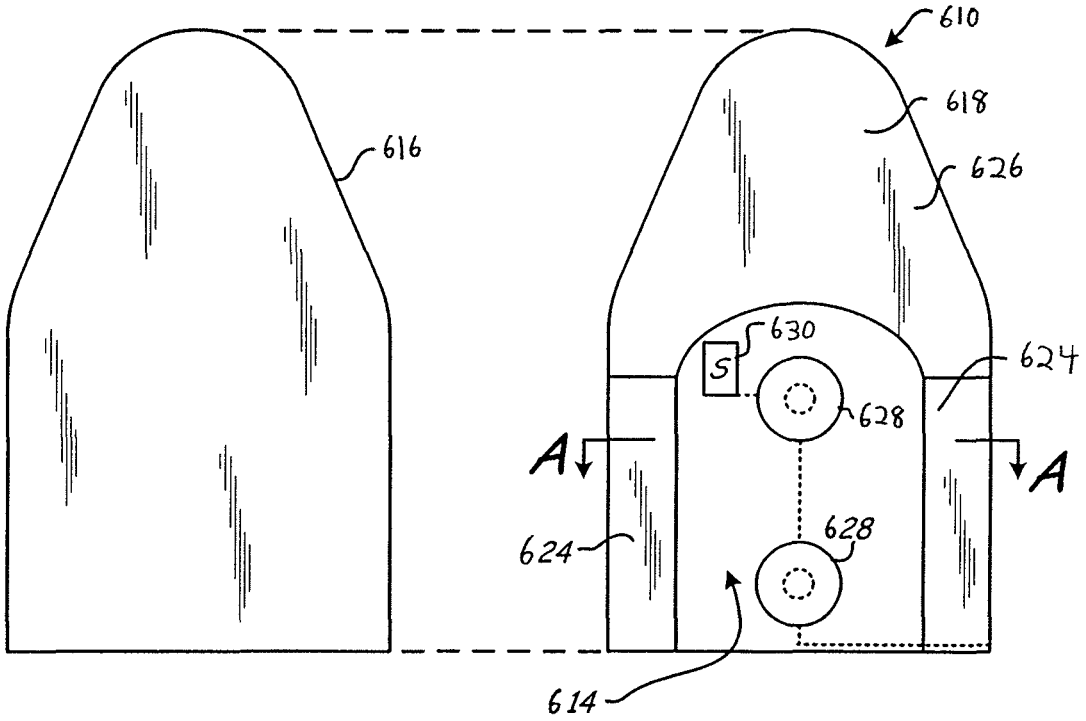
FIG. 62 is a side elevational view of a partially disassembled back pad of the chair of FIG. 61.
Figure 63:
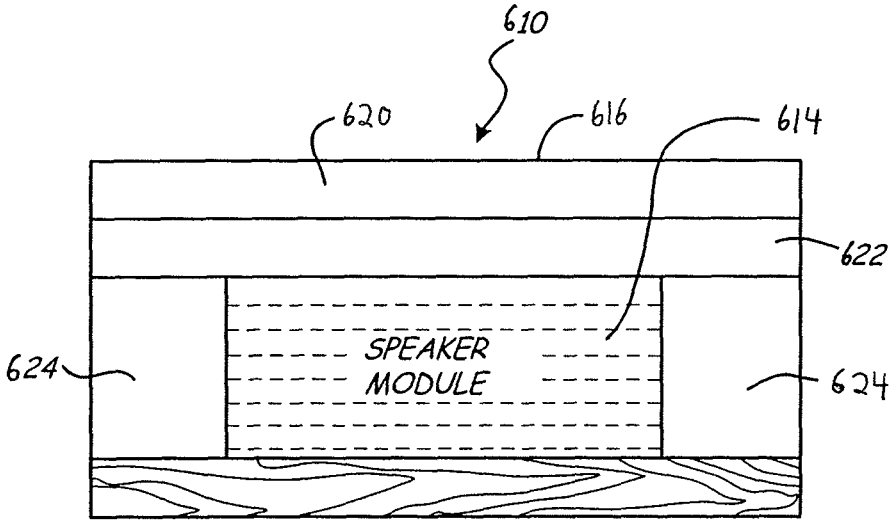
FIG. 63 is a cross sectional view the back pad taken along lines A-A of FIG. 62.
Figure 64:
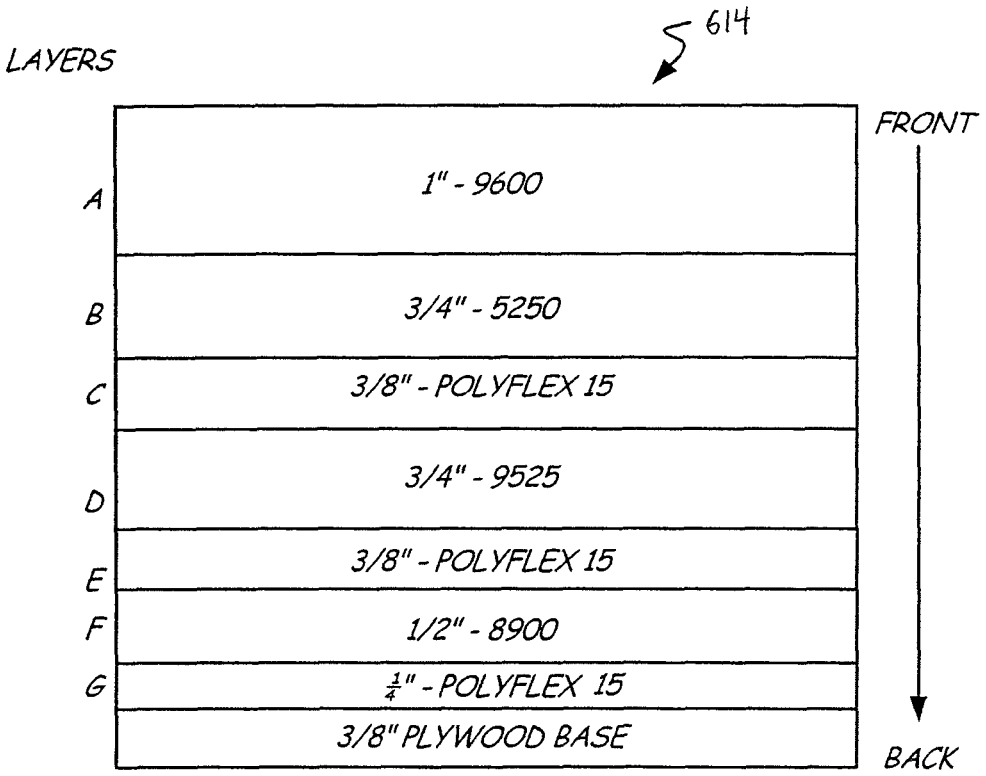
FIG. 64 is a diagrammatic view of the plurality of different layers comprising the speaker module of the back pad of FIG. 62.
Figure 65:
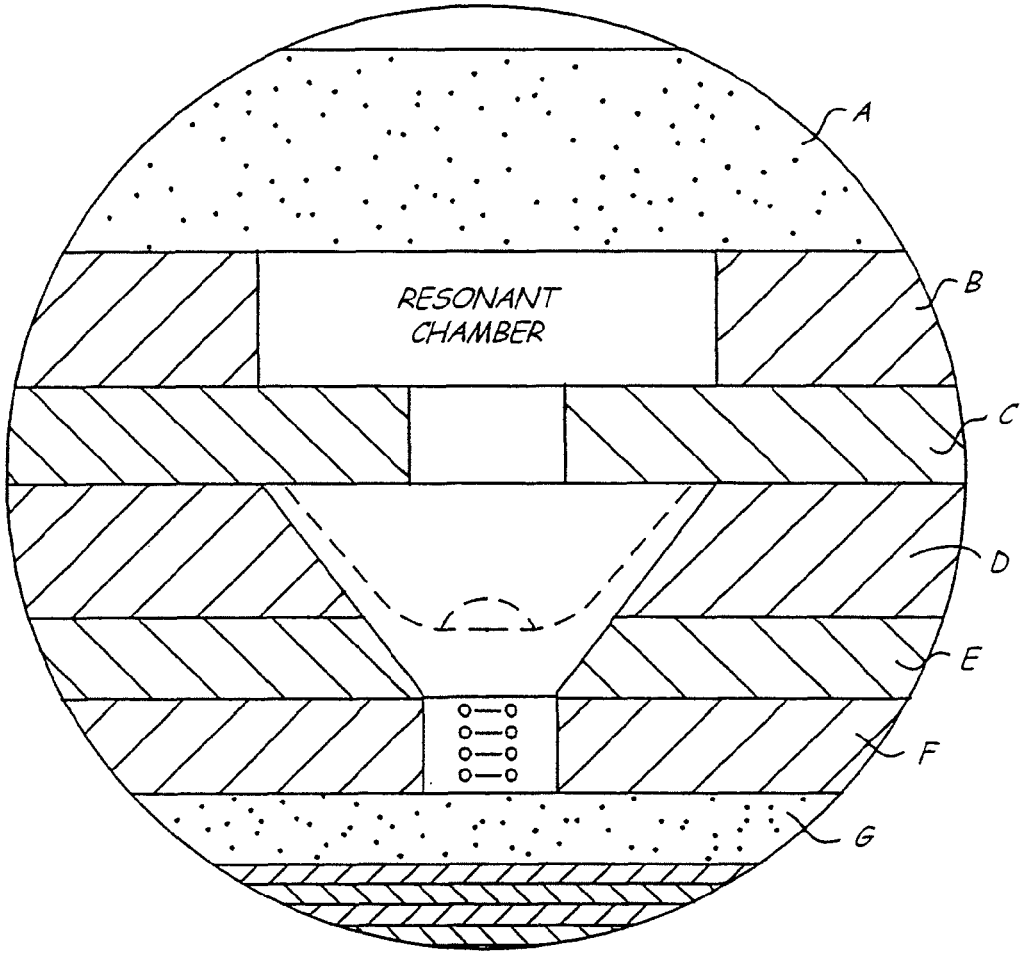
FIG. 65 is a diagrammatic view of the speaker module of the back pad of FIG. 62 illustrating placement of the speaker and resonant chamber within the speaker module of the back pad.
Figure 66:
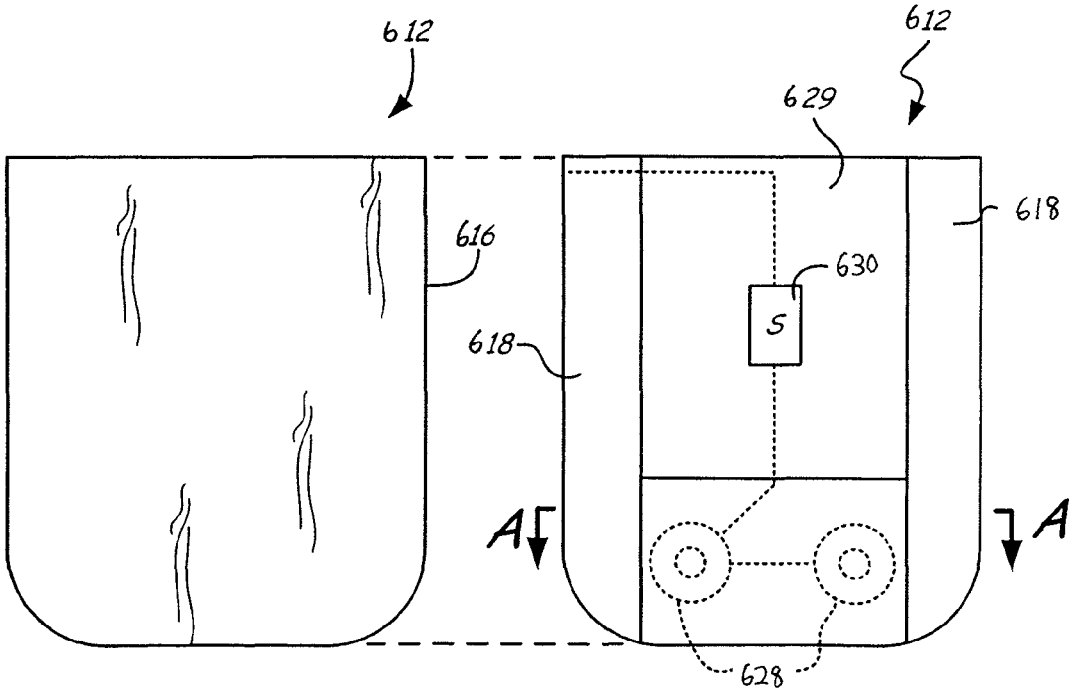
FIG. 66 is a top plan view of a partially disassembled seat pad of the chair of FIG. 61.
Figure 67:
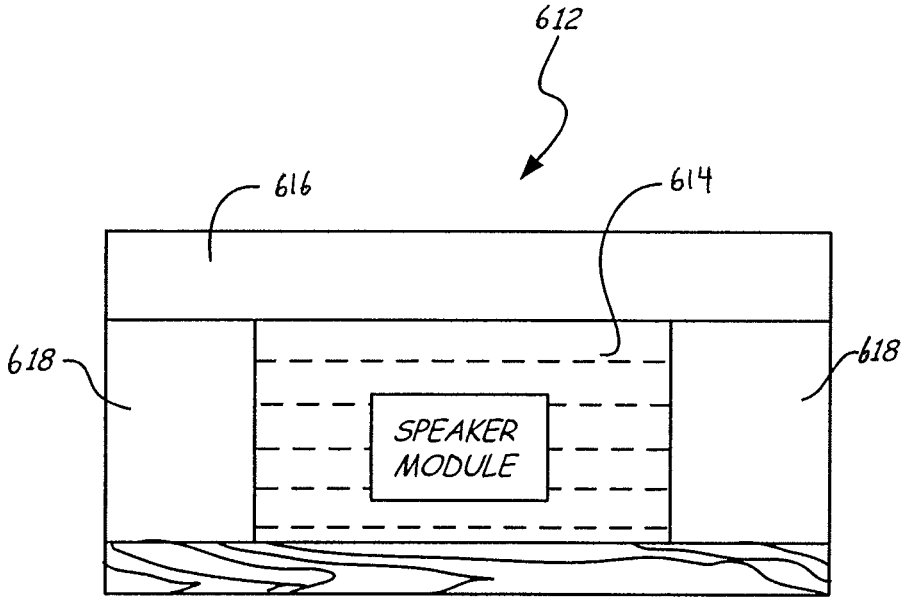
FIG. 67 is a cross sectional view the seat pad taken along lines A-A of FIG. 66.

FIGS. 62-65 illustrate elements of a preferred embodiment of a back pad 610 according to the present invention. FIG. 62 is a side elevational view of a partially disassembled back pad 610. FIG. 63 is a cross-sectional view of the back pad of FIG. 62 taken along lines A-A. FIG. 64 depicts various materials of construction of the speaker module 614 of back pad 610 of FIG. 62. FIG. 65 is a diagrammatic cross-sectional view taken through the speaker module 614 of back pad 610 of FIG. 62.

Referring to FIG. 63, in the illustrated embodiment of the back pad 610, the covering layer 616 is comprised of two layers, 620, 622. Both layers 620, 622 are designed to be very compressible to conform to the user's head and back for comfort purposes and to allow sound and vibration energy to pass with minimal filtration and obstruction. The top covering layer 620 is made of a highly porous material through which sound and vibrations can readily penetrate. The top covering layer 620 is preferably made of a reticulated polyurethane filter foam. The bottom covering layer 622 lies just under the topmost layer and is made of a ¾ ounce fiber that also has limited sound and vibration filtering. In comparison, the seat pad 612 has a covering layer 616 comprised of a single layer.

Referring to FIGS. 62 and 63, the surrounding foam 618 of back pad 610 has three elements, including two lateral elements 624 which are located on either side of the speaker module 614 and one top element 626 which is located substantially above the speaker module 614. The lateral elements 624 are approximately 4 inches in thickness approximating the thickness of the speaker module 614. The top element 626 is approximately 3⅝ inches thick, 14.5 inches at its greatest height and 23 inches at its greatest width. It is less thick than the speaker module 614 so that the user's upper back and shoulders can be positioned more comfortably in a more natural posterior position. Preferably, the foam and other material in the surrounding foam 618 must not substantially resist the user in leaning back so that it can afford greater comfort while sitting or reclining, as a person's shoulders and shoulder blade area are naturally positioned more posterior than the lumbar region in many people. Preferably, the foam used in the surrounding foam 618 is not as sound conductive as the elements of the speaker module 614. One preferred material for the surrounding foam 618 is a polyurethane foam material with a density of about 0.9 to 1.1 lbs/ft$^3$ and an indent force deflection at 25% of about 612 to 618, all properties measured using the ASTM D-3574-86 testing methods. An example of a suitable polyurethane foam for use in the present invention is "1675" Foam available from Amcon/VAS, Minneapolis, Minn., although other materials meeting these characteristics are also suitable for use in the present invention.

In one embodiment, the speaker module 614 for the back pad 610 includes foam to support and protect the speakers 628 and to maximize the conductance of sound and vibration to the user. In addition, the foam of speaker module 614 is a stiffer protective foam which provides more postural support than the softer surrounding foam 618. The thickness of the speaker module 614 and/or the covering layer 616 can be increased, particularly in the area proximal to the lowermost speaker to create further lumbar support. Alternatively, a lumbar support pillow can be used at this location.

FIG. 64 shows a layer-by-layer view of one embodiment of the speaker module 614 of the back pad 610. The layers of the pad of the present invention can be of any thickness suitable to support the user comfortably and through which sound and vibrations can be transmitted and experienced by the user. Although the layers can be of any thickness, it is preferable to minimize the separation between the speakers and the user's body to maximize the transmission of sound and vibration into the body. Layers A, B, C, D, E and F help to form chambers around the speakers and provide orientation and support for the speakers. The speaker chambers form a resonant chamber portion formed by apertures in layers overlaying the speaker. The resonant chamber space is air-filled between layers A and the speaker cone at the level of layer D.

Referring to FIGS. 62, 64 and 65, layers A and B also provide cushioning between the user and the speakers and stiffer foam of layer C, particularly at the back curved border of layer C where layer C is inset approximately ½ inch to reduce the likelihood that the user will feel the stiff edge. Layer B has full thickness circular holes 5 inches diameter, placed at the site of the resonant chambers. Layer C is a stiff foam layer with full thickness circular holes 2½ inches in diameter, placed at the site of the resonant chamber. These through holes aid in the transmission of sound energy and create a resonant space for sound and vibration. Layer D is a more flexible foam with through holes that house the speaker frame at the approximate level of the speaker cone. Layer A does not have through holes, as it is not only designed to transmit some of the sound and vibration energy directly towards the user, but also to spread some of the sound and vibrations throughout layer A in order to be felt more diffusely. Layer E is a stiff foam material in which the narrow portions of the speakers 628 are housed and the posterior border of the resonant chamber portion of the speaker chamber defined. The speaker housing chambers can be of any diameter. The speaker housing openings are preferably of a diameter suitable for securing the speakers used in the pad(s) and chair. Layer F is made of a material of density similar to layer D, and the back portion of the speakers are affixed hereto. Layer F also includes openings corresponding to the speaker chamber openings in layers B, C, D and E. The openings in Layer F preferably go all the way through the thickness of Layer F, but alternative embodiments are possible in which some or all of the openings in Layer F do not run the entire thickness of layer F and form a sort of well or cavity instead. Preferably, the thickness of layer F is approximately equal to the thickness of the magnet of the speaker to be positioned in the speaker chambers. The openings in layer F that are to receive the speakers preferably have a diameter somewhat less than the diameter of the speaker magnet. In one embodiment, the speaker 628 magnet has a diameter of about 3 inches and the corresponding speaker-receiving opening in layer F has a diameter of about 2.5 inches. Layer G is added behind or underneath layer F to provide a cushion effect adjacent to the back of the speaker magnet and to anchor the switch. Layer G is of the same stiff foam of layers C and E and can also reflect sound forward. Other variations of the opening positions and diameters are contemplated by the present invention, and may be varied to achieve a desired result.

In one embodiment the thickness of the layers will vary from ¼ inch to 2 inches. Preferably, layer C and layer E are narrower than layers A, B, D and F and are made of firmer material to transmit vibrations through the speaker module more efficiently. A sound reflective film can also be placed or adhered to the either surface of layers C and/or E to conduct more sound and vibration towards the body. In one preferred embodiment, layer A is about 1 inch thick, Layer B is about ¾ inch thick, layer C is about ⅜ inch thick, layer D is about ¾ inch thick, layer E is about ⅜ inch thick, layer F is about ½ inch thick and layer G is about ¼ inch thick.

In one embodiment, layer A is made of a more dense resonant material than that of layers B, D, and F, and functions as a resonating layer to spread and transmit vibrations emanating from the speakers. In this manner the vibration from the speaker module is spread throughout the pad/chair rather than just one point (speaker) source. One preferred material for layer A is polyurethane foam. In one preferred embodiment, layer A is made of a polyurethane foam material having a density of about 2.75 to 2.95 lbs/ft$^3$, an indent force deflection at 25% of about 30 to 36, a compression set of about 10%, a tensile strength of about 10 psi, a tear resistance of about 1 lbs/in, and an elongation of 100%, all properties measured using the ASTM D-3574-86 testing methods. An example of a suitable polyurethane foam for use in the present invention is "9600" Foam available from Amcon/VAS, Minneapolis, Minn., although other materials meeting these characteristics are also suitable for use in the present invention.

In one embodiment, layers B, D and F are made of polyurethane foam of varying flexibility with densities ranging from approximately 1.7 to 2.0 lbs/ft$^3$. Layer B has an indent force deflection at 25% of about 27 to 35, while that of layer D is about 30 to 38 and that of layer F is about 100 to 125, all properties measured using the ASTM D-3574-86 testing methods. An example of a suitable polyurethane foam for use in the present invention for Layer B is "5250" Foam, for layer D is "9525" Foam and for layer F is "8900" Foam available from Amcon/VAS, Minneapolis, Minn., although other materials meeting these characteristics are also suitable for use in the present invention.

In one embodiment, the wires and cabling are routed along a layer in order to incur less bending and breakage. The switch connections also occur at this level. This limits bending and potential breakage of the connections between wires and speakers, wiring and cables. Those of ordinary skill in the art would appreciate a variety of different wire bundling and/or routing approaches.

In one embodiment layers C, E and G are made of a more stiff or rigid material, which can transmit vibrations emanating from the speakers or other sound or vibration source. One preferred material for layers C, E and G is polyethylene foam. In preferred embodiments, layers C, E and G are made of a polyethylene foam material having a density of about 1.5 lbs/ft$^3$, a compressive strength at 25% of about 11, a vertical direction at 50% of about 20 psi, a compression set of about 16%, a tensile strength of about 39 psi, a tear resistance of about 15 lbs/in, a cell size of about 0.5 microns, and a buoyancy of about 60 lbs/ft$^3$, all properties measured using the ASTM D-3575 testing methods. An example of a suitable polyethylene foam for use in the present invention is "Polyflex 15" Foam available from Amcon/VAS, Minneapolis, Minn., although other materials meeting these characteristics are also suitable for use in the present invention.

A visco-elastic, polyurethane foam can also serve as an alternative for layer A and/or layer B. The characteristics of visco-elastic polyurethane foam allow for greater conductance of sound and vibration in addition to greater comfort. Using a visco-elastic polyurethane foam or another conductive material creates a more uniform sensation of sound and vibration from the entire surface of the speaker module. However, because this material compresses so significantly with prolonged pressure it offers less cushioning effect.

Preferably, the visco-elastic polyurethane foam used in an embodiment of the present invention has a density of between about 3.5 to 4.5 lbs/ft$^3$, an indent force deflection at 25% of between about 8-12, a tensile strength of about 10 psi, a tear strength of about 1.0 lbs/linear inch, and demonstrates 100% elongation, all properties measured using the ASTM D-3574-86 testing methods. An example of suitable visco-elastic polyurethane foam for use in the present invention is "SR38" Foam available from Amcon/VAS, Minneapolis, Minn., although other materials meeting these characteristics are also suitable for use in the present invention.

Seat Pad 12

In one embodiment, as shown in FIGS. 66 through 70, the seat pad 612 includes a seat module 629, a speaker module 614 and surrounding foam 618. The seat module 629 and the speaker module 614 share a common top layer which is akin to layer A of the back pad 610. The seat module 629 is constructed so that the user's weight will cause greater compression of the seat module 629, than the speaker module 614. This elevates the user's knees and crates a backward lean towards the back pad 610.

Figure 68:
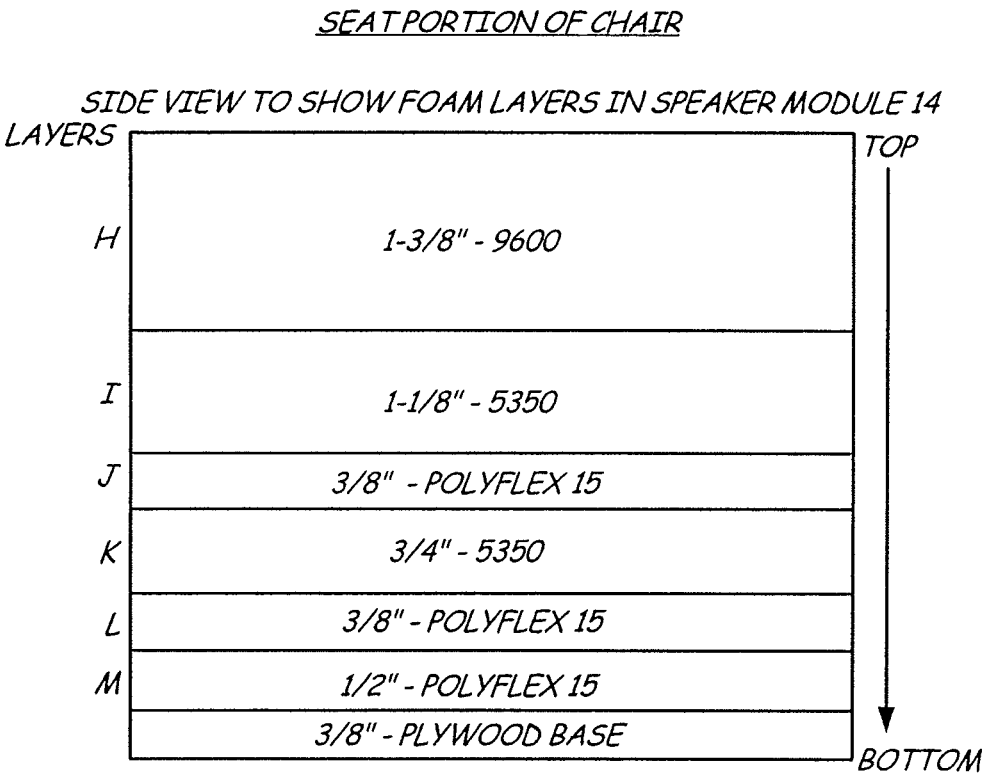
FIG. 68 is a diagrammatic view of the plurality of different layers comprising the speaker module of the seat pad of FIG. 66.
Figure 69:
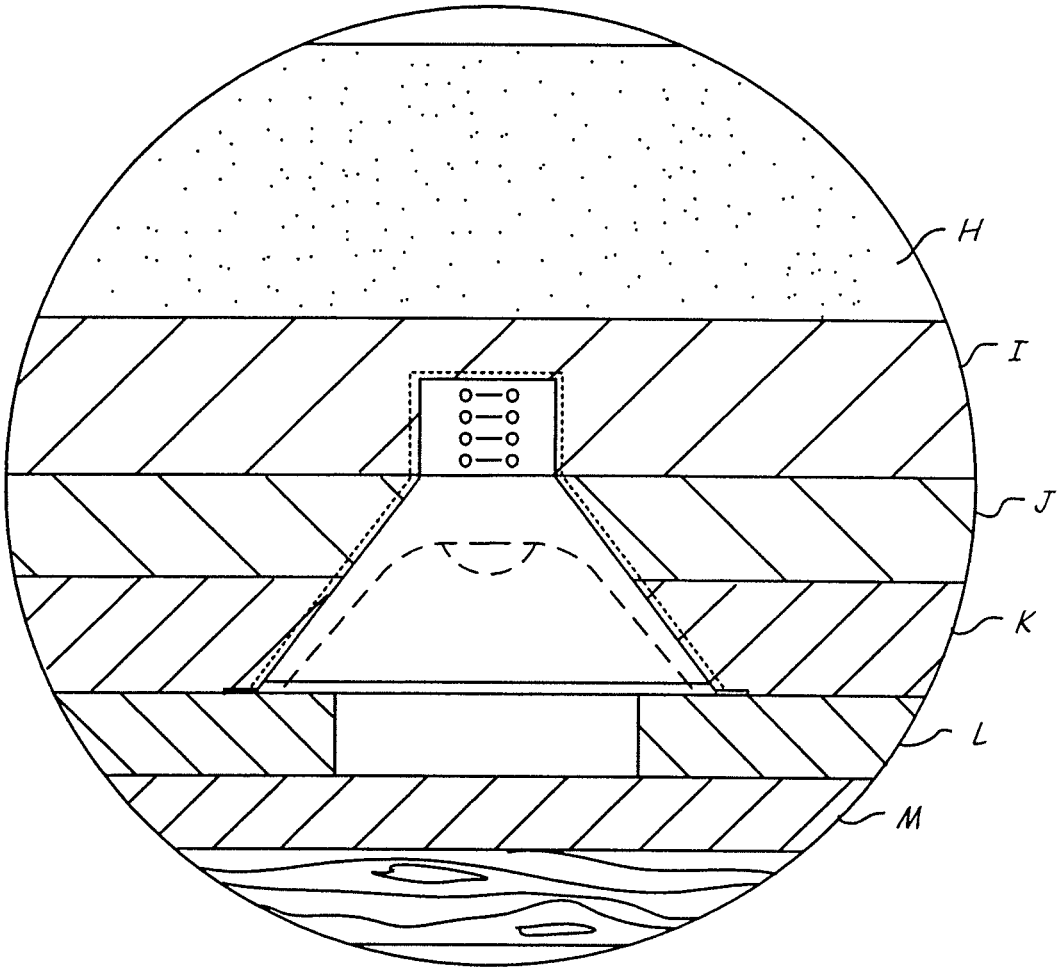
FIG. 69 is a diagrammatic view of the speaker module of the seat pad of FIG. 66 illustrating placement of the speaker in a downward direction and a resonant chamber within the speaker module of the seat pad.

In one embodiment, the speaker module 614 for the seat pad 612 is approximately 17 inches wide, 8 inches deep and 5½ inches high. As illustrated in FIGS. 68 and 69, the speaker module 614 of seat pad 612 includes layers H, I, J, K, L, and M. The space bordered on the bottom by layer M and on the top by layer J defines a resonant chamber. The resonant chamber space is air-filled between layer M and the speaker cone at the level of Layer K.

Layer M is a stiff foam material that has no through holes. Layer M is designed to conduct sound and vibrational energy. Layer L is a stiff foam material that has through holes of approximately 4 inches in diameter at the site of the resonant chambers. Layer L is designed to conduct sound and vibrational energy and also transmit sound energy to layer M and to the plywood layer and the metal frame when used. Layer K is a more flexible foam with through holes that house the speaker frame at the approximate level of the speaker cone. These through holes aid in the transmission of sound energy and create a resonant space for sound and vibration.

Layer J is a stiff foam material in which the narrow portions of the speakers are housed and the back border of the resonant chamber portion of the speaker chamber defined. The speaker housing chambers can be of any diameter. The speaker housing openings are preferably of a diameter suitable for securing the speakers used in the pad(s) and chair.

Layer I is made of a material of density similar to layer K, and the back portion of the speakers are affixed hereto. Layer I also includes openings corresponding to the speaker chamber openings in layers J, K, and L. The openings in layer I preferably go all the way through the thickness of layer I, but alternative embodiments are possible in which some or all of the openings in layer I do not run the entire thickness of layer I and form a sort of well or cavity instead. Preferably, the thickness of layer I is approximately equal to the thickness of the magnet of the speaker to be positioned in the speaker chambers. The openings in layer I that are to receive the speakers preferably have a diameter somewhat less than the diameter of the speaker magnet. In one embodiment, for example, the speaker magnet has a diameter of about 3 inches, the corresponding speaker-receiving opening in layer M has a diameter of about 2.75 inches.

Layer H is made of a more dense material than that of layers I and K and has a tendency to spread and transmit vibrations emanating from the speakers or other sound or vibration source. In this manner the vibration from the speaker module becomes somewhat more homogeneous.

Generally, the thickness of the layers will vary from ⅜ inch to 3 inches. Preferably, layers J, L and M are narrower than layers H, I, and K are made of firmer material to transmit vibrations through the Speaker module more efficiently. A sound reflective film can also be placed or adhered to the either surface of layers J, L and/or M to conduct more sound and vibration. In one preferred embodiment, layer H is about 1⅜ inch thick, layer I is about 1⅛ inch thick, layer J is about ⅜ inch thick, Layer K is about ¾ inch thick, layer L is about ⅜ inch thick, and layer M is about ½ inch thick.

One preferred material for layer H is polyurethane foam previously described as "9600." One preferred material for layers I and K is a polyurethane foam material with a density of about 1.8 to 2.0 lbs/ft$^3$ and an indent force deflection at 25% of about 50 to 60, all properties measured using the ASTM D-3574-86 testing methods. An example of a suitable polyurethane foam for use in the present invention is "5350" Foam available from Amcon/VAS, Minneapolis, Minn., although other materials meeting these characteristics are also suitable for use in the present invention. One preferred material for layers J, L and M is polyethylene foam labeled and previously described as "Polyflex 15."

Figure 70:
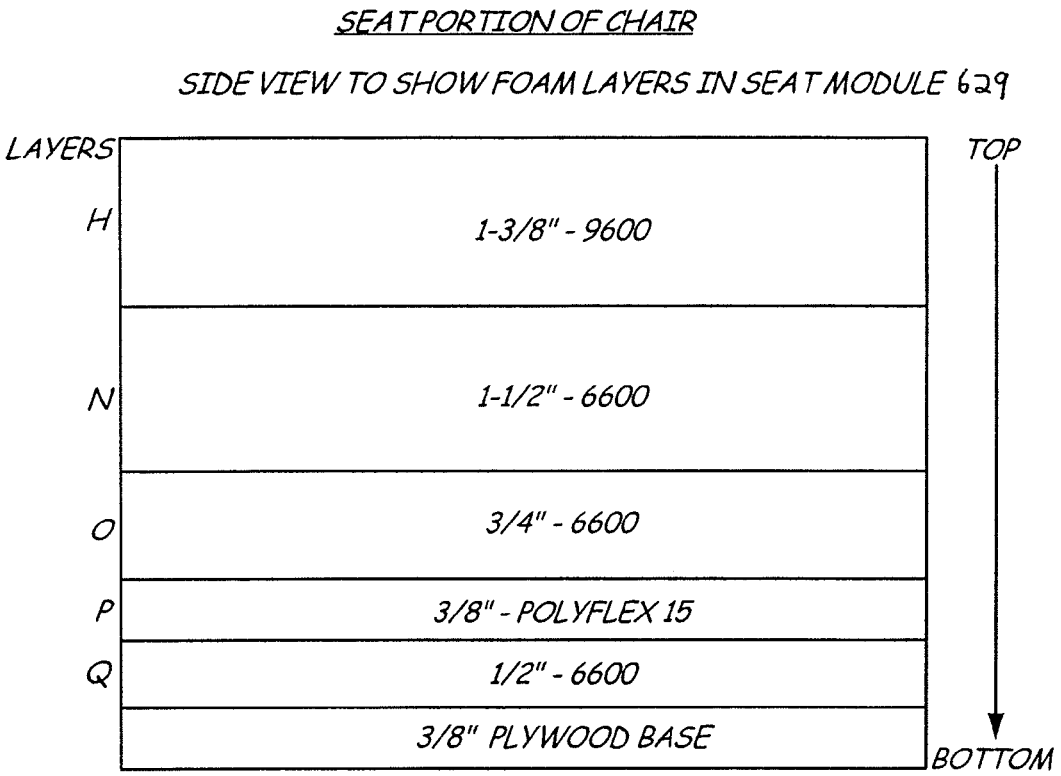
FIG. 70 is a diagrammatic view of the plurality of different layers comprising the seat module of the seat pad of FIG. 66.

Component layers of the seat module 629 are illustrated in FIG. 70, and include layers H, N, O, P, Q. In one embodiment the seat module 629 is approximately 17 inches wide, 11 inches deep and 5.5 inches high. The seat module 629 is constructed to maximize comfort and support, while transmitting the sound and vibrational energy to the user. The polyurethane foams are chosen for increasing indent force deflections from the top surface (including the covering layer 616) to layer O just above the stiffer foam of layer P for greater softness closer to the user's body and reduced likelihood of the material compressing to the point of bottoming out such that the user would feel the stiffness of layer P. The seat module 629 is constructed so that although the user's weight is well supported, there will be greater compression versus the speaker module 614 such that the user's knees are elevated relative to his or her hips and the user assumes a position of backward lean. This position is more comfortable than a strict level positioning particularly when the lumbar spine is well supported.

Layer P is an extension of layer L of the speaker module 614 so that the wires and cabling could be routed at the same level in order to incur less bending and breakage. The switch connections also occur at this level. Also layer H of the seat module 629 extends to become layer H of the speaker module 614. These unbroken layers of foam, which connect the speaker and seat modules when glued to their adjacent layers creates an interdigitation that secures both modules together more than if there were a clean division between the modules. This also limits bending and potential breakage of the connections between wires and speakers, wiring and cables.

The switch is supported by holes cut into layers P and Q. The switch plate is located between layers N and O and is the reason why these 2 layers are not manufactured as one. The post partially protrudes into a corresponding hole cut in layer O. Layer Q is flexible foam chosen for compressibility to increase comfort. In another embodiment, particularly when the plywood base is not used, layer Q maybe a continuation of layer M in the speaker module 614.

Generally, the thickness of the layers will vary from ⅜ inch to 3 inches. Preferably, layer P is narrower than layers H, N and O, and is made of firmer material to transmit vibrations through the speaker module more efficiently. A sound reflective film can also be placed or adhered to the either surface of layers P to conduct more sound and vibration towards the body. In one preferred embodiment, layer A is about 1.375 inch thick, layer N is about 10.5 inches thick, layer O is about 0.75 inch thick, layer P is about 0.375 inch thick, and layer Q is about 0.5 inch thick.

One preferred material for layer H is polyurethane foam previously foam previously described as "9600". One preferred material for layers N, O, and Q, is a polyurethane foam material with a density of about 2.5 to 2.7 lbs/ft3, an indent force deflection at 25% of about 59 to 71, a compression set of about 10%, a tensile strength of about 15 psi, a tear resistance of about 1.5 lbs/in, and an elongation of 150%, all properties measured using the ASTM D-3574-86 testing methods. An example of a suitable polyurethane foam for use in the present invention is "6600" Foam available from Amcon/VAS, Minneapolis, Minn., although other materials meeting these characteristics are also suitable for use in the present invention. One preferred material for layer P is polyethylene foam labeled and previously described as "Polyflex 15."

The lower pad or seat portion 612 of the chair is assembled by positioning the speakers 628 in layer J of the speaker module 614 and then attaching layers K, L, and M. The speaker cables are attached to bottom top surface of layer J and are preferably wrapped together to form a single robust cable. Layer I is then positioned on top of layer J. Layer Q of the seat module 29 is then affixed to the underside of layer P (layer L of the speaker module 14). Layers O and then N of the seat module 29 are then attached. Layer H is then added to the top of both modules 614, 629. An adhesive attaches the layers to each other, the surrounding foam 618 to the sides of the speaker and seat modules 614, 629 and the covering layer 616 to the top of layer H and the corresponding side of the surrounding foam 618. In one embodiment layer M of the speaker module 614, layer L of the seat module 629 and the corresponding side of the surrounding foam 618 is glued to a ⅜ inch plywood base, which is used to secure the speaker module 614, seat module 629, surrounding foam 618 and covering layer to metal framing to create a chair structure. The speaker modules 614, seat module 629 and surrounding foam 618 along with the plywood base are all preferably housed in a removable outer cover. The outer cover is preferably washable or can be cleaned, and as described above, is made of fabric or a material that does not cause excessive interference in the transmission of the sound waves from the speakers to the user's body. Openings are placed on both lateral sides of the covers to that the pad cable can be drawn out either side for convenience.

Surrounding foam 618 of seat pad 612 is preferably not as sound conductive as the elements of the speaker module 614. One preferred material for the surrounding foam 618 is a polyurethane foam material with a density of about 0.9 to 1.1 lbs/ft$^3$ and an indent force deflection at 25% of about 12 to 18, all properties measured using the ASTM D-3574-86 testing methods. An example of a suitable polyurethane foam for use in the present invention is "1675" Foam available from Amcon/VAS, Minneapolis, Minn., although other materials meeting these characteristics are also suitable for use in the present invention.

Frame

As depicted in FIG. 61, frame 613 is a tubular metal frame. In alternative embodiments, frame 613 may be made of different materials or combinations of materials. A rigid frame 613 further enhances the amount of vibration, particularly high frequency sound, that is transmitted to the user. This is of benefit as some amount of the higher frequency sound waves is filtered out by one or more materials of the speaker module, seat module or surrounding foam. The amplifier 640 of the present invention preferably has either a treble adjust for the user to adjust the high frequency content to compensate for high frequency attenuation or has the treble adjustment fixed and thereby not requiring adjustment with a bias towards greater amplification of the higher frequencies.

In another embodiment of the present invention, a recline mechanism is provided to adjust the relative orientation between the back pad 610 and seat pad 612. Additionally, a swivel mechanism may be provided to permit angular rotation of portions of the chair relative to the ground surface.

The back and lower pad, or portions thereof, can be positioned on the floor or upon other surfaces or furniture or alternatively incorporated, as a module, into another structure that supports the user. When the pads are positioned on the floor or upon other surfaces the vibration is reduced as some of the sound energy is absorbed in part by whatever they are resting upon. This effect is magnified if the pads are placed upon a more absorptive substance such as bedding or carpet. To enhance the vibrations that are experienced by the user it is useful to place the pads in a structure that enhances transmission of the sound and resultant vibrations to the user. The greater the density of the material used therefore, the greater amount of sound and vibration that is transmitted, as less dense materials absorb more of the sound energy.

Electronics

In the illustrated embodiment of the present invention, electronic devices are utilized to communicate signals to speakers 628 and an amplifier 640. Those of ordinary skill in the art would appreciate that a variety of different amplifiers and associated hardware may be utilized to provide functional control of speakers 628. Aspects of a preferred embodiment of the invention are provided below.

Figure 71:
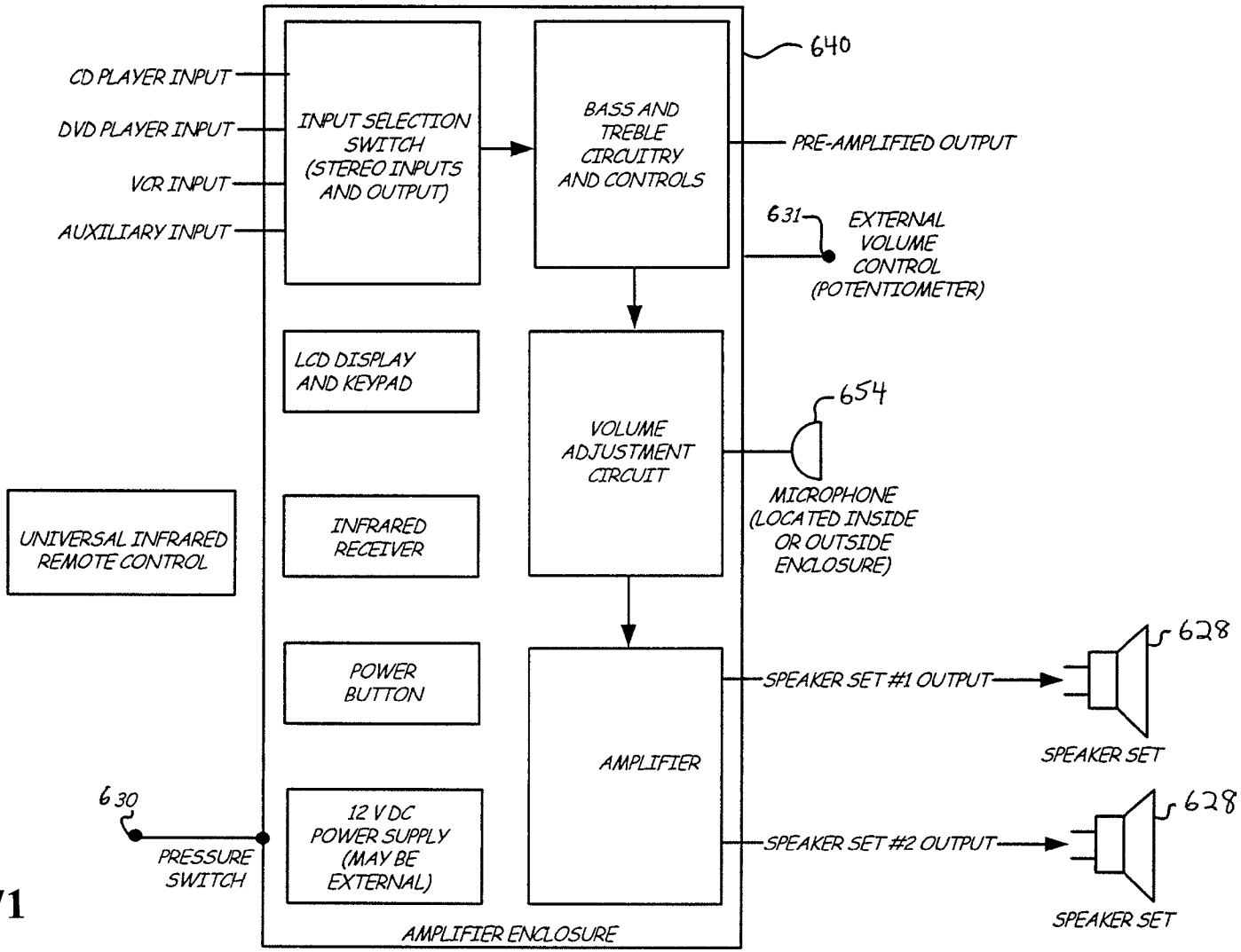
FIG. 71 is a block diagram of an electronics package suitable for use with the chair of FIGS. 61-70.

One or more switches 630 may be utilized to control amplifier 640. One or more manually adjustable volume control devices may also be utilized. As shown in FIG. 71, in one embodiment, the speakers 628 are connected to an amplifier 640 that accepts audio output from a VCR, DVD, CD or MP3 player, or other electronic devices that have audio output capabilities. The audio output of the amplifier 640 can be sent to the user's TV or stereo receiver (connected to other external speakers) instead of or in addition to the pad. The amplifier 640 includes an automatic volume adjustment mechanism which adjusts the volume of the sound to be transmitted through the pad(s), chair and air.

In one embodiment, a variable resistor network or potentiometer is provided to control the sound volume generated by speakers 628. Potentiometers may be presented to the user at a side panel, for example. Alternatively, an additional amplifier can be utilized to amplify one or more speaker 628 signals to control the volume of respective speakers 628.

In one embodiment the amplifier 640 may control sound generation to multiple chairs. In such an instance, amplifier 640 may contain independent controls for each chair that it is connected to. The pads 610, 612 of each chair may be independently controlled in regards to volume, balance within the unit as each pad or portion of the chair is an independent channel, base, treble, automatic volume settings and input sound source. Manufacturing an amplifier with independent controls is a more cost-effective and space efficient solution, as opposed to using separate amplifiers, as any redundant amplifier stages and/or sound monitoring circuits are powered by a common power supply, controlled by common control mechanisms and enclosed by a common enclosure. This amplifier can also be used to provide a sound signal to speakers independent of the pad(s) and/or chair(s) in order to control those speakers independently from the pad(s) and/or chair(s).

In one embodiment, pressure, light or heat sensitive activation switches 630 are placed on or in the pad(s) or chair. In one embodiment of the present invention the switch 630 is open (sound sources will then not transmit sound) until pressure is placed against the pad(s) or a portion of the chair thereby closing the circuit. Switches can be inserted in the circuitry for each of the sound sources within each of the pads or back or seat portions of the chair such that only the sound sources receiving the triggering signal will emanate sound. This methodology serves as an on/off mechanism for the entire pad or chair or portions thereof. These methods of use are particularly helpful when multiple transmitting pads or chairs are all connected to a sound or music source, but only some of the pads or chairs are in use (engaged by a user) or in partial use. Such situations include, but are not limited to, movie theaters, automobiles, office spaces and homes with multiple users. Manual switches can also be used in the place of automatic switches on or in the pad(s) or chair for this function.

In one embodiment, a pressure sensitive switch 630 is placed in each pad or back and seat portion of the chair to control each channel independently. The pressure required to trigger (close the circuit) the switch is 567 grams and the switch life is 200,000 cycles. Switches requiring substantially greater force to close the circuit are too insensitive, particularly in the back pad (back portion of the chair), as they would force the user to position themselves awkwardly on the pad or chair in order to apply sufficient triggering pressure against the switch. Switches that are too sensitive and don't have sufficient spring force may not quickly or reliably open the circuit when pressure is removed. Switches that can't perform reliably for more than a reasonable number of cycles should not be used, as they may necessitate repair or create obsolescence. An example of a suitable switch for use in the present invention is a "C & K A series general purpose snap-acting switch" available from The Bergquist Company, Chanhassen, Minn., although other devices meeting these characteristics are also suitable for use in the present invention.

In one embodiment, rigid planar structure such as a plate or film is placed between the switch mechanism and the user's body so that pressure from the user's body can more easily triggering the switch. A post (comprising a rubber foot), protrudes through a corresponding hole in the foam layer directly above the switch is adhered to a plastic disc (located one layer more proximal to the user's body). In this embodiment the post is about ⅜ inch long and ½ inch in diameter, while the disc is approximately 2 inches in diameter. Different sized posts and plates can be used. The greater resiliency of the foam in between the plate (plastic disc) and the switch assists the switch in achieving an open position when pressure is removed as the foam between the switch and the plate acts as a supplementary spring. The switch may be supported by holes cut into layers E and F. The switch plate is located between layers C and D with the post partially protruding through a corresponding hole cut in layer D.

In addition to optimizing sound and vibration to the user's body and not ears, using the system of the present invention also requires that the user is able to be comfortably positioned for hours, as occurs when watching TV or a movie or playing video games. Because the pad(s) or chair produces sound and vibration the user will tend to remain in a given position for periods of time that are longer than would otherwise be the case when simply performing these activities in a seat that does not produce sound and vibration. This occurs because the user will tend to find a position that optimizes the sound and vibration to their liking. As a result, since the user is likely to make fewer bodily adjustments to relieve discomfort from pressure or reduced blood flow, it is necessary to create pads and chairs that provide excellent comfort by properly supporting and cushioning the user's body. Therefore, foam softness, support and resiliency, as well as shape and contour of the seat and back pads or portions of the chair are critical to the user's experience.

The speakers 628 can be any type of conventional stereo speaker. Alternatively, other sound/vibration-emitting devices can be used. In the embodiment shown in the Figures, a commercially available stereo speaker having an outermost diameter of 5¼ inches was used. Generally, any commercially available speaker can be used in the present invention, and preferably speakers that can transmit a range of frequencies from about 20 hertz to 20,000 hertz are used. In one embodiment, two additional speakers are added in the back pad or back portion of the chair to transmit sound from an amplifier that provides surround sound. Separate cabling is required from the surround sound-providing amplifier, which can also include a means to adjust the volume of these speakers. Alternatively, the additional speakers with surround sound connections can be incorporated into the lower pad or seat portion of the chair.

Since pressure is applied to the front of the speaker assembly, protective measures are taken to avoid damage to the speaker cone. To protect the speaker cone a circle of more rigid material (¼-inch high rigid foam in one embodiment) is adhered to the frame between the rubber material that suspends the cone and the outer front edge of the frame (5/16-inch thickness—between inner and outer diameter). In one embodiment of the present invention, this ring of more rigid foam abuts against a layer of rigid polyethylene foam in front of it (layer C) preventing any material from protruding into and damaging the speaker cone.

In one embodiment the connections (pad cable to speaker) of each speaker 628 are oriented towards one another. In this manner the top speaker is facing so that the connections are facing downwards, while the opposite is true for the lower speaker. The connections are oriented in this manner to limit the amount of bending and therefore, potential damage that can occur at these connections and to the wires leading from these connections because less compression force is applied to the pad in the space between the speakers during use. It is important to optimize the intensity of the sound stimulus, but yet avoid harmful exposure to the ear. Recorded music, TV broadcasts and soundtracks on tapes and DVDs typically have significant fluctuations in volume. Therefore, a single volume setting results in variable intensity of stimulus exposure when using these media with the decibel level at times far exceeding the desired level and at times being too low to hear. Therefore, an amplification control system with automated volume adjustments based upon the output of a decibel meter or sensor enables the user to automatically optimize his or her sound experience, without the need to manually adjust the volume setting. This can more readily be accomplished using the present invention as the sound source(s) is proximal to the user(s).

Embodiments of the present invention may include the placement of a decibel sensor 654 within the amplifier or remote to the amplifier and more proximal to the user. The latter embodiment is preferred with multiple users. This sensor transmits a signal corresponding to the decibel level to a microprocessor, which executes an algorithm designed to maximize intensity of stimulus exposure, but to not exceed a user defined level. Therefore, hearing loss/ear damage can be avoided, while providing a maximum user-defined intensity. A minimum level can also be specified so that harder to hear segments can be further amplified if desired. Levels can be set by either setting upper and lower threshold decibel numbers or one decibel number (mean) with a range number (plus and minus from the mean that each serve as upper and lower threshold numbers respectively when added to and subtracted from the mean). The output of the microprocessor is transmitted to a controller, which automatically adjusts the level of amplification. The user has the ability to disengage the system manually or remotely. This system is particularly useful when the user engages (sits, lies on or leans against) the pad(s) or chair and there is a need for rapid volume adjustment or when abrupt changes occur in the broadcast, soundtrack, music, etc. The amplifier and/or remote unit can also be supplied with a digital readout of the decibel level in the event that the user disengages the automatic adjustment means in favor of manual volume level setting.

Method of Pad Construction

The back pad 610 is assembled by positioning the speakers in layer E and then attaching layer F to the back of layer E and layer G to the back of layer F, when used. The speaker cables are attached to the front side of layer E and are preferably wrapped together to form a single robust cable. Layer D is then positioned on top of layer E, layer C on top of layer D, layer B on top of layer C and layer A on top of layer B. An adhesive attaches the layers to each other, the surrounding foam 624 to the speaker module 614 and the covering layers 616 to the top of layer A and the corresponding side of the surrounding foam 624. In one embodiment layer G of the speaker module 614 and the corresponding side of the surrounding foam 624 is glued to a ⅜ inch plywood base, which is used to secure the speaker module 614, surrounding foam 624 and covering layers 616 to metal framing to create a chair structure. The entire foam and speaker assembly, and the plywood base when used, is preferably housed in a removable outer cover. This aids in the manufacturing process as manufacturing a cover is simpler and more cost-effective than the more expensive and time-consuming process of upholstering. The outer cover is preferably washable or can be cleaned, and as described above, is made of fabric or a material that does not cause excessive interference in the transmission of the sound waves from the speakers to the user's body. Openings are placed on both lateral sides of the covers so that the pad cable can be drawn out either side for convenience.

The lower pad 612 or seat portion of the chair can be constructed similarly to the back pad or back portion of the chair. Another embodiment consists of a covering layer 616, surrounding foam 618, and a downward oriented speaker 628 within speaker module 614. In this embodiment the speaker module 614 is oriented such that the speaker cone is directed downward, away from the user towards the bottom of the pad 612. The sound energy and vibrations are carried through the denser foam layers and plywood and metal when used.

Additional Features

In another embodiment the speakers 628 in each pad 610, 612 do not comprise an independent left or right channel, but instead are assigned to either (one or more speaker to each) left and right channels to maintain the left channel on the left side of the user and the right channel on the right side of the user. In this embodiment either a common switch can be used to control both channels, single switches for each channel or individual switches for each speaker. The switches that control either the entire system or each channel can be placed in either the back or lower pad or either portion of the chair.

Alternative Embodiments

As described in the illustrated embodiments, pads 610, 612 are associated with a chair structure. In alternative embodiments, pads 610, 612 may together, or individually be associated with other types of body-supporting structures, such as sofas, couches, vehicle seats, benches, etc. While not required, pads 610, 612 are optimally connected to a rigid frame of the associated body-supporting structure. In alternative embodiments, pads 610, 612 may be portable and separable from each other.

Various modifications of this invention will be apparent to those skilled in the art. Thus, the scope of this invention is to be limited only by the appended claims. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Although the present invention and it advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, the processes, machines, manufacture, compositions of matter, means, methods, or steps, presently existing or later to be developed that perform substantially the same function or achieve substantially the same result as the corresponding embodiments described herein may be utilized according to the present invention.

What is claimed is:

1. A pad comprising:

a vibration source including a magnet;

a layered plurality of materials; and a resonant chamber, wherein at least a portion of the resonant chamber is defined within an aperture extending through at least one material of the layered plurality of materials, and wherein at least a portion of said aperture is configured to be positioned between the vibration source and a user.

2. The pad of claim 1, wherein said aperture extends through more than one material of the layered plurality of materials.

3. The pad of claim 1, wherein the resonant chamber is filled with air.

4. The pad of claim 1, wherein the layered plurality of materials comprises a plurality of different foam elements.

5. The pad of claim 4, wherein the different foam elements have different degrees of compressibility.

6. The chair of claim 4, wherein the different foam elements have different degrees of acoustic conductance.

7. The pad of claim 1, wherein the pad comprises a plurality of vibration sources, each vibration source including a magnet.

8. The pad of claim 7, wherein each vibration source is capable of being independently controlled.

9. The pad of claim 1, further comprising an activation switch.

10. The pad of claim 9, wherein the activation switch is in communication with an amplification system.

11. A chair comprising:

a seat portion comprising a first vibration source including a first magnet; and, a back portion comprising a layered plurality of materials, a resonant chamber, and a second vibration source including a second magnet, wherein at least a portion of the resonant chamber is defined within an aperture extending through at least one material of the layered plurality of materials, and wherein at least a portion of said aperture is configured to be positioned between the second vibration source and a user sitting in the chair.

12. The chair of claim 11, wherein said aperture extends through more than one material of the layered plurality of materials.

13. The chair of claim 11, wherein the resonant chamber is filled with air.

14. The chair of claim 11, wherein the layered plurality of materials comprises a plurality of different foam elements.

15. The chair of claim 14, wherein the different foam elements have different degrees of compressibility.

16. The chair of claim 14, wherein the different foam elements have different degrees of acoustic conductance.

17. The chair of claim 11, wherein the first vibration source and the second vibration source are each capable of being independently controlled.

18. The chair of claim 11, further comprising an activation switch located in the back portion or the seat portion.

19. The chair of claim 11, further comprising a third vibration source comprising a third magnet.

20. The chair of claim 19, wherein the second vibration source and the third vibration source are each capable of being independently controlled.

* * * * *